US008780017B2

(12) United States Patent
Yamamoto et al.

(10) Patent No.: US 8,780,017 B2
(45) Date of Patent: Jul. 15, 2014

(54) DISPLAY DRIVING CIRCUIT, DISPLAY DEVICE AND DISPLAY DRIVING METHOD

(75) Inventors: Etsuo Yamamoto, Osaka (JP); Shige Furuta, Osaka (JP); Yuhichiroh Murakami, Osaka (JP); Seijirou Gyouten, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 286 days.

(21) Appl. No.: 13/377,723

(22) PCT Filed: Feb. 24, 2010

(86) PCT No.: PCT/JP2010/001254
§ 371 (c)(1),
(2), (4) Date: Dec. 12, 2011

(87) PCT Pub. No.: WO2010/146741
PCT Pub. Date: Dec. 23, 2010

(65) Prior Publication Data

US 2012/0092317 A1 Apr. 19, 2012

(30) Foreign Application Priority Data

Jun. 17, 2009 (JP) ..... 2009-144752

(51) Int. Cl.
*G09G 3/30* (2006.01)

(52) U.S. Cl.
USPC ..... 345/76; 345/204

(58) Field of Classification Search
USPC ..... 345/76, 204
See application file for complete search history.

(56) References Cited

U.S. PATENT DOCUMENTS

| | | | | |
|---|---|---|---|---|
| 2001/0035849 | A1* | 11/2001 | Kimura et al. | 345/76 |
| 2006/0239085 | A1* | 10/2006 | Wu et al. | 365/189.12 |
| 2008/0055300 | A1* | 3/2008 | Yamazaki | 345/212 |
| 2009/0002585 | A1 | 1/2009 | Shimoshikiryoh et al. | |
| 2009/0115772 | A1* | 5/2009 | Shiomi et al. | 345/214 |
| 2010/0128009 | A1 | 5/2010 | Okada et al. | |

FOREIGN PATENT DOCUMENTS

| | | | |
|---|---|---|---|
| JP | 2001-083943 | A | 3/2001 |
| JP | 2007140191 | A | 6/2007 |
| JP | 2007140192 | A | 6/2007 |
| WO | WO-2006098449 | A1 | 9/2006 |
| WO | WO-2009/050926 | A1 | 4/2009 |

OTHER PUBLICATIONS

International Search Report and Written Opinion of Searching Authority.

* cited by examiner

*Primary Examiner* — Viet Pham
(74) *Attorney, Agent, or Firm* — Harness, Dickey & Pierce, P.L.C.

(57) ABSTRACT

A display driving circuit which carries out CC driving is configured such that a polarity of a data signal to be supplied to a source line is reversed every two horizontal scanning periods and a signal electric potential written from the source line to a pixel electrode changes in a different direction every two adjacent rows. In at least one example embodiment, this allows, in a display device which carries out CC driving, enhancement of a display quality by removing lateral stripes that are produced in a display video while n-line reversal driving is being carried out.

8 Claims, 62 Drawing Sheets

DISPLAY DRIVING CIRCUIT, DISPLAY DEVICE AND DISPLAY DRIVING METHOD

TECHNICAL FIELD

The present invention relates to driving of a display device, such as a liquid crystal display device having an active matrix liquid crystal display panel, particularly to a display driving circuit and a display driving method for driving a display panel of a display device which employs a driving method referred to as CC (Charge Coupling) driving.

BACKGROUND ART

For example, Patent Literature 1 discloses a CC driving method which has been employed in an active matrix liquid crystal display device. The following description discusses CC driving with reference to what is disclosed in Patent Literature 1.

FIG. 52 illustrates an arrangement of a device which implements CC driving. FIG. 53 illustrates waveforms of respective signals, the waveforms being obtained during the CC driving implemented by the device of FIG. 52.

A liquid crystal display device which carries out CC driving includes an image display section 110, a source line driving circuit 111, gate line driving circuits 112, and CS bus line driving circuits 113 (see FIG. 52).

The image display section 110 includes a plurality of source lines (signal lines) 101, a plurality of gate lines (scanning lines) 102, switching elements 103, pixel electrodes 104, a plurality of CS (Capacity Storage) bus lines (common electrode lines) 105, retention capacitors 106, liquid crystals 107, and a counter electrode 109. The switching elements 103 are provided in the vicinity of intersections of the plurality of source lines 101 and the plurality of gate lines 102. The pixel electrodes 104 are connected to the respective switching elements 103.

Each of the CS bus lines 105 is paired with and is parallel to a corresponding gate line 102. Each of the retention capacitors 106 has one end which is connected to a corresponding pixel electrode 104 and the other end which is connected to a corresponding CS bus line 105. The counter electrode 109 is provided so as to face the pixel electrodes 104 via the liquid crystals 107.

The source line driving circuit 111 is provided so as to drive the plurality of source lines 101, and the gate line driving circuits 112 are provided so as to drive the plurality of gate lines 102. The CS bus line driving circuits 113 are provided so as to drive the plurality of CS bus lines 105.

Each of the switching elements 1.03 is made of amorphous silicon (a-Si), polycrystalline polysilicon (p-Si), single crystal silicon (c-Si), or the like. Such a structure forms a capacitor 108 between a gate and a drain of a switching element 3. The capacitor 108 causes a phenomenon such that a gate pulse from the gate line 102 shifts an electric potential of the pixel electrode 104 to a negative electric potential.

The liquid crystal display device is arranged such that a gate line 102 has an electric potential Vg that (i) is Von only during an H period (a horizontal scanning period) in which the gate line 102 is selected and (ii) is maintained at Voff during the other periods (see FIG. 53). Though an electric potential Vs of a source line 101 varies in its amplitude depending on a video signal to be displayed, a polarity of the electric potential Vs is reversed at a boundary of a counter electrode electric potential Vcom between Von and Voff every H period, and during an adjacent H period for the gate line 102, the electric potential Vs has a waveform such that the electric potential Vs has a reversed polarity (line reversal driving). Note that since FIG. 53 assumes that a uniform video signal is inputted, the electric potential Vs changes at a constant amplitude.

Since the switching element 103 turns on during the period in which the electric potential Vg is Von, an electric potential Vd of the pixel electrode 104 is identical to the electric potential Vs of the source line 101. At the moment the electric potential Vg becomes Voff, the electric potential Vd is slightly shifted toward a negative electric potential via the capacitor 108 formed between the gate and the drain of the switching element 3.

The CS bus line 105 has an electric potential Vc of Ve+ during a first H period and a second H period in each of which a corresponding gate line 102 is selected, the second H period following the first H period. The electric potential Vc changes to Ve− during a third H period following the second H period and is then maintained at Ve− until the next field. The change causes the electric potential Vd to be shifted toward a negative electric potential via the retention capacitor 106.

This causes the electric potential Vd to change at a higher amplitude than the electric potential Vs. Therefore, the electric potential Vs can change at a lower amplitude. This allows simplification of a circuit configuration and reduction in power consumption in the source line driving circuit 111.

CITATION LIST

Patent Literature 1

Japanese Patent Application Publication, Tokukai, No. 2001-83943 A (Publication Date: Mar. 30, 2001)

Patent Literature 2

International Publication No. WO2009/050926 (Publication Date: Apr. 23, 2009)

SUMMARY OF INVENTION

Technical Problem

A liquid crystal display device which employs line reversal driving and CC driving that are described above causes a problem such that lateral stripes of light and shade of every one row (every one horizontal line of the liquid crystal display device) are observed in the first frame after the start of display.

FIG. 54 is a timing chart which is used to explain a cause for the problem and illustrates operation of the liquid crystal display device.

In FIG. 54, GSP is a gate start pulse which defines a timing of vertical scanning and each of GCK1 (CK) and GCK2 (CKB) is a gate clock which is supplied from a control circuit and defines a timing at which a shift register operates. A period between a first fall and a second fall of GSP, the second fall following the first fall is equivalent to one vertical scanning period (1V period). Each of a period between a first rise of GCK1 and a first rise of GCK2 and a period between the first rise of GCK2 and a second rise of GCK1, the second rise following the first rise is one horizontal scanning period (1H period). CMI is a polarity signal whose polarity is reversed every one horizontal scanning period.

FIG. 54 illustrates, in this order, (i) a source signal S (a video signal) to be supplied from the source line driving circuit 111 to a source line 101 (a source line 101 provided in the xth column), (ii) a gate signal G1 to be supplied from a gate line driving circuit 112 to a gate line 102 provided in the first row, (iii) a CS signal CS1 to be supplied from a CS bus line driving circuit 113 to a CS bus line 105 provided in the first row, and (iv) an electric potential Vpix1 of a pixel electrode provided in the first row and the xth column. Similarly, FIG. 54 illustrates, in this order, (i) a gate signal G2 to be supplied to a gate line 102 provided in the second row, (ii) a CS signal CS2 to be supplied to a CS bus line 105 provided in the second row, and (iii) an electric potential Vpix2 of a pixel electrode provided in the second row and the xth column. Further, FIG. 54 similarly illustrates, in this order, (i) a gate signal G3 to be supplied to a gate line 102 provided in the third row, (ii) a CS signal CS3 to be supplied to a CS bus line 105 provided in the third row, and (iii) an electric potential Vpix3 of a pixel electrode provided in the third row and the xth column.

Note that a broken line in each of the electric potentials Vpix1, Vpix2, and Vpix3 indicates an electric potential of the counter electrode 109.

The following description assumes that an initial frame of a display video is the first frame and a frame before the first frame is an initial state. In the initial state, each of the source line driving circuit 111, the gate line driving circuit 112, and the CS bus line driving circuit 113 is in a preliminary stage before normal operation or in a stopped state. Therefore, each of the gate signals G1, G2, and G3 is fixed at a gate OFF electric potential (an electric potential which turns off the gate of the switching element 103), whereas each of the CS signals CS1, CS2, and CS3 is fixed at an electric potential having one level (e.g., a low level).

In the first frame after the initial state, each of the source line driving circuit 111, the gate line driving circuit 112, and the CS bus line driving circuit 113 operates normally. This causes the source signal S to have an amplitude in accordance with a gray scale indicated by a video signal and to be a signal whose polarity is reversed every 1H period.

Note that, since FIG. 54 assumes that a uniform video is displayed, the source signal S has a constant amplitude. Note also that the gate signals G1, G2, and G3 have gate ON electric potentials (electric potentials for turning on the switching element 103) during the respective first, second, and third 1H periods in an active period (an effective scanning period) of each frame and have gate OFF electric potentials during the other periods of the each frame.

Then, the CS signals CS1, CS2, and CS3 are reversed after the gate signals G1, G2, and G3 corresponding to the respective CS signals CS1, CS2, and CS3 fall. In addition, waveforms of the CS signals CS1, CS2, and CS3 have a relationship such that directions in which the CS signals CS1, CS2, and CS3 are reversed are alternately opposite to each other. Specifically, in an odd-numbered frame, the CS signal CS2 rises after the gate signal G2 corresponding thereto falls, and the CS signals CS1 and CS3 fall after the gate signals G1 and G3 corresponding to the respective CS signals CS1 and CS3 fall. In contrast, in an even-numbered frame, the CS signal CS2 falls after the gate signal G2 corresponding thereto falls, and the CS signals CS1 and CS3 rise after the gate signals G1 and G3 corresponding to the respective CS signals CS1 and CS3 fall.

A relationship of a rise and a fall among the CS signals CS1, CS2, and CS3 in an odd-numbered frame and an even-numbered frame may be opposite to the relationship described above. It is only necessary that the CS signals CS1, CS2, and CS3 be reversed after the gate signals G1, G2, and G3 corresponding to the respective CS signals CS1, CS2, and CS3 fall, i.e., after the horizontal scanning periods of the respective gate signals G1, G2, and G3 corresponding to the respective CS signals CS1, CS2, and CS3. For example, a CS signal of a first row is reversed in sync with a rise of a gate signal of a second row following the first row.

However, the electric potentials Vpix1 and Vpix3 are in an irregular state in the first frame since each of the CS signals CS1, CS2, and CS3 is fixed at an electric potential having one level (a low level in FIG. 54) in the initial state. Specifically, the CS signal CS2 in the first frame is identical to that in the other odd-numbered (third, fifth, . . . ) frames in that the CS signal CS2 rises after the gate signal G2 corresponding thereto falls. In contrast, the CS signals CS1 and CS3 in the first frame are different from those in the other odd-numbered (third, fifth, . . . ) frames in that each of the CS signals CS1 and CS3 maintains an identical electric potential (a low level in FIG. 54) after the gate signals G1 and G3 corresponding to the respective CS signals CS1 and CS3 fall.

Therefore, since a change in electric potential of the CS signal CS2 occurs as usual in a pixel electrode 104 of the second row in the first frame, the electric potential Vpix2 is subjected to an electric potential shift due to the change in electric potential of the CS signal CS2. In contrast, since no change in electric potentials of the CS signals CS1 and CS3 occurs in pixel electrodes 104 of the first and third rows, the electric potentials Vpix1 and Vpix3 are subjected to no electric, potential shift (see shaded parts in FIG. 54). As a result, a difference among the electric potentials Vpix1, Vpix2, and Vpix3 causes a difference in luminance among the first, second, and third rows though the source signal S having an identical gray scale is inputted. Such a difference in luminance appears as a difference in luminance between an odd-numbered row and an even-numbered row in the entire image display section. Therefore, lateral stripes of light and shade of every one row are observed.

Patent Literature 2 discloses a technique for preventing production of such lateral stripes. The following description discusses the technique of Patent Literature 2 with reference to FIGS. 55 through 57. FIG. 55 is a block diagram illustrating configurations of driving circuits (a gate line driving circuit 30 and a CS bus line driving circuit 40) described in Patent Literature 2. FIG. 56 is a timing chart illustrating waveforms of respective signals of a liquid crystal display device. FIG. 57 is a timing chart illustrating waveforms of respective signals supplied to/from the CS bus line driving circuit.

The CS bus line driving circuit 40 includes a plurality of CS circuits 41, 42, 43, . . . , 4*n* which correspond to the respective rows (see FIG. 54). The CS circuits 41, 42, 43, . . . , 4*n* include respective D latch circuits 41*a*, 42*a*, 43*a*, . . . , 4*na* and respective OR circuits 41*b*, 42*b*, 43*b*, . . . , 4*nb*. The following description takes, as an example, the CS circuits 41 and 42 corresponding to the respective first and second rows.

The CS circuit 41 receives the gate signals G1 and G2, a polarity signal POL, and a reset signal RESET. The CS circuit 42 receives the gate signals G2 and G3, the polarity signal POL, and the reset signal RESET. The polarity signal POL and the reset signal RESET are supplied from a control circuit (not illustrated).

The OR circuit 41*b* which has received the gate signal G1 of a first gate line 12 corresponding to the OR circuit 41*b* and the gate signal G2 of a second gate line 12 following the first gate line 12 outputs a signal g1 illustrated in FIG. 57. The OR circuit 42*b* which has received the gate signal G2 of the second gate line 12 corresponding to the OR circuit 42*b* and the gate signal G3 of a third gate line 12 following the second gate line 12 outputs a signal g2 illustrated in FIG. 57.

The D latch circuit 41*a* receives the reset signal RESET via a terminal CL thereof, the polarity signal POL via a terminal D thereof, and an output g1 of the OR circuit 41*b* via a clock terminal CK thereof. In accordance with a change in electric potential level (from low level to high level or from high level to low level) of the signal g1 to be supplied to the clock terminal CK, the D latch circuit 41*a* outputs, as the CS signal CS1 indicating a change in electric potential level, an input state (a low level or a high level) of the polarity signal POL which input state is supplied to the terminal D. Specifically, in a case where the signal g1 to be supplied to the clock terminal CK has a high level electric potential, the D latch circuit 41*a* outputs an input state (a low level or a high level) of the polarity signal POL which input state is supplied to the terminal D. When the electric potential of the signal g1 to be supplied to the clock terminal CK changes from a high level to a low level, the D latch circuit 41*a* latches an input state (a low level or a high level) of the polarity signal POL which input state is supplied to the terminal D when the change occurs. The D latch circuit 41*a* maintains the latched state until the next time the signal g1 to be supplied to the clock terminal CK has a high level electric potential. Then, the D latch circuit 41*a* outputs, via a terminal, Q thereof, the latched state as the CS signal CS1 illustrated in FIG. 57 and indicating a change in electric potential level.

Similarly, the reset signal RESET and the polarity signal POL are supplied to the terminal CL and the terminal D, respectively of the D latch circuit 42*a*, and an output g2 of the OR circuit 42*b* is supplied to the clock terminal CK. This causes the CS signal CS2 illustrated in FIG. 57 and indicating a change in electric potential level to be supplied from the terminal Q of the D latch circuit 42*a*.

According to the arrangement, electric potentials of the respective CS signals CS1 and CS2 are different from each other when the gate signals of the respective first and second rows fall. Therefore, the electric potential Vpix1 is subjected to an electric potential shift due to a change in electric potential of the CS signal CS1, and the electric potential Vpix2 is subjected to an electric potential shift due to a change in electric potential of the CS signal CS2 (see FIG. 56). This can remove lateral stripes of light and shade of every one row (see FIG. 54).

However, the technique of Patent Literature 2 assumes line (1H) reversal driving for reversing a polarity of a voltage of a pixel electrode every one row (every one horizontal scanning period). According to line (1H) reversal driving, the CS signal has a different electric potential every one row. Therefore, it is impossible to cause the CS signal to have a different electric potential every two rows, for example. In this case, lateral stripes of light and shade of every two rows are produced. Namely, the technique is not applicable to a liquid crystal display device which carries out 2-line (2H) reversal driving for reversing a polarity of a voltage of a pixel electrode every two rows.

As described earlier, according to the conventional techniques, in a case where n-line (nH) reversal driving for reversing a polarity of a voltage of a pixel electrode every n (n is an integer not less than 2) rows is carried out in a liquid crystal display device which carries out CC driving, it is difficult to remove lateral stripes of light and shade which stripes are produced in a display video.

The present invention has been made in view of the problems, and an object of the present invention is to provide a display driving circuit and a display driving method each of which allows, in a display device which carries out CC driving, enhancement of a display quality by removing lateral stripes that are produced in a display video while n-line reversal driving is being carried out.

Solution to Problem

A display driving circuit in accordance with the present invention that is used for a display device which causes a signal electric potential written from a data signal line to a pixel electrode included in a pixel to change in direction in accordance with a polarity of the signal electric potential by supplying a retention capacitor wire signal to a retention capacitor wire with which the pixel electrode forms a capacitor, the display driving circuit reverses, every n (n is an integer not less than 2) horizontal scanning periods, the polarity of the signal electric potential to be supplied to the data signal line, and causes the signal electric potential written from the data signal line to the pixel electrode to change in a different direction every n adjacent rows.

According to the display driving circuit, the retention capacitor wire signal causes the signal electric potential written to the pixel electrode to change in direction in accordance with a polarity of the signal electric potential. This enables CC driving.

According to the configuration, the signal electric potential written from the data signal line to the pixel electrode changes in a different direction every n adjacent rows in n-line (nH) reversal driving. According to this, for example, while 2-line reversal driving is being carried out, it is possible to remove lateral stripes of light and shade which stripes are produced in a display video in the first frame. This allows, in a display device which carries out CC driving, enhancement of a display quality by removing lateral stripes that are produced in a display video while n-line reversal driving is being carried out.

A display driving method in accordance with the present invention for driving a display device which causes a signal electric potential written from a data signal line to a pixel electrode included in a pixel to change in direction in accordance with a polarity of the signal electric potential by supplying a retention capacitor wire signal to a retention capacitor wire with which the pixel electrode forms a capacitor, the display driving method includes the steps of:

(a) reversing, every n (n is an integer not less than 2) horizontal scanning periods, the polarity of the signal electric potential to be supplied to the data signal line; and (b) causing the signal electric potential written from the data signal line to the pixel electrode to change in a different direction every n adjacent rows.

Advantageous Effects of Invention

As described earlier, according to the display driving circuit and the display driving method in accordance with the present invention, the signal electric potential written from the data signal line to the pixel electrode changes in a different direction every n adjacent rows in a case where n-line (nH) (nH) reversal driving is carried out in CC driving. This allows, in a display device which carries out CC driving, enhancement of a display quality by removing lateral stripes that are produced in a display video while n-line reversal driving is being carried out.

DESCRIPTION OF EMBODIMENTS

Embodiment 1

A first embodiment of the present invention is described below with reference to FIGS. 1 through 24.

Figure 1:
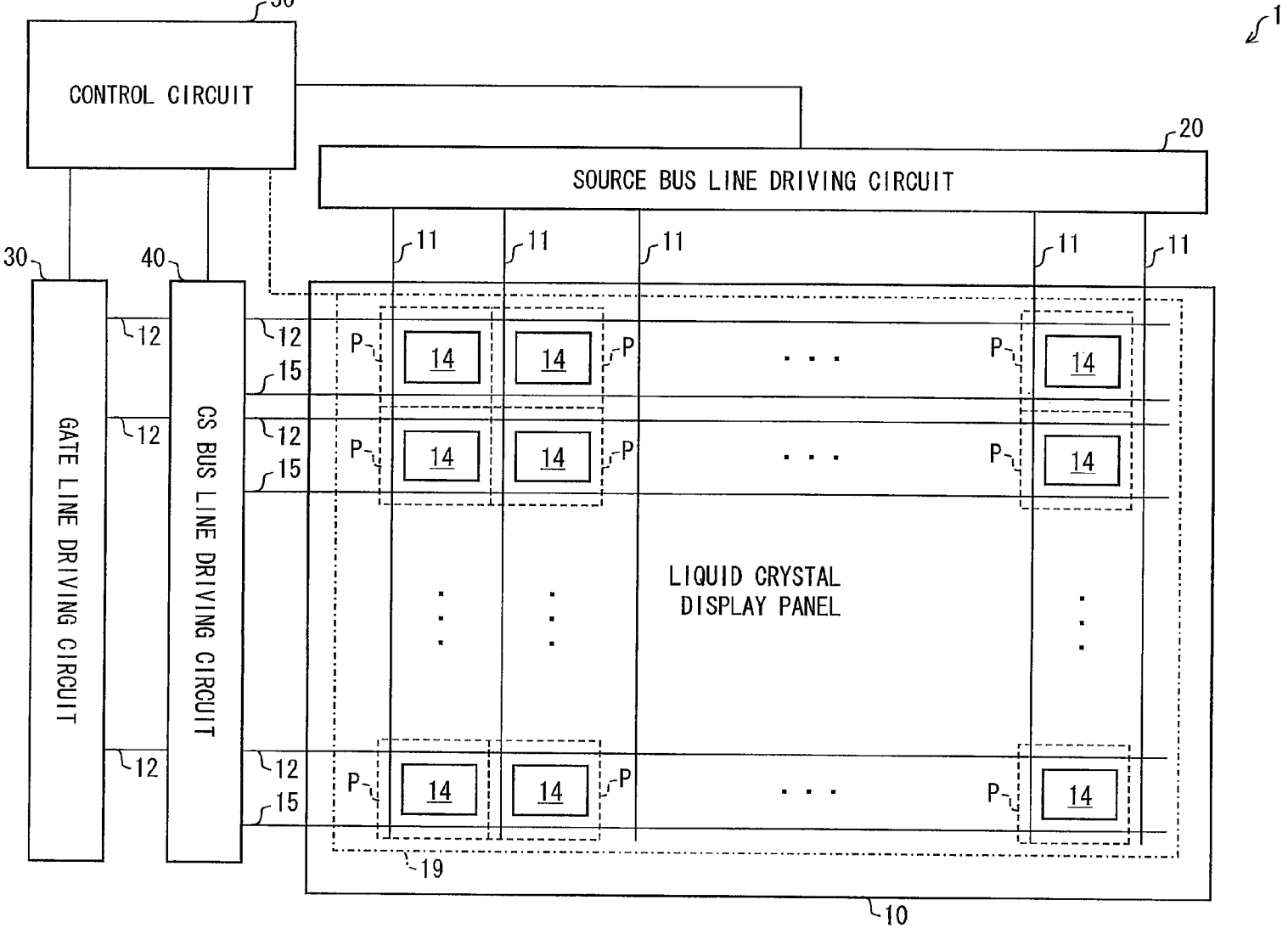
FIG. 1 is a block diagram illustrating an arrangement of a liquid crystal display device in accordance with a first embodiment of the present invention.
Figure 2:
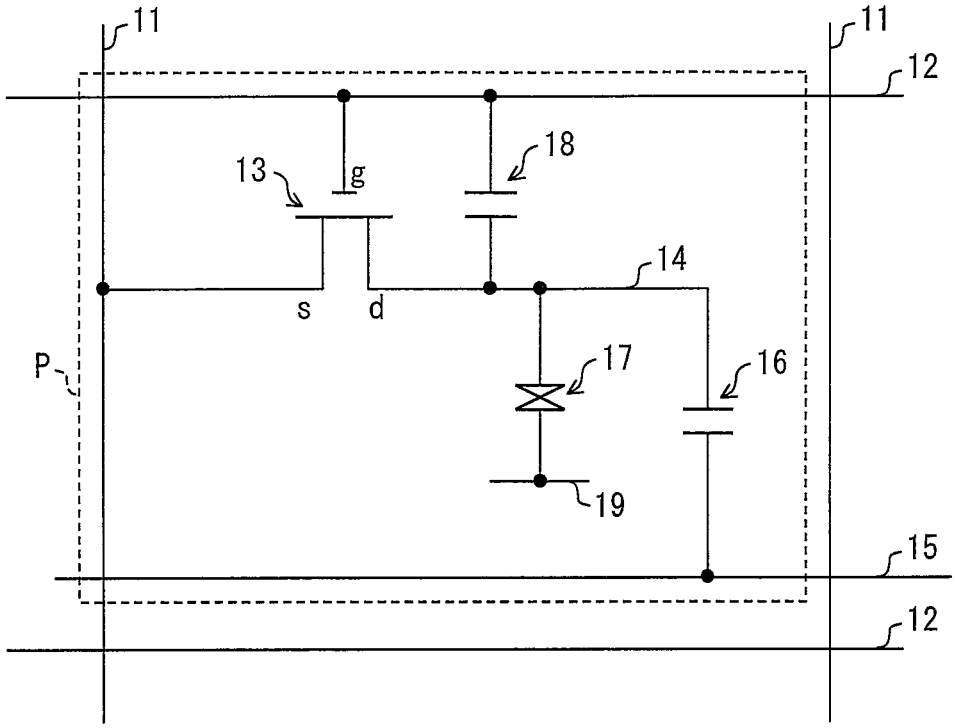
FIG. 2 is an equivalent circuit diagram illustrating an electrical configuration of each pixel of the liquid crystal display device of FIG. 1.

First, the following description discusses, with reference to FIGS. 1 and 2, an arrangement of a liquid crystal display device 1 which corresponds to a display device of the present invention. Note that FIG. 1 is a block diagram illustrating a schematic arrangement of the liquid crystal display device 1 and FIG. 2 is an equivalent circuit diagram illustrating an electrical configuration of a pixel of the liquid crystal display device 1.

The liquid crystal display device 1 includes an active matrix liquid crystal display panel 10, a source bus line driving circuit 20, a gate line driving circuit 30, a CS bus line driving circuit 40, and a control circuit 50. The active matrix liquid crystal display panel 10 corresponds to a display panel of the present invention. The source bus line driving circuit 20 corresponds to a data signal line driving circuit of the present invention. The gate line driving circuit 30 corresponds to a scanning signal line driving circuit of the present invention. The CS bus line driving circuit 40 corresponds to a retention capacitor wire driving circuit of the present invention. The control circuit 50 corresponds to a control circuit of the present invention.

The liquid crystal display panel 10 is constituted by an active matrix substrate and a counter substrate (which are not illustrated), and liquid crystals provided between the active matrix substrate and the counter substrate. The liquid crystal display panel 10 has many pixels P provided in a matrix pattern.

The liquid crystal display panel 10 is arranged such that source bus lines 11, gate lines 12, thins film transistors (hereinafter abbreviated as "TFT") 13, pixel electrodes 14, and CS bus lines 15 are provided on the active matrix substrate and a counter electrode 19 is provided on the counter electrode. The source bus lines 11 correspond to data signal lines of the present invention. The gate lines 12 correspond to scanning signal lines of the present invention. The TFTs 13 correspond to switching elements of the present invention. The pixel electrodes 14 correspond to pixel electrodes of the present invention. The CS bus lines 15 correspond to retention capacitor wires of the present invention. Note that a TFT 13 is illustrated only in FIG. 2 but is not illustrated in FIG. 1.

The source bus lines 11 are provided so that one source bus line 11 is provided for each column and the source bus lines 11 are parallel to each other in a column direction (a vertical direction). The gate lines 12 are provided so that one gate line 12 is provided for each row and the gate lines 12 are parallel to each other in a row direction (a horizontal direction). The TFTs 13 and the pixel electrodes 14 are provided so as to correspond to intersections of the source bus lines 11 and the gate lines 12. Each of the TFTs 13 has a source electrode s which is connected to a corresponding source bus line 11, a gate electrode g which is connected to a corresponding gate line 12, and a drain electrode d which is connected to a corresponding pixel electrode 14. A liquid crystal capacitor 17 is formed between the pixel electrode 14 and the counter electrode 19 via the liquid crystals.

According to this, a gate signal (a scanning signal) to be supplied the gate line 12 turns on a gate of the TFT 13. In a case where a source signal (a data signal) from the source bus line 11 is written to the pixel electrode 14, an electric potential in accordance with the source signal is applied to the pixel electrode 14. As a result, a voltage in accordance with the source signal is applied to the liquid crystals provided between the pixel electrode 14 and the counter electrode 19, so that a grayscale display in accordance with the source signal can be provided.

The CS bus lines 15 are provided so that one CS bus line 15 is provided for each row and the CS bus lines 15 are parallel to each other in a row direction (a horizontal direction). The CS bus lines 15 are provided so as to be paired with the respective gate lines 12. Each of the CS bus lines 15 is capacitively coupled with a corresponding pixel electrode 14 provided for the each row by a retention capacitor 16 (also referred to as a "storage capacitor") which is formed between the CS bus line 15 and the pixel electrode 14.

Note that, since a structure of the TFT 13 forms a feed-through capacitor 18 between the gate electrode g and the drain electrode d of the TFT 13, an electric potential of the pixel electrode 14 is subjected to an influence (a feed through) due to a change in electric potential of the gate line 12. However, for simplification of explanation, the influence is not considered here.

The liquid crystal display panel 10 arranged as described above is driven by the source bus line driving circuit 20, the gate line driving circuit 30, and the CS bus line driving circuit 40. The control circuit 50 supplies, to the source bus line driving circuit 20, the gate line driving circuit 30, and the CS bus line driving circuit 40, signals which are necessary for driving the liquid crystal display panel 10.

According to the present embodiment, in an active period (an effective scanning period) of a vertical scanning period which is periodically repeated, a horizontal scanning period for each row is sequentially allotted and the each row is sequentially scanned. Therefore, the gate line driving circuit 30 sequentially supplies, to a gate line 12 of the each row, the gate signal for turning on the TFT 13 in sync with the horizontal scanning period for the each row. The gate line driving circuit 30 is specifically described later.

The source bus line driving circuit 20 supplies a source signal to each of the source bus lines 11. The source signal is obtained by assigning, to each column in the source bus line driving circuit 20, a video signal which has been supplied from an outside of the liquid crystal display device 1 to the source bus line driving circuit 20 via the control circuit 50 and subjecting the video signal to, for example, boost.

Figure 4:
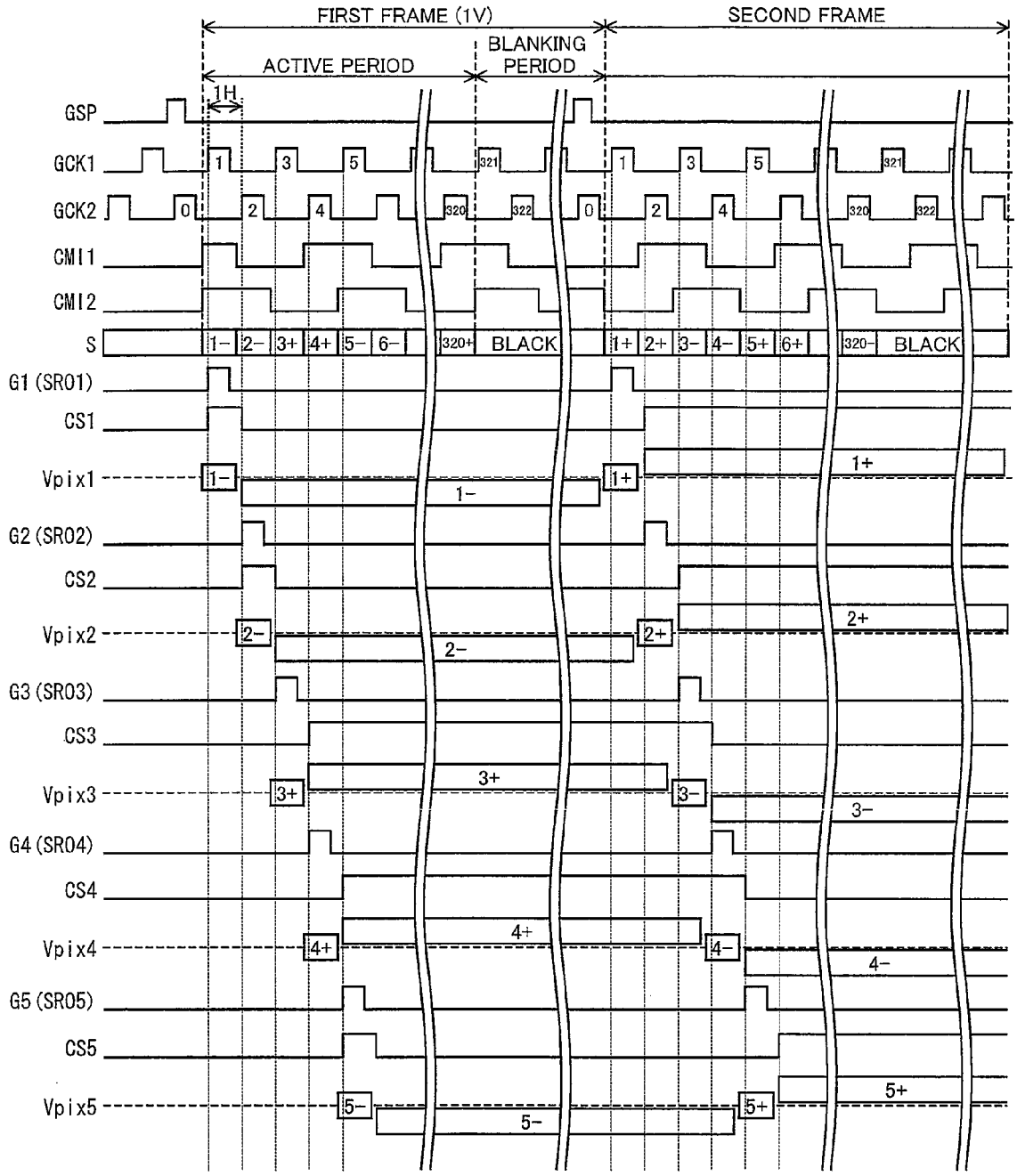
FIG. 4 is a timing chart illustrating waveforms of respective signals of a liquid crystal display device 1 of Example 1.

In order to carry out so-called n-line (nH) reversal driving, the source bus line driving circuit 20 is arranged such that a polarity of the source signal to be outputted is reversed in sync with a vertical scanning period, is identical for all the pixels provided in an identical row, and is reversed every n rows. For example, in FIG. 4 illustrating a timing at which 2-line (2H) reversal driving is carried out, a polarity of a source signal S is reversed between the horizontal periods for the first and second rows and the horizontal periods for the third and fourth rows. The polarity of the source signal S is reversed between the horizontal period for the first row of the first frame and the horizontal period for the first row of the second frame. Namely, according to the n-line (nH) reversal driving, the polarity of the source signal S (a polarity of an electric potential of a pixel electrode) is reversed every n rows.

The CS bus line driving circuit 40 supplies, to each of the CS bus lines 15, a CS signal which corresponds to a retention capacitor wire signal of the present invention. The CS signal has an electric potential which changes (rises or falls) between two values (a high level and a low level). The electric potential is controlled to be different every n rows when the TFT 13 of each of the n rows in an ON state is turned off (when the gate signal falls). The CS bus line driving circuit, 40 is specifically described later.

The control circuit 50 controls the gate line driving circuit 30, the source bus line driving circuit 20, and the CS bus line driving circuit 40 to supply, from these circuits, signals illustrated in FIG. 4.

In the present embodiment, attention should be paid particularly to characteristics of the gate line driving circuit 30 and the CS bus line driving circuit 40 of the above members constituting the liquid crystal display device 1. The following description specifically discusses the gate line driving circuit 30 and the CS bus line driving circuit 40.

Example 1

Figure 54:
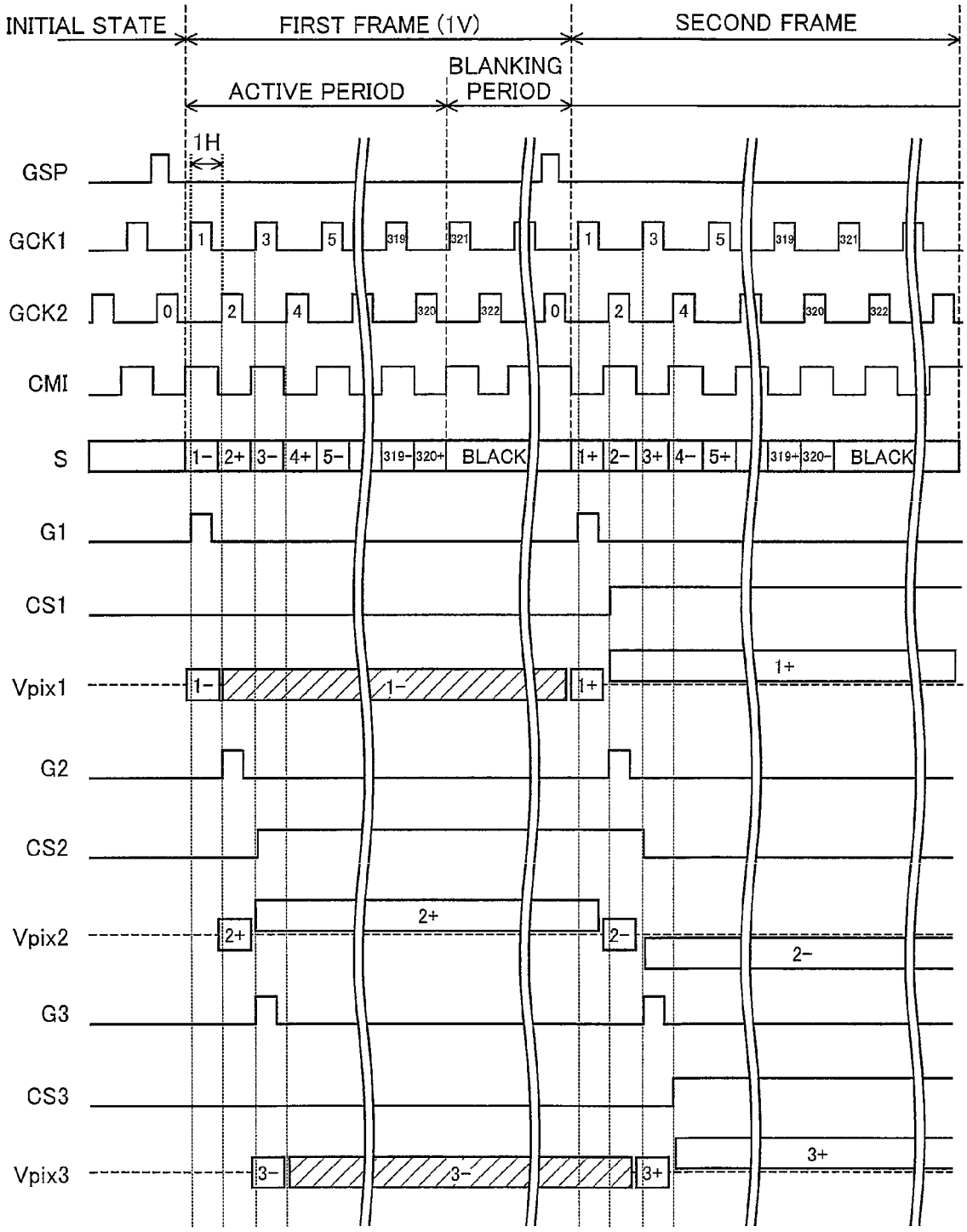
FIG. 54 is a timing chart illustrating waveforms of respective signals of the conventional liquid crystal display device.
Figure 55:
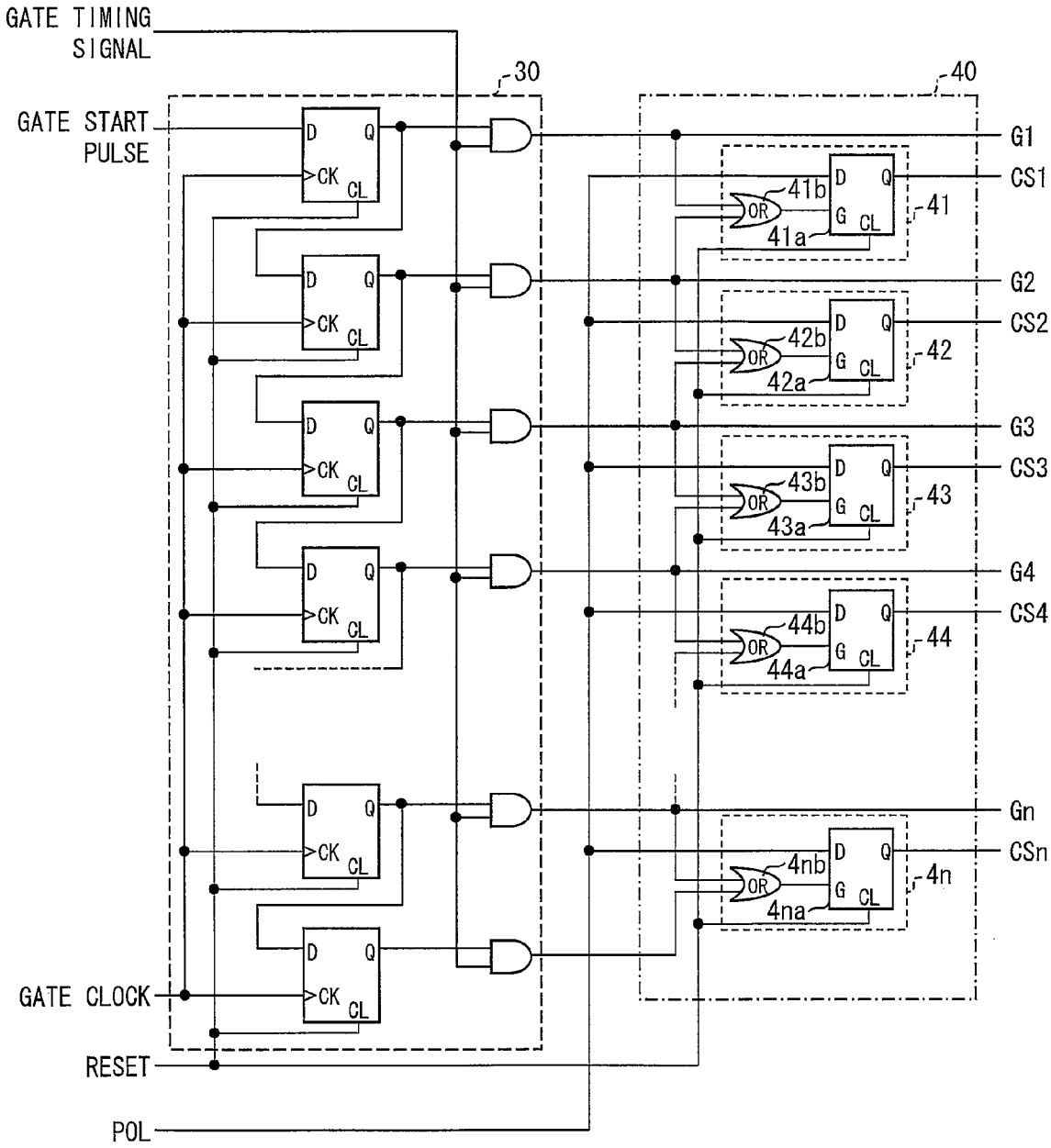
FIG. 55 is a block diagram illustrating other configurations of a gate line driving circuit and a CS bus line driving circuit of the conventional liquid crystal display device.
Figure 56:
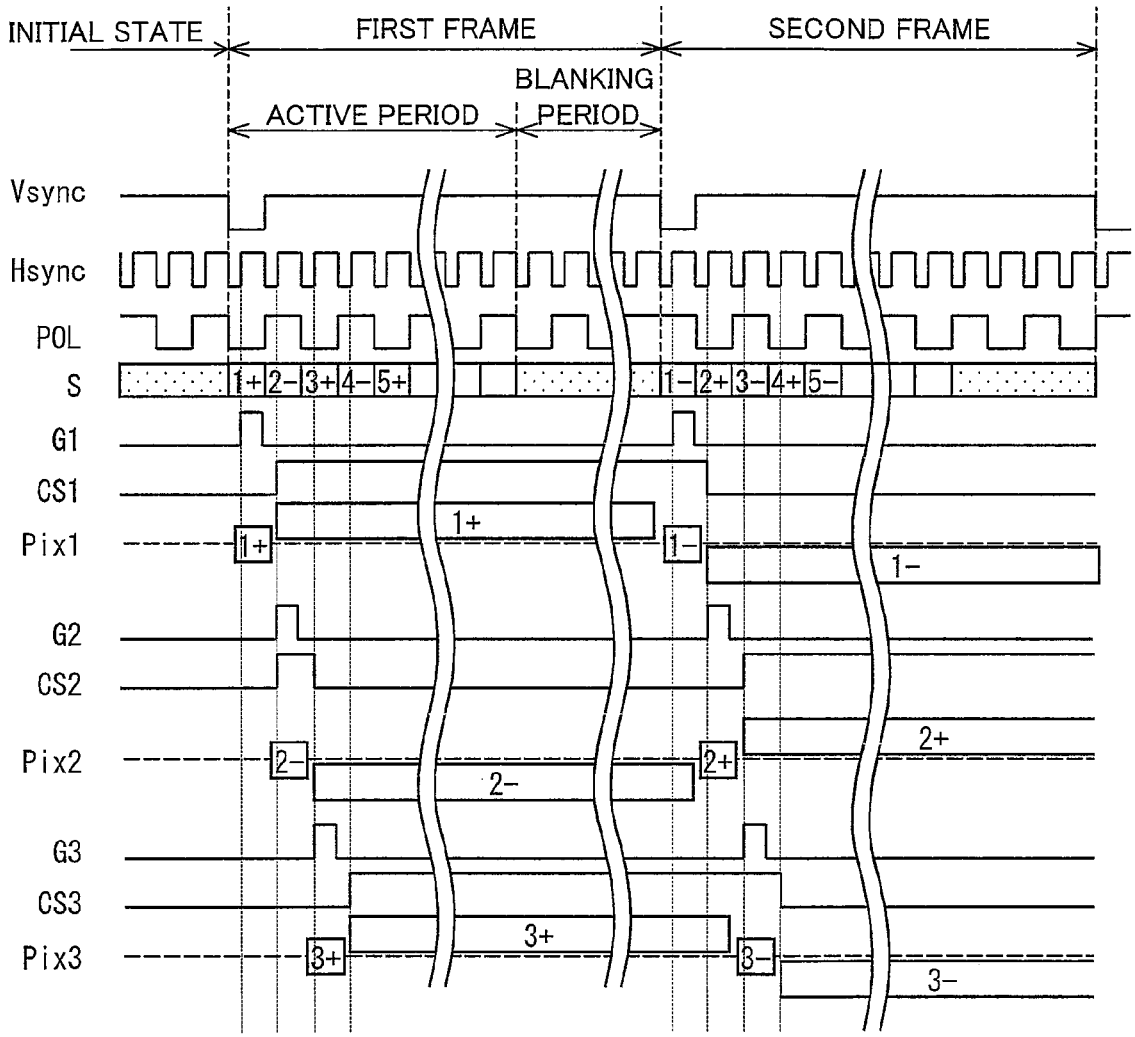
FIG. 56 is a timing chart illustrating waveforms of respective signals of the liquid crystal display device including the drive circuits of FIG. 55.
Figure 57:
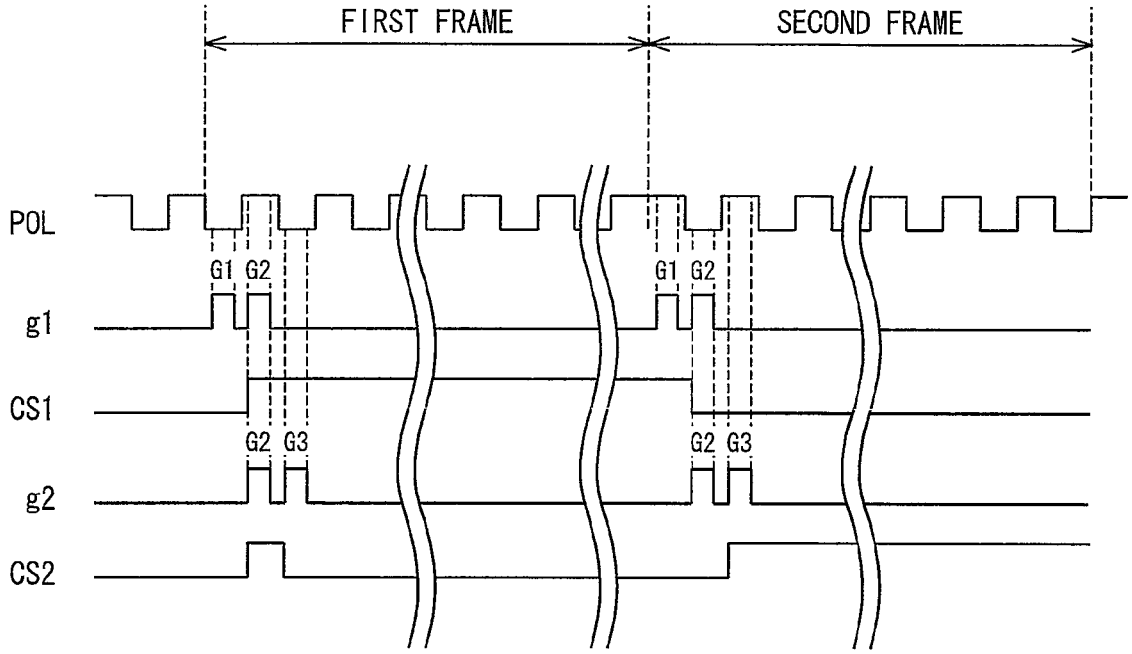
FIG. 57 is a timing chart illustrating waveforms of respective signals supplied to/from the CS bus line driving circuit illustrated in FIG. 55.

FIG. 4 is a timing chart illustrating waveforms of respective signals of the liquid crystal display device 1 which carries out 2-line (2H) reversal driving. In FIG. 4, as in the case of FIG. 54, GSP is a gate start pulse which defines a timing of vertical scanning and each of GCK1 (CK) and GCK2 (CKB) is a gate clock which is supplied from the control circuit 50 and defines a timing at which a shift register operates. A period between a first fall and a second fall of GSP, the second fall following the first fall is equivalent to one vertical scanning period (1V period). Each of a period between a first rise of GCK1 and a first rise of GCK2 and a period between the first rise of GCK2 and a second rise of GCK1, the second rise following the first rise is one horizontal scanning period (1H period). Each of CMI1 and CMI2 is a polarity signal whose polarity is reversed at a given timing.

FIG. 4 illustrates, in this order, (i) the source signal S (video signal) to be supplied from the source bus line driving circuit 20 to a source bus line 11 (a source bus line 11 provided in the xth column), (ii) a gate signal G1 to be supplied from the gate line driving circuit 30 to a gate line 12 provided in the first row, (iii) a CS signal CS1 to be supplied from the CS bus line driving circuit 40 to a CS bus line 105 provided in the first row, and (iv) a waveform of an electric potential Vpix1 of a pixel electrode 14 provided in the first row and the xth column. Then, FIG. 4 illustrates, in this order, (i) a gate signal G2 to be supplied to a gate line 12 provided in the second row, (ii) a CS signal CS2 to be supplied to a CS bus line 15 provided in the second row, and (iii) a waveform of an electric potential Vpix2 of a pixel electrode 14 provided in the second row and the xth column. Further, FIG. 4 illustrates, in this order, (i) a gate signal G3 to be supplied to a gate line 12 provided in the third row, (ii) a CS signal CS3 to be supplied to a CS bus line 15 provided in the third row, and (iii) a waveform of an electric potential Vpix3 of a pixel electrode 14 provided in the third row and the xth column. Also for the fourth row and the fifth row, FIG. 4 similarly illustrates, in this order, a gate signal G4, a CS signal CS4, and a waveform of an electric potential Vpix4, and a gate signal G5, a CS signal CS5, and a waveform of an electric potential Vpix5.

Note that a broken line in each of the electric potentials Vpix1, Vpix2, Vpix3, Vpix4, and Vpix5 indicates an electric potential of the counter electrode 19.

The following description assumes that an initial frame of a display video is the first frame and a frame before the first frame is an initial state. In the initial state, each of the CS signals CS1 through CS5 is fixed at an electric potential having one level (a low level in FIG. 4) (see FIG. 4). In the first frame, the CS signal CS1 of the first row is at a high level when the gate signal G1 corresponding thereto (equivalent to an output SRO1 of a corresponding shift register circuit SR1) falls, the CS signal CS2 of the second row is at a high level when the gate signal G2 corresponding thereto falls, the CS signal CS3 of the third row is at a low level when the gate signal G3 corresponding thereto falls, the CS signal CS4 of the fourth row is at a low level when the gate signal G4 corresponding thereto falls, and the CS signal CS5 of the fifth row is at a high level when the gate signal G5 corresponding thereto falls.

Note here that the source signal S has an amplitude in accordance with a gray scale indicated by a video signal and is a signal whose polarity is reversed every two horizontal scanning periods (2H). Note also that, since FIG. 4 assumes that a uniform video is displayed, the source signal S has a constant amplitude. The gate signals G1 through G5 have gate ON electric potentials during the respective first through fifth 1H periods in an active period (an effective scanning period) of each frame and have gate OFF electric potentials during the other periods of the each frame.

Then, electric potential levels of the respective CS signals CS1 through CS5 change between high and low levels after the gate signals G1 through G5 corresponding to the respective CS signals CS1 through CS5 fall. Specifically, in the first frame, the CS signals CS1 and CS2 fall, after the gate signals G1 and G2 corresponding to the respective CS signals CS1 and CS2 fall, and the CS signals CS3 and CS4 rise after the gate signals G3 and G4 corresponding to the respective CS signals CS3 and CS4 fall. Note that the second frame has a relationship opposite to that of the first frame. The CS signals CS1 and CS2 rise after the gate signals G1 and G2 corresponding to the respective CS signals CS1 and CS2 fall, and the CS signals CS3 and CS4 fall after the gate signals G3 and G4 corresponding to the respective CS signals CS3 and CS4 fall.

As described earlier, according to the liquid crystal display device 1 which carries out 2-line (2H) reversal driving, since electric potentials of the CS signals are different from each other every two rows in accordance with a polarity of the source signal S when the gate signals corresponding to the respective CS signals fall, the electric potentials Vpix1 through Vpix5 of the respective pixel electrodes 14 are properly shifted by the respective CS signals CS1 through CS5. Therefore, an input of the source signal S of an identical gray scale causes positive and negative electric potential differences between the electric potential of the counter electrode and the shifted electric potential of each of the pixel electrodes 14 to be equal to each other. Namely, in the first frame, in an identical pixel column, the source signal of a negative polarity is written to pixels corresponding to respective first two adjacent rows, and the source signal of a positive polarity is written to pixels corresponding to respective second two adjacent rows following the first two adjacent rows. In electric potentials of the CS signals corresponding to the respective first two adjacent rows, no reversal of polarity occurs during the writing of the source signal to the pixels corresponding to the respective first two adjacent rows, reversal of polarity toward a negative polarity occurs after the writing, and no reversal of polarity occurs until the next writing. In electric potentials of the CS signals corresponding to the respective second two adjacent rows, no reversal of polarity occurs during the writing of the source signal to the pixels corresponding to the respective second two adjacent rows, reversal of polarity toward a positive polarity occurs after the writing, and no reversal of polarity occurs until the next writing. This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 3:
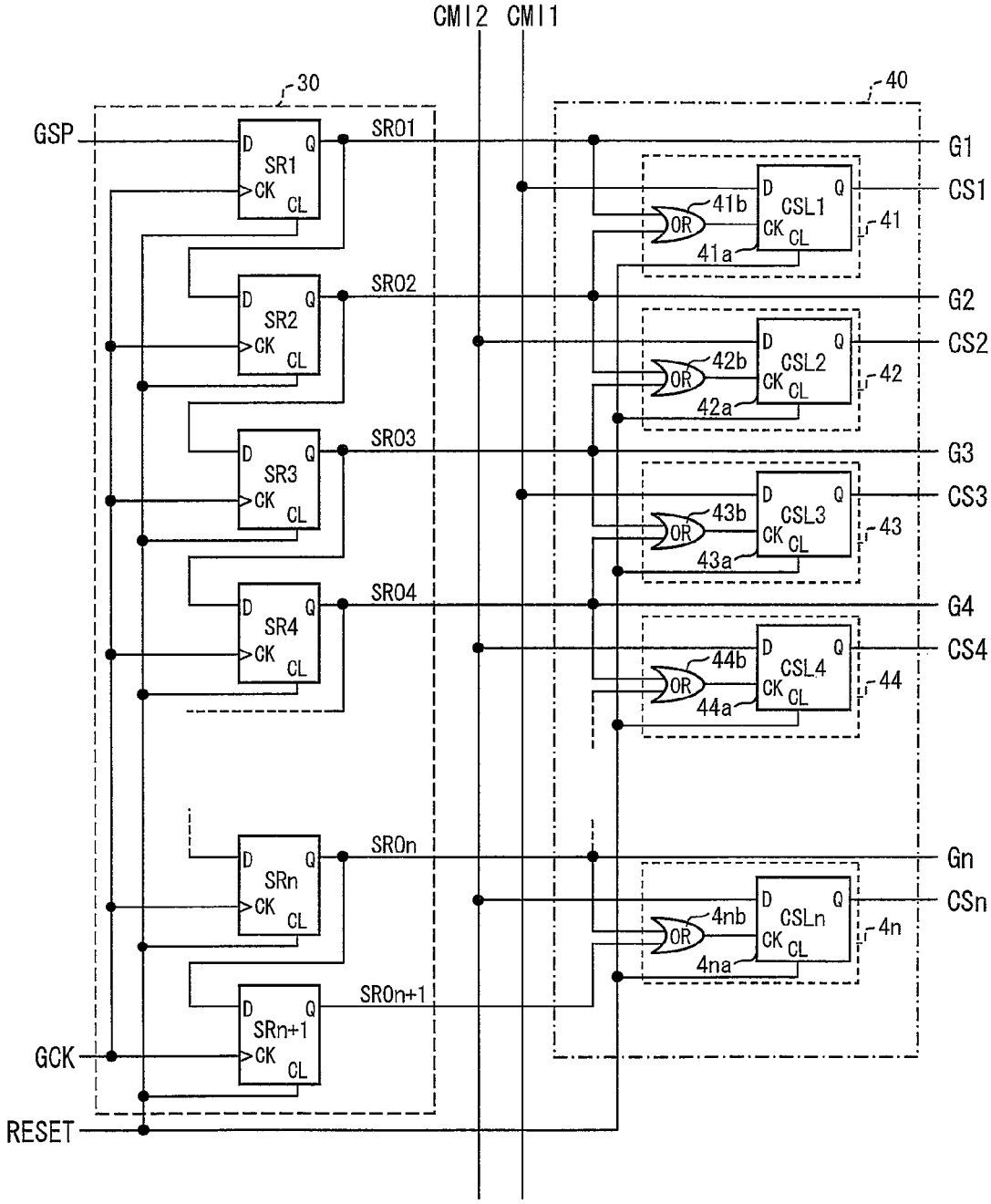
FIG. 3 is a block diagram illustrating configurations of a gate line driving circuit and a CS bus line driving circuit of Example 1.

FIG. 3 illustrates configurations of the gate line driving circuit 30 and the CS bus line driving circuit 40. The CS bus line driving circuit 40 includes a plurality of CS circuits 41, 42, 43, . . . , 4*n* which correspond to the respective rows. The plurality of CS circuits 41, 42, 43, . . . , 4*n* include respective D latch circuits 41*a*, 42*a*, 43*a*, . . . , 4*na* and respective OR circuits (logic circuits) 41*b*, 42*b*, 43*b*, . . . , 4*nb*. The gate line driving circuit 30 includes a plurality of shift register circuits SR1, SR2, SR3, . . . , SRn. Note that the gate line driving circuit 30 and the CS bus line driving circuit 40 are provided on one end side of a liquid crystal display panel in FIG. 3. However, how to provide the gate line driving circuit 30 and the CS bus line driving circuit 40 is not limited to this. The gate line driving circuit 30 and the CS bus line driving circuit 40 may be provided on different sides of the liquid crystal display panel.

The CS circuit 41 receives the shift register output SRO1 and a shift register output SRO2 corresponding to the respective gate signals G1 and G2, a polarity signal CMI1, and a reset signal RESET. The CS circuit 42 receives the shift register output SRO2 and a shift register output SRO3 corresponding to the respective gate signals G2 and G3, a polarity signal CMI2, and the reset signal RESET. The CS circuit 43 receives the shift register output SRO3 and a shift register output SRO4 corresponding to the respective gate signals G3 and G4, the polarity, signal CMI1, and the reset signal RESET. The CS circuit 44 receives the shift register output SRO4 and a shift register output SRO5 corresponding to the respective gate signals G4 and G5, the polarity signal CMI2, and the reset signal RESET. As described earlier, each of the CS circuits receives a shift register output SROn of the corresponding nth row and a shift register output SROn+1 of the (n+1)th row following the nth row, and the polarity signals CMI1 and CMI2 are supplied to the CS circuits alternately every one row. Polarities of the respective polarity signals CMI1 and CMI2 are reversed every two horizontal scanning periods, and phases of the polarity signals CMI1 and CMI2 are shifted by one horizontal scanning period (see FIG. 4). The polarity signals CMI1 and CMI2 and the reset signal RESET are supplied from the control circuit 50.

For convenience, the following description mainly takes, as an example, the CS circuits 42 and 43 corresponding to the respective second and third rows.

The D latch circuit 42*a* receives the reset signal RESET via a reset terminal CL thereof, the polarity signal CMI2 (a retention target signal) via a data terminal D (a second input section) thereof, and an output of the OR circuit 42*b* via a clock terminal CK (a first input section) thereof. In accordance with a change in electric potential level (from low level to high level or from high level to low level) of the signal to be supplied to the clock terminal CK, the D latch circuit 42*a* outputs, as the CS signal CS2 indicating a change in electric potential level, an input state (a low level or a high level) of the polarity signal CMI2 which input state is supplied to the data terminal D.

Specifically, in a case where the signal to be supplied to the clock terminal CK has a high level electric potential, the D latch circuit 42*a* outputs an input state (a low level or a high level) of the polarity signal CMI2 which input state is supplied to the data terminal D. When the electric potential of the signal to be supplied to the clock terminal CK changes from a high level to a low level, the D latch circuit 42*a* latches an input state (a low level or a high level) of the polarity signal CMI2 which input state is supplied to the terminal D when the change occurs. The D latch circuit 42*a* maintains the latched state until the next time the signal to be supplied to the clock terminal CK has a high level electric potential. Then, the D latch circuit 42*a* outputs, via an output terminal Q thereof, the latched state as the CS signal CS2 indicating a change in electric potential level.

Similarly, the reset signal RESET and the polarity signal CMI1 are supplied to the reset terminal CL and the data terminal D, respectively of the D latch circuit 43*a*. In contrast, and an output of the OR circuit 43*b* is supplied to the clock terminal CK of the D latch circuit 43*a*. This causes the CS signal CS3 indicating a change in electric potential level to be supplied from the output terminal Q (an output section) of the D latch circuit 43*a*.

Figure 5:
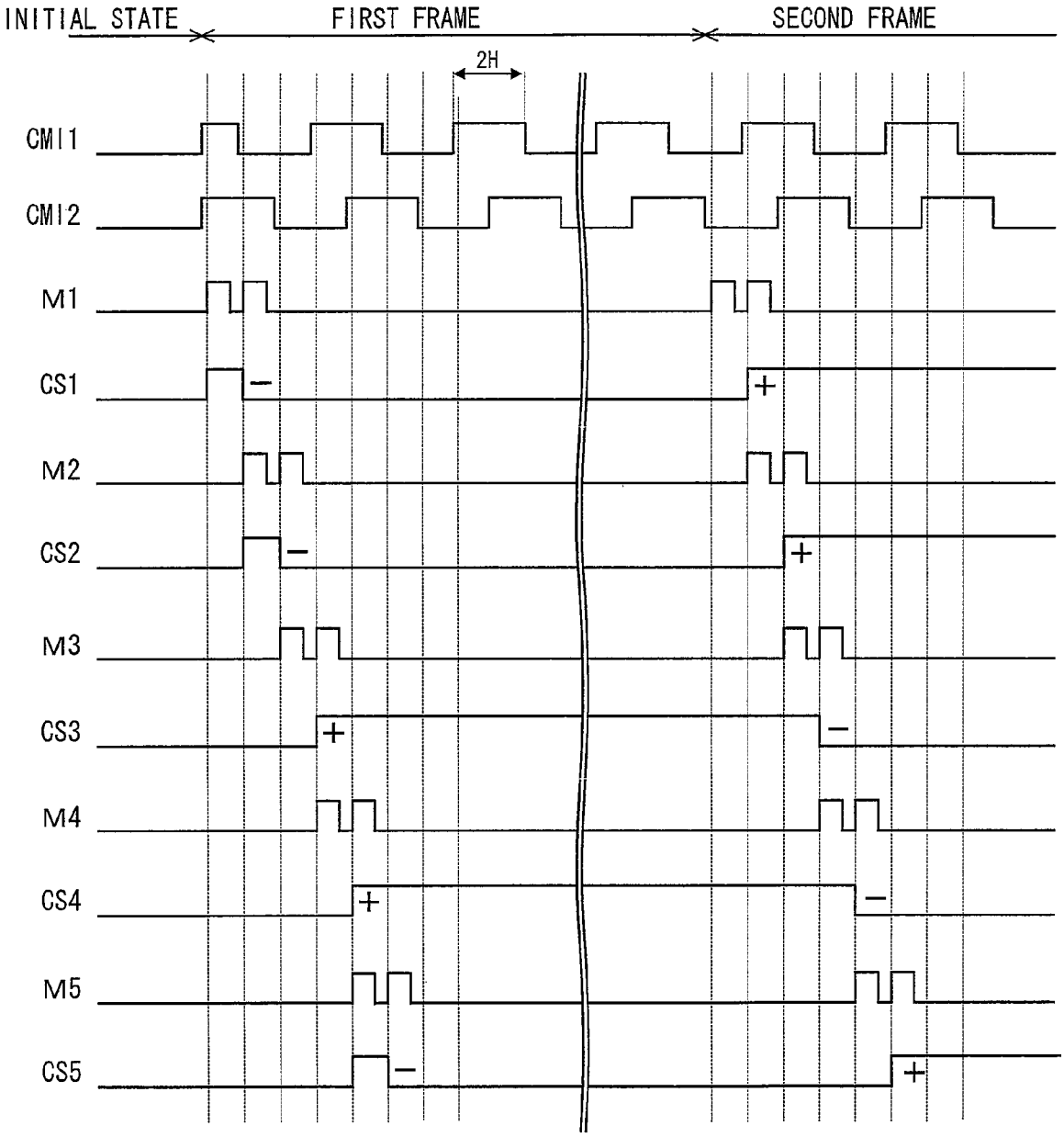
FIG. 5 illustrates waveforms of respective signals supplied to/from the CS bus line driving circuit of the liquid crystal display device 1 of Example 1.

The OR circuit 42*b* which has received the output signal SRO2 of the shift register circuit SR2 of a first row corresponding to the OR circuit 42*b* and the output signal SRO3 of the shift register circuit SR3 of a second row following the first row outputs a signal M2 illustrated in FIG. 5. The OR circuit 43*b* which has received the output signal SRO3 of the shift register circuit SR3 of the second row and the output signal SRO4 of the shift register circuit SR4 of a third row following the second row outputs a signal M3 illustrated in FIG. 5.

Note that the shift register outputs SROs to be supplied to the OR circuits are generated by a publicly-known method in the gate line driving circuit 30 including a D-type flip-flop circuit illustrated in FIG. 3. At a timing of a gate clock GCK having one horizontal scanning period, the gate line driving circuit 30 sequentially shifts a gate start pulse GSP supplied from the control circuit 50 to the shift register circuit SR of a second stage followed by a first stage.

FIG. 5 illustrates waveforms of respective signals supplied to/from the CS bus line driving circuit 40 of the liquid crystal display device 1 of Example 1.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches, an input state of the polarity signal CMI2 which input state is obtained when the change occurs, i.e., a high level. Then, the high level is maintained until the signal M2 becomes at a high level.

Subsequently, the shift register output SRO3 which has been shifted to the third row in the gate line driving circuit 30 is supplied to the other terminal of the OR circuit 42*b*. Note that the shift register output SRO3 is also supplied to one terminal of the OR circuit 43*b* of the CS circuit 43.

A change in electric potential level (from low level to high level) of the shift register output SRO3 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO3 occurs. The D latch circuit 42*a* outputs a low level until a change in electric potential level (from high level to low level) of the shift register output SRO3 occurs in the signal M2 to be supplied to the clock terminal CK (during a period in which the signal M2 is at a high level). Next, when the change in electric potential level (from high level to low level) of the shift register output SRO3 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

In the second frame, during a period in which the shift register output SRO2 is at a high level in the signal M2, after the D latch circuit 42*a* transfers an input state (a low level) of the polarity signal CMI2 which input state is supplied to the data terminal D, the D latch circuit 42*a* latches an input state (a low level) of the polarity signal CMI2, the input state being obtained when a change in electric potential level (from high level to low level) of the shift register output SRO2 is supplied to the clock terminal CK. Then, the low level is maintained until the next time the signal M2 becomes at a high level.

Next, a change in electric potential level (from low level to high level) of the shift register output SRO3 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO3 occurs. The D latch circuit 42*a* outputs a high level until a change in electric potential level (from high level to low level) of the shift register output SRO3 to be supplied to the clock terminal CK occurs (during a period in which the signal M2 is at a high level). Next, when the change in electric potential level (from high level to low level) of the shift register output SRO2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level in the third frame.

Note that in the first row, the CS signal CS1 illustrated in FIG. 5 is outputted by causing the shift register outputs SRO1 and SRO2 to latch the polarity signal CMI1.

Next, a change in waveforms of respective signals of the third row is to be described. In the initial state, the polarity signal CMI1 is supplied to the data terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI1 which input state is supplied to the data terminal D when the change occurs, i.e., a low level. The D latch circuit 43*a* outputs a low level until the next time a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level.

Subsequently, the shift register output SRO4 which has been shifted to the fourth row in the gate line driving circuit 30 is supplied to the other terminal of the OR circuit 43*b*. Note that the shift register output SRO4 is also supplied to one terminal of the OR circuit 44*b* of the CS circuit 44.

A change in electric potential level (from low level to high level) of the shift register output SRO4 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, the electric potential of the CS signal CS3 changes from a low level to a high level when the change in electric potential level (from low level to high level) of the shift register output SRO4 occurs. The D latch circuit 43*a* outputs a high level until the next time a change in electric potential level (from high level to low level) of the shift register output SRO4 occurs in the signal M3 to be supplied to the clock terminal CK (during a period in which the signal M3 is at a high level). Next, when the change in electric potential level (from high level to low level) of the shift register output 51204 in the signal M3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level in the second frame.

In the second frame, during a period in which the shift register output SRO3 is at a high level in the signal M3, after the D latch circuit 43*a* transfers an input state (a high level) of the polarity signal CMI1 which input state is supplied to the data terminal D, the D latch circuit 43*a* latches an input state (a high level) of the polarity signal CMI1, the input state being obtained when a change in electric potential level (from high level to low level) of the shift register output SRO3 is supplied to the clock terminal CK. Then, the high level is maintained until the next time the signal M3 becomes at a high level.

Next, a change in electric potential level (from low level to high level) of the shift register output SRO4 is supplied to the clock terminal CK of the D latch circuit 43*a*, and the D latch circuit 43*a* transfers an input state of the polarity signal CMI1 which input state is supplied to the terminal D when the change occurs, i.e., a low level. Namely, the electric potential of the CS signal CS3 changes from a high level to a low level when the change in electric potential level (from low level to high level) of the shift register output SRO4 occurs.

The D latch circuit 43*a* outputs a low level until the next time a change in electric potential level (from high level to low level) of the shift register output SRO4 to be supplied to the clock terminal CK occurs (during a period in which the signal M3 is at a high level). Next, when the change in electric potential level (from high level to low level) of the shift register output SRO4 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level in the third frame.

Note that in the fourth row, the CS signal CS4 illustrated in FIG. 5 is outputted by causing the shift register outputs SRO4 and SRO5 to latch the polarity signal CMI2.

As described earlier, in 2H reversal driving, for each frame, it is possible to cause the CS circuits 41, 42, 43, . . . , 4*n* which correspond to the respective rows to change, between high and low levels, an electric potential level of the CS signal between when the gate signal of each row falls (when the TFT 13 in an ON state is turned off) and after the gate signal of the each row has fallen.

Namely, according to Example 1, a CS signal CSn to be supplied to a CS bus line 15 of the nth row is generated by latching (i) an electric potential level of the polarity signal CMI1 which level is obtained when a gate signal Gn of the nth row rises and (ii) an electric potential level of the polarity signal CMI1 which level is obtained when a gate signal G(n+1) of the (n+1)th row rises, and a CS signal CSn+1 to be supplied to a CS bus line 15 of the (n+1)th row is generated by latching (i) an electric potential level of the polarity signal CMI2 which level is obtained when the gate signal G(n+1) of the (n+1)th row rises and (ii) an electric potential level of the polarity signal CMI2 which level is obtained when a gate signal G(n+2) of the (n+2)th row rises. A CS signal CSn+2 to be supplied to a CS bus line 15 of the (n+2)th row is generated by latching (i) an electric potential level of the polarity signal CMI1 which level is obtained when the gate signal G(n+2) of the (n+2)th row rises and (ii) an electric potential level of the polarity signal CMI1 which level is obtained when a gate signal G(n+3) of the (n+3)th row rises, and a CS signal CS(n+3) to be supplied to a CS bus line 15 of the (n+3)th row is generated by latching (i) an electric potential level of the polarity signal CMI2 which level is obtained when the gate signal G(n+3) of the (n+3)th row rises and (ii) an electric potential level of the polarity signal CMI2 which level is obtained when a gate signal G(n+4) of the (n+4)th row rises.

This allows the CS bus line driving circuit 40 to operate properly in the first frame also in 2H reversal driving. Therefore, it is possible to remove irregular waveforms which are described above and serve as a cause for lateral stripes in the first frame and to yield an effect of preventing lateral stripes of light and shade which stripes are produced in a display video in the first frame, so as to enhance a display quality.

Figure 6:
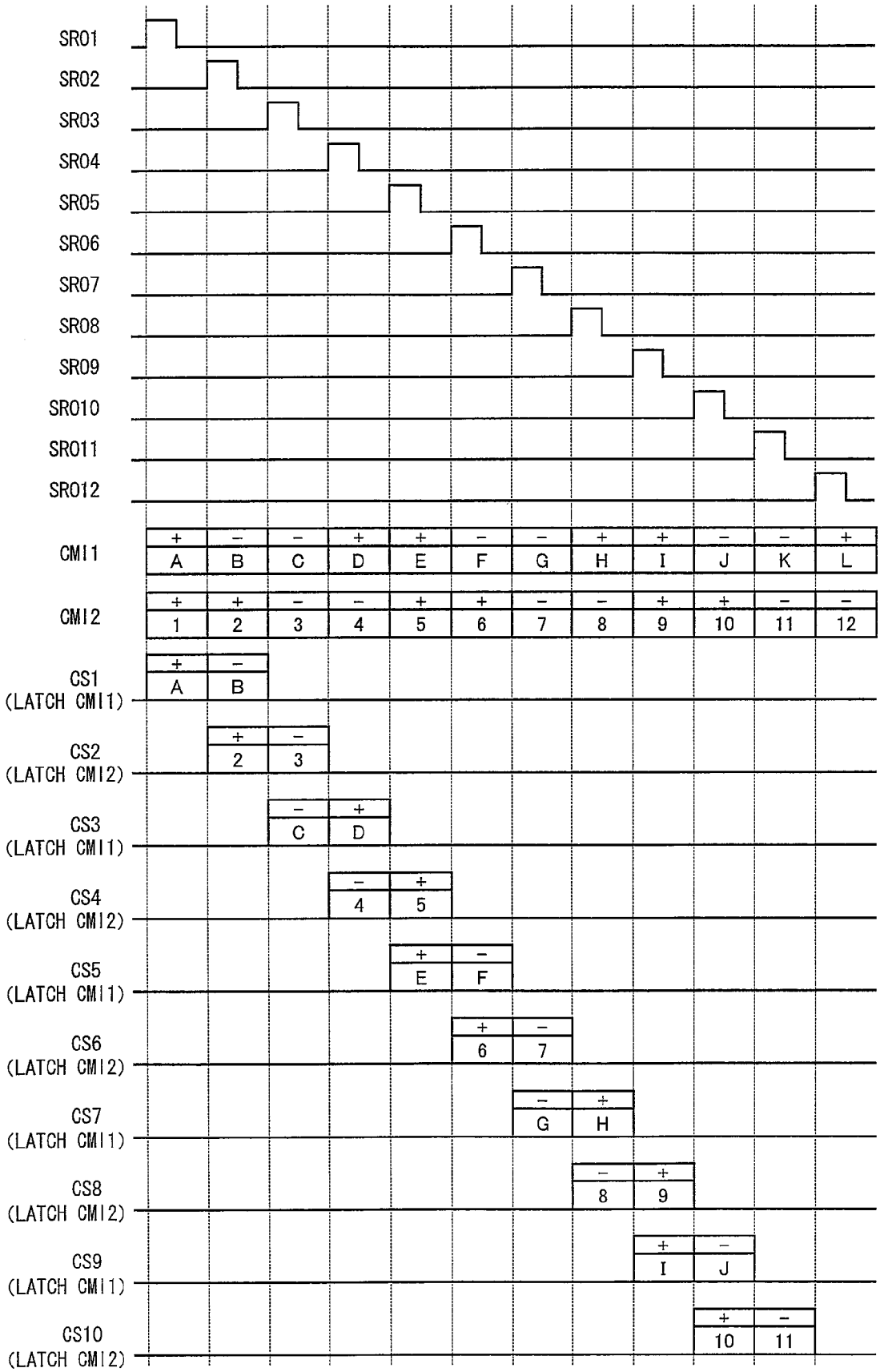
FIG. 6 illustrates how (i) a polarity signal and a shift register output each of which is supplied to a CS circuit of Example 1 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 6 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 6, signs A through L correspond to respective one horizontal scanning periods and indicate polarities (positive polarities or negative polarities) of the respective one horizontal scanning periods. For example, CMI1 has a negative polarity during the second horizontal scanning period "B", has a negative polarity during the third horizontal scanning period "C", has a positive polarity during the fourth horizontal scanning period "D", and has a positive polarity during the fifth horizontal scanning period "E". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a negative polarity during the third horizontal scanning period "3", and has a negative polarity during the fourth horizontal scanning period "4". As described earlier, the polarities of respective of CMI1 and CMI2 are reversed every two horizontal scanning periods, and the phases of CMI1 and CMI2 are shifted by one horizontal scanning period. CMI1 and CMI2 are supplied to the CS circuit 4*n* alternately every one row. For example, CMI1 is supplied to the CS circuit 41, CMI2 is supplied to the CS circuit 42, and CMI1 is supplied to the CS circuit 43 (see FIG. 3).

According to the CS circuit 4*n*, since the shift register output SROn of the nth row and the shift register output SROn+1 of the (n+1)th row following the nth row are supplied to the clock terminal CK, (i) CMI to be supplied to the data terminal D during the nth horizontal scanning period and (ii) CMI to be supplied to the data terminal D during the (n+1)th horizontal scanning period are latched. For example, the CS circuit 41 loads (i) a positive polarity of "A" of CMI1 during the first horizontal scanning period and (ii) a negative polarity of "B" of CMI1 during the second horizontal scanning period. The CS circuit 42 loads (i) a positive polarity of "2" of CMI2 during the second horizontal scanning period and (ii) a negative polarity of "3" of CMI2 during the third horizontal scanning period. The CS circuit 43 loads (i) a negative polarity of "C" of CMI1 during the third horizontal scanning period and (ii) a positive polarity of "D" of CMI1 during the fourth horizontal scanning period. The CS circuit 44 loads (i) a negative polarity of "4" of CMI2 during the fourth horizontal scanning period and (ii) a positive polarity of "5" of CMI2 during the fifth horizontal scanning period. Each of the CS signals CSn illustrated in FIGS. 4 and 5 is thus outputted.

Example 2

Figure 7:
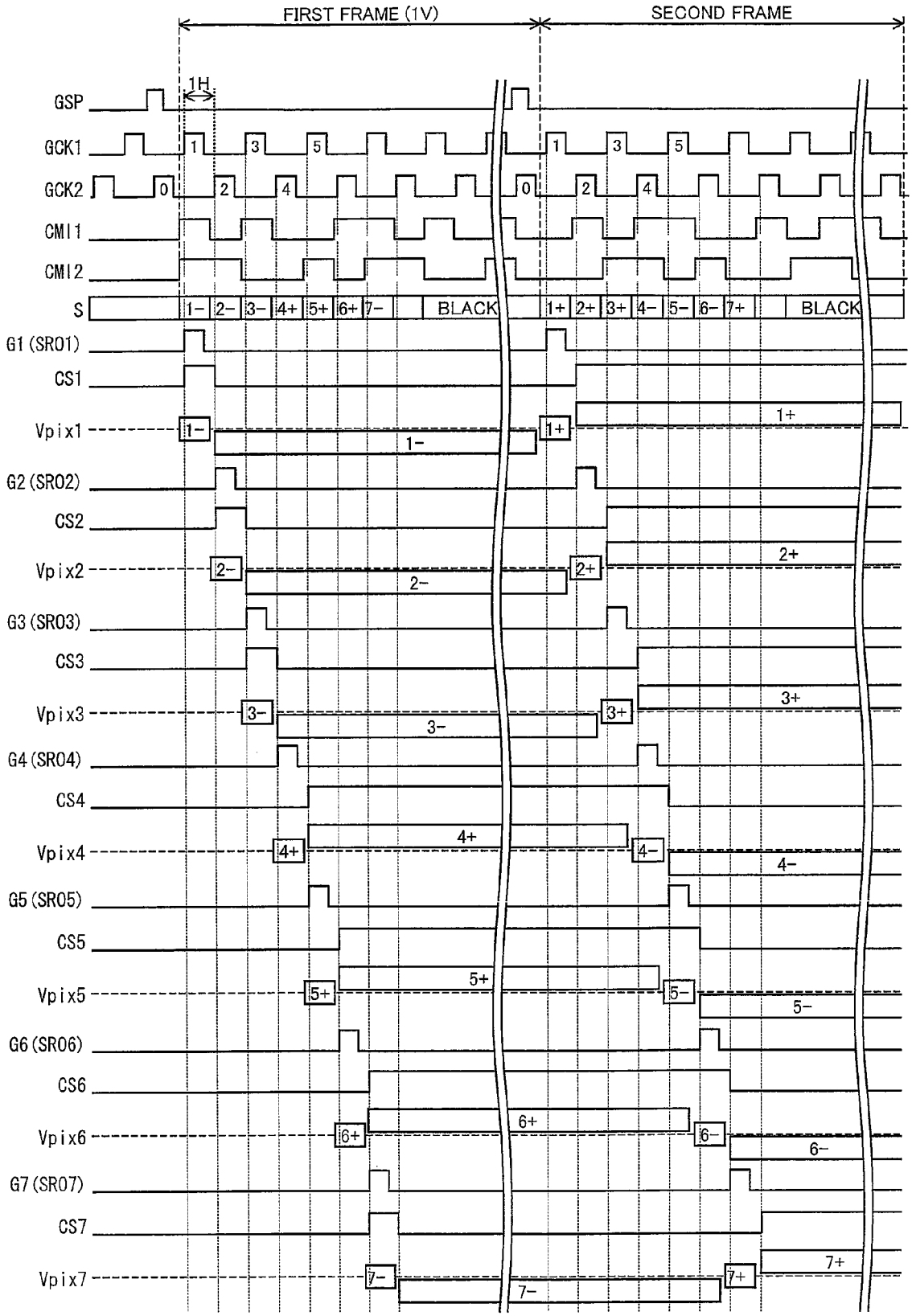
FIG. 7 is a timing chart illustrating waveforms of respective signals, the waveforms being obtained in a case where 3-line (3H) reversal driving is carried out in a liquid crystal display device 1 of Example 2.

FIG. 7 is a timing chart illustrating waveforms of respective signals, the waveforms being obtained in a case where 3-line (3H) reversal driving is carried out in the liquid crystal display device 1 illustrated in FIG. 3. FIG. 7 is different from FIG. 4 in timing at which polarities of respective of CMI1 and CMI2 are reversed.

In the initial state, each of the CS signals CS1 through CS7 is fixed at an electric potential having one level (a low level in FIG. 7) (see FIG. 7). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 7 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

As described earlier, according to the liquid crystal display device 1 which carries out 3-line (3H) reversal driving, since electric potentials of the CS signals are different from each other every three rows in accordance with a polarity of the source signal S when the gate signals corresponding to the respective CS signals fall, the electric potentials Vpix1 through Vpix7 of the respective pixel electrodes 14 are properly shifted by the respective CS signals CS1 through CS7. Therefore, an input of the source signal S of an identical gray scale causes positive and negative electric potential differences between the electric potential of the counter electrode and the shifted electric potential of each of the pixel electrodes 14 to be equal to each other. Namely, in the first frame, in an identical pixel column, the source signal of a negative polarity is written to pixels corresponding to respective first three adjacent rows, and the source signal of a positive polarity is written to pixels corresponding to respective second three adjacent rows following the first three adjacent rows. In electric potentials of the CS signals corresponding to the respective first three adjacent rows, no reversal of polarity occurs during the writing of the source signal to the pixels corresponding to the respective first three adjacent rows, reversal of polarity toward a negative polarity occurs after the writing, and no reversal of polarity occurs until the next writing. In electric potentials of the CS signals corresponding to the respective second three adjacent rows, no reversal of polarity occurs during the writing of the source signal to the pixels corresponding to the respective second three adjacent rows, reversal of polarity toward a positive polarity occurs after the writing, and no reversal of polarity occurs until the next writing. This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

The gate line driving circuit 30 and the CS bus line driving circuit 40 of Example 2 are different from those of Example 1 in timing at which polarities of the respective polarity signals CMI1 and CMI2 are reversed. The other configurations are identical to those illustrated in FIG. 3. Each of the CS circuits receives the shift register output SROn of the corresponding nth row and the shift register output SROn+1 of the (n+1)th row following the nth row, and the polarity signals CMI1 and CMI2 are supplied to the CS circuits alternately every one row. A timing at which the polarities of the respective polarity signals CMI1 and CMI2 are reversed is set as illustrated in FIG. 7.

Figure 8:
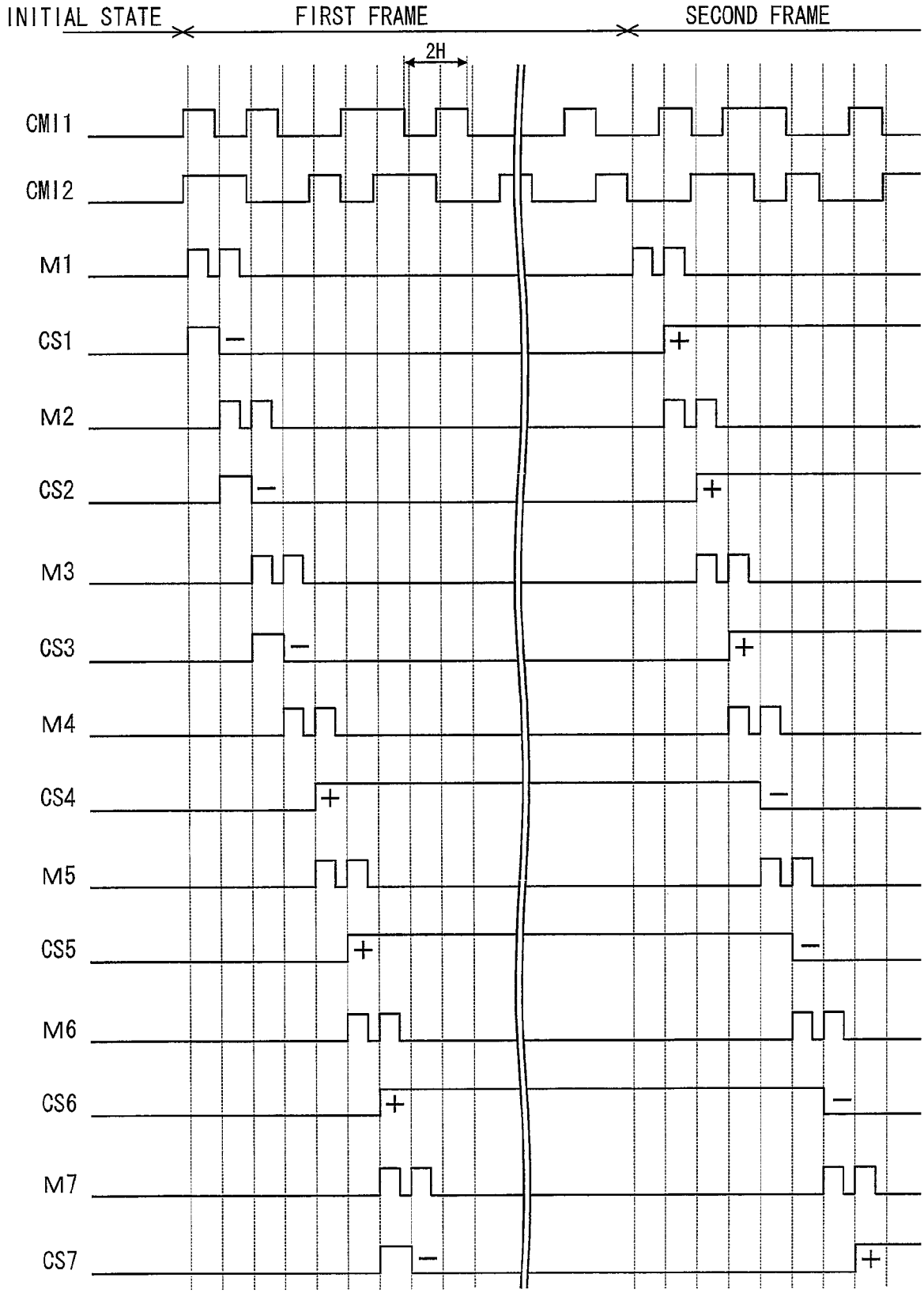
FIG. 8 illustrates waveforms of respective signals supplied to/from a CS bus line driving circuit of the liquid crystal display device 1 of Example 2.

A description of how the gate line driving circuit 30 and the CS bus line driving circuit 40 are connected is omitted here, and 3H reversal driving is described with reference to FIGS. 7 and 8. FIG. 8 illustrates waveforms of respective signals supplied to/from the CS bus line driving circuit 40 of the liquid crystal display device 1 of Example 2. For convenience, the following description takes, as an example, the CS circuits 42, 43, and 44 corresponding to the respective second through fourth rows, so as to discuss operation of the first frame.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level.

Subsequently, the shift register output SRO3 which has been shifted to the third row in the gate line driving circuit 30 is supplied to the other terminal of the OR circuit 42*b*. Note that the shift register output SRO3 is also supplied to one terminal of the OR circuit 43*b* of the CS circuit 43.

A change in electric potential level (from low level to high level) of the shift register output SRO3 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO3 occurs. The D latch circuit 42*a* outputs a low level until a change in electric potential level (from high level to low level) of the shift register output SRO3 occurs in the signal M2 to be supplied to the clock terminal CK (during a period in which the signal M2 is at a high level). Next, when the change in electric potential level (from high level to low level) of the shift register output SRO3 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

In the second frame, during a period in which the shift register output SRO2 is at a high level in the signal M2, after the D latch circuit 42*a* transfers an input state (a low level) of the polarity signal CMI2 which input state is supplied to the data terminal D, the D latch circuit 42*a* latches an input state (a low level) of the polarity signal CMI2, the input state being obtained when a change in electric potential level (from high level to low level) of the shift register output SRO2 is supplied to the clock terminal CK. Then, the low level is maintained until the next time the signal M2 becomes at a high level.

Next, a change in electric potential level (from low level to high level) of the shift register output SRO3 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO3 occurs. The D latch circuit 42*a* outputs a high level until a change in electric potential level (from high level to low level) of the shift register output SRO3 to be supplied to the clock terminal CK occurs (during a period in which the signal M2 is at a high level). Next, when the change in electric potential level (from high level to low level) of the shift register output SRO2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level in the third frame.

Note that in the first row, the CS signal CS1 illustrated in FIG. 8 is outputted by causing the shift register outputs SRO1 and SRO2 to latch the polarity signal CMI1.

Next, a change in waveforms of respective signals of the third row is to be described. In the initial state, the polarity signal CMI1 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level.

Subsequently, the shift register output SRO4 which has been shifted to the fourth row in the gate line driving circuit 30 is supplied to the other terminal of the OR circuit 43*b*. Note that the shift register output SRO4 is also supplied to one terminal of the OR circuit 43*b* of the CS circuit 43.

A change in electric potential level (from low level to high level) of the shift register output SRO4 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a low level. Namely, the electric potential of the CS signal CS3 changes from a high level to a low level when the change in electric potential level (from low level to high level) of the shift register output SRO4 occurs. The D latch circuit 43*a* outputs a low level until a change in electric potential level (from high level to low level) of the shift register output SRO4 occurs in the signal M3 to be supplied to the clock terminal CK (during a period in which the signal M3 is at a high level). Next, when the change in electric potential level (from high level to low level) of the shift register output SRO4 in the signal M3 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level in the second frame.

In the second frame, during a period in which the shift register output SRO3 is at a high level in the signal M3, after the D latch circuit 43*a* transfers an input state (a low level) of the polarity signal CMI1 which input state is supplied to the data terminal D, the D latch circuit 43*a* latches an input state (a low level) of the polarity signal CMI1, the input state being obtained when a change in electric potential level (from high level to low level) of the shift register output SRO3 is supplied to the clock terminal CK. Then, the low level is maintained until the next time the signal M3 becomes at a high level.

Next, a change in electric potential level (from low level to high level) of the shift register output SRO4 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, the electric potential of the CS signal CS3 changes from a low level to a high level when the change in electric potential level (from low level to high level) of the shift register output SRO3 occurs. The D latch circuit 43*a* outputs a high level until a change in electric potential level (from high level to low level) of the shift register output SRO4 to be supplied to the clock terminal CK occurs (during a period in which the signal M3 is at a high level). Next, when the change in electric potential level (from high level to low level) of the shift register output SRO3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level in the third frame.

Next, a change in waveforms of respective signals of the fourth row is to be described. In the initial state, the polarity signal CMI2 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI2 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI2 which input state is obtained when the change occurs, i.e., a low level. Then, the low level is maintained until the signal M4 becomes at a high level.

Subsequently, the shift register output SRO5 which has been shifted to the fifth row in the gate line driving circuit 30 is supplied to the other terminal of the OR circuit 44*b*. Note that the shift register output SRO5 is also supplied to one terminal of the OR circuit 45*b* of the CS circuit 45.

A change in electric potential level (from low level to high level) of the shift register output SRO5 in the signal M4 is supplied to the clock terminal CK of the D latch circuit 44*a*, and the D latch circuit 44*a* transfers an input state of the polarity signal CMI2 which input state is supplied to the terminal D when the change occurs, i.e., a high level. Namely, the electric potential of the CS signal CS4 changes from a low level to a high level when the change in electric potential level (from low level to high level) of the shift register output SRO5 occurs. The D latch circuit 44*a* outputs a high level until the next time a change in electric potential level (from high level to low level) of the shift register output SRO5 occurs in the signal M4 to be supplied to the clock terminal CK (during a period in which the signal M4 is at a high level). Next, when the change in electric potential level (from high level to low level) of the shift register, output SRO5 in the signal M4 is supplied to the clock terminal CK, the D latch circuit 44*a* latches an input state of the polarity signal CMI2 which input state is obtained when the change occurs, i.e., a high level. Then, the high level is maintained until the signal M4 becomes at a high level in the second frame.

In the second frame, during a period in which the shift register output SRO4 is at a high level in the signal M4, after the D latch circuit 44*a* transfers an input state (a high level) of the polarity signal CMI2 which input state is supplied to the data terminal D, the D latch circuit 44*a* latches an input state (a high level) of the polarity signal CMI2, the input state being obtained when a change in electric potential level (from high level to low level) of the shift register output SRO4 is supplied to the clock terminal CK. Then, the high level is maintained until the next time the signal M4 becomes at a high level.

Next, a change in electric potential level (from low level to high level) of the shift register output SRO5 is supplied to the clock terminal CK of the D latch circuit 44*a*, and the D latch circuit 44*a* transfers an input state of the polarity signal CMI2 which input state is supplied to the terminal D when the change occurs, i.e., a low level. Namely, the electric potential of the CS signal CS4 changes from a high level to a low level when the change in electric potential level (from low level to high level) of the shift register output SRO5 occurs.

The D latch circuit 44*a* outputs a low level until the next time a change in electric potential level (from high level to low level) of the shift register output SRO5 to be supplied to the clock terminal CK occurs (during a period in which the signal M4 is at a high level). Next, when the change in electric potential level (from high level to low level) of the shift register output SRO5 is supplied to the clock terminal CK, the D latch circuit 44*a* latches an input state of the polarity signal CMI2 which input state is obtained when the change occurs, i.e., a low level. Then, the low level is maintained until the signal M4 becomes at a high level in the third frame.

According to the above operation, in the first through third rows, an electric potential level of the CS signal which level is obtained when the gate signal of a corresponding row falls (when the TFT 13 in an ON state is turned off) falls after the gate signal of the corresponding row has fallen, and in the fourth through sixth rows, an electric potential level of the CS signal which level is obtained when the gate signal of a corresponding row falls (when the TFT 13 in an ON state is turned off) rises after the gate signal of the corresponding row has fallen (see FIGS. 7 and 8).

As described earlier, according to Example 2, 3H reversal driving can be carried out in the liquid crystal display device 1 having the arrangement illustrated in FIG. 3 by adjusting a timing at which the polarities of the respective polarity signals CMI1 and CMI2 are reversed. This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 9:
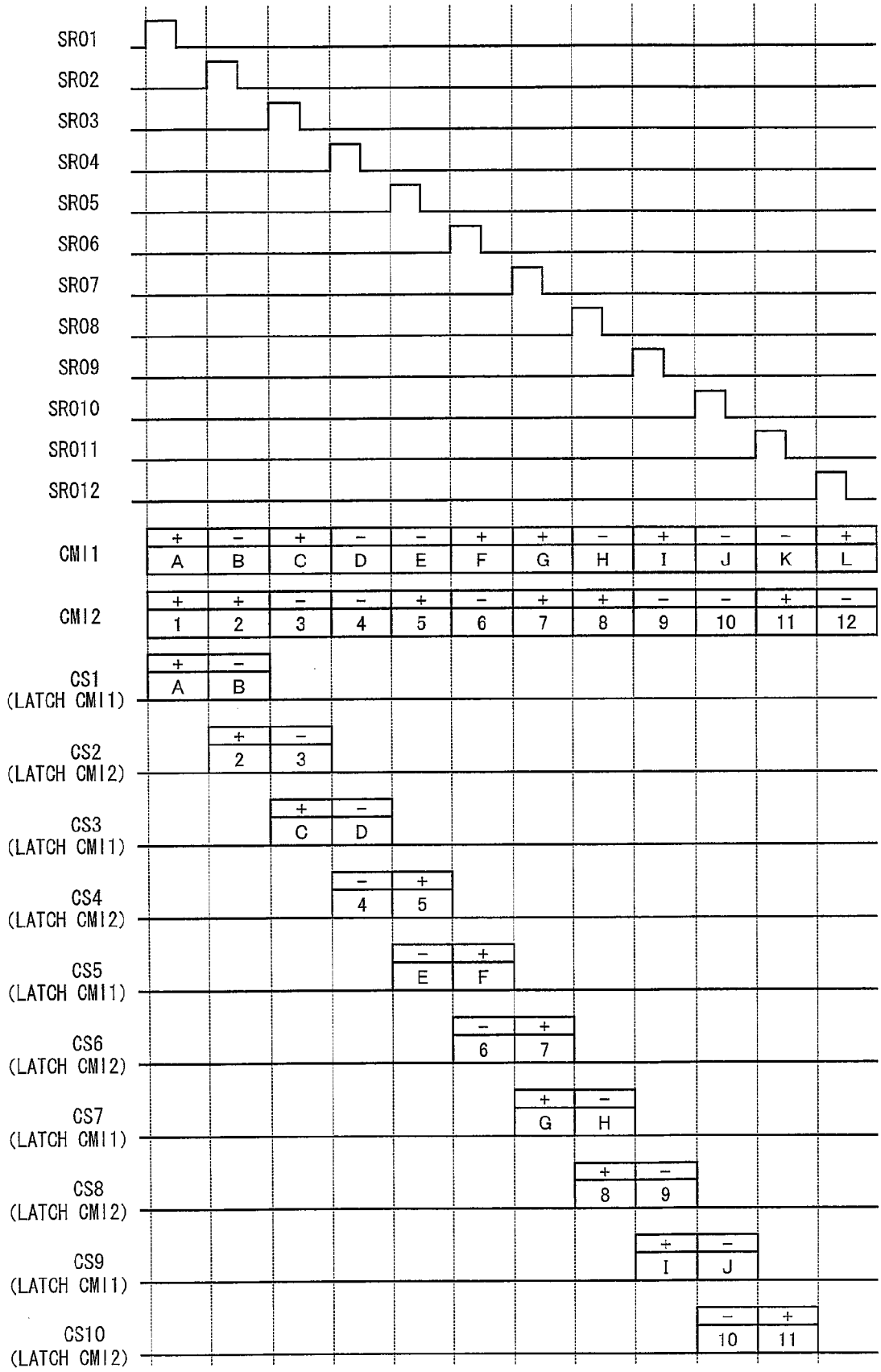
FIG. 9 illustrates how (i) a polarity signal and a shift register output each of which is supplied to a CS circuit of Example 2 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 9 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 9, signs A through L correspond to respective one horizontal scanning periods and indicate polarities of the respective one horizontal scanning periods. For example, CMI1 has a negative polarity during the second horizontal scanning period "B", has a positive polarity during the third horizontal scanning period "C", has a negative polarity during the fourth horizontal scanning period "D", and has a negative polarity during the fifth horizontal scanning period "E". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a negative polarity during the third horizontal scanning period "3", and has a negative polarity during the fourth horizontal scanning period "4". CMI1 and CMI2 are supplied to the CS circuit 4*n* alternately every one row. For example, CMI1 is supplied to the CS circuit 41, CMI2 is supplied to the CS circuit 42, and CMI1 is supplied to the CS circuit 43.

According to the CS circuit 4*n*, since the shift register output SROn of the nth row and the shift register output SROn+1 of the (n+1)th row following the nth row are supplied to the clock terminal CK, (i) CMI to be supplied to the data terminal D during the nth horizontal scanning period and (ii) CMI to be supplied to the data terminal D during the (n+1)th horizontal scanning period are latched. For example, the CS circuit 41 loads (i) a positive polarity of "A" of CMI1 during the first horizontal scanning period and (ii) a negative polarity of "B" of CMI1 during the second horizontal scanning period. The CS circuit 42 loads (i) a positive polarity of "2" of CMI2 during the second horizontal §canning period and (ii) a negative polarity of "3" of CMI2 during the third horizontal scanning period. The CS circuit 43 loads (i) a positive polarity of "C" of CMI1 during the third horizontal scanning period and (ii) a negative polarity of "D" of CMI1 during the fourth horizontal scanning period. The CS circuit 44 loads (i) a negative polarity of "4" of CMI2 during the fourth horizontal scanning period and (ii) a positive polarity of "5" of CMI2 during the fifth horizontal scanning period. Each of the CS signals CSn illustrated in FIGS. 7 and 8 is thus outputted.

As described earlier in Examples 1 and 2, in a case where two polarity signals CMI1 and CMI2 are used which are identical to or different from each other in timing at which polarities of the respective polarity signals CMI1 and CMI2 are reversed, the liquid crystal display device 1 illustrated in FIG. 3 can also carry out 2H reversal driving and 3H reversal driving. In a case where the timing is adjusted at which polarities of the respective polarity signals CMI1 and CMI2 are reversed, 4H, . . . , nH (n-line) reversal driving can be similarly implemented.

Example 3

Each of Examples 1 and 2 is arranged such that the CS circuit 4*n* of the nth row receives the shift register output SROn of the corresponding nth row and the shift register output SROn+1 of the (n+1)th row following the nth row. However, an arrangement of the liquid crystal display device 1 of the present invention is not limited to such an arrangement. For example, the liquid crystal display device 1 may also be arranged such that the CS circuit 4*n* of the nth row receives the shift register output SROn of the corresponding nth row and a shift register output SROn+2 of the (n+2)th row (see FIG. 10). Namely, the CS circuit 41 receives the shift register output SRO1 of the corresponding first row and the shift register output SRO3 of the third row. FIG. 11 is a timing chart illustrating waveforms of respective signals of the liquid crystal display device 1 which has such an arrangement and carries out 2-line (2H) reversal driving. In the initial state, each of the CS signals CS1 through CS5 is fixed at an electric potential having one level (a low level in FIG. 11) (see FIG. 11). In the first frame, the CS signal CS1 of the first row is at a high level when the gate signal G1 corresponding thereto falls, the CS signal CS2 of the second row is at a high level when the gate signal G2 corresponding thereto falls, the CS signal CS3 of the third row is at a low level when the gate signal G3 corresponding thereto falls, the CS signal CS4 of the fourth row is at a low level when the gate signal G4 corresponding thereto falls, and the CS signal CS5 of the fifth row is at a high level when the gate signal G5 corresponding thereto falls. The source signal S has an amplitude in accordance with a gray scale indicated by a video signal and is a signal whose polarity is reversed every 2H.

Then, electric potential levels of the respective CS signals CS1 through CS5 change between high and low levels after the gate signals G1 through G5 corresponding to the respective CS signals CS1 through CS5 fall. Specifically, in the first frame, the CS signals CS1 and CS2 fall after the gate signals G1 and G2 corresponding to the respective CS signals CS1 and CS2 fall, and the CS signals CS3 and CS4 rise after the gate signals G3 and G4 corresponding to the respective CS signals CS3 and CS4 fall. Note that the second frame has a relationship opposite to that of the first frame. The CS signals CS1 and CS2 rise after the gate signals G1 and G2 corresponding to the respective CS signals CS1 and CS2 fall, and the CS signals CS3 and CS4 fall after the gate signals G3 and G4 corresponding to the respective CS signals CS3 and CS4 fall.

This enables 2H reversal driving and removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

The CS circuit 41 receives the shift register outputs SRO1 and SRO3 corresponding to the respective gate signals G1 and G3, the polarity signal CMI1, and the reset signal RESET. The CS circuit 42 receives the shift register outputs SRO2 and SRO4 corresponding to the respective gate signals G2 and G4, the polarity signal CMI1, and the reset signal RESET. The CS circuit 43 receives the shift register outputs SRO3 and SRO5 corresponding to the respective gate signals G3 and G5, the polarity signal CMI2, and the reset signal RESET. The CS circuit 44 receives the shift register outputs SRO4 and SRO6 corresponding to the respective gate signals G4 and 06, the polarity signal CMI2, and the reset signal RESET. The polarity signals CMI1 and CMI2 are supplied to the CS circuits alternately every two rows. Namely, as described earlier, CMI1 is, supplied to each of the CS circuits 41 and 42, CMI2 is supplied to each of the CS circuits 43 and 44, and CMI1 is supplied to each of the CS circuits 45 and 46. Polarities of the respective polarity signals CMI1 and CMI2 are reversed every two horizontal scanning periods, and phases of the polarity signals CMI1 and CMI2 are set to be identical to each other. Accordingly, the present example may be arranged such that only one of the polarity signals CMI1 and CMI2 is used to be supplied to each of the CS circuits.

Figure 12:
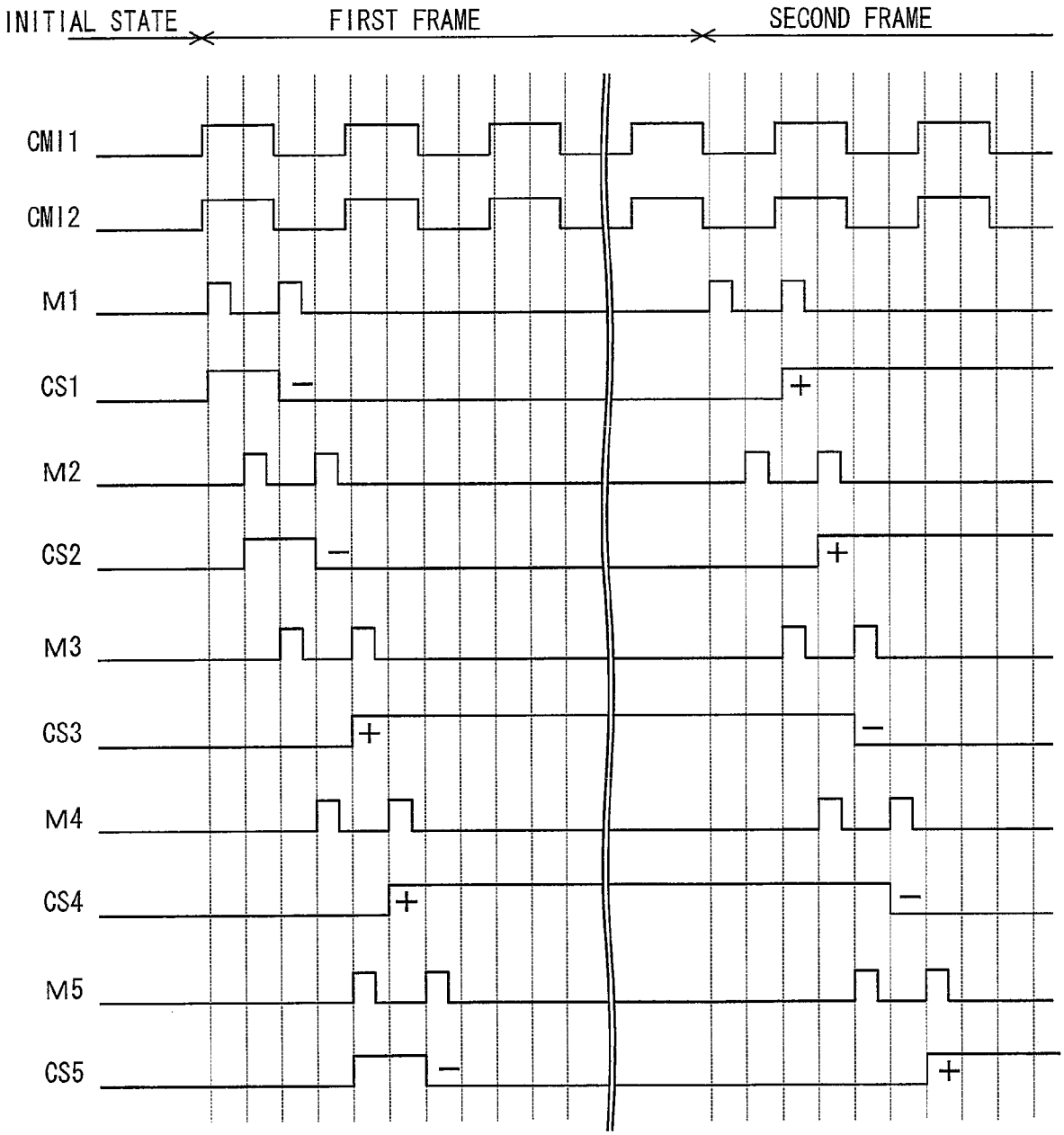
FIG. 12 illustrates waveforms of respective signals supplied to/from the CS bus line driving circuit of the liquid crystal display device 1 of Example 3.

For convenience, the following description mainly takes, as an example, the CS circuits 42 and 43 corresponding to the respective second and third rows, so as to discuss operation of the first frame. FIG. 12 illustrates waveforms of respective signals supplied to/from the CS bus line driving circuit 40 of the liquid crystal display device 1 of Example 3.

First, a change in waveforms of respective signals of the second row is to be described. In the initial state, the polarity signal CMI1 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI1 which input state is obtained when the change occurs, i.e., a high level. Then, the high level is maintained until the signal M2 becomes at a high level.

Subsequently, the shift register output SRO4 which has been shifted to the fourth row in the gate line driving circuit 30 is supplied to the other terminal of the OR circuit 42*b*. Note that the shift register output 51204 is also supplied to one terminal of the OR circuit 44*b* of the CS circuit 44.

A change in electric potential level (from low level to high level) of the shift register output SRO4 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a low level. Namely, the electric potential of the CS signal CS2 changes from a high level to a low level when the change in electric potential level (from low level to high level) of the shift register output SRO4 occurs. The D latch circuit 42*a* outputs a low level until a change in electric potential level (from high level to low level) of the shift register output SRO4 occurs in the signal M2 to be supplied to the clock terminal CK (during a period in which the signal M2 is at a high level). Next, when the change in electric potential level (from high level to low level) of the shift register output SRO4 in the signal M2 is supplied to the clock terminal CK, the D latch circuit 42*a* latches an input state of the polarity signal CMI1 which input state is obtained when the change occurs, i.e., a low level. Then, the low level is maintained until the signal M2 becomes at a high level in the second frame.

Next, a change in waveforms of respective signals of the third row is to be described. In the initial state, the polarity signal CMI2 is supplied to the data terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI2 which input state is supplied to the data terminal D when the change occurs, i.e., a low level. The D latch circuit 43*a* outputs a low level until the next time a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI2 which input state is obtained when the change occurs, i.e., a low level. Then, the low level is maintained until the signal M3 becomes at a high level.

Subsequently, the shift register output SRO5 which has been shifted to the fifth row in the gate line driving circuit 30 is supplied to the other terminal of the OR circuit 43*b*. Note that the shift register output SRO5 is also supplied to one terminal of the OR circuit 45*b* of the CS circuit 45.

A change in electric potential level (from low level to high level) of the shift register output SRO5 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a high level. Namely, the electric potential of the CS signal CS3 changes from a low level to a high level when the change in electric potential level (from low level to high level) of the shift register output SRO5 occurs. The D latch circuit 43*a* outputs a high level until the next time a change in electric potential level (from high level to low level) of the shift register output SRO5 occurs in the signal M3 to be supplied to the clock terminal CK (during a period in which the signal M3 is at a high level). Next, when the change in electric potential level (from high level to low level) of the shift register output SRO5 in the signal M3 is supplied to the clock terminal CK, the D latch circuit 43*a* latches an input state of the polarity signal CMI2 which input state is obtained when the change occurs, i.e., a high level. Then, the high level is maintained until the signal M3 becomes at a high level in the second frame.

As described earlier, according to Example 3, a CS signal CSn to be supplied to a CS bus line 15 of the nth row is generated by latching (i) an electric potential level of the polarity signal CMI1 which level is obtained when a gate signal Gn of the nth row rises and (ii) an electric potential level of the polarity signal CMI1 which level is obtained when a gate signal G(n+2) of the (n+2)th row rises, and a CS signal to be supplied to a CS bus line 15 of the (n+1)th row is generated by latching (i) an electric potential level of the polarity signal CMI1 which level is obtained when a gate signal G(n+1) of the (n+1)th row rises and (ii) an electric potential level of the polarity signal CMI1 which level is obtained when a gate signal G(n+3) of the (n+3)th row rises. A CS signal to be supplied to a CS bus line 15 of the (n+2)th row is generated by latching (i) an electric potential level of the polarity signal CMI2 which level is obtained when the gate signal G(n+2) of the (n+2)th row rises and (ii) an electric potential level of the polarity signal CMI2 which level is obtained when a gate signal G(n+4) of the (n+4)th row rises. A CS signal to be supplied to a CS bus line 15 of the (n+3)th row is generated by latching (i) an electric potential level of the polarity signal CMI2 which level is obtained when the gate signal G(n+3) of the (n+3)th row rises and (ii) an electric potential level of the polarity signal CMI2 which level is obtained when a gate signal G(n+5) of the (n+5)th row rises.

This allows the CS bus line driving circuit 40 to operate properly in the first frame also in 2H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 13:
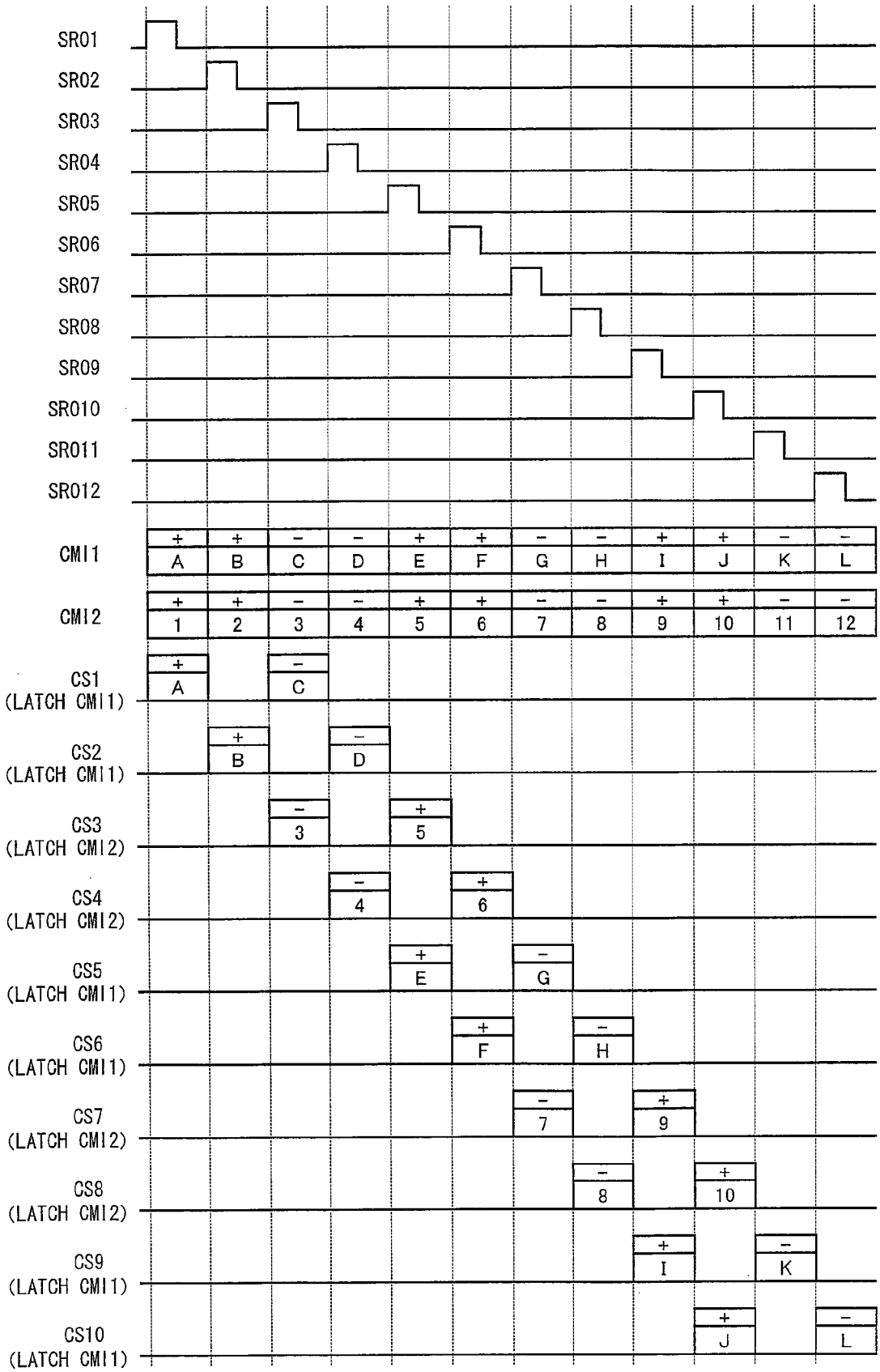
FIG. 13 illustrates how (i) a polarity signal and a shift register output each of which is supplied to a CS circuit of Example 3 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 13 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 13, signs A through L correspond to respective one horizontal scanning periods and indicate polarities of the respective one horizontal scanning periods. For example, CMI1 has a positive polarity during the second horizontal scanning period "B", has a negative polarity during the third horizontal scanning period "C", has a negative polarity during the fourth horizontal scanning period "D", and has a positive polarity during the fifth horizontal scanning period "E". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a negative polarity during the third horizontal scanning period "3", and has a negative polarity during the fourth horizontal scanning period "4". CMI1 and CMI2 are supplied to the CS circuit 4*n* alternately every two rows. For example, CMI1 is supplied to each of the CS circuits 41 and 42, CMI2 is supplied to each of the CS circuits 43 and 44, and CMI1 is supplied to each of the CS circuits 45 and 46.

According to the CS circuit 4*n*, since the shift register output SROn of the nth row and the shift register output SROn+2 of the (n+2)th row are supplied to the clock terminal CK, (i) CMI to be supplied to the data terminal D during the nth horizontal scanning period and (ii) CMI to be supplied to the data terminal D during the (n+2)th horizontal scanning period are latched. For example, the CS circuit 41 loads (i) a positive polarity of "A" of CMI1 during the first horizontal scanning period and (ii) a positive polarity of "C" of CMI1 during the third horizontal scanning period. The CS circuit 42 loads (i) a positive polarity of "B" of CMI1 during the second horizontal scanning period and (ii) a negative polarity of "D" of CMI1 during the fourth horizontal scanning period. The CS circuit 43 loads (i) a negative polarity of "3" of CMI2 during the third horizontal scanning period and (ii) a positive polarity of "5" of CMI2 during the fifth horizontal scanning period. The CS circuit 44 loads (i) a negative polarity of "4" of CMI2 during the fourth horizontal scanning period and (ii) a positive polarity of "6" of CMI2 during the sixth horizontal scanning period. Each of the CS signals CSn illustrated in FIGS. 11 and 12 is thus outputted.

Example 4

Figure 10:
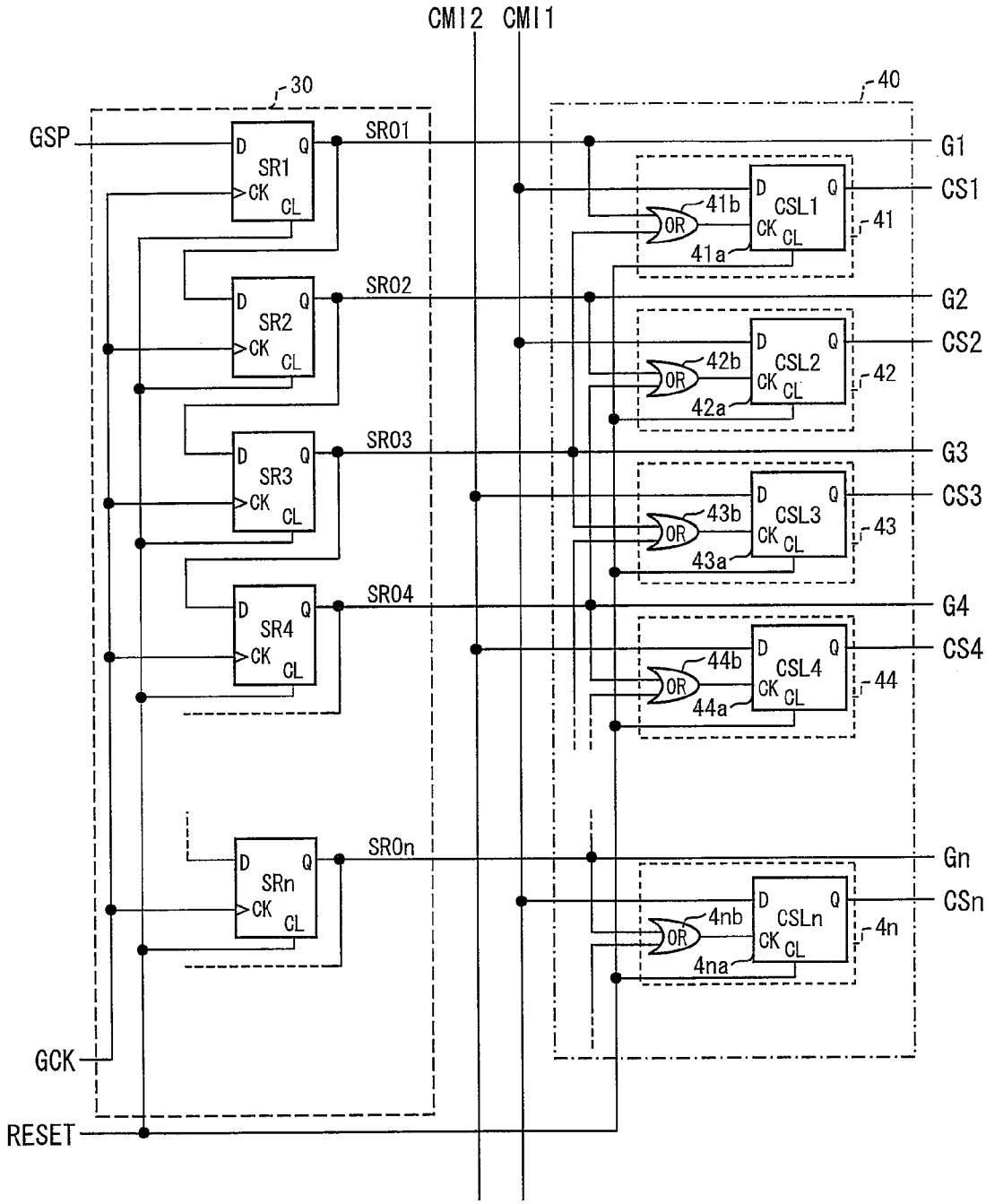
FIG. 10 is a block diagram illustrating configurations of a gate line driving circuit and a CS bus line driving circuit of Example 3.
Figure 11:
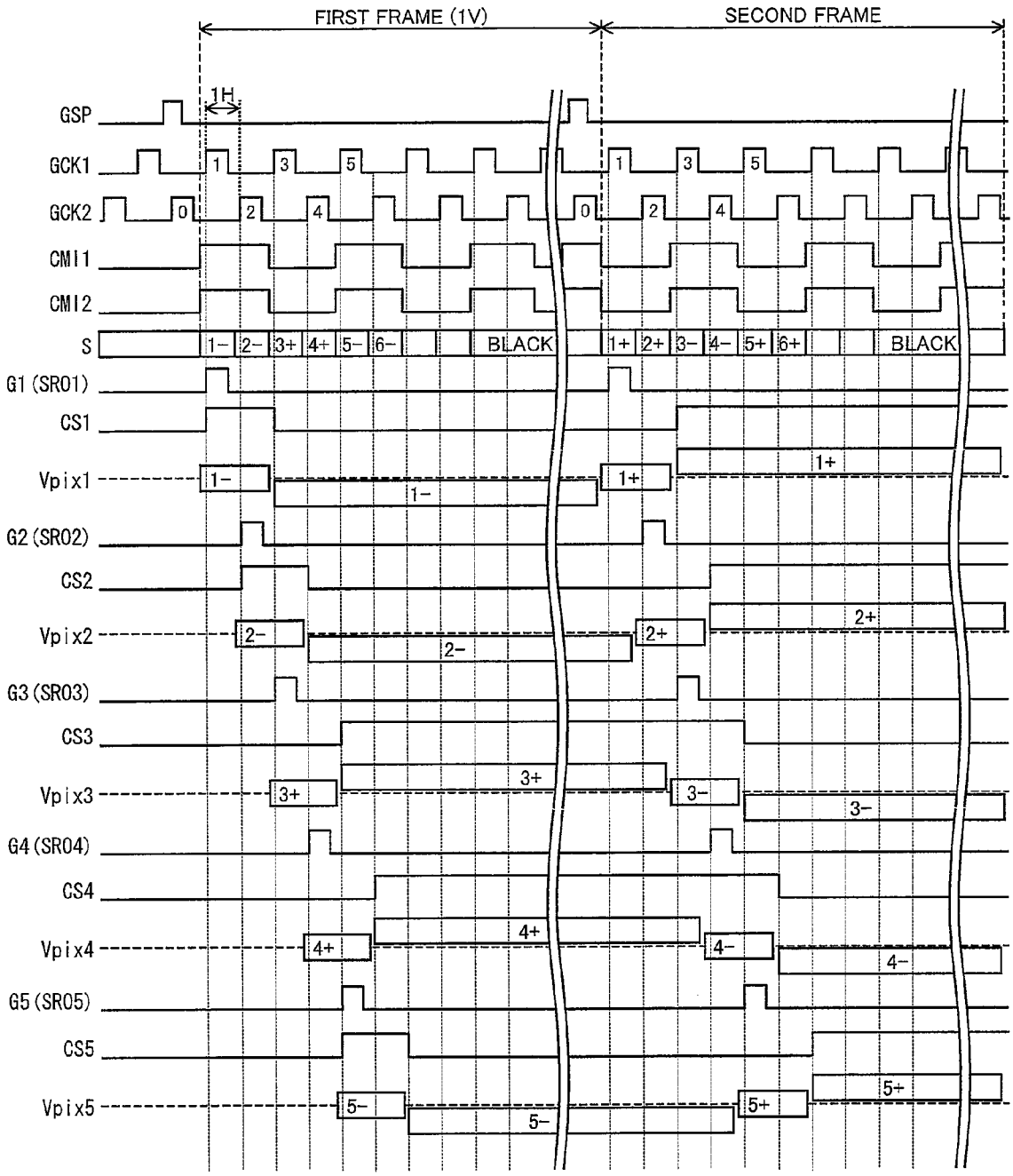
FIG. 11 is a timing chart illustrating waveforms of respective signals, the waveforms being obtained in a case where 2-line (2H) reversal driving is carried out in a liquid crystal display device 1 of Example 3.
Figure 14:
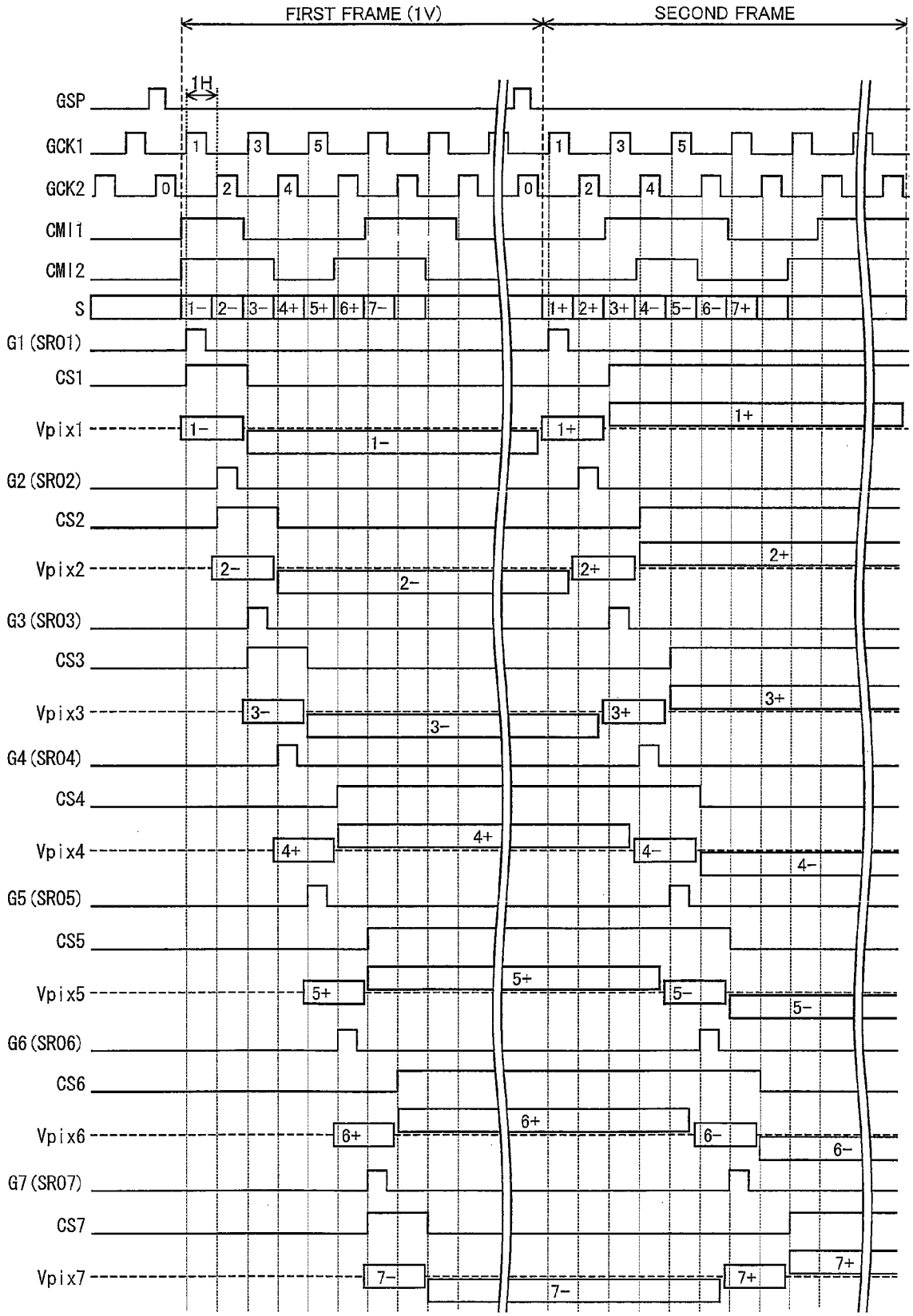
FIG. 14 is a timing chart illustrating waveforms of respective signals, the waveforms being obtained in a case where 3-line (3H) reversal, driving is carried out in a liquid crystal display device 1 of Example 4.

FIG. 14 is a timing chart illustrating waveforms of respective signals, the waveforms being obtained in a case where 3-line (3H) reversal driving is carried out in the liquid crystal display device 1 illustrated in FIG. 10. FIG. 14 is different from FIG. 11 in timing at which polarities of respective of CMI1 and CMI2 are reversed.

In the initial state, each of the CS signals CS1 through CS7 is fixed at an electric potential having one level (a low level in FIG. 14) (see FIG. 14). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 14 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

As described earlier, according to the liquid crystal display device 1 which carries out 3H reversal driving, since electric potentials of the CS signals are different from each other every three rows in accordance with a polarity of the source signal S when the gate signals corresponding to the respective CS signals fall, the electric potentials Vpix1 through Vpix7 of the respective pixel electrodes 14 are properly shifted by the respective CS signals CS1 through CS7. Therefore, an input of the source signal S of an identical gray scale causes positive and negative electric potential differences between the electric potential of the counter electrode and the shifted electric potential of each of the pixel electrodes 14 to be equal to each other. Namely, in the first frame, in an identical pixel column, the source signal of a negative polarity is written to pixels corresponding to respective first three adjacent rows, and the source signal of a positive polarity is written to pixels corresponding to respective second three adjacent rows following the first three adjacent rows. In electric potentials of the CS signals corresponding to the respective first three adjacent rows, no reversal of polarity occurs during the writing of the source signal to the pixels corresponding to the respective first three adjacent rows, reversal of polarity toward a negative polarity occurs after the writing, and no reversal of polarity occurs until the next writing. In electric potentials of the CS signals corresponding to the respective second three adjacent rows, no reversal of polarity occurs during the writing of the source signal to the pixels corresponding to the respective second three adjacent rows, reversal of polarity toward a positive polarity occurs after the writing, and no reversal of polarity occurs until the next writing. This removes lateral stripes of light and shade which stripes, are produced in a display video in the first frame, so that a display quality can be enhanced.

Specific configurations, of the gate line driving circuit 30 and the CS bus line driving circuit 40 are described here for carrying out control described above.

The gate line driving circuit 30 and the CS bus line driving circuit 40 of Example 4 are different from those of Example 3 in timing at which polarities of the respective polarity signals CMI1 and CMI2 are reversed. The other configurations are identical to those illustrated in FIG. 10. Each of the CS circuits receives the shift register output SROn of the corresponding nth row and the shift register output SROn+2 of the (n+2)th row, and the polarity signals CMI1 and CMI2 are supplied to the CS circuits alternately every two rows. Namely, as described earlier, CMI1 is supplied to each of the CS circuits 41 and 42, CMI2 is supplied to each of the CS circuits 43 and 44, and CMI1 is supplied to each of the CS circuits 45 and 46. A timing at which the polarities of the respective polarity signals CMI1 and CMI2 are reversed is set as illustrated in FIG. 14.

Figure 15:
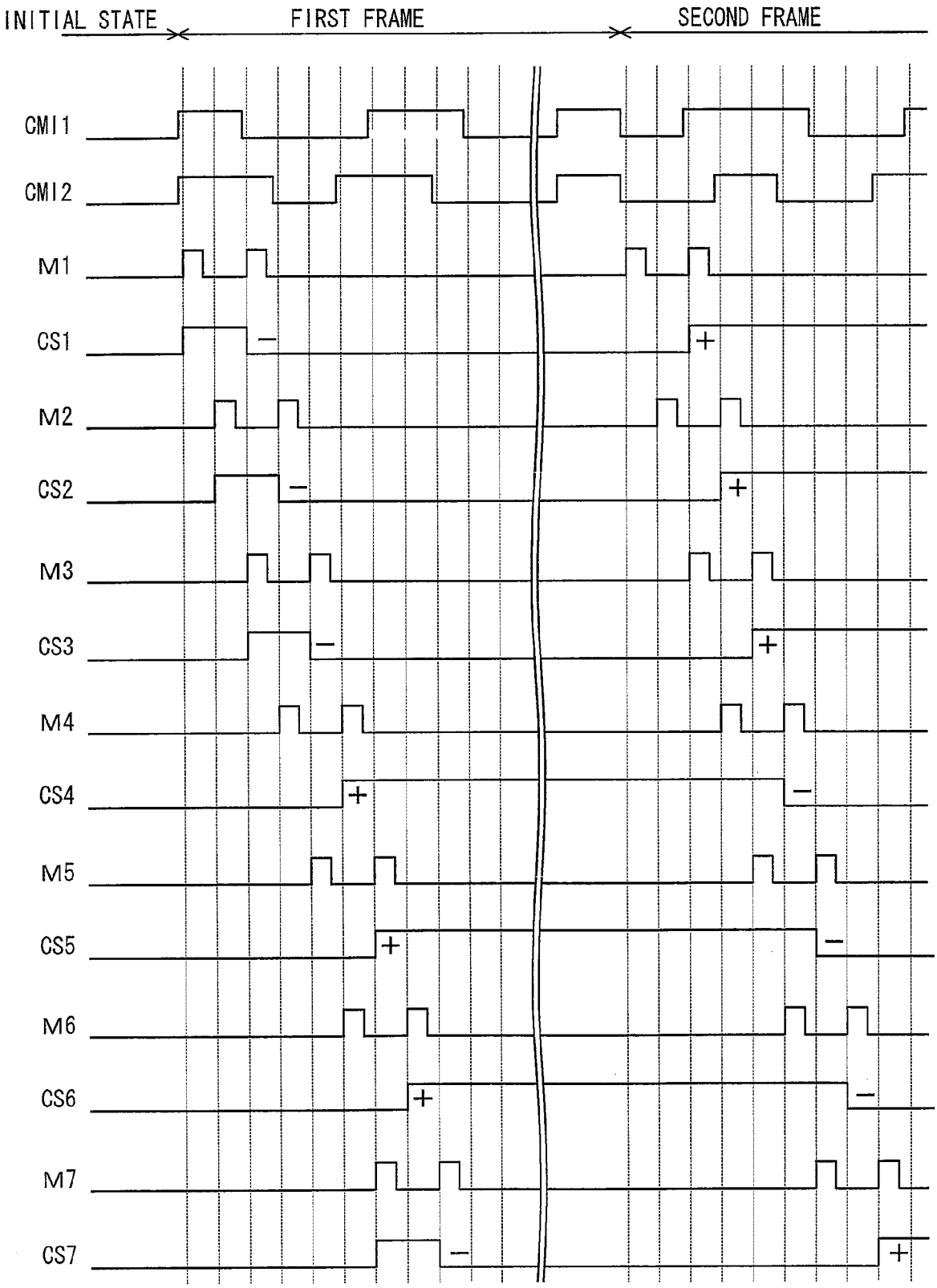
FIG. 15 illustrates waveforms of respective signals supplied to/from a CS bus line driving circuit of the liquid crystal display device 1 of Example 4.

A description of how the gate line driving circuit 30 and the CS bus line driving circuit 40 are connected is omitted here, and 3H reversal driving is described with reference to FIGS. 14 and 15. FIG. 15 illustrates waveforms of respective signals supplied to/from the CS bus line driving circuit 40 of the liquid crystal display device 1 of Example 4. For convenience, the following description takes, as an example, the CS circuits 42, 43, and 44 corresponding to the respective second through fourth rows, so as to discuss operation of the first frame.

First, a change in waveforms of respective signals of the second row is to be described. In the initial state, the polarity signal CMI1 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output 51202 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI1 which input state is obtained when the change occurs, i.e., a high level. Then, the high level is maintained until the signal M2 becomes at a high level.

Subsequently, the shift register output SRO4 which has been shifted to the fourth row in the gate line driving circuit 30 is supplied to the other terminal of the OR circuit 42*b*. Note that the shift register output SRO4 is also supplied to one terminal of the OR circuit 44*b* of the CS circuit 44.

A change in electric potential level (from low level to high level) of the shift register output SRO4 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a low level. Namely, the electric potential of the CS signal CS2 changes from a high level to a low level when the change in electric potential level (from low level to high level) of the shift register output SRO4 occurs. The D latch circuit 42*a* outputs a low level until a change in electric potential level (from high level to low level) of the shift register output SRO4 occurs in the signal M2 to be supplied to the clock terminal CK (during a period in which the signal M2 is at a high level). Next, when the change in electric potential level (from high level to low level) of the shift register output SRO4 in the signal M2 is supplied to the clock terminal CK, the D latch circuit 42*a* latches an input state of the polarity signal CMI1 which input state is obtained when the change occurs, i.e., a low level. Then, the low level is maintained until the signal M2 becomes at a high level in the second frame.

Next, a change in waveforms of respective signals of the third row is to be described. In the initial state, the polarity signal CMI2 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input, state of the polarity signal CMI2 which input state is obtained when the change occurs, i.e., a high level. Then, the high level is maintained until the signal M3 becomes at a high level.

Subsequently, the shift register output SRO5 which has been shifted to the fifth row in the gate line driving circuit 30 is supplied to the other terminal of the OR circuit 43*b*. Note that the shift register output SRO5 is also supplied to one terminal of the OR circuit 45*b* of the CS circuit 45.

A change in electric potential level (from low level to high level) of the shift register output SRO5 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a low level. Namely, the electric potential of the CS signal CS3 changes from a high level to a low level when the change in electric potential level (from low level to high level) of the shift register output SRO5 occurs. The D latch circuit 43*a* outputs a low level until a change in electric potential level (from high level to low level) of the shift register output SRO5 occurs in the signal M3 to be supplied to the clock terminal CK (during a period in which the signal M3 is at a high level). Next, when the change in electric potential level (from high level to low level) of the shift register output SRO5 in the signal M3 is supplied to the clock terminal CK, the D latch circuit 43*a* latches an input state of the polarity signal CMI2 which input state is obtained when the change occurs, i.e., a low level. Then, the low level is maintained until the signal M3 becomes at a high level in the second frame.

Next, a change in waveforms of respective signals of the fourth row is to be described. In the initial state, the polarity signal CMI2 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI2 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI2 which input state is obtained when the change occurs, i.e., a low level. Then, the low level is maintained until the signal M4 becomes at a high level.

Subsequently, the shift register output SRO6 which has been shifted to the sixth row in the gate line driving circuit 30 is supplied to the other terminal of the OR circuit 44*b*. Note that the shift register output SRO6 is also supplied to one terminal of the OR circuit 46*b* of the CS circuit 46.

A change in electric potential level (from low level to high level) of the shift register output SRO6 in the signal M4 is supplied to the clock terminal CK of the D latch circuit 44*a*, and the D latch circuit 44*a* transfers an input state of the polarity signal CMI2 which input state is supplied to the terminal D when the change occurs, i.e., a high level. Namely, the electric potential of the CS signal CS4 changes from a low level to a high level when the change in electric potential level (from low level to high level) of the shift register output SRO6 occurs. The D latch circuit 44*a* outputs a high level until the next time a change in electric potential level (from high level to low level) of the shift register output SRO6 occurs in the signal M4 to be supplied to the clock terminal CK (during a period in which the signal M4 is at a high level). Next, when the change in electric potential level (from high level to low level) of the shift register output SRO6 in the signal M4 is supplied to the clock terminal CK, the D latch circuit 44*a* latches an input state of the polarity signal CMI2 which input state is obtained when the change occurs, i.e., a high level. Then, the high level is maintained until the signal M4 becomes at a high level in the second frame.

According to the above operation, in the first through third rows, an electric potential level of the CS signal which level is obtained when the gate signal of a corresponding row falls (when the TFT 13 in an ON state is turned off) falls after the gate signal of the corresponding row has fallen, and in the fourth through sixth rows, an electric potential level of the CS signal which level is obtained when the gate signal of a corresponding row falls (when the TFT 13 in an ON state is turned off) rises after the gate signal of the corresponding row has fallen (see FIGS. 14 and 15).

As described earlier, according to Example 4, 3H reversal driving can be carried out in the liquid crystal display device 1 having the arrangement illustrated in FIG. 10 by adjusting a timing at which the polarities of the respective polarity signals CMI1 and CMI2 are reversed. This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 16:
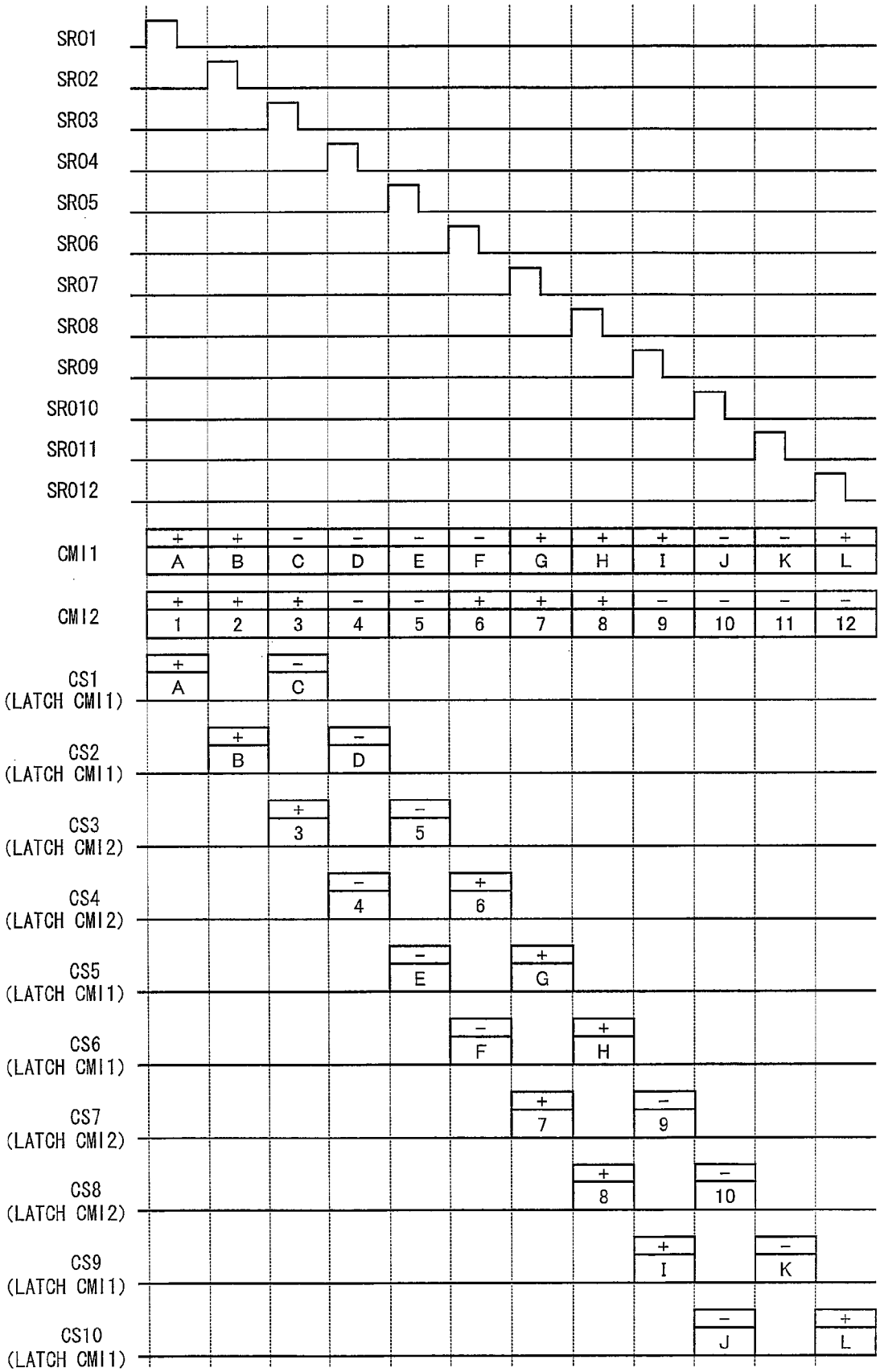
FIG. 16 illustrates how (i) a polarity signal and a shift register output each of which is supplied to a CS circuit of Example 4 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 16 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 16, signs A through L correspond to respective one horizontal scanning periods and indicate polarities of the respective one horizontal scanning periods. For example, CMI1 has a positive polarity during the second horizontal scanning period "B", has a negative polarity during the third horizontal scanning period "C", has a negative polarity during the fourth horizontal scanning period "D", and has a negative polarity during the fifth horizontal scanning period "E". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a positive polarity during the third horizontal scanning period "3", and has a negative polarity during the fourth horizontal scanning period "4". CMI1 and CMI2 are supplied to the CS circuit 4*n* alternately every two rows. For example, CMI1 is supplied to each of the CS circuits 41 and 42, CMI2 is supplied to each of the CS circuits 43 and 44, and CMI1 is supplied to each of the CS circuits 45 and 46.

According to the CS circuit 4*n*, since the shift register output SROn of the nth row and the shift register output SROn+2 of the (n+2)th row are supplied to the clock terminal CK, (i) CMI to be supplied to the data terminal D during the nth horizontal scanning period and (ii) CMI to be supplied to the data terminal D during the (n+2)th horizontal scanning period are latched. For example, the CS circuit 41 loads (i) a positive polarity of "A" of CMI1 during the first horizontal scanning period and (ii) a positive polarity of "C" of CMI1 during the third horizontal scanning period. The CS circuit 42 loads (i) a positive polarity of "B" of CMI1 during the second horizontal scanning period and (ii) a negative polarity of "D" of CMI1 during the fourth horizontal scanning period. The CS circuit 43 loads (i) a positive polarity of "3" of CMI2 during the third horizontal scanning period and (ii) a negative polarity of "5" of CMI2 during the fifth horizontal scanning period. The CS circuit 44 loads (i) a negative polarity of "4" of CMI2 during the fourth horizontal scanning period and (ii) a positive polarity of "6" of CMI2 during the sixth horizontal scanning period. Each of the CS signals CSn illustrated in FIGS. 14 and 15 is thus outputted.

As described earlier in Examples 3 and 4, in a case where two polarity signals CMI1 and CMI2 are used which are identical to or different from each other in timing at which polarities of the respective polarity signals CMI1 and CMI2 are reversed, the liquid crystal display device illustrated in FIG. 10 can also carry out 2H reversal driving and 3H reversal driving. In a case where the timing is adjusted at which polarities of the respective polarity signals CMI1 and CMI2 are reversed, 4H, . . . , nH reversal driving can be similarly implemented.

Example 5

Each of Examples 3 and 4 is arranged such that the CS circuit 4*n* of the nth row receives the shift register output SROn of the corresponding nth row and the shift register output SROn+2 of the (n+2)th row. However, an arrangement of the liquid crystal display device of the present invention is not limited to such an arrangement. For example, the liquid crystal display device may also be arranged such that the CS circuit 4*n* of the nth row receives the shift register output SROn of the corresponding nth row and a shift register output SROn+3 of the (n+3)th row (see FIG. 17). Namely, the CS circuit 41 receives the shift register output SRO1 of the corresponding first row and the shift register output SRO4 of the fourth row. FIG. 18 is a timing chart illustrating waveforms of respective signals of the liquid crystal display device 1 which has such an arrangement and implements 2-line (2H) reversal driving. In the initial state, each of the CS signals CS1 through CS5 is fixed at an electric potential having one level (a low level in FIG. 18) (see FIG. 18). In the first frame, the CS signal CS1 of the first row is at a high level when the gate signal G1 corresponding thereto falls, the CS signal CS2 of the second row is at a high level when the gate signal G2 corresponding thereto falls, the CS signal CS3 of the third row is at a low level when the gate signal G3 corresponding thereto falls, the CS signal CS4 of the fourth row is at a low level when the gate signal G4 corresponding thereto falls, and the CS signal CS5 of the fifth row is at a high level when the gate signal G5 corresponding thereto falls. The source signal S has an amplitude in accordance with a gray scale indicated by a video signal and is a signal whose polarity is reversed every 2H periods.

Then, electric potential levels of the respective CS signals CS1 through CS5 change between high and low levels after the gate signals G1 through G5 corresponding to the respective CS signals CS1 through CS5 fall. Specifically, in the first frame, the CS signals CS1 and CS2 fall after the gate signals G1 and G2 corresponding to the respective CS signals CS1 and CS2 fall, and the CS signals CS3 and CS4 rise after the gate signals G3 and G4 corresponding to the respective CS signals CS3 and CS4 fall. Note that the second frame has a relationship opposite to that of the first frame. The CS signals CS1 and CS2 rise after the gate signals G1 and G2 corresponding to the respective CS signals CS1 and CS2 fall, and the CS signals CS3 and CS4 fall after the gate signals G3 and G4 corresponding to the respective CS signals CS3 and CS4 fall.

This enables 2H reversal driving and removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 17:
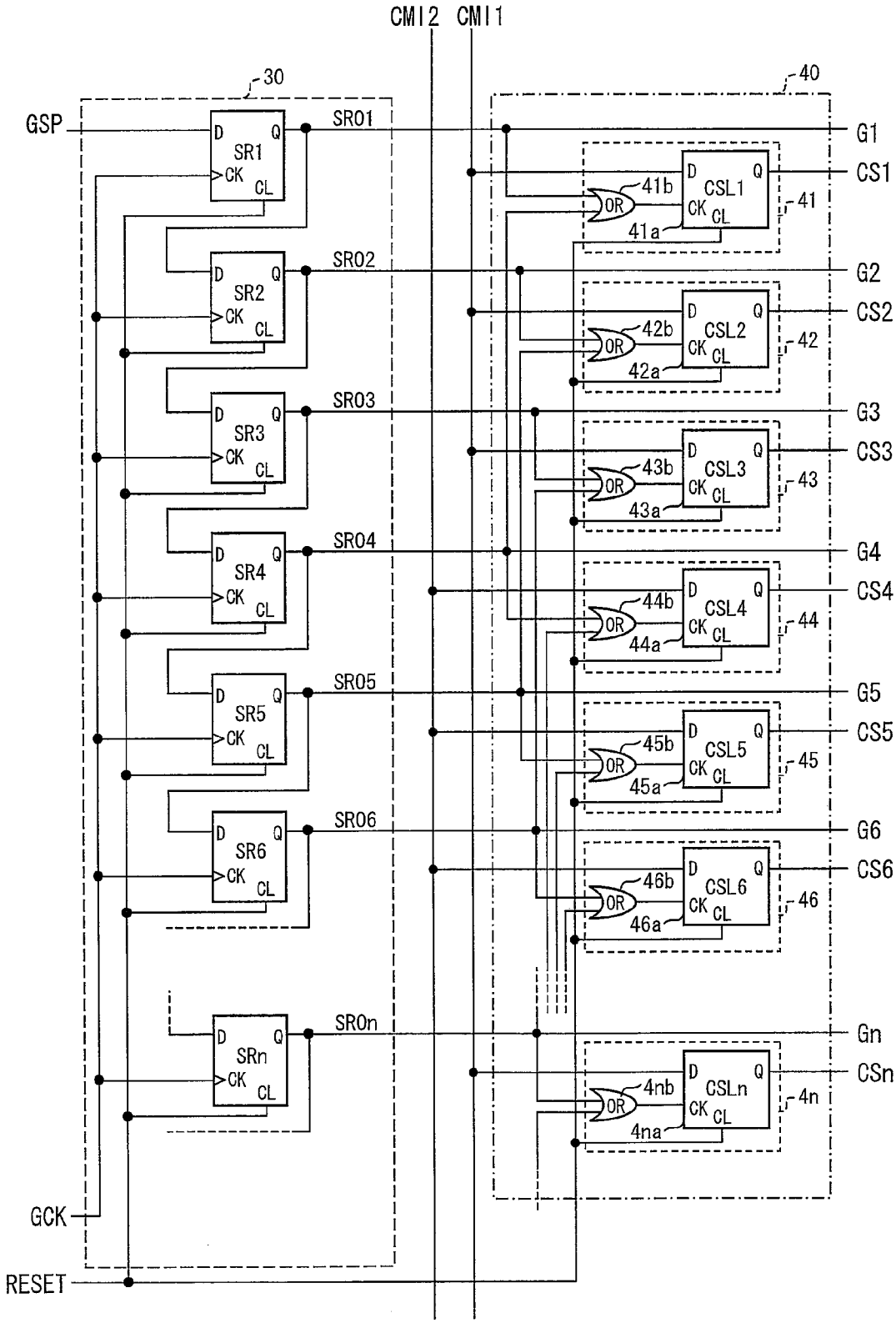
FIG. 17 is a block diagram illustrating configurations of a gate line driving circuit and a CS bus line driving circuit of Example 5.
Figure 18:
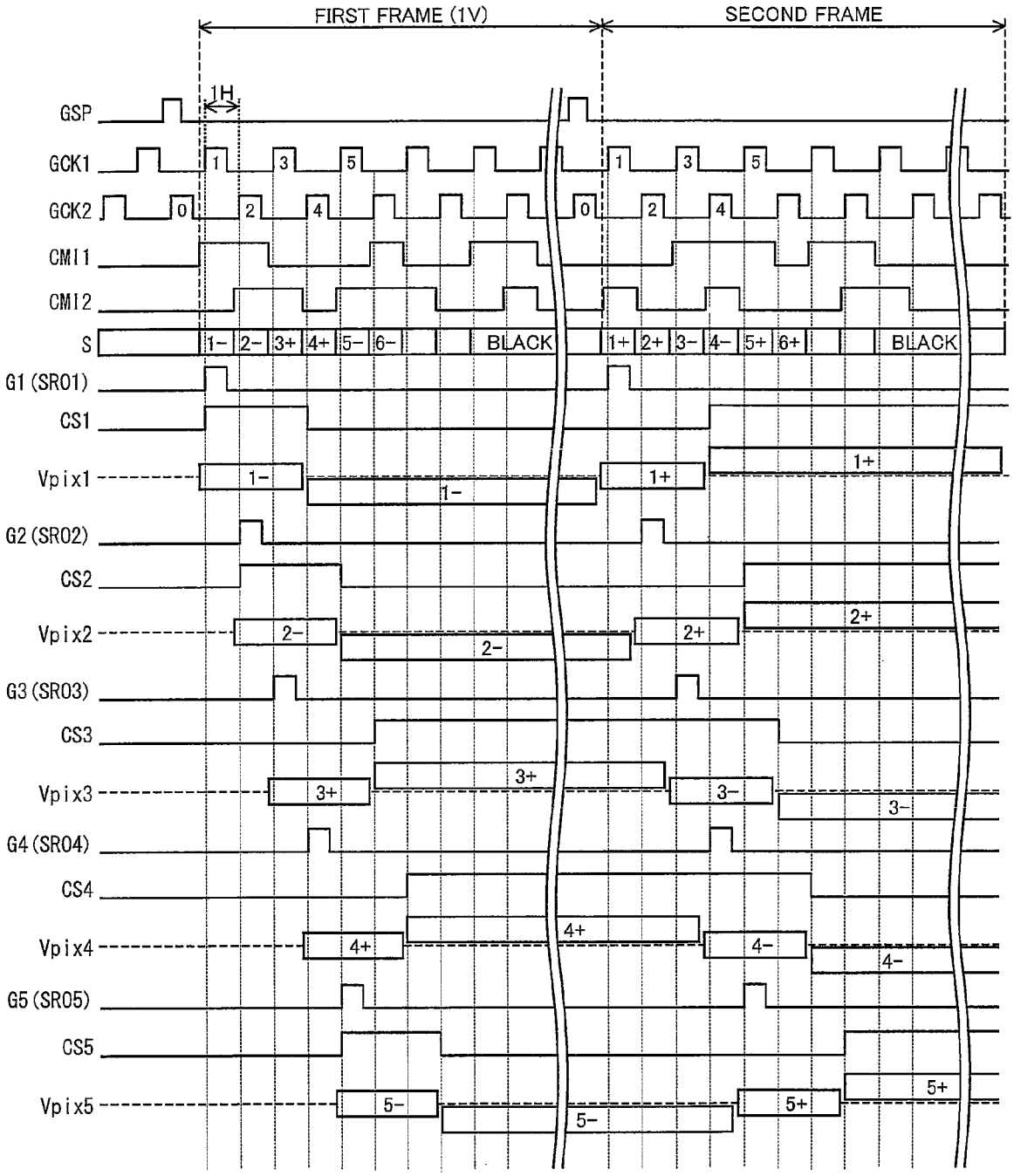
FIG. 18 is a timing chart illustrating waveforms of respective signals, the waveforms being obtained in a case where 2-line (2H) reversal driving is carried out in a liquid crystal display device 1 of Example 5.

The CS circuit 41 receives the shift register outputs SRO1 and SRO4 corresponding to the respective gate signals G1 and G4, the polarity signal CMI1, and the reset signal RESET are supplied to, the CS circuit 42 receives the shift register outputs SRO2 and SRO5 corresponding to the respective gate signals G2 and G5, the polarity signal CMI1, and the reset signal RESET, the CS circuit 43 receives the shift register outputs SRO3 and SRO6 corresponding to the respective gate signals G3 and G6, the polarity signal CMI1, and the reset signal RESET, and the CS circuit 44 receives the shift register outputs SRO4 and SRO7 corresponding to the respective gate signals G4 and G7, the polarity signal CMI2, and the reset signal RESET (see FIG. 17). The polarity signals CMI1 and CMI2 are supplied to the CS circuits alternately every three rows. Namely, as described earlier, each of the CS circuits 41, 42, and 43 receives CMI1, each of the CS circuits 44, 45, and 46 receives CMI2, and each of the CS circuits 47, 48, and 49 receives CMI1. Polarities of the respective polarity signals CMI1 and CMI2 are reversed at a timing illustrated in FIG. 18.

Figure 19:
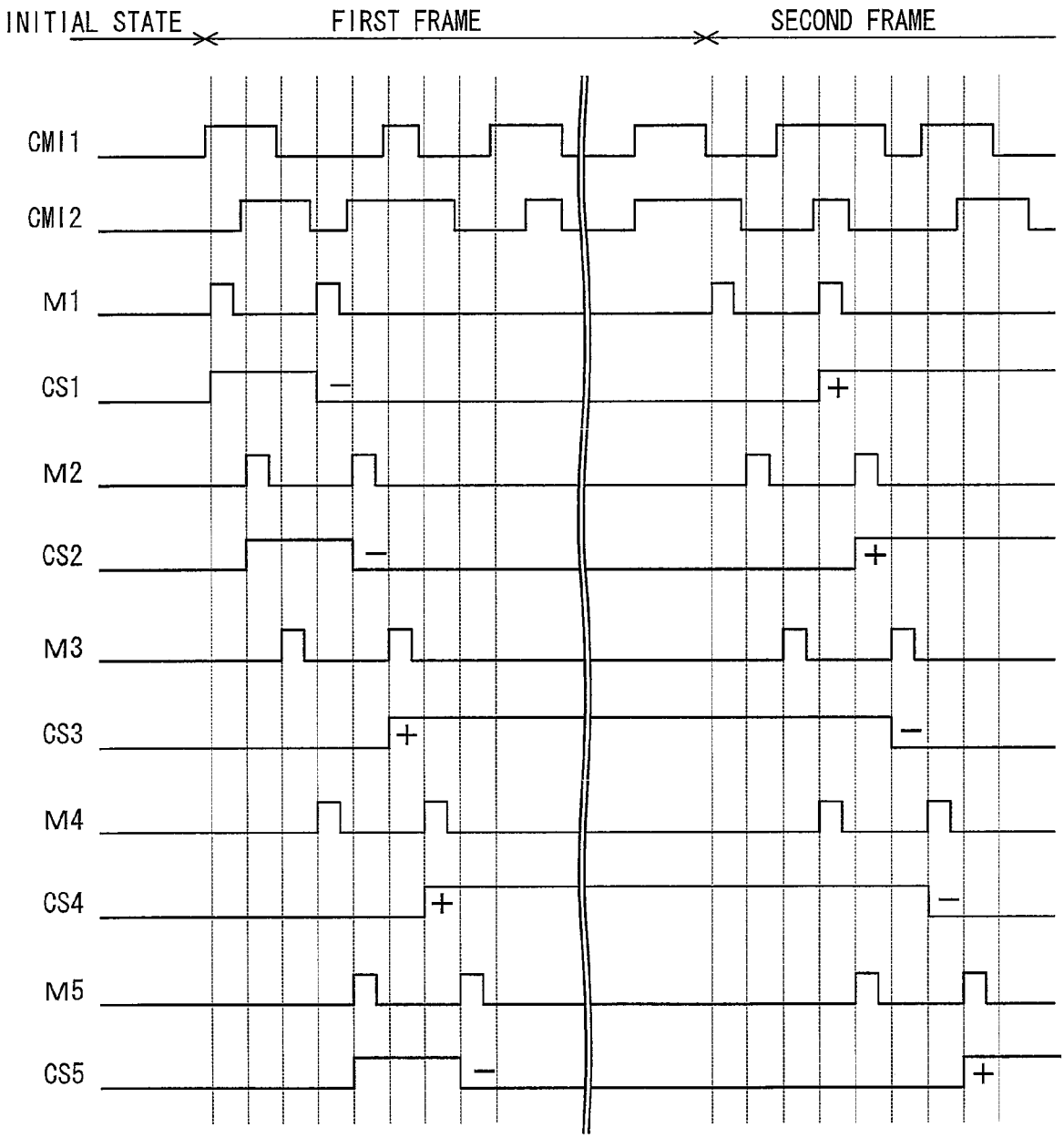
FIG. 19 illustrates waveforms of respective signals supplied to/from the CS bus line driving circuit of the liquid crystal display device 1 of Example 5.

For convenience, the following description mainly takes, as an example, the CS circuits 42 and 43 corresponding to the respective second and third rows, so as to discuss operation of the first frame. FIG. 19 illustrates waveforms of respective signals supplied to/from the CS bus line driving circuit 40 of the liquid crystal display device 1 of Example 5.

First, a change in waveforms of respective signals of the second row is to be described. In the initial state, the polarity signal CMI1 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a high level. Namely, the electric potential of the CS signal. CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI1 which input state is obtained when the change occurs, i.e., a high level. Then, the high level is maintained until the signal M2 becomes at a high level.

Subsequently, the shift register output SRO5 which has been shifted to the fifth row in the gate line driving circuit 30 is supplied to the other terminal of the OR circuit 42*b*. Note that the shift register output SRO5 is also supplied to one terminal of the OR circuit 45*b* of the CS circuit 45.

A change in electric potential level (from low level to high level) of the shift register output SRO5 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a low level. Namely, the electric potential of the CS signal CS2 changes from a high level to a low level when the change in electric potential level (from low level to high level) of the shift register output SRO5 occurs. The D latch circuit 42*a* outputs a low level until a change in electric potential level (from high level to low level) of the shift register output SRO5 occurs in the signal M2 to be supplied to the clock terminal CK (during a period in which the signal M2 is at a high level). Next, when the change in electric potential level (from high level to low level) of the shift register output SRO5 in the signal M2 is supplied to the clock terminal CK, the D latch circuit 42*a* latches an input state of the polarity signal CMI1 which input state is obtained when the change occurs, i.e., a low level. Then, the low level is maintained until the signal M2 becomes at a high level in the second frame.

Next, a change in waveforms of respective signals of the third row is to be described. In the initial state, the polarity signal CMI1 is supplied to the data terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI1 which input state is supplied to the data terminal D when the change occurs, i.e., a low level. The D latch circuit 43*a* outputs a low level until the next time a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level.

Subsequently, the shift register output SRO6 which has been shifted to the sixth row in the gate line driving circuit 30 is supplied to the other terminal of the OR circuit 43*b*. Note that the shift register output SRO6 is also supplied to one terminal of the OR circuit 46*b* of the CS circuit 46.

A change in electric potential level (from low level to high level) of the shift register output SRO6 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, the electric potential of the CS signal CS3 changes from a low level to a high level when, the change in electric potential level (from low level to high level) of the shift register output SRO6 occurs. The D latch circuit 43*a* outputs a high level until the next time a change in electric potential level (from high level to low level) of the shift register output SRO6 occurs in the signal M3 to be supplied to the clock terminal CK (during a period in which the signal M3 is at a high level). Next, when the change in electric potential level (from high level to low level) of the shift register output SRO6 in the signal M3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level in the second frame.

As described earlier, according to Example 5, a CS signal CSn to be supplied to a CS bus line 15 of the nth row is generated by latching (i) an electric potential level of the polarity signal CMI1 which level is obtained when a gate signal Gn of the nth row rises and (ii) an electric potential level of the polarity signal CMI1 which level is obtained when a gate signal G(n+3) of the (n+3)th row rises, and a CS signal to be supplied to a CS bus line 15 of the (n+1)th row is generated by latching (i) an electric potential level of the polarity signal CMI1 which level is obtained when a gate signal G(n+1) of the (n+1)th row rises and (ii) an electric potential level of the polarity signal CMI1 which level is obtained when a gate signal G(n+4) of the (n+4)th row rises. A CS signal to be supplied to a CS bus line 15 of the (n+2)th row is generated by latching (i) an electric potential level of the polarity signal CMI1 which level is obtained when the gate signal G(n+2) of the (n+2)th row rises and (ii) an electric potential level of the polarity signal CMI1 which level is obtained when a gate signal G(n+5) of the (n+5)th row rises. A CS signal to be supplied to a CS bus line 15 of the (n+3)th row is generated by latching (i) an electric potential level of the polarity signal CMI2 which level is obtained when the gate signal G(n+3) of the (n+3)th row rises and (ii) an electric potential level of the polarity signal CMI2 which level is obtained when a gate signal G(n+6) of the (n+6)th row rises.

This allows the CS bus line driving circuit 40 to operate properly in the first frame also in 2H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 20:
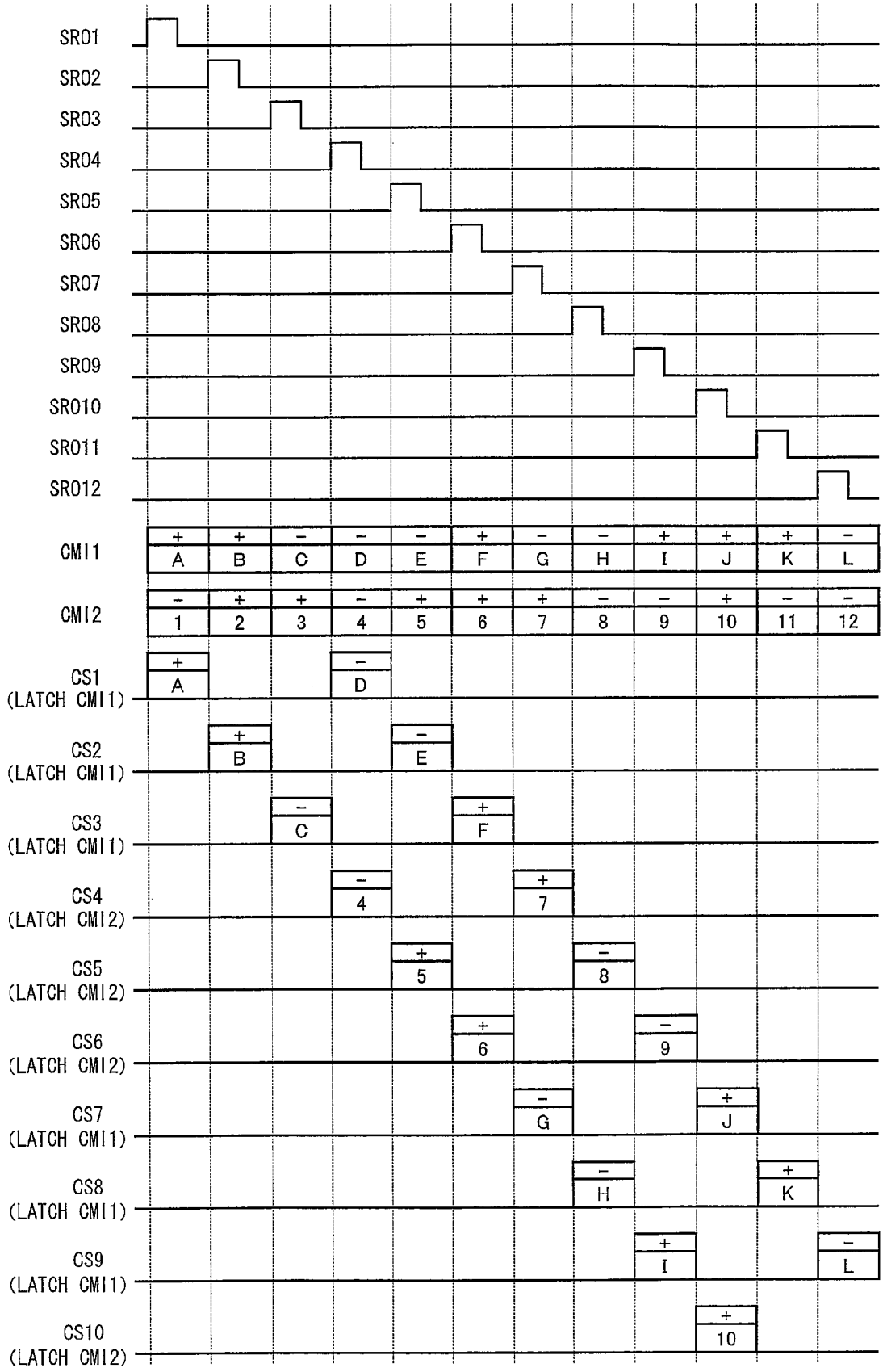
FIG. 20 illustrates how (i) a polarity signal and a shift register output each of which is supplied to a CS circuit of Example 5 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 20 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 13, signs A through L correspond to respective one horizontal scanning periods and indicate polarities of the respective one horizontal scanning periods. For example, CMI1 has a positive polarity during the second horizontal scanning period "B", has a negative polarity during the third horizontal scanning period "C", has a negative polarity during the fourth horizontal scanning period "D", and has a negative polarity during the fifth horizontal scanning period "E". As for CMI2, signs 1 through 12 correspond to respective one horizontal scanning periods and indicate polarities of the respective one horizontal scanning periods. For example, CMI2 has a negative polarity during the first horizontal scanning period "1", has a positive polarity during the second horizontal scanning period "2", has a positive polarity during the third horizontal scanning period "3", and has a negative polarity during the fourth horizontal scanning period "4". CMI1 and CMI2 are set so that a timing at which their respective polarities are reversed has a relationship illustrated in FIG. 20. CMI1 and CMI2 are supplied to the CS circuit 4*n* alternately every three rows. For example, CMI1 is supplied to each of the CS circuits 41, 42, and 43, CMI2 is supplied to each of the CS circuits 44, 45, and 46, and CMI1 is supplied to each of the CS circuits 47, 48, and 49.

According to the CS circuit 4*n*, since the shift register output SROn of the nth row and the shift register output SROn+2 of the (n+2)th row are supplied to the clock terminal CK, (i) CMI to be supplied to the data terminal D during the nth horizontal scanning period and (ii) CMI to be supplied to the data terminal D during the (n+2)th horizontal scanning period are latched. For example, the CS circuit 41 loads (i) a positive polarity of "A" of CMI1 during the first horizontal scanning period and (ii) a positive polarity of "D" of CMI1 during the fourth horizontal scanning period. The CS circuit 42 loads (i) a positive polarity of "B" of CMI1 during the second horizontal scanning period and (ii) a negative polarity of "E" of CMI1 during the fifth horizontal scanning period. The CS circuit 43 loads (i) a negative polarity of "C" of CMI1 during the third horizontal scanning period and (ii) a positive polarity of "F" of CMI1 during the sixth horizontal scanning period. The CS circuit 44 loads (i) a negative polarity of "4" of CMI2 during the fourth horizontal scanning period and (ii) a positive polarity of "7" of CMI2 during the seventh horizontal scanning period. Each of the CS signals CSn illustrated in FIGS. 18 and 19 is thus outputted.

Example 6

Figure 21:
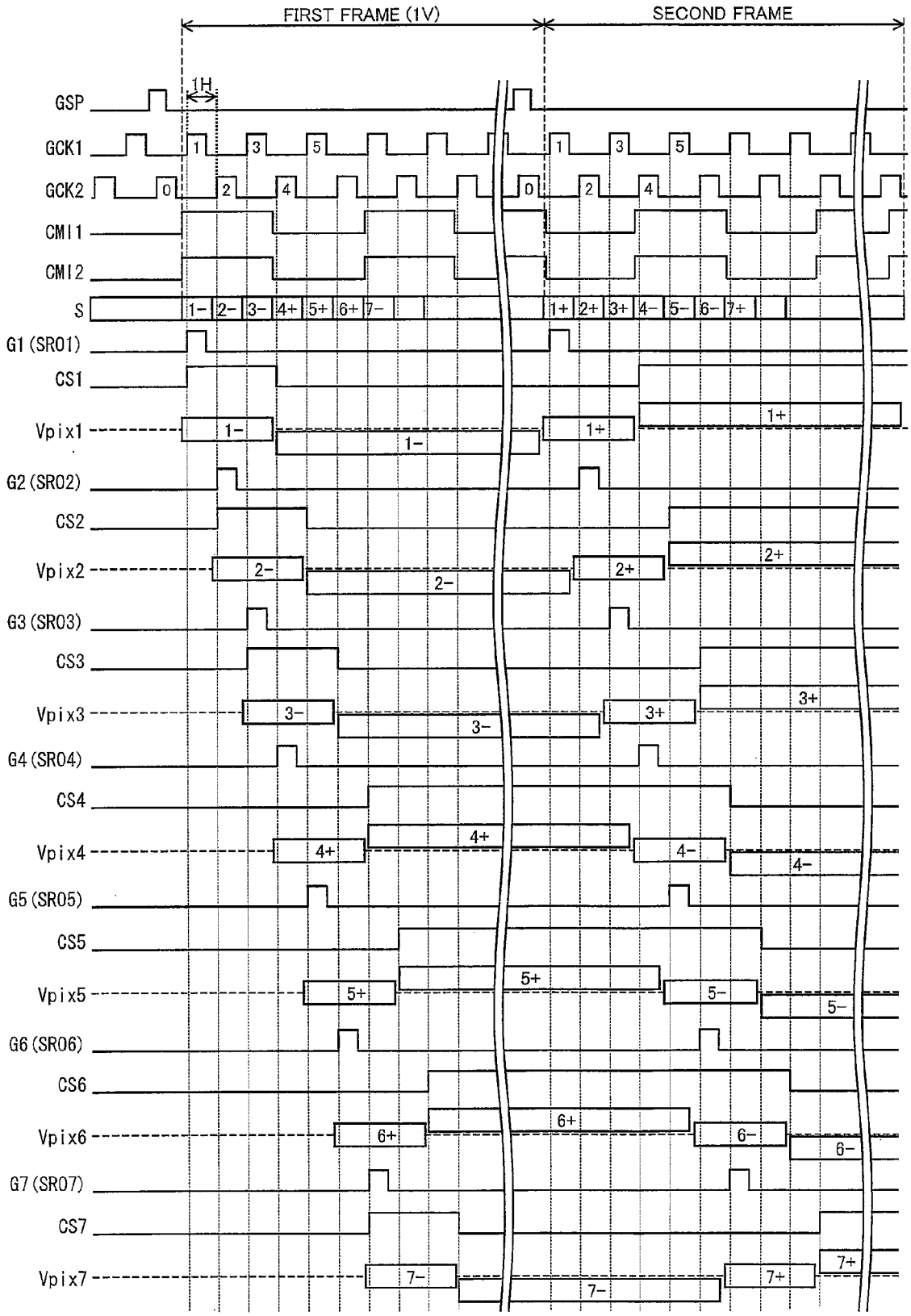
FIG. 21 is a timing chart illustrating waveforms of respective signals, the waveforms being obtained in a case where 3-line (3H) reversal driving is carried out in the liquid crystal display device 1 of Example 5.

FIG. 21 is a timing chart illustrating waveforms of respective signals, the waveforms being obtained in a case where 3-line (3H) reversal driving is carried out in the liquid crystal display device 1 illustrated in FIG. 17. In FIG. 21, polarities of respective of CMI1 and CMI2 are reversed every three horizontal scanning periods (3H), and phases of CMI1 and CMI2 are set to be identical to each other. Accordingly, the present example may be arranged such that only one of the polarity signals CMI1 and CMI2 is used to be supplied to each of the CS circuits.

In the initial state, each of the CS signals CS1 through CS7 is fixed at an electric potential having one level (a low level in FIG. 21) (see FIG. 21). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 21 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

As described earlier, according to the liquid crystal display device 1 which carries out 3H reversal driving, since electric potentials of the CS signals are different from each other every three rows in accordance with a polarity of the source signal S when the gate signals corresponding to the respective CS signals fall, the electric potentials Vpix1 through Vpix7 of the respective pixel electrodes 14 are properly shifted by the respective CS signals CS1 through CS7. Therefore, an input of the source signal S of an identical gray scale causes positive and negative electric potential differences between the electric potential of the counter electrode and the shifted electric potential of each of the pixel electrodes 14 to be equal to each other. Namely, in the first frame, in an identical pixel column, the source signal of a negative polarity is written to pixels corresponding to respective first three adjacent rows, and the source signal of a positive polarity is written to pixels corresponding to respective second three adjacent rows following the first three adjacent rows. In electric potentials of the CS signals corresponding to the respective first three adjacent rows, no reversal of polarity occurs during the writing of the source signal to the pixels corresponding to the respective first three adjacent rows, reversal of polarity toward a negative polarity occurs after the writing, and no reversal of polarity occurs until the next writing. In electric potentials of the CS signals corresponding to the respective second three adjacent rows, no reversal of polarity occurs during the writing of the source signal to the pixels corresponding to the respective second three adjacent rows, reversal of polarity toward a positive polarity occurs after the writing, and no reversal of polarity occurs until the next writing. This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

The gate line driving circuit 30 and the CS bus line driving circuit 40 of Example 6 are different from those of Example 5 in timing at which polarities of the respective polarity signals CMI1 and CMI2 are reversed. The other configurations are identical to those illustrated in FIG. 17. Each of the CS circuits receives the shift register output SROn of the corresponding nth row and the shift register output SROn+3 of the (n+3)th row, and the polarity signals CMI1 and CMI2 are supplied to the CS circuits alternately every three rows. Namely, as described earlier, CMI1 is supplied to each of the CS circuits 41, 42, and 43, CMI2 is supplied to each of the CS circuits 44, 45, and 46, and CMI1 is supplied to each of the CS circuits 47, 48, and 49. The polarity signals CMI1 and CMI2 are set as illustrated in FIG. 21.

Figure 22:
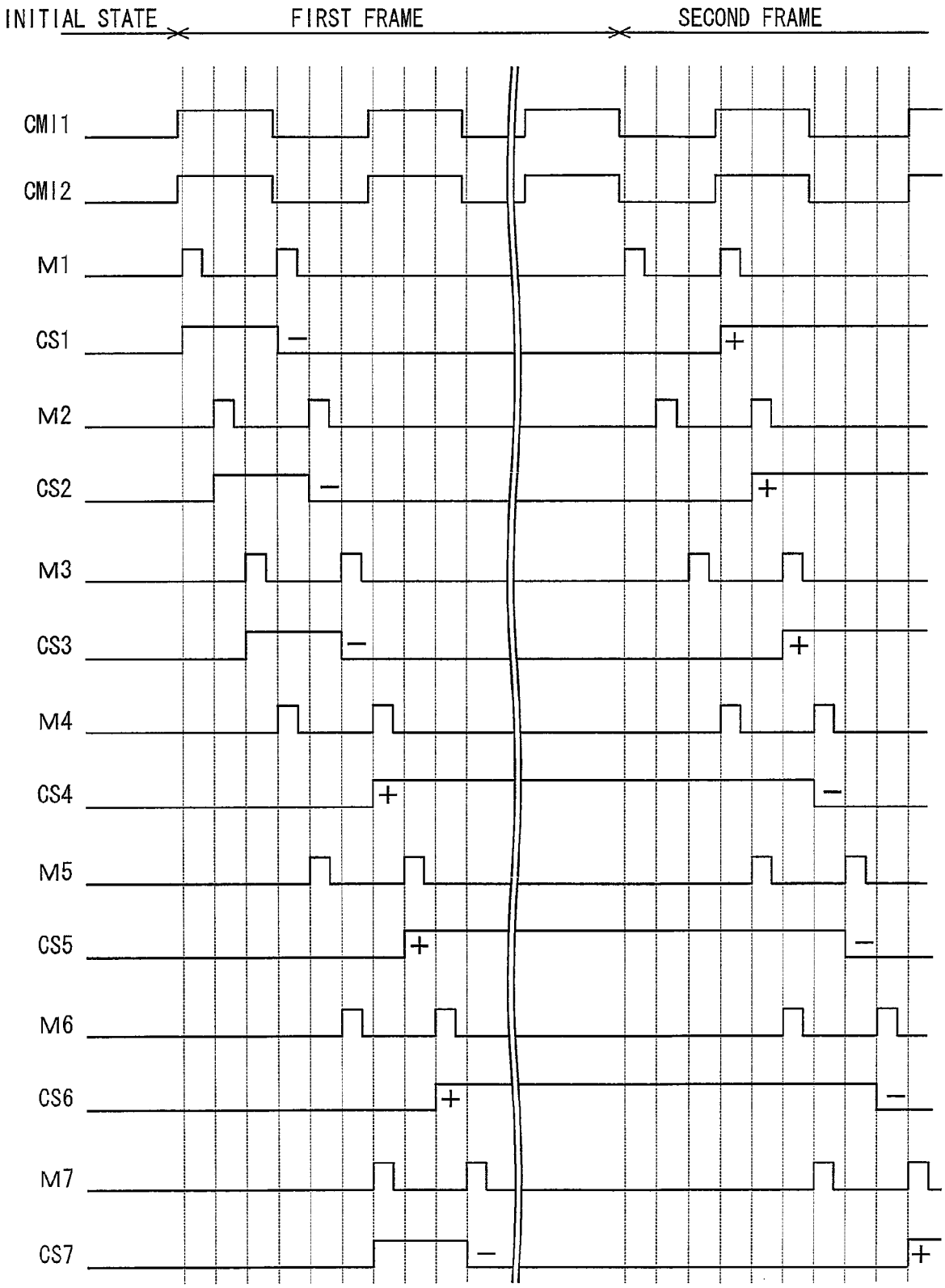
FIG. 22 illustrates waveforms of respective signals supplied to/from a CS bus line driving circuit of a liquid crystal display device 1 of Example 6.

A description of how the gate line driving circuit 30 and the CS bus line driving circuit 40 are connected is omitted here, and 3H reversal driving is described with reference to FIGS. 21 and 22. FIG. 22 illustrates waveforms of respective signals supplied to/from the CS bus line driving circuit 40 of the liquid crystal display device 1 of Example 6. For convenience, the following description takes, as an example, the CS circuits 42, 43, and 44 corresponding to the respective second through fourth rows, so as to discuss operation of the first frame.

First, a change in waveforms of respective signals of the second row is to be described. In the initial state, the polarity signal CMI1 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI1 which input state is obtained when the change occurs, i.e., a high level. Then, the high level is maintained until the signal M2 becomes at a high level.

Subsequently, the shift register output SRO5 which has been shifted to the fifth row in the gate line driving circuit 30 is supplied to the other terminal of the OR circuit 42*b*. Note that the shift register output SRO5 is also supplied to one terminal of the OR circuit 45*b* of the CS circuit 45.

A change in electric potential level (from low level to high level) of the shift register output SRO5 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a low level. Namely, the electric potential of the CS signal CS2 changes from a high level to a low level when the change in electric potential level (from low level to high level) of the shift register output SRO5 occurs. The D latch circuit 42*a* outputs a low level until a change in electric potential level (from high level to low level) of the shift register output SRO5 occurs in the signal M2 to be supplied to the clock terminal CK (during a period in which the signal M2 is at a high level). Next, when the change in electric potential level (from high level to low level) of the shift register output SRO5 in the signal M2 is supplied to the clock terminal CK, the D latch circuit 42*a* latches an input state of the polarity signal CMI1 which input state is obtained when the change occurs, i.e., a low level. Then, the low level is maintained until the signal M2 becomes at a high level in the second frame.

Next, a change in waveforms of respective signals of the third row is to be described. In the initial state, the polarity signal CMI1 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level.

Subsequently, the shift register output SRO6 which has been shifted to the sixth row in the gate line driving circuit 30 is supplied to the other terminal of the OR circuit 43*b*. Note that the shift register output SRO6 is also supplied to one terminal of the OR circuit 45*b* of the CS circuit 46.

A change in electric potential level (from low level to high level) of the shift register output SRO6 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a low level. Namely, the electric potential of the CS signal CS3 changes from a high level to a low level when the change in electric potential level (from low level to high level) of the shift register output SRO6 occurs. The D latch circuit 43*a* outputs a low level until a change in electric potential level (from high level to low level) of the shift register output SRO6 occurs in the signal M3 to be supplied to the clock terminal CK (during a period in which the signal M3 is at a high level). Next, when the change in electric potential level (from high level to low level) of the shift register output SRO6 in the signal M3 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level in the second frame.

Next, a change in waveforms of respective signals of the fourth row is to be described. In the initial state, the polarity signal CMI2 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI2 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI2 which input state is obtained when the change occurs, i.e., a low level. Then, the low level is maintained until the signal M4 becomes at a high level.

Subsequently, the shift register output SRO7 which has been shifted to the seventh row in the gate line driving circuit 30 is supplied to the other terminal of the OR circuit 44*b*. Note that the shift register output SRO7 is also supplied to one terminal of the OR circuit 47*b* of the CS circuit 47.

A change in electric potential level (from low level to high level) of the shift register output SRO7 in the signal M4 is supplied to the clock terminal CK of the D latch circuit 44*a*, and the D latch circuit 44*a* transfers an input state of the polarity signal CMI2 which input state is supplied to the terminal D when the change occurs, i.e., a high level. Namely, the electric potential of the CS signal CS4 changes from a low level to a high level when the change in electric potential level (from low level to high level) of the shift register output 51207 occurs. The D latch circuit 44*a* outputs a high level until the next time a change in electric potential level (from high level to low level) of the shift register output SRO7 occurs in the signal M4 to be supplied to the clock terminal CK (during a period in which the signal M4 is at a high level). Next, when the change in electric potential level (from high level to low level) of the shift register output SRO7 in the signal M4 is supplied to the clock terminal CK, the D latch circuit 44*a* latches an input state of the polarity signal CMI2 which input state is obtained when the change occurs, i.e., a high level. Then, the high level is maintained until the signal M4 becomes at a high level in the second frame.

According to the above operation, in the first through third rows, an electric potential level of the CS signal which level is obtained when the gate signal of a corresponding row falls (when the TFT 13 in an ON state is turned off) falls after the gate signal of the corresponding row has fallen, and in the fourth through sixth rows, an electric potential level of the CS signal which level is obtained when the gate signal of a corresponding row falls (when the TFT 13 in an ON state is turned off) rises after the gate signal of the corresponding row has fallen (see FIGS. 21 and 22).

As described earlier, according to Example 6, 3H reversal driving can be carried out in the liquid crystal display device 1 having the arrangement illustrated in FIG. 17 by adjusting a timing at which the polarities of the respective polarity signals CMI1 and CMI2 are reversed. This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 23:
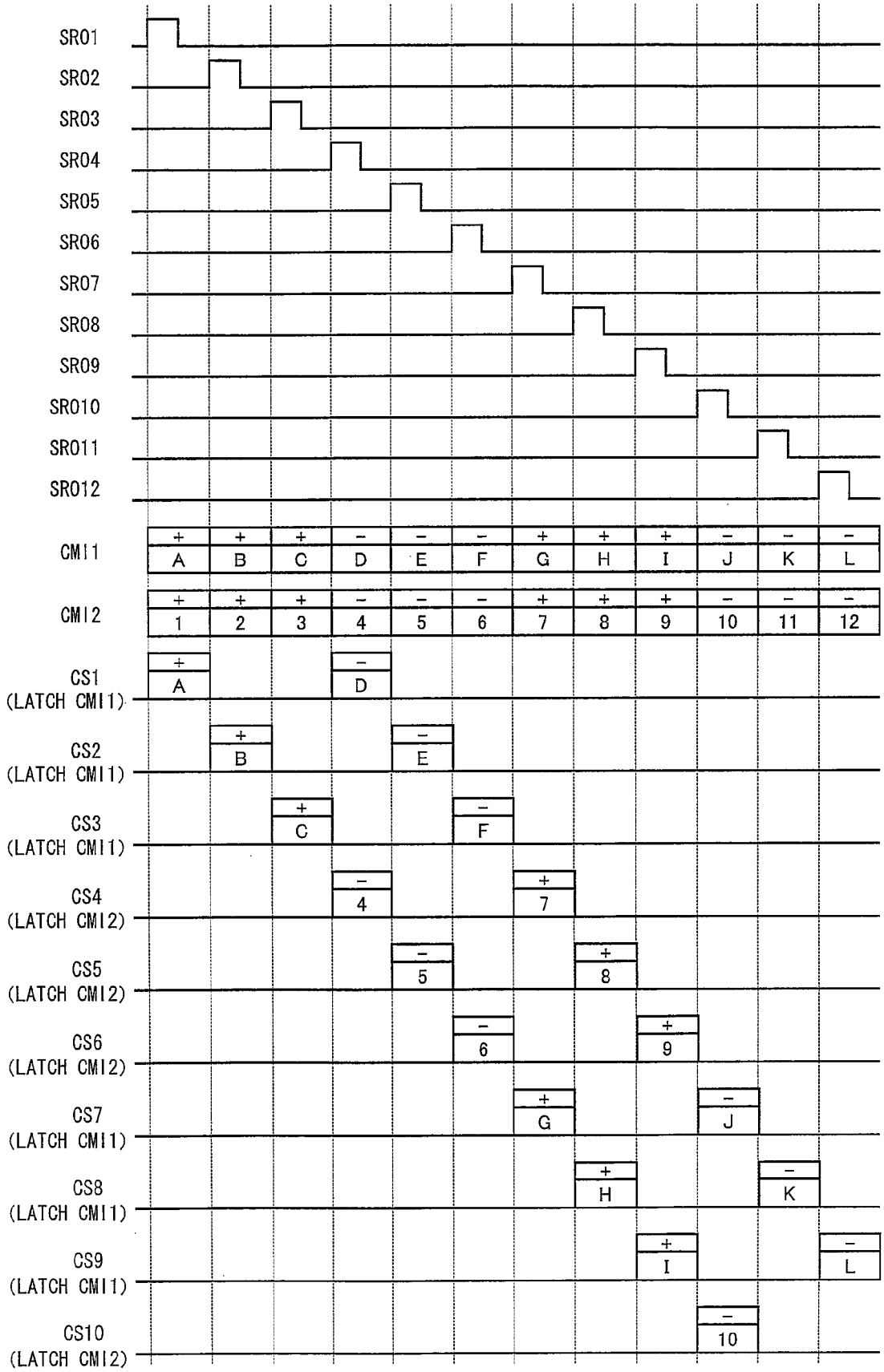
FIG. 23 illustrates how (i) a polarity signal and a shift register output each of which is supplied to a CS circuit of Example 6 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 23 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 23, signs A through L correspond to respective one horizontal scanning periods and indicate polarities of the respective one horizontal scanning periods. For example, CMI1 has a positive polarity during the second horizontal scanning period "B", has a positive polarity during the third horizontal scanning period "C", has a negative polarity during the fourth horizontal scanning period "D", and has a negative polarity during the fifth horizontal scanning period "E". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a positive polarity during the third horizontal scanning period "3", and has a negative polarity during the fourth horizontal scanning period "4". CMI1 and CMI2 are supplied to the CS circuit 4*n* alternately every three rows. For example, CMI1 is supplied to each of the CS circuits 41, 42, and 43, CMI2 is supplied to each of the CS circuits 44, 45, and 46, and CMI1 is supplied to each of the CS circuits 47, 48, and 49.

According to the CS circuit 4*n*, since the shift register output SROn of the nth row and the shift register output SROn+3 of the (n+3)th row are supplied to the clock terminal CK, (i) CMI to be supplied to the data terminal D during the nth horizontal scanning period and (ii) CMI to be supplied to the data terminal D during the (n+3)th horizontal scanning period are latched. For example, the CS circuit 41 loads (i) a positive polarity of "A" of CMI1 during the first horizontal scanning period and (ii) a positive polarity of "D" of CMI1 during the fourth horizontal scanning period. The CS circuit 42 loads (i) a positive polarity of "B" of CMI1 during the second horizontal scanning period and (ii) a negative polarity of "E" of CMI1 during the fifth horizontal scanning period. The CS circuit 43 loads (i) a positive polarity of "C" of CMI1 during the third horizontal scanning period and (ii) a negative polarity of "F" of CMI1 during the sixth horizontal scanning period. The CS circuit 44 loads (i) a negative polarity of "4" of CMI2 during the fourth horizontal scanning period and (ii) a positive polarity of "7" of CMI2 during the seventh horizontal scanning period. Each of the CS signals CSn illustrated in FIGS. 21 and 22 is thus outputted.

As described earlier in Examples 5 and 6, in a case where two polarity signals CMI1 and CMI2 are used which are identical to or different from each other in timing at which polarities of the respective polarity signals CMI1 and CMI2 are reversed, the liquid crystal display device 1 illustrated in FIG. 17 can also carry out 2H reversal driving and 3H reversal driving. In a case where the timing is adjusted at which polarities of the respective polarity signals CMI1 and CMI2 are reversed, 4H, . . . , nH reversal driving can be similarly implemented.

Embodiment 2

A second embodiment of the present invention is described below with reference to FIGS. 25 through 27. Note that, for convenience, members having functions identical to those of the respective members described in the First Embodiment are given respective identical reference numerals, and a description of those members is omitted here. Note also that terms defined in the First Embodiment are used also in the present examples in accordance with the definition unless otherwise noted.

A schematic arrangement of a liquid crystal display device 2 in accordance with the present embodiment is identical to that of the liquid crystal display device 1 illustrated in FIGS. 1 and 2. Accordingly, a description of the schematic arrangement of the liquid crystal display device 2 is omitted here. The following description specifically discusses a gate line driving circuit 30 and a CS bus line driving circuit 40 of the present embodiment. The liquid crystal display device 2 is provided with one signal line for supplying a polarity signal CMI from a control circuit 50 (see FIG. 1) to the CS bus line driving circuit 40. The liquid crystal display device 2 is arranged to implement n-line reversal (nH) driving by adjusting a frequency at which a polarity of the polarity signal CMI is reversed. Note here that 2H reversal driving can be implemented in a case where one of CMI1 and CMI2 is used as the polarity signal CMI and its polarity is set to be reversed every 2H in the configuration illustrated in FIGS. 10 and 11. Note also that 3H reversal driving can be implemented in a case where one of CMI1 and CMI2 is used as the polarity signal CMI and its polarity is set to be reversed every 3H in the driving illustrated in FIGS. 17 and 21.

As described earlier, in order to cause the polarity signal CMI of a single phase to implement n-line (nH) reversal driving, it is only necessary that a logical sum (an output of an OR circuit) of a shift register output SROm of an mth stage and a shift register output SROm+n of an (m+n)th stage be supplied to a clock terminal CK of a latch circuit CSLm of the mth stage and a polarity of the polarity signal CMI to be supplied to a data terminal D be set to be reversed every n horizontal scanning periods (nH). The following description discusses an arrangement for implementing 4H reversal driving, the arrangement typifying n-line (nH) reversal driving.

Example 7

Figure 24:
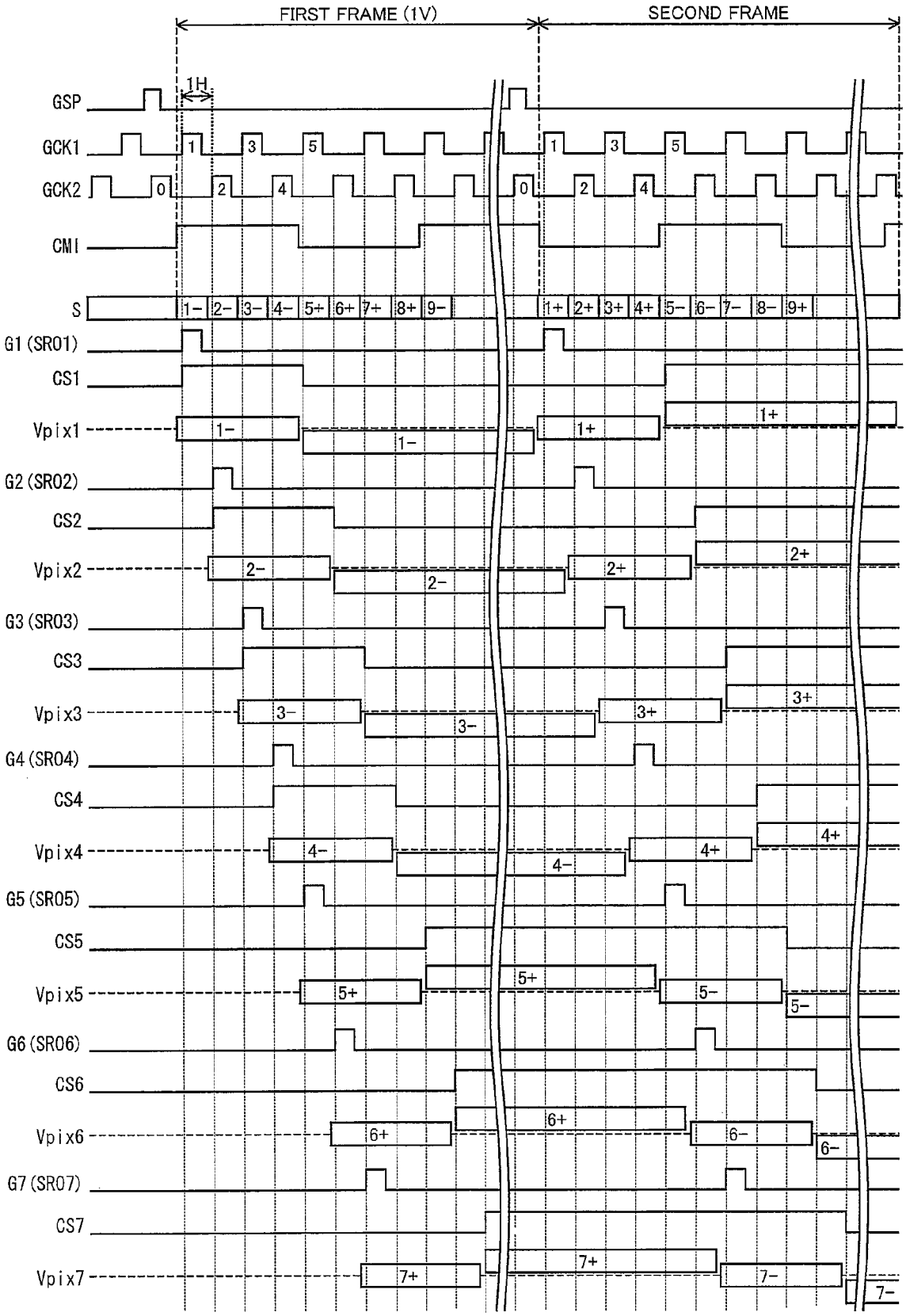
FIG. 24 is a timing chart illustrating waveforms of respective signals, the waveforms being obtained in a case where 4-line (4H) reversal driving is carried out in a liquid crystal display device 2 of Example 7.

FIG. 24 is a timing chart illustrating waveforms of respective signals of the liquid crystal display device 1 which carries out 4-line (4H) reversal driving. In FIG. 24, GSP is a gate start pulse which defines a timing of vertical scanning and each of GCK1 (CK) and GCK2 (CKB) is a gate clock which is supplied from the control circuit 50 and defines a timing at which a shift register operates. A period between a first fall and a second fall of GSP, the second fall following the first fall is equivalent to one vertical scanning period (1V period). Each of a period between a first rise of GCK1 and a first rise of GCK2 and a period between the first rise of GCK2 and a second rise of GCK1, the second rise following the first rise is one horizontal scanning period (1H period). A polarity of the polarity signal CMI1 is reversed every four horizontal scanning periods (4H).

FIG. 24 illustrates, in this order, (i) the source signal S (video signal) to be supplied from the source bus line driving circuit 20 to a source bus line 11 (a source bus line 11 provided in the xth column), (ii) a gate signal G1 to be supplied from the gate line driving circuit 30 to a gate line 12 provided in the first row, (iii) a CS signal CS1 to be supplied from the CS bus line driving circuit 40 to a CS bus line 105 provided in the first row, and (iv) a waveform of an electric potential Vpix1 of a pixel electrode 14 provided in the first row and the xth column. Then, FIG. 24 illustrates, in this order, (i) a gate signal G2 to be supplied to a gate line 12 provided in the second row, (ii) a CS signal CS2 to be supplied to a CS bus line 15 in the second row, and (iii) a waveform of an electric potential Vpix2 of a pixel electrode 14 provided in the second row and the xth column. Same, applies to the third through ninth rows.

Note that a broken line in each of the electric potentials Vpix1 through Vpix9 indicates an electric potential of the counter electrode 19.

The following description assumes that an initial frame of a display video is the first frame and a frame before the first frame is an initial state. In the initial state, each of the CS signals CS1 through CS9 is fixed at an electric potential having one level (a low level in FIG. 24) (see FIG. 24). In the first frame, the CS signals CS1 through CS4 of the respective first through fourth rows are at a high level when the gate signals G1 (equivalent to an output SRO1 of a corresponding shift register circuit SR1) through G4 (equivalent to an output SRO4 of a corresponding shift register circuit SR4) corresponding to the respective CS signals CS1 through CS4 fall, the CS signals CS5 through CS8 of the respective fifth through eighth rows are at a low level when the gate signals G5 through G8 corresponding to the respective CS signals CS5 through CS8 fall, and the CS signal CS9 of the ninth row is at a high level when the gate signal G9 corresponding thereto falls.

Note here that the source signal S has an amplitude in accordance with a gray scale indicated by a video signal and is a signal whose polarity is reversed every four horizontal scanning periods (4H). Note also that, since FIG. 24 assumes that a uniform video is displayed, the source signal S has a constant amplitude. The gate signals G1 through G9 have gate ON electric potentials during the respective first through ninth 1H periods in an active period (an effective scanning period) of each frame and have gate OFF electric potentials during the other periods of the each frame.

Then, electric potential levels of the respective CS signals CS1 through CS9 change between high and low levels after the gate signals G1 through G9 corresponding to the respective CS signals CS1 through CS9 fall. Specifically, in the first frame, the CS signals CS1 through CS4 fall after the gate signals G1 through G4 corresponding to the respective CS signals CS1 through CS4 fall, the CS signals CS5 through CS8 rise after the gate signals G5 through G8 corresponding to the respective CS signals CS5 through CS8 fall, and the CS signal CS9 falls after the gate signal G9 corresponding thereto falls. Note that the second frame has a relationship opposite to that of the first frame. The CS signals CS1 through CS4 rise after the gate signals G1 through G4 corresponding to the respective CS signals CS1 through CS4 fall, the CS signals CS5 through CS8 fall after the gate signals G5 through G8 corresponding to the respective CS signals CS5 through CS8 fall, and the CS signal CS9 rises after the gate signal G9 corresponding thereto falls.

As described earlier, according to the liquid crystal display device 2 which carries out 4-line (4H) reversal driving, since electric potentials of the CS signals are different from each other every four rows in accordance with a polarity of the source signal S when the gate signals corresponding to the respective CS signals fall, the electric potentials Vpix1 through Vpix9 of the respective pixel electrodes 14 are properly shifted by the respective CS signals CS1 through CS9. Therefore, an input of the source signal S of an identical gray scale causes positive and negative electric potential differences between the electric potential of the counter electrode and the shifted electric potential of each of the pixel electrodes 14 to be equal to each other. Namely, in the first frame, in an identical pixel column, the source signal of a negative polarity is written to pixels corresponding to respective first four adjacent rows, and the source signal of a positive polarity is written to pixels corresponding to respective second four adjacent rows following the first four adjacent rows. In electric potentials of the CS signals CS1 through CS4 corresponding to the respective first four adjacent rows, no reversal of polarity occurs during the writing of the source signal to the pixels corresponding to the respective first four adjacent rows, reversal of polarity toward a negative polarity occurs after the writing, and no reversal of polarity occurs until the next writing. In electric potentials of the CS signals CS5 through CS8 corresponding to the respective second four adjacent rows, no reversal of polarity occurs during the writing of the source signal to the pixels corresponding to the respective second four adjacent rows, reversal of polarity toward a positive polarity occurs after the writing, and no reversal of polarity occurs until the next writing. This enables 4-line reversal driving to be carried out in CC driving. According to the arrangement, the electric potentials Vpix1 through Vpix9 of the respective pixel electrodes 14 can be properly shifted by the respective CS signals CS1 through CS9. This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 25:
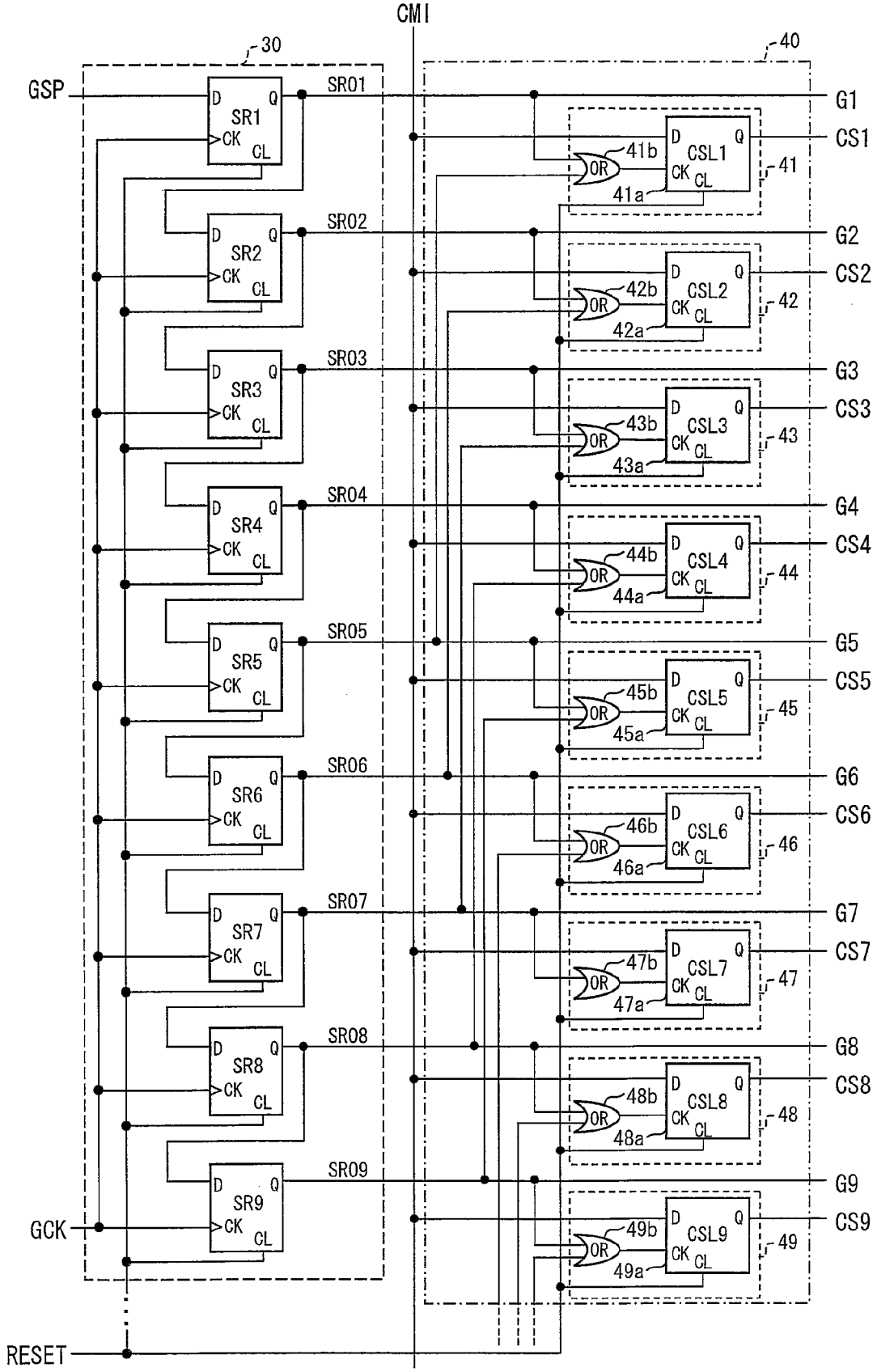
FIG. 25 is a block diagram illustrating configurations of a gate line driving circuit and a CS bus line driving circuit of Example 7.

FIG. 25 illustrates configurations of the gate line driving circuit 30 and the CS bus line driving circuit 40. The CS bus line driving circuit 40 includes a plurality of CS circuits 41, 42, 43, . . . which correspond to the respective rows. The CS circuits 41, 42, 43, . . . include respective D latch circuits 41*a*, 42*a*, 43*a*, . . . and respective OR circuits 41*b*, 42*b*, 43*b*, . . . . The gate line driving circuit 30 includes a plurality of shift register circuits SR1, SR2, SR3, . . . . Note that the gate line driving circuit 30 and the CS bus line driving circuit 40 are provided on one end side of a liquid crystal display panel in FIG. 3. However, how to provide the gate line driving circuit 30 and the CS bus line driving circuit 40 is not limited to this. The gate line driving circuit 30 and the CS bus line driving circuit 40 may be provided on different sides of the liquid crystal display panel.

The CS circuit 41 receives the shift register output SRO1 and a shift register output SRO5 corresponding to the respective gate signals G1 and G5, a polarity signal CMI, and a reset signal RESET. The CS circuit 42 receives a shift register output SRO2 and a shift register output SRO6 corresponding to the respective gate signals G2 and G6, the polarity signal CMI, and the reset signal RESET. The CS circuit 43 receives the shift register output SRO3 and a shift register output SRO7 corresponding to the respective gate signals G3 and G7, the polarity signal CMI, and the reset signal RESET. The CS circuit 44 receives the shift register output SRO4 and a shift register output SRO8 corresponding to the respective gate signals G4 and G8, the polarity signal CMI, and the reset signal RESET. As described earlier, each of the CS circuits receives a shift register output SROm of the corresponding mth row and a shift register output SROm+4 of the (m+4)th row, and the polarity signal is supplied to each of the CS circuits. A polarity of the polarity signal CMI is reversed every four horizontal scanning periods (see FIG. 24). The polarity signal CMI and the reset signal RESET are supplied from the control circuit 50.

For convenience, the following description mainly takes, as an example, the CS circuits 44 and 45 corresponding to the respective fourth and fifth rows.

The D latch circuit 44*a* receives the reset signal RESET via a reset terminal CL thereof, the polarity signal CMI via a data terminal D thereof, and an output of the OR circuit 44*b* via a clock terminal CK thereof. In accordance with a change in electric potential level (from low level to high level or from high level to low level) of the signal to be supplied to the clock terminal CK, the D latch circuit 44*a* outputs, as the CS signal CS4 indicating a change in electric potential level, an input state (a low level or a high level) of the polarity signal CMI which input state is supplied to the data terminal D.

Specifically, in a case where the signal to be supplied to the clock terminal CK has a high level electric potential, the D latch circuit 44*a* outputs an input state (a low level or a high level) of the polarity signal CMI which input state is supplied to the data terminal D. When the electric potential of the signal to be supplied to the clock terminal CK changes from a high level to a low level, the D latch circuit 44*a* latches an input state (a low level or a high level) of the polarity signal CMI which input state is supplied to the terminal D when the change occurs. The D latch circuit 42*a* maintains the latched state until the next time the signal to be supplied to the clock terminal CK has a high level electric potential. Then, the D latch circuit 44*a* outputs, via an output terminal Q thereof, the latched state as the CS signal CS2 indicating a change in electric potential level.

Similarly, the reset signal RESET and the polarity signal CMI1 are supplied to the reset terminal CL and the data terminal D, respectively of the D latch circuit 45*a*. In contrast, and an output of the OR circuit 45*b* is supplied to the clock terminal CK of the D latch circuit 45*a*. This causes the CS signal CS5 indicating a change in electric potential level to be supplied from the output terminal Q of the D latch circuit 45*a*.

Figure 26:
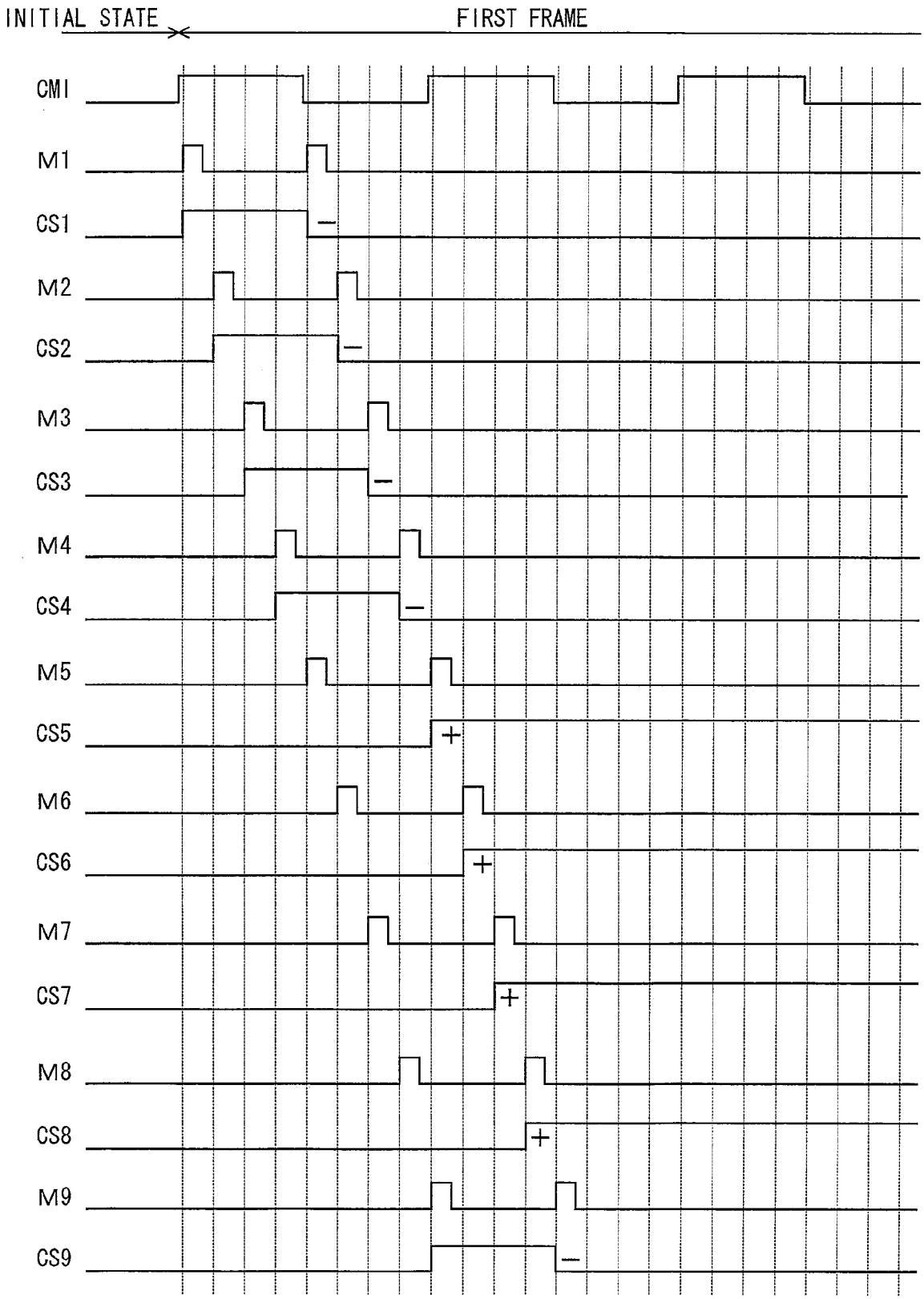
FIG. 26 illustrates waveforms of respective signals supplied to/from a CS bus line driving circuit of the liquid crystal display device 2 of Example 7.

The OR circuit 44*b* which has received the output signal SRO4 of the shift register SR4 of the corresponding fourth row and the output signal SRO8 of the shift register SR8 of the eighth row outputs a signal M4 illustrated in FIG. 26. The OR circuit 45*b* which has received the output signal SRO5 of the shift register SR5 of the corresponding fifth row and the output signal SRO9 of the shift register SR9 of the ninth row outputs a signal M5 illustrated in FIG. 26.

Note that the shift register outputs SROs to be supplied to the OR circuits are generated by a publicly-known method in the gate line driving circuit 30 including a D-type flip-flop circuit illustrated in FIG. 24. At a timing of a gate clock GCK having one horizontal scanning period, the gate line driving circuit 30 sequentially shifts a gate start pulse GSP supplied from the control circuit 50 to the shift register circuit SR of a second stage followed by a first stage.

FIG. 26 illustrates waveforms of respective signals supplied to/from the CS bus line driving circuit 40 of the liquid crystal display device 2 of Example 7.

First, a change in waveforms of respective signals of the fourth row is to be described. In the initial state, the polarity signal CMI is supplied to the terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 corresponding to the gate signal G4 to be supplied to the gate line 12 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI2 which input state is supplied to the terminal D when the change occurs, i.e., a high level. Namely, the electric potential of the CS signal CS4 changes from a low level to a high level when the change in electric potential level (from low level to high level) of the shift register output SRO4 occurs. The D latch circuit 44*a* outputs a high level until a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI which input state is obtained when the change occurs, i.e., a high level. Then, the high level is maintained until the signal M4 becomes at a high level.

Subsequently, the shift register output SRO8 which has been shifted to the eighth row in the gate line driving circuit 30 is supplied to the other terminal of the OR circuit 44*b*. Note that the shift register output SRO8 is also supplied to one terminal of the OR circuit 48*b* of the CS circuit 48.

A change in electric potential level (from low level to high level) of the shift register output SRO8 in the signal M4 is supplied to the clock terminal CK of the D latch circuit 44*a*, and the D latch circuit 44*a* transfers an input state of the polarity signal CMI which input state is supplied to the terminal D when the change occurs, i.e., a low level. Namely, the electric potential of the CS signal CS4 changes from a high level to a low level when the change in electric potential level (from low level to high level) of the shift register output SRO8 occurs. The D latch circuit 44*a* outputs a low level until a change in electric potential level (from high level to low level) of the shift register output SRO8 occurs in the signal M4 to be supplied to the clock terminal CK (during a period in which the signal M4 is at a high level). Next, when the change in electric potential level (from high level to low level) of the shift register output SRO8 in the signal M4 is supplied to the clock terminal CK, the D latch circuit 44*a* latches an input state of the polarity signal CMI which input state is obtained when the change occurs, i.e., a low level. Then, the low level is maintained until the signal M4 becomes at a high level in the second frame.

Note that the first through third rows have waveforms identical to that of the fourth row (see FIG. 26).

Next, a change in waveforms of respective signals of the fifth row is to be described. In the initial state, the polarity signal CMI is supplied to the data terminal D of the D latch circuit 45*a* of the CS circuit 45, and the reset signal RESET is supplied to the reset terminal CL of the D latch circuit 45*a* of the CS circuit 45. The reset signal RESET maintains, at a low level, an electric potential of the CS signal CS5 to be supplied from the output terminal Q of the D latch circuit 45*a*.

Thereafter, the shift register output SRO5 corresponding to the gate signal G5 to be supplied to the gate line 12 of the fifth row is supplied from the shift register circuit SR5 to one terminal of the OR circuit 45*b* of the CS circuit 45. Then, a change in electric potential level (from low level to high level) of the shift register output SRO5 in the signal M5 is supplied to the clock terminal CK of the D latch circuit 45*a*, and the D latch circuit 45*a* transfers an input state of the polarity signal CMI which input state is supplied to the data terminal D when the change occurs, i.e., a low level. The D latch circuit 45*a* outputs a low level until the next time a change in electric potential level (from high level to low level) of the shift register output SRO5 occurs in the signal M5 to be supplied to the clock terminal CK (during a period in which the signal M5 is at a high level). Next, when the change in electric potential level (from high level to low level) of the shift register output SRO5 in the signal M5 is supplied to the clock terminal CK, the D latch circuit 45*a* latches an input state of the polarity signal CMI which input state is obtained when the change occurs, i.e., a low level. Then, the low level is maintained until the signal M5 becomes at a high level.

Subsequently, the shift register output SRO9 which has been shifted to the fourth row in the gate line driving circuit 30 is supplied to the other terminal of the OR circuit 45*b*. Note that the shift register output SRO9 is also supplied to one terminal of the OR circuit 49*b* of the CS circuit 49.

A change in electric potential level (from low level to high level) of the shift register output SRO9 in the signal M5 is supplied to the clock terminal CK of the D latch circuit 45*a*, and the D latch circuit 45*a* transfers an input state of the polarity signal CMI which input state is supplied to the terminal D when the change occurs, i.e., a high level. Namely, the electric potential of the CS signal CS5 changes from a low level to a high level when the change in electric potential level (from low level to high level) of the shift register output SRO9 occurs. The D latch circuit 45*a* outputs a high level until the next time a change in electric potential level (from high level to low level) of the shift register output SRO9 occurs in the signal M5 to be supplied to the clock terminal CK (during a period in which the signal. M5 is at a high level). Next, when the change in electric potential level (from high level to low level) of the shift register output SRO9 in the signal M5 is supplied to the clock terminal CK, the D latch circuit 45*a* latches an input state of the polarity signal CMI which input state is obtained when the change occurs, i.e., a high level. Then, the high level is maintained until the signal M5 becomes at a high level in the second frame.

Note that the sixth through eighth rows have waveforms identical to that of the fifth row (see FIG. 26). Since the polarity of the polarity signal CMI is reversed in the second frame (see FIG. 24), the first through fourth rows of the second frame have waveforms identical to those of the respective fifth through eighth rows of the first frame and the fifth through eighth rows of the second frame have waveforms identical to those of the respective first through fourth rows of the first frame. In the third and later frames, waveforms of the first frame and the second frame are alternately repeated for each row.

As described earlier, in 4H reversal driving, for each frame, it is possible to cause the CS circuits 41, 42, 43, . . . , 4*n* which correspond to the respective rows to change, between high and low levels, an electric potential level of the CS signal between when the gate signal of each row falls (when the TFT 13 in an ON state is turned off) and after the gate signal of the each row has fallen.

Namely, according to Example 7, a CS signal CSm to be supplied to a CS bus line 15 of the mth row is generated by latching (i) an electric potential level of the polarity signal CMI which level is obtained when a gate signal Gm of the mth row rises and (ii) an electric potential level of the polarity signal CMI which level is obtained when a gate signal G(m+4) of the (m+4)th row rises, and a CS signal CSm+1 to be supplied to a CS bus line 15 of the (m+1)th row is generated by latching (i) an electric potential level of the polarity signal CMI which level is obtained when the gate signal G(m+1) of the (m+1)th row rises and (ii) an electric potential level of the polarity signal CMI which level is obtained when a gate signal G(m+5) of the (m+5)th row rises.

This allows the CS bus line driving circuit 40 to operate properly in the first frame also in 4H reversal driving. Therefore, it is possible to remove irregular waveforms which are described above and serve as a cause for lateral stripes in the first frame and to yield an effect of preventing lateral stripes of light and shade which stripes are produced in a display video in the first frame, so as to enhance a display quality.

A relationship between the polarity signal CMI and the shift register output SRO each of which is supplied to the CS circuit is described here. FIG. 6 illustrates how (i) the polarity signal CMI and the shift register output SRO each of which is supplied to the CS circuit and (ii) the CS signal CS to be supplied from the CS circuit correspond to each other.

Figure 27:
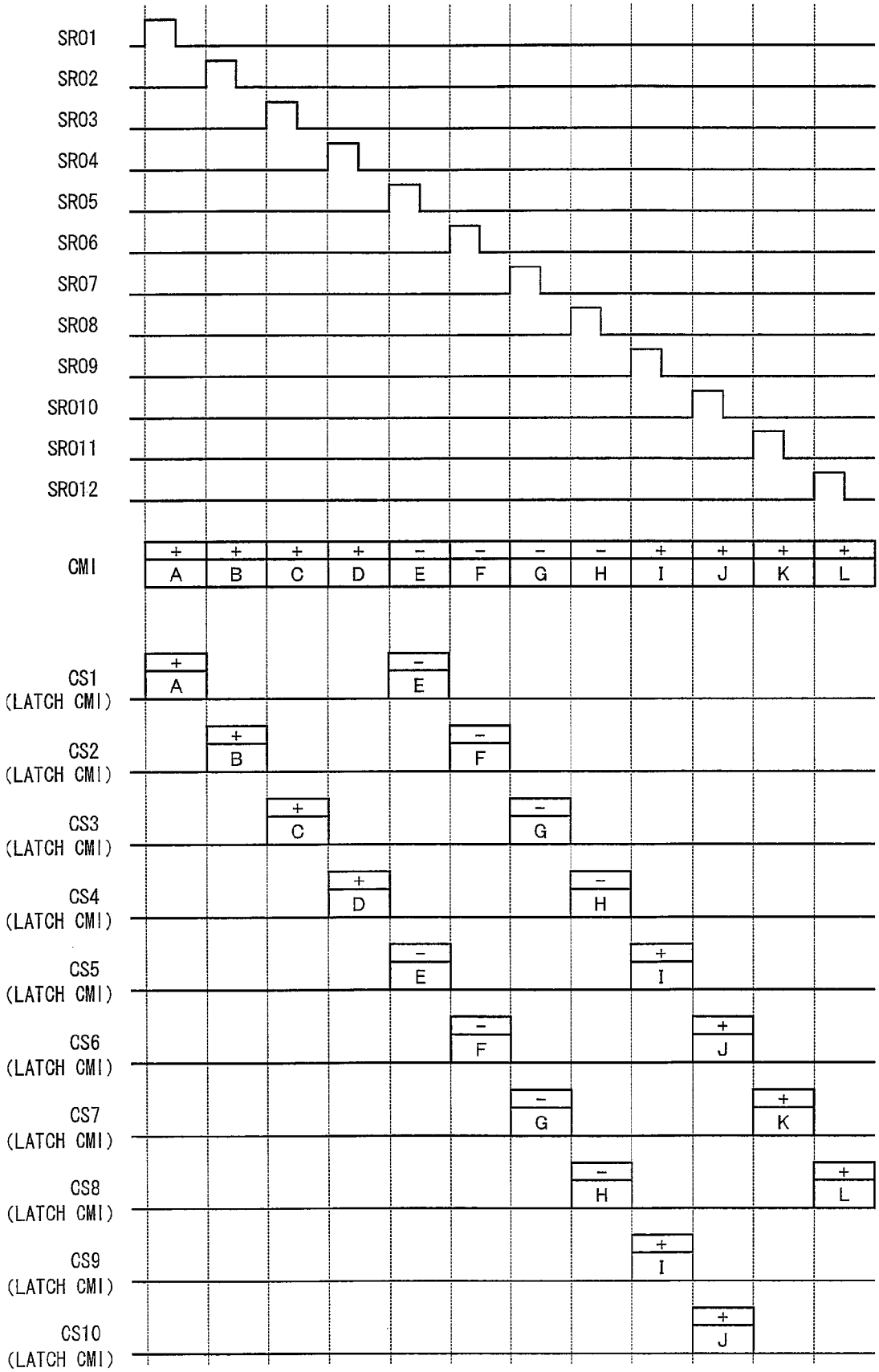
FIG. 27 illustrates how (i) a polarity signal and a shift register output each of which is supplied to a CS circuit of Example 7 and (ii) a CS signal which is supplied from the CS circuit correspond to each other.

As for CMI of FIG. 27, signs A through L correspond to respective one horizontal scanning periods and indicate polarities (positive polarities or negative polarities) of the respective one horizontal scanning periods. For example, CMI1 has a positive polarity during the second horizontal scanning period "B", has a positive polarity during the third horizontal scanning period "C", has a positive polarity during the fourth horizontal scanning period "D", and has a negative polarity during the fifth horizontal scanning period "E". As described earlier, the polarity of CMI is reversed every four horizontal scanning periods.

According to the CS circuit, since the shift register output SROm of the mth row and the shift register output SROm+4 of the (m+4)th row are supplied to the clock terminal CK, (i) CMI to be supplied to the data terminal D during the mth horizontal scanning period and (ii) CMI to be supplied to the data terminal D during the (m+4)th horizontal scanning period are latched. For example, the CS circuit 41 corresponding to the first row loads (i) a positive polarity of "A" of CMI during the first horizontal scanning period and (ii) a negative polarity of "E" of CMI during the fifth horizontal scanning period. The CS circuit 42 corresponding to the second row loads (i) a positive polarity of "B" of CMI during the second horizontal scanning period and (ii) a negative polarity of "F" of CMI during the sixth horizontal scanning period. The CS circuit 43 corresponding to the third row loads (i) a positive polarity of "C" of CMI during the third horizontal scanning period and (ii) a negative polarity of "G" of CMI during the seventh horizontal scanning period. The CS circuit 44 corresponding to the fourth row loads (i) a positive polarity of "D" of CMI during the fourth horizontal scanning period and (ii) a negative polarity of "H" of CMI during the eighth horizontal scanning period. The CS circuit 45 corresponding to the fifth row loads (i) a negative polarity of "E" of CMI during the fifth horizontal scanning period and (ii) a positive polarity of "I" of CMI during the ninth horizontal scanning period. Each of the CS signals CS illustrated in FIGS. 24 and 26 is thus outputted.

Embodiment 3

A third embodiment of the present invention is described below with reference to FIGS. 28 through 43. Note that, for convenience, members having functions identical to those of the respective members described in the First Embodiment are given respective identical reference numerals, and a description of those members is omitted here. Note also that terms defined in the First Embodiment are used also in the present examples in accordance with the definition unless otherwise noted.

A schematic arrangement of a liquid crystal display device 3 in accordance with the present embodiment is identical to that of the liquid crystal display device 1 illustrated in FIGS. 1 and 2. Accordingly, a description of the schematic arrangement of the liquid crystal display device 3 is omitted here. The following description specifically discusses a gate line driving circuit 30 and a CS bus line driving circuit 40 of the present embodiment. As in the case of the First Embodiment, the liquid crystal display device 3 is provided with two signal lines for supplying a polarity signal CMI from a control circuit 50 (see FIG. 1) to the CS bus line driving circuit 40. Polarity signals CMI1 and CMI2 to be supplied to each of the two signal lines have waveforms in which their polarities are opposite to each other. In order to implement n-line reversal (nH) driving, in such an arrangement, a timing is adjusted at which the polarities of the respective polarity signals CMI1 and CMI2 are reversed and the polarity signals CMI1 and CMI2 to be supplied to a latch circuit CSL of each row are set. The following description discusses a specific example.

Example 8

Figure 28:
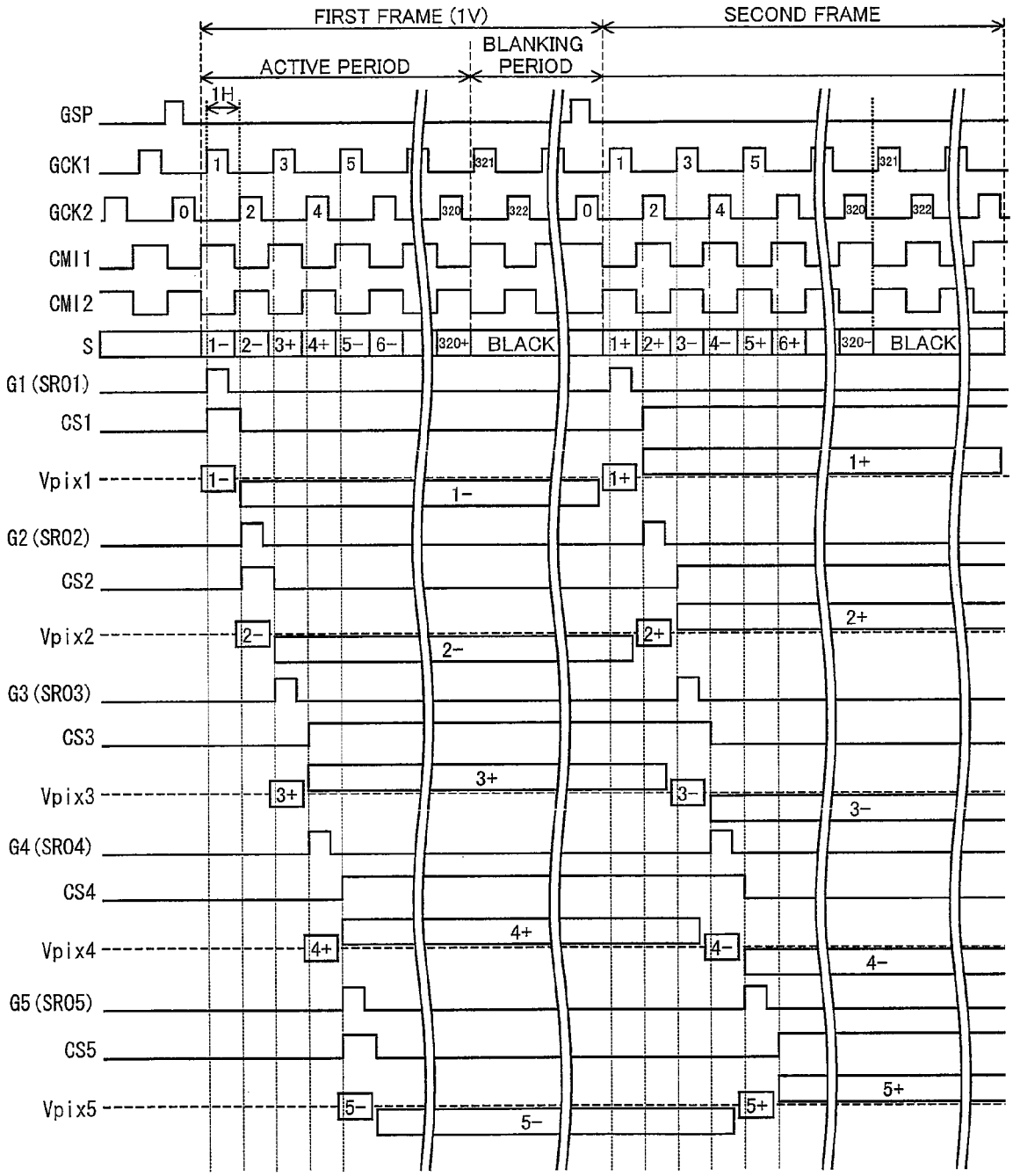
FIG. 28 is a timing chart illustrating waveforms of respective signals, the waveforms being obtained in a case where 2-line (2H) reversal driving is carried out in a liquid crystal display device 3 of Example 8.

FIG. 28 is a timing chart illustrating waveforms of respective signals of the liquid crystal display device 3 which carries out 2-line (2H) reversal driving. In FIG. 28, the polarity signals CMI1 and CMI2 are set so that their respective polarities are reversed every one horizontal scanning period (1H) and the polarities are opposite to each other.

In the initial state, each of the CS signals CS1 through CS5 is fixed at an electric potential having one level (a low level in FIG. 28) (see FIG. 28). In the first frame, the CS signal CS1 of the first row is at a high level when the gate signal G1 corresponding thereto (equivalent to an output SRO1 of a corresponding shift register circuit SR1) falls, the CS signal CS2 of the second row is at a high level when the gate signal G2 corresponding thereto falls, the CS signal CS3 of the third row is at a low level when the gate signal G3 corresponding thereto falls, the CS signal CS4 of the fourth row is at a low level when the gate signal G4 corresponding thereto falls, and the CS signal CS5 of the fifth row is at a high level when the gate signal G5 corresponding thereto falls.

Note here that the source signal S has an amplitude in accordance with a gray scale indicated by a video signal and is a signal whose polarity is reversed every two horizontal scanning periods (2H). Note also that, since FIG. 28 assumes that a uniform video is displayed, the source signal S has a constant amplitude. The gate signals G1 through G5 have gate ON electric potentials during the respective first through fifth 1H periods in an active period (an effective scanning period) of each frame and have gate OFF electric potentials during the other periods of the each frame.

Then, electric potential levels of the respective CS signals CS1 through CS5 change between high and low levels after the gate signals G1 through G5 corresponding to the respective CS signals CS1 through CS5 fall. Specifically, in the first frame, the CS signals CS1 and CS2 fall after the gate signals G1 and G2 corresponding to the respective CS signals CS1 and CS2 fall, and the CS signals CS3 and CS4 rise after the gate signals G3 and G4 corresponding to the respective CS signals CS3 and CS4 fall. Note that the second frame has a relationship opposite to that of the first frame. The CS signals CS1 and CS2 rise after the gate signals G1 and G2 corresponding to the respective CS signals CS1 and CS2 fall, and the CS signals CS3 and CS4 fall after the gate signals G3 and G4 corresponding to the respective CS signals CS3 and CS4 fall.

This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 29:
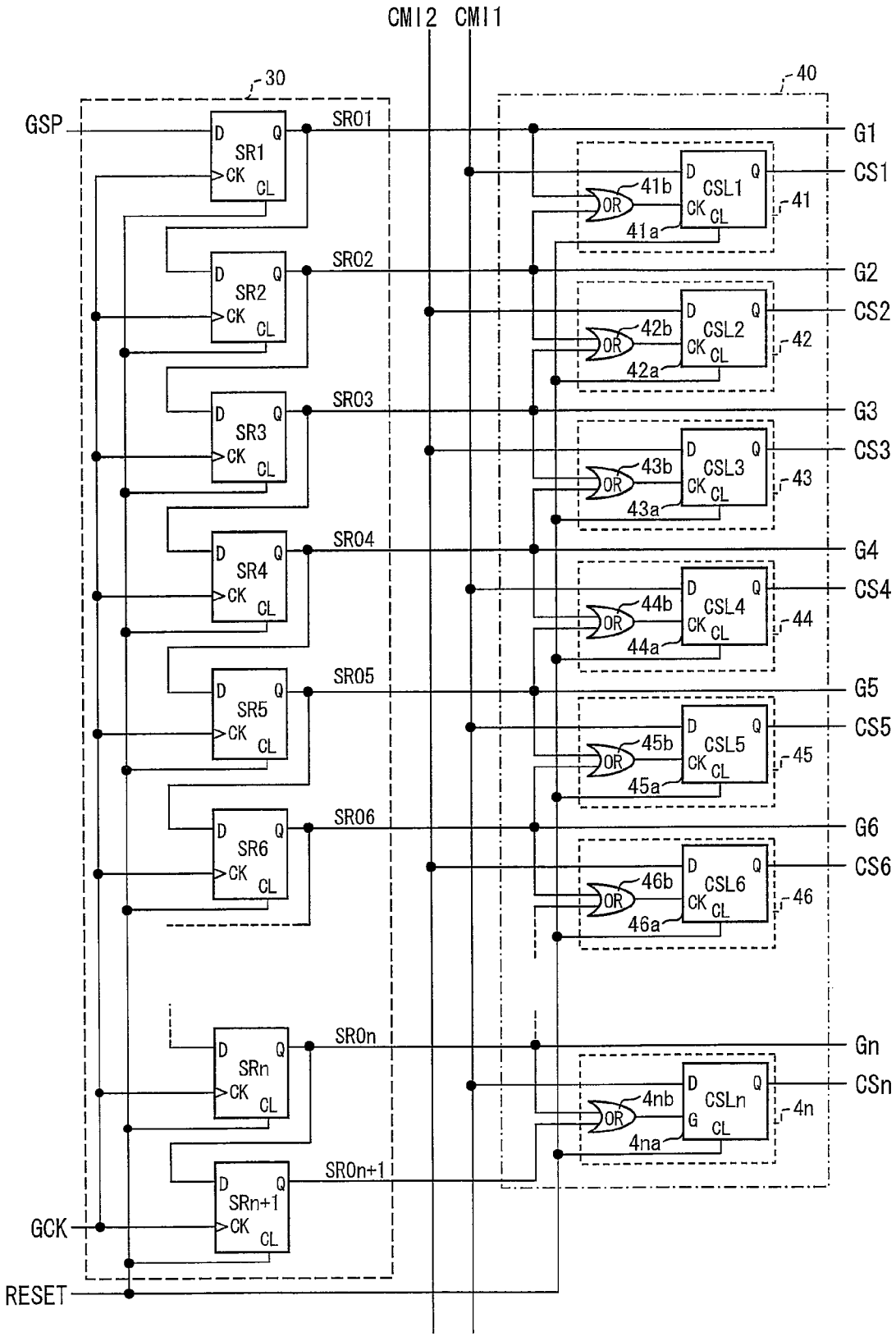
FIG. 29 is a block diagram illustrating configurations of a gate line driving circuit and a CS bus line driving circuit of Example 8.

FIG. 29 illustrates configurations of the gate line driving circuit 30 and the CS bus line driving circuit 40. The CS bus line driving circuit 40 includes a plurality of CS circuits 41, 42, 43, . . . , 4*n* which correspond to the respective rows. The plurality of CS circuits 41, 42, 43, . . . , 4*n* include respective D latch circuits 41*a*, 42*a*, 43*a*, . . . , 4*na* and respective OR circuits 41*b*, 42*b*, 43*b*, . . . , 4*nb*. The gate line driving circuit 30 includes a plurality of shift register circuits SR1, SR2, SR3, . . . , SRn. Note that the gate line driving circuit 30 and the CS bus line driving circuit 40 are provided on one end side of a liquid crystal display panel in FIG. 29. However, how to provide the gate line driving circuit 30 and the CS bus line driving circuit 40 is not limited to this. The gate line driving circuit 30 and the CS bus line driving circuit 40 may be provided on different sides of the liquid crystal display panel.

The CS circuit 41 receives the shift register output SRO1 and a shift register output SRO2 corresponding to the respective gate signals G1 and G2, a polarity signal CMI1, and a reset signal RESET. The CS circuit 42 receives the shift register output SRO2 and a shift register output SRO3 corresponding to the respective gate signals G2 and G3, a polarity signal CMI2, and the reset signal RESET. The CS circuit 43 receives the shift register output SRO3 and a shift register output SRO4 corresponding to the respective gate signals G3 and G4, the polarity signal CMI2, and the reset signal RESET. The CS circuit 44 receives the shift register output 51204 and a shift register output SRO5 corresponding to the respective gate signals G4 and G5, the polarity signal CMI1, and the reset signal RESET. As described earlier, each of the CS circuits receives a shift register output SROn of the corresponding nth row and a shift register output SROn+1 of the (n+1)th row following the nth row, and the polarity signals CMI1 and CMI2 are supplied to the CS circuits alternately every two rows. The polarity signals CMI1 and CMI2 and the reset signal RESET are supplied from the control circuit 50.

Figure 30:
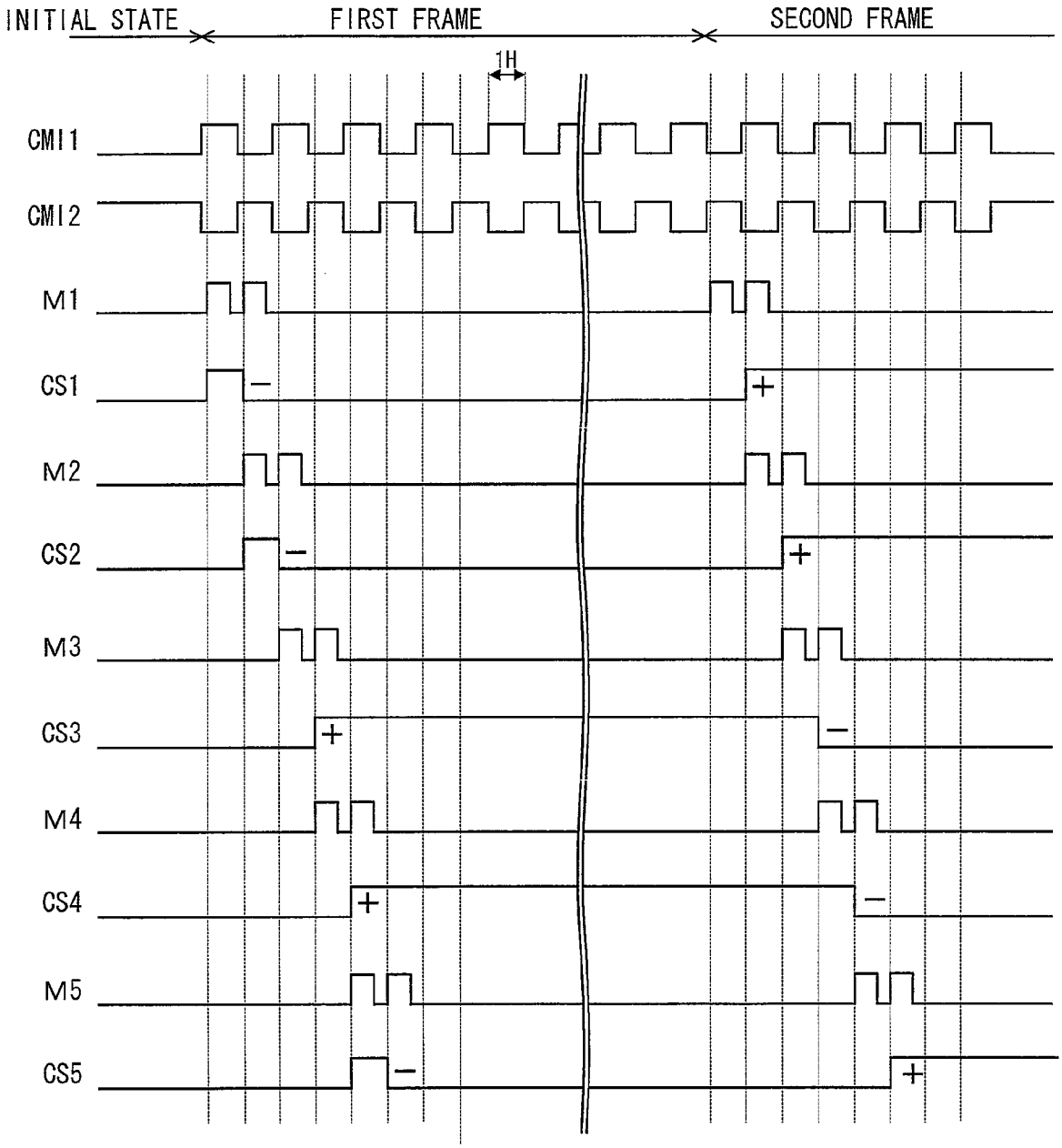
FIG. 30 illustrates waveforms of respective signals supplied to/from a CS bus line driving circuit of the liquid crystal display device 3 of Example 8.

For convenience, the following description mainly takes, as an example, the CS circuits 42 and 43 corresponding to the respective second and third rows. FIG. 30 illustrates waveforms of respective signals supplied to/from the CS bus line driving circuit 40 of the liquid crystal display device 3 of Example 8.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level.

Subsequently, the shift register output SRO3 which has been shifted to the third row in the gate line driving circuit 30 is supplied to the other terminal of the OR circuit 42*b*. Note that the shift register output SRO3 is also supplied to one terminal of the OR circuit 43*b* of the CS circuit 43.

A change in electric potential level (from low level to high level) of the shift register output SRO3 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO3 occurs. The D latch circuit 42*a* outputs a low level until a change in electric potential level (from high level to low level) of the shift register output SRO3 occurs in the signal M2 to be supplied to the clock terminal CK (during a period in which the signal M2 is at a high level). Next, when the change in electric potential level (from high level to low level) of the shift register output SRO3 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

In the second frame, during a period in which the shift register output SRO2 is at a high level in the signal M2, after the D latch circuit 42*a* transfers an input state (a low level) of the polarity signal CMI2 which input state is supplied to the data terminal D, the D latch circuit 42*a* latches an input state (a low level) of the polarity signal CMI2, the input state being obtained when a change in electric potential level (from high level to low level) of the shift register output SRO2 is supplied to the clock terminal CK. Then, the low level is maintained until the next time the signal M2 becomes at a high level.

Next, a change in electric potential level (from low level to high level) of the shift register output SRO3 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO3 occurs. The D latch circuit 42*a* outputs a high level until a change in electric potential level (from high level to low level) of the shift register output SRO3 to be supplied to the clock terminal CK occurs (during a period in which the signal M2 is at a high level). Next, when the change in electric potential level (from high level to low level) of the shift register output SRO3 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level in the third frame.

Note that in the first row, the CS signal CS1 illustrated in FIG. 30 is outputted by causing the shift register outputs SRO1 and SRO2 to latch the polarity signal CMI1.

Next, a change in waveforms of respective signals of the third row is to be described. In the initial state, the polarity signal CMI2 is supplied to the data terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI2 which input state is supplied to the data terminal D when the change occurs, i.e., a low level. The D latch circuit 43*a* outputs a low level until the next time a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI2 which input state is obtained when the change occurs, i.e., a low level. Then, the low level is maintained until the signal M3 becomes at a high level.

Subsequently, the shift register output SRO4 which has been shifted to the fourth row in the gate line driving circuit 30 is supplied to the other terminal of the OR circuit 43*b*. Note that the shift register output SRO4 is also supplied to one terminal of the OR circuit 44*b* of the CS circuit 44.

A change in electric potential level (from low level to high level) of the shift register output SRO4 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a high level. Namely, the electric potential of the CS signal CS3 changes from a low level to a high level when the change in electric potential level (from low level to high level) of the shift register output SRO4 occurs. The D latch circuit 43*a* outputs a high level until the next time a change in electric potential level (from high level to low level) of the shift register output SRO4 occurs in the signal M3 to be supplied to the clock terminal CK (during a period in which the signal M3 is at a high level). Next, when the change in electric potential level (from high level to low level) of the shift register output SRO4 in the signal M3 is supplied to the clock terminal CK, the D latch circuit 43*a* latches an input state of the polarity signal CMI2 which input state is obtained when the change occurs, i.e., a high level. Then, the high level is maintained until the signal M3 becomes at a high level in the second frame.

In the second frame, during a period in which the shift register output SRO3 is at a high level in the signal M3, after the D latch circuit 43*a* transfers an input state (a high level) of the polarity signal CMI2 which input state is supplied to the data terminal D, the D latch circuit 43*a* latches an input state (a high level) of the polarity signal CMI2, the input state being obtained when a change in electric potential level (from high level to low level) of the shift register output SRO3 is supplied to the clock terminal CK. Then, the high level is maintained until the next time the signal M3 becomes at a high level.

Next, a change in electric potential level (from low level to high level) of the shift register output SRO4 is supplied to the clock terminal CK of the D latch circuit 43*a*, and the D latch circuit 43*a* transfers an input state of the polarity signal CMI2 which input state is supplied to the terminal D when the change occurs, i.e., a low level. Namely, the electric potential of the CS signal CS3 changes from a high level to a low level when the change in electric potential level (from low level to high level) of the shift register output SRO4 occurs.

The D latch circuit 43*a* outputs a low level until the next time a change in electric potential level (from high level to low level) of the shift register output SRO4 to be supplied to the clock terminal CK occurs (during a period in which the signal M3 is at a high level). Next, when the change in electric potential level (from high level to low level) of the shift register output SRO4 is supplied to the clock terminal CK, the D latch circuit 43*a* latches an input state of the polarity signal CMI2 which input state is obtained when the change occurs, i.e., a low level. Then, the low level is maintained until the signal M3 becomes at a high level in the third frame.

Note that in the fourth row, the CS signal CS4 illustrated in FIG. 30 is outputted by causing the shift register outputs SRO4 and SRO5 to latch the polarity signal CMI1.

As described earlier, in 2H reversal driving, for each frame, it is possible to cause the CS circuits 41, 42, 43, . . . , 4*n* which correspond to the respective rows to change, between high and low levels, an electric potential level of the CS signal between when the gate signal of each row falls (when the TFT 13 in an ON state is turned off) and after the gate signal of the each row has fallen.

Namely, according to Example 8, a CS signal CSn to be supplied to a CS bus line 15 of the nth row is generated by latching (i) an electric potential level of the polarity signal CMI1 which level is obtained when a gate signal Gn of the nth row rises and (ii) an electric potential level of the polarity signal CMI1 which level is obtained when a gate signal G(n+1) of the (n+1)th row rises, and a CS signal CSn+1 to be supplied to a CS bus line 15 of the (n+1)th row is generated by latching (i) an electric potential level of the polarity signal CMI1 which level is obtained when the gate signal G(n+1) of the (n+1)th row rises and (ii) an electric potential level of the polarity signal CMI1 which level is obtained when a gate signal G(n+2) of the (n+2)th row rises. A CS signal CSn+2 to be supplied to a CS bus line 15 of the (n+2)th row is generated by latching (i) an electric potential level of the polarity signal CMI2 which level is obtained when the gate signal G(n+2) of the (n+2)th row rises and (ii) an electric potential level of the polarity signal CMI2 which level is obtained when a gate signal G(n+3) of the (n+3)th row rises, and a CS signal CS(n+3) to be supplied to a CS bus line 15 of the (n+3)th row is generated by latching (i) an electric potential level of the polarity signal CMI2 which level is obtained when the gate signal G(n+3) of the (n+3)th row rises and (ii) an electric potential level of the polarity signal CMI2 which level is obtained when a gate signal G(n+4) of the (n+4)th row rises.

This allows the CS bus line driving circuit 40 to operate properly in the first frame also in 2H reversal driving. Therefore, it is possible to remove irregular waveforms which are described above and serve as a cause for lateral stripes in the first frame and to yield an effect of preventing lateral stripes of light and shade which stripes are produced in a display video in the first frame, so as to enhance a display quality.

Figure 31:
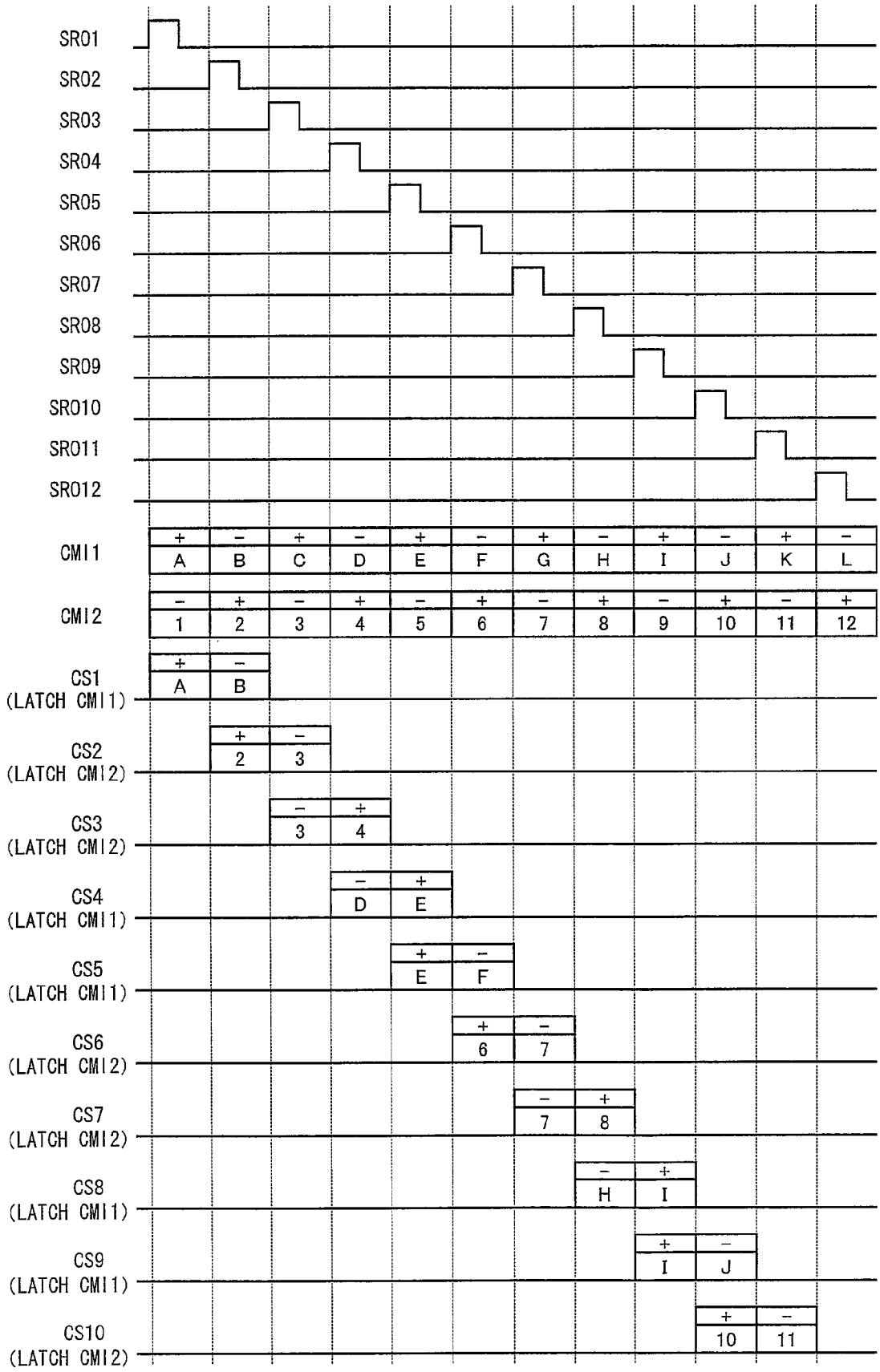
FIG. 31 illustrates how (i) a polarity signal and a shift register output each of which is supplied to a CS circuit of Example 8 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 31 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 31, signs A through L correspond to respective one horizontal scanning periods and indicate polarities (positive polarities or negative polarities) of the respective one horizontal scanning periods. For example, CMI1 has a negative polarity during the second horizontal scanning period "B", has a positive polarity during the third horizontal scanning period "C", has a negative polarity during the fourth horizontal scanning period "D", and has a positive polarity during the fifth horizontal scanning period "E". As for CMI2, signs 1 through 12 correspond to respective one horizontal scanning periods and indicate polarities of the respective one horizontal scanning periods. For example, CMI2 has a negative polarity during the first horizontal scanning period "1", has a positive polarity during the second horizontal scanning period "2", has a negative polarity during the third horizontal scanning period "3", and has a positive polarity during the fourth horizontal scanning period "4". As described earlier, the polarities of respective of CMI1 and CMI2 are reversed every one horizontal scanning period and are opposite to each other. CMI1 and CMI2 are supplied to the CS circuit 4*n* alternately every two rows. For example, CMI1 is supplied to the CS circuit 41, CMI2 is supplied to the CS circuit 42, CMI2 is supplied to the CS circuit 43, CMI1 is supplied to the CS circuit 44, and CMI1 is supplied to the CS circuit 45 (see FIG. 29).

According to the CS circuit 4*n*, since the shift register output SROn of the nth row and the shift register output SROn+1 of the (n+1)th row following the nth row are supplied to the clock terminal CK, (i) CMI1 (or CMI2) to be supplied to the data terminal D during the nth horizontal scanning period and (ii) CMI1 (or CMI2) to be supplied to the data terminal D during the (n+1)th horizontal scanning period are latched. For example, the CS circuit 41 loads (i) a positive polarity of "A" of CMI1 during the first horizontal scanning period and (ii) a negative polarity of "B" of CMI1 during the second horizontal scanning period. The CS circuit 42 loads (i) a positive polarity of "2" of CMI2 during the second horizontal scanning period and (ii) a negative polarity of "3" of CMI2 during the third horizontal scanning period. The CS circuit 43 loads (i) a negative polarity of "3" of CMI2 during the third horizontal scanning period and (ii) a positive polarity of "4" of CMI2 during the fourth horizontal scanning period. The CS circuit 44 loads (i) a negative polarity of "D" of CMI1 during the fourth horizontal scanning period and (ii) a positive polarity of "E" of CMI1 during the fifth horizontal scanning period. Each of the CS signals CSn illustrated in FIGS. 28 and 30 is thus outputted.

Example 9

Figure 32:
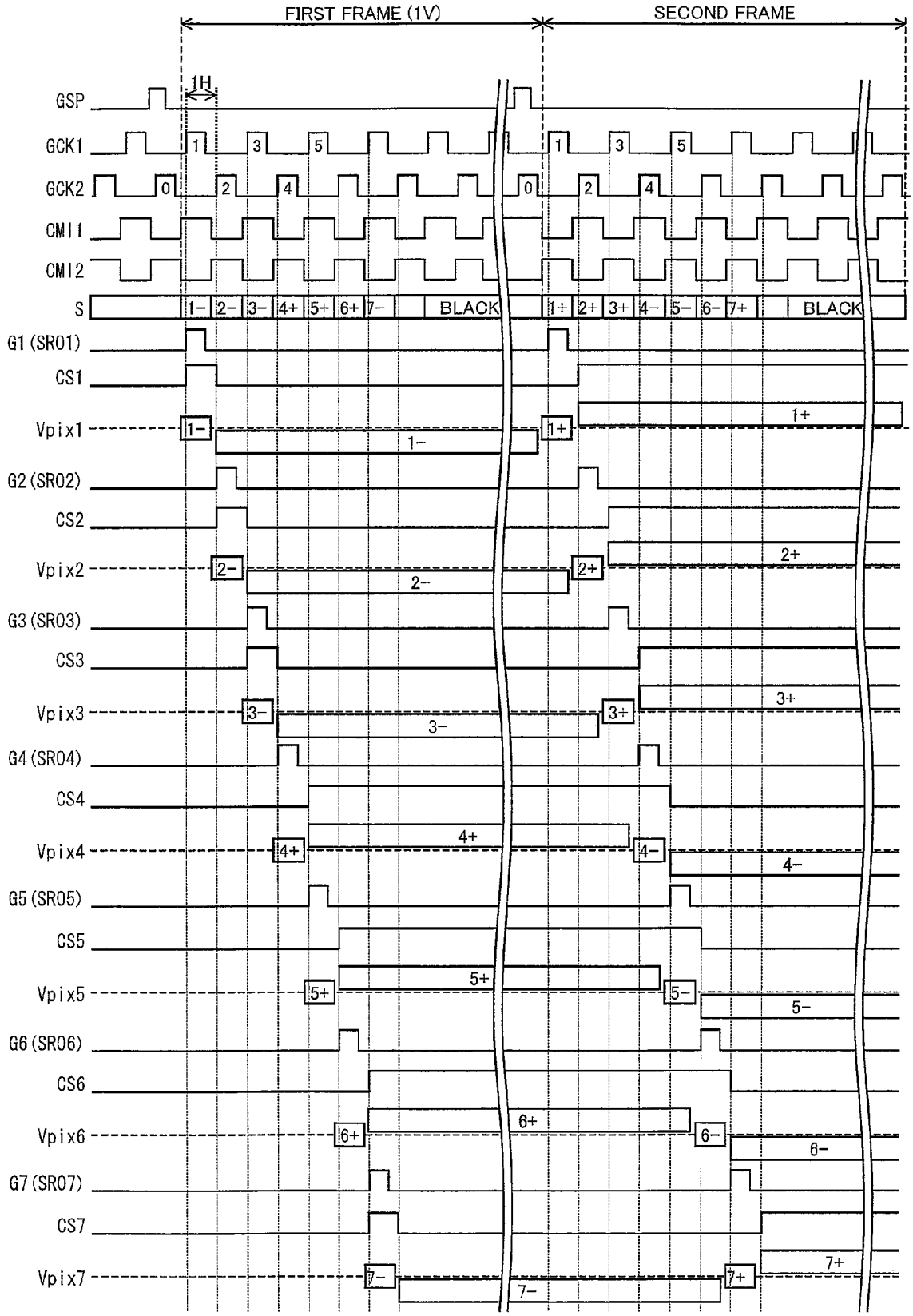
FIG. 32 is a timing chart illustrating waveforms of respective signals, the waveforms being obtained in a case where 3-line (3H) reversal driving is carried out in a liquid crystal display device 3 of Example 9.

FIG. 32 is a timing chart illustrating waveforms of respective signals of the liquid crystal display device 3 which carries out 3-line (3H) reversal driving. In FIG. 32, as in the case of Example 8, the polarity signals CMI1 and CMI2 are set so that their respective polarities are reversed every one horizontal scanning period (1H) and the polarities are opposite to each other.

In the initial state, each of the CS signals CS1 through CS7 is fixed at an electric potential having one level (a low level in FIG. 32) (see FIG. 32). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 32 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 33:
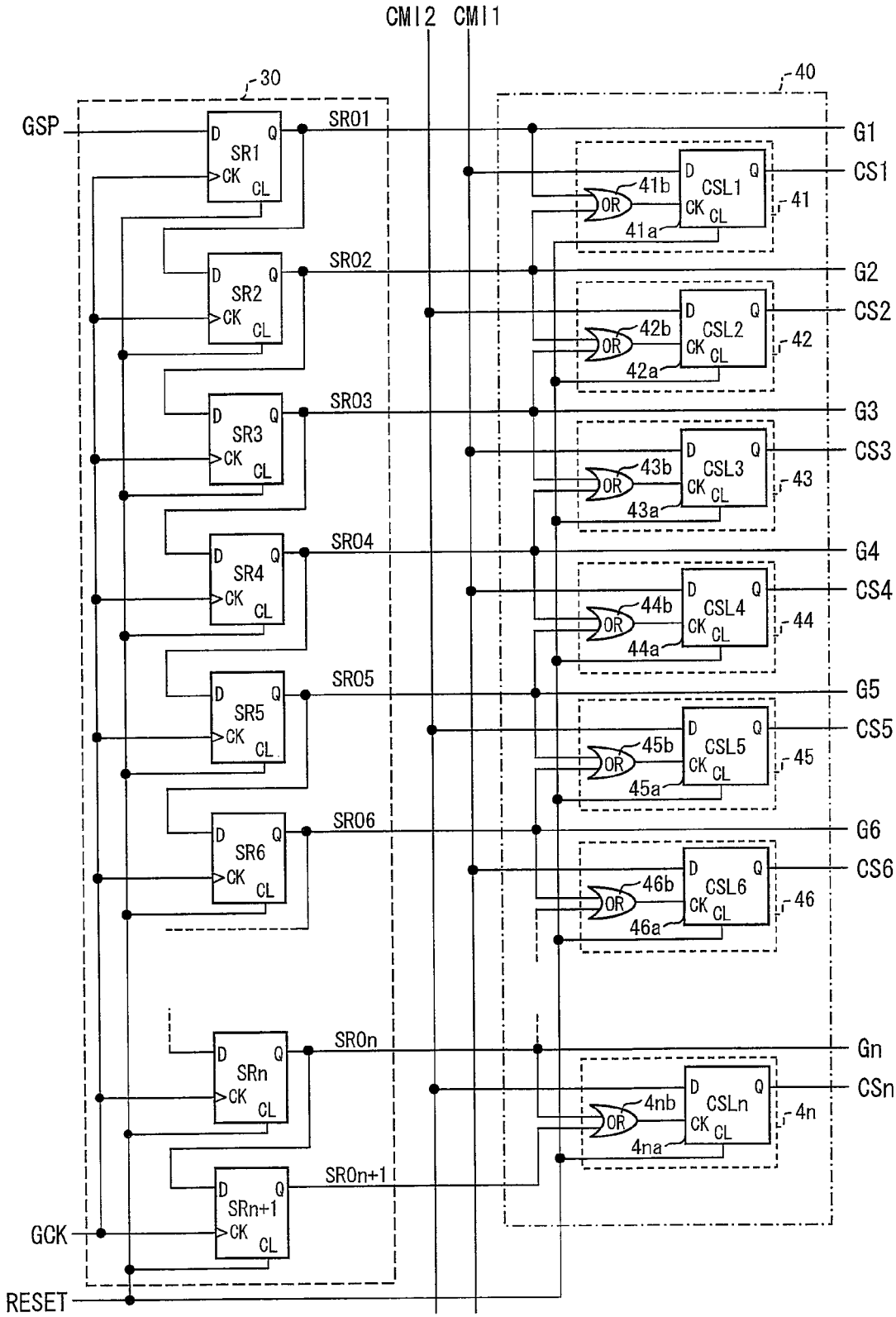
FIG. 33 is a block diagram illustrating configurations of a gate line driving circuit and a CS bus line driving circuit of Example 9.

FIG. 33 illustrates configurations of the gate line driving circuit 30 and the CS bus line driving circuit 40. The CS circuit 41 receives a shift register output SRO1 and a shift register output SRO2 corresponding to the respective gate signals G1 and G2, a polarity signal CMI1, and a reset signal RESET. The CS circuit 42 receives the shift register output SRO2 and a shift register output SRO3 corresponding to the respective gate signals G2 and G3, a polarity signal CMI2, and the reset signal RESET. The CS circuit 43 receives the shift register output SRO3 and a shift register output SRO4 corresponding to the respective gate signals G3 and G4, the polarity signal CMI1, and the reset signal RESET. The CS circuit 44 receives the shift register output SRO4 and a shift register output SRO5 corresponding to the respective gate signals G4 and G5, the polarity signal CMI1, and the reset signal RESET. As described earlier, each of the CS circuits receives a shift register output SROn of the corresponding nth row and a shift register output SROn+1 of the (n+1)th row following the nth row, and the polarity signals CMI1 and CMI2 are supplied to the CS circuits regularly (from the nth row in the order of CMI1, CMI2, CMI1, CMI1, CMI2, and CMI1). The polarity signals CMI1 and CMI2 and the reset signal RESET are supplied from the control circuit 50.

Figure 34:
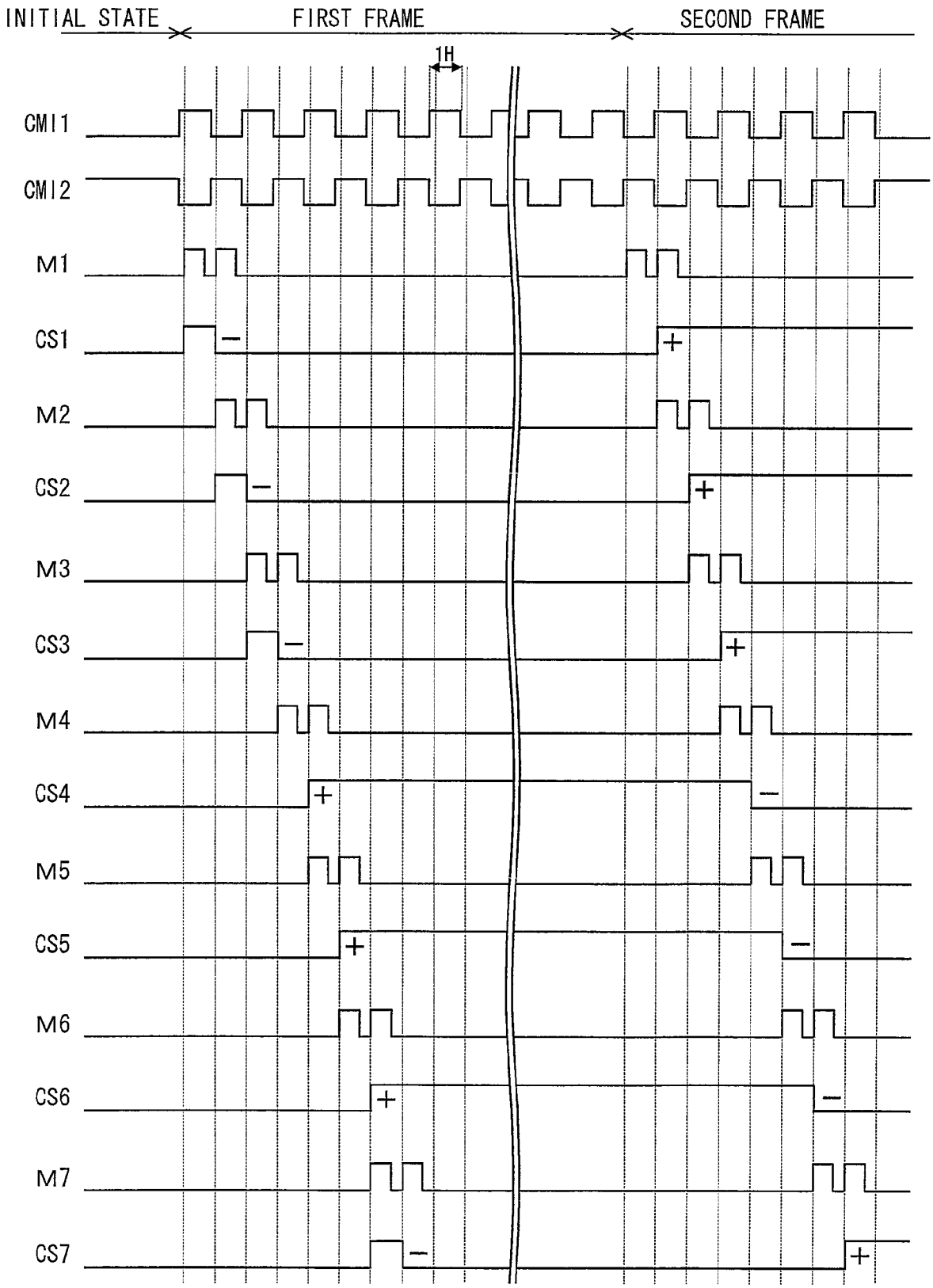
FIG. 34 illustrates waveforms of respective signals supplied to/from a CS bus line driving circuit of the liquid crystal display device 3 of Example 9.

For convenience, the following description mainly takes, as an example, the CS circuits 42, 43, and 44 corresponding to the respective second through fourth rows. FIG. 34 illustrates waveforms of respective signals supplied to/from the CS bus line driving circuit 40 of the liquid crystal display device 3 of Example 9.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level.

Subsequently, the shift register output SRO3 which has been shifted to the third row in the gate line driving circuit 30 is supplied to the other terminal of the OR circuit 42*b*. Note that the shift register output SRO3 is also supplied to one terminal of the OR circuit 43*b* of the CS circuit 43.

A change in electric potential level (from low level to high level) of the shift register output SRO3 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO3 occurs. The D latch circuit 42*a* outputs a low level until a change in electric potential level (from high level to low level) of the shift register output SRO3 occurs in the signal M2 to be supplied to the clock terminal CK (during a period in which the signal M2 is at a high level). Next, when the change in electric potential level (from high level to low level) of the shift register output SRO3 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

In the second frame, during a period in which the shift register output SRO2 is at a high level in the signal M2, after the D latch circuit 42*a* transfers an input state (a low level) of the polarity signal CMI2 which input state is supplied to the data terminal D, the D latch circuit 42*a* latches an input state (a low level) of the polarity signal CMI2, the input state being obtained when a change in electric potential level (from high level to low level) of the shift register output SRO2 is supplied to the clock terminal CK. Then, the low level is maintained until the next time the signal M2 becomes at a high level.

Next, a change in electric potential level (from low level to high level) of the shift register output SRO3 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO3 occurs. The D latch circuit 42*a* outputs a high level until a change in electric potential level (from high level to low level) of the shift register output 51203 to be supplied to the clock terminal CK occurs (during a period in which the signal M2 is at a high level). Next, when the change in electric potential level (from high level to low level) of the shift register output SRO2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level in the third frame.

Note that in the first row, the CS signal CS1 illustrated in FIG. 34 is outputted by causing the shift register outputs SRO1 and SRO2 to latch the polarity signal CMI1.

Next, a change in waveforms of respective signals of the third row is to be described. In the initial state, the polarity signal CMI1 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level.

Subsequently, the shift register output SRO4 which has been shifted to the fourth row in the gate line driving circuit 30 is supplied to the other terminal of the OR circuit 43*b*. Note that the shift register output SRO4 is also supplied to one terminal of the OR circuit 43*b* of the CS circuit 43.

A change in electric potential level (from low level to high level) of the shift register output SRO4 in the signal M3 is supplied to the clock terminal CK of the D latch circuit 43*a*, and the D latch circuit 43*a* transfers an input state of the polarity signal CMI1 which input state is supplied to the terminal D when the change occurs, i.e., a low level. Namely, the electric potential of the CS signal CS3 changes from a high level to a low level when the change in electric potential level (from low level to high level) of the shift register output SRO4 occurs. The D latch circuit 43*a* outputs a low level until a change in electric potential level (from high level to low level) of the shift register output SRO4 occurs in the signal M3 to be supplied to the clock terminal CK (during a period in which the signal M3 is at a high level). Next, when the change in electric potential level (from high level to low level) of the shift register output SRO4 in the signal M3 is supplied to the clock terminal CK, the D latch circuit 43*a* latches an input state of the polarity signal CMI1 which input state is obtained when the change occurs, i.e., a low level. Then, the low level is maintained until the signal M3 becomes at a high level in the second frame.

In the second frame, during a period in which the shift register output SRO3 is at a high level in the signal M3, after the D latch circuit 43*a* transfers an input state (a low level) of the polarity signal CMI1 which input state is supplied to the data terminal D, the D latch circuit 43*a* latches an input state (a low level) of the polarity signal CMI1, the input state being obtained when a change in electric potential level (from high level to low level) of the shift register output SRO3 is supplied to the clock terminal CK. Then, the low level is maintained until the next time the signal M3 becomes at a high level.

Next, a change in electric potential level (from low level to high level) of the shift register output SRO4 is supplied to the clock terminal CK of the D latch circuit 43*a*, and the D latch circuit 43*a* transfers an input state of the polarity signal CMI1 which input state is supplied to the terminal D when the change occurs, i.e., a high level. Namely, the electric potential of the CS signal CS3 changes from a low level to a high level when the change in electric potential level (from low level to high level) of the shift register output SRO3 occurs. The D latch circuit 43*a* outputs a high level until a change in electric potential level (from high level to low level) of the shift register output SRO4 to be supplied to the clock terminal CK occurs (during a period in which the signal M3 is at a high level). Next, when the change in electric potential level (from high level to low level) of the shift register output SRO3 is supplied to the clock terminal CK, the D latch circuit 43*a* latches an input state of the polarity signal CMI1 which input state is obtained when the change occurs, i.e., a high level. Then, the high level is maintained until the signal M3 becomes at a high level in the third frame.

Next, a change in waveforms of respective signals of the fourth row is to be described. In the initial state, the polarity signal CMI1 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI1 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level.

Subsequently, the shift register output SRO5 which has been shifted to the fifth row in the gate line driving circuit 30 is supplied to the other terminal of the OR circuit 44*b*. Note that the shift register output SRO5 is also supplied to one terminal of the OR circuit 45*b* of the CS circuit 45.

A change in electric potential level (from low level to high level) of the shift register output SRO5 in the signal M4 is supplied to the clock terminal CK of the D latch circuit 44*a*, and the D latch circuit 44*a* transfers an input state of the polarity signal CMI1 which input state is supplied to the terminal D when the change occurs, i.e., a high level. Namely, the electric potential of the CS signal CS4 changes from a low level to a high level when the change in electric potential level (from low level to high level) of the shift register output SRO5 occurs. The D latch circuit 44*a* outputs a high level until the next time a change in electric potential level (from high level to low level) of the shift register output SRO5 occurs in the signal M4 to be supplied to the clock terminal CK (during a period in which the signal M4 is at a high level). Next, when the change in electric potential level (from high level to low level) of the shift register output SRO5 in the signal M4 is supplied to the clock terminal CK, the D latch circuit 44*a* latches an input state of the polarity signal CMI1 which input state is obtained when the change occurs, i.e., a high level. Then, the high level is maintained until the signal M4 becomes at a high level in the second frame.

In the second frame, during a period in which the shift register output SRO4 is at a high level in the signal M4, after the D latch circuit 44*a* transfers an input state (a high level) of the polarity signal CMI1 which input state is supplied to the data terminal D, the D latch circuit 44*a* latches an input state (a high level) of the polarity signal CMI2, the input state being obtained when a change in electric potential level (from high level to low level) of the shift register output SRO4 is supplied to the clock terminal CK. Then, the high level is maintained until the next time the signal M4 becomes at a high level.

Next, a change in electric potential level (from low level to high level) of the shift register output SRO5 is supplied to the clock terminal CK of the D latch circuit 44*a*, and the D latch circuit 44*a* transfers an input state of the polarity signal CMI1 which input state is supplied to the terminal D when the change occurs, i.e., a low level. Namely, the electric potential of the CS signal CS4 changes from a high level to a low level when the change in electric potential level (from low level to high level) of the shift register output SRO5 occurs.

The D latch circuit 44*a* outputs a low level until the next time a change in electric potential level (from high level to low level) of the shift register output SRO5 to be supplied to the clock terminal CK occurs (during a period in which the signal M4 is at a high level). Next, when the change in electric potential level (from high level to low level) of the shift register output SRO5 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level in the third frame.

Note that in the fifth row, the CS signal CS5 illustrated in FIG. 34 is outputted by causing the shift register outputs SRO5 and SRO6 to latch the polarity signal CMI2.

As described earlier, according to Example 9, 3H reversal driving can be carried out in the liquid crystal display device 3 having the arrangement illustrated in FIG. 33 by adjusting how the polarity signals CMI1 and CMI2 and each of the CS circuits are connected. This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 35:
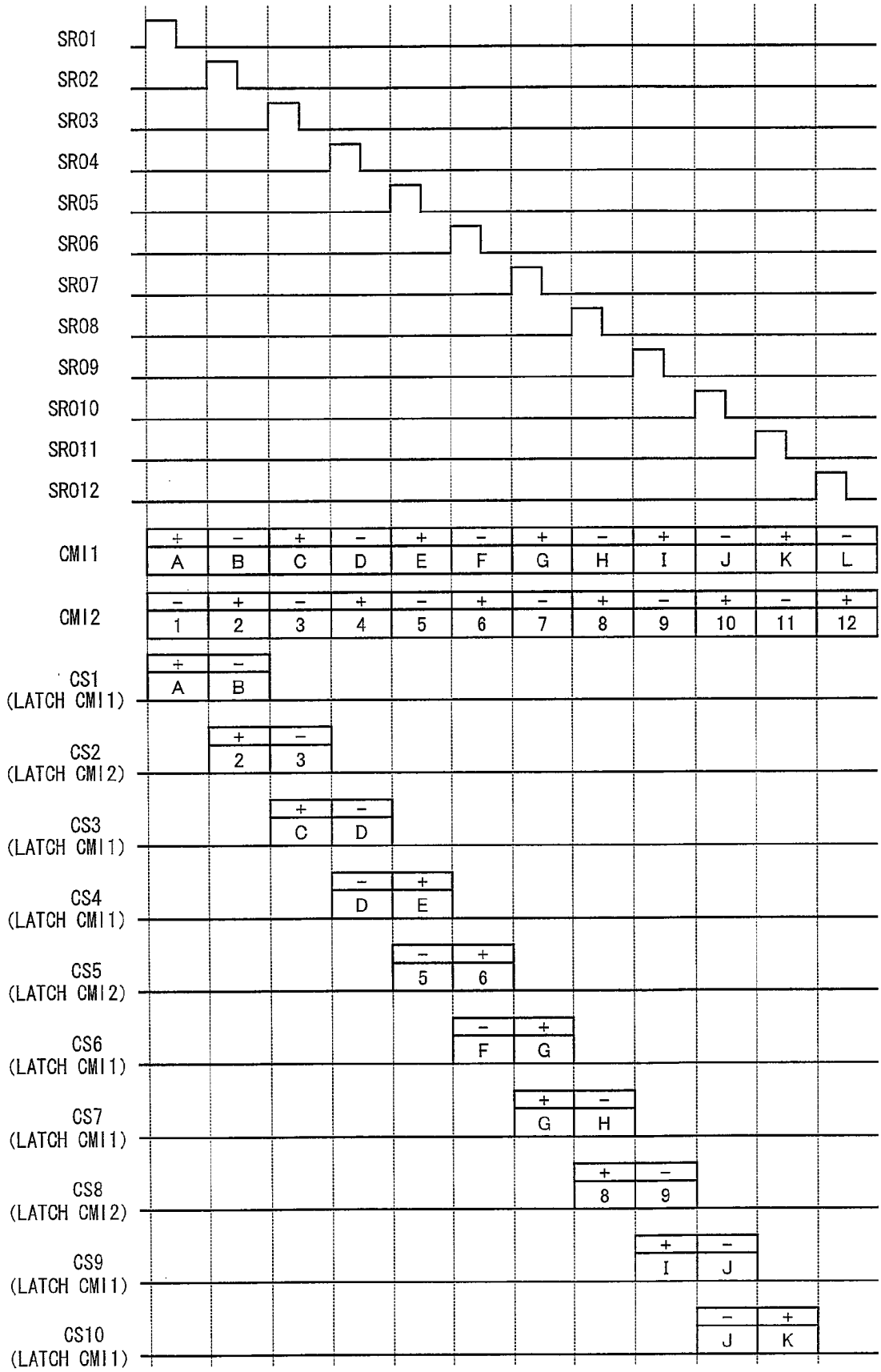
FIG. 35 illustrates how (i) a polarity signal and a shift register output each of which is supplied to a CS circuit of Example 9 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 35 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 35, signs A through L correspond to respective one horizontal scanning periods and indicate polarities (positive polarities or negative polarities) of the respective one horizontal scanning periods. For example, CMI1 has a negative polarity during the second horizontal scanning period "B", has a positive polarity during the third horizontal scanning period "C", has a negative polarity during the fourth horizontal scanning period "D", and has a positive polarity during the fifth horizontal scanning period "E". As for CMI2, signs 1 through 12 correspond to respective one horizontal scanning periods and indicate polarities of the respective one horizontal scanning periods. For example, CMI2 has a negative polarity during the first horizontal scanning period "1", has a positive polarity during the second horizontal scanning period "2", has a negative polarity during the third horizontal scanning period "3", and has a positive polarity during the fourth horizontal scanning period "4". As described earlier, the polarities of respective of CMI1 and CMI2 are reversed every one horizontal scanning period and are reversed to each other. For example, CMI1 and CMI2 are regularly supplied to each of the CS circuits (CMI1 to the CS circuit 41, CMI2 to the CS circuit 42, CMI1 to the CS circuit 43, CMI1 to the CS circuit 44, CMI2 to the CS circuit 45, and CMI1 to the CS circuit 46).

According to the CS circuit 4*n*, since the shift register output SROn of the nth row and the shift register output SROn+1 of the (n+1)th row are supplied to the clock terminal CK, (i) CMI to be supplied to the data terminal D during the nth horizontal scanning period and (ii) CMI to be supplied to the data terminal D during the (n+1)th horizontal scanning period are latched. For example, the CS circuit 41 loads (i) a positive polarity of "A" of CMI1 during the first horizontal scanning period and (ii) a negative polarity of "B" of CMI1 during the second horizontal scanning period. The CS circuit 42 loads (i) a positive polarity of "2" of CMI2 during the second horizontal scanning period and (ii) a negative polarity of "3" of CMI2 during the third horizontal scanning period. The CS circuit 43 loads (i) a positive polarity of "C" of CMI1 during the third horizontal scanning period and (ii) a negative polarity of "D" of CMI1 during the fourth horizontal scanning period. The CS circuit 44 loads (i) a negative polarity of "D" of CMI1 during the fourth horizontal scanning period and (ii) a positive polarity of "E" of CMI1 during the fifth horizontal scanning period. Each of the CS signals CSn illustrated in FIGS. 32 and 34 is thus outputted.

As described earlier in Examples 8 and 9, in a case where two polarity signals CMI1 and CMI2 are used which are different from each other in phase, 2H reversal driving and 3H reversal driving can be implemented. In a case where how the polarity signals CMI1 and CMI2 and the CS circuit 4*n* are connected is adjusted, 4H, . . . , nH (n-line) reversal driving can be similarly implemented.

Example 10

Figure 37:
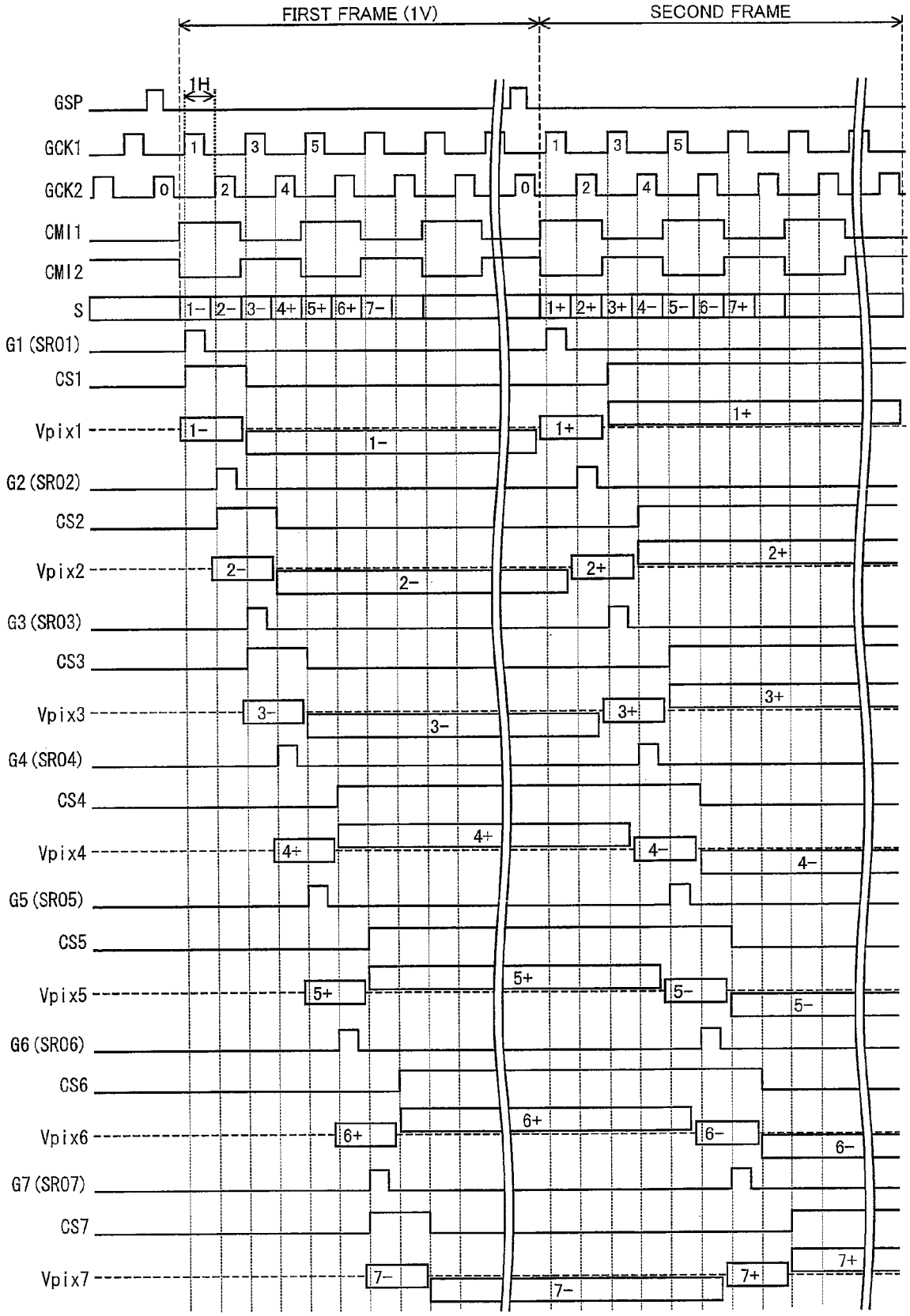
FIG. 37 is a timing chart illustrating waveforms of respective signals, the waveforms being obtained in a case where 3-line (3H) reversal driving is carried out in a liquid crystal display device 3 of Example 10.

Another liquid crystal display device 3 which carries out 3-line (3H) reversal driving is described below. FIG. 37 is a timing chart illustrating waveforms of respective signals of the another liquid crystal display device 3. Note that in FIG. 37, the polarity signals CMI1 and CMI2 are set so that their respective polarities are reversed every two horizontal scanning periods (2H) and the polarities are opposite to each other.

In the initial state, each of the CS signals CS1 through CS7 is fixed at an electric potential having one level (a low level in FIG. 37) (see FIG. 37). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 37 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

This removes lateral stripes of light and shade which stripes are produced in a display video in the first frame, so that, a display quality can be enhanced.

Specific configurations of the gate line driving circuit 30 and the CS bus line driving circuit 40 are described here for carrying out control described above.

Figure 36:
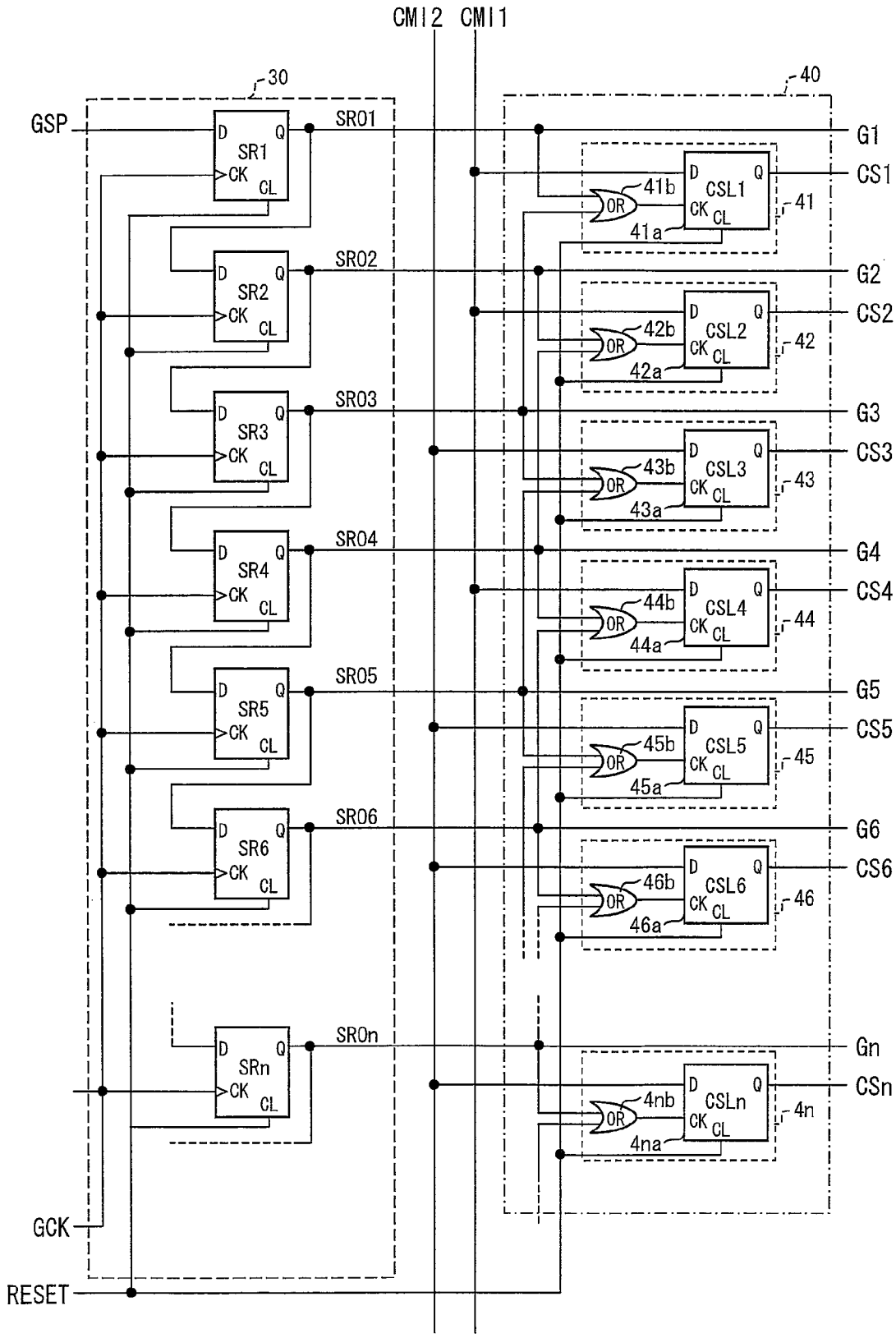
FIG. 36 is a block diagram illustrating configurations of a gate line driving circuit and a CS bus line driving circuit of Example 10.

FIG. 36 illustrates configurations of the gate line driving circuit 30 and the CS bus line driving circuit 40. Each of the CS circuits receives the shift register output SROn of the corresponding nth row and the shift register output SROn+2 of the (n+2)th row, and the polarity signal CMI1 or CMI2 is supplied to each of the CS circuits.

Figure 38:
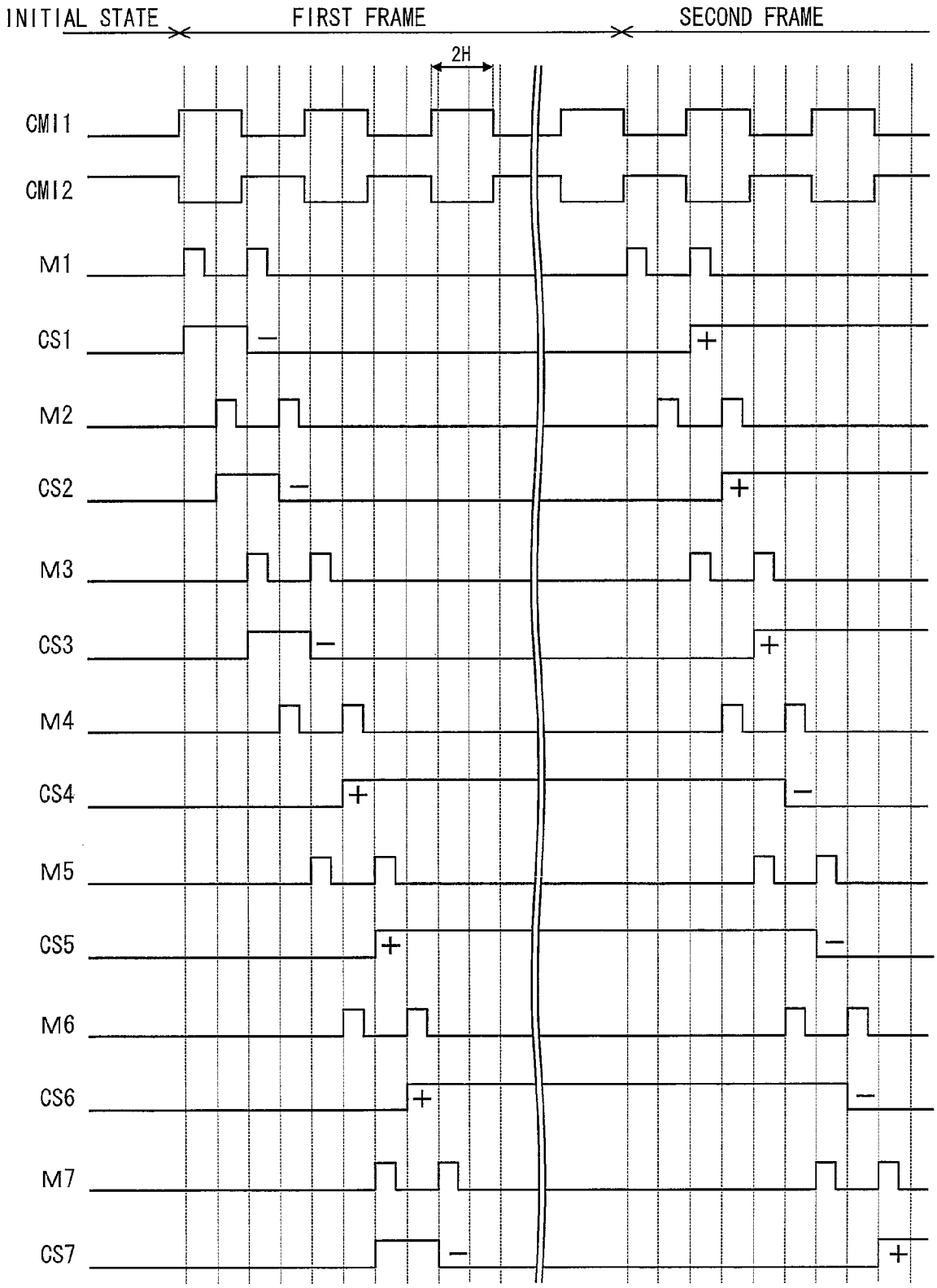
FIG. 38 illustrates waveforms of respective signals supplied to/from a CS bus line driving circuit of the liquid crystal display device 3 of Example 10.

A description of how the gate line driving circuit 30 and the CS bus line driving circuit 40 are connected is omitted here, and 3H reversal driving is described with reference to FIGS. 37 and 38. FIG. 38 illustrates waveforms of respective signals supplied to/from the CS bus line driving circuit 40 of the liquid crystal display device 3 of Example 10. For convenience, the following description takes, as an example, the CS circuits 42, 43, and 44 corresponding to the respective second through fourth rows, so as to discuss operation of the first frame.

First, a change in waveforms of respective signals of the second row is to be described. In the initial state, the polarity signal CMI1 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI1 which input state is obtained when the change occurs, i.e., a high level. Then, the high level is maintained until the signal M2 becomes at a high level.

Subsequently, the shift register output SRO4 which has been shifted to the fourth row in the gate line driving circuit 30 is supplied to the other terminal of the OR circuit 42*b*. Note that the shift register output SRO4 is also supplied to one terminal of the OR circuit 44*b* of the CS circuit 44.

A change in electric potential level (from low level to high level) of the shift register output SRO4 in the signal M2 is supplied to the clock terminal CK of the D latch circuit 42*a*, and the D latch circuit 42*a* transfers an input state of the polarity signal CMI1 which input state is supplied to the terminal D when the change occurs, i.e., a low level. Namely, the electric potential of the CS signal CS2 changes from a high level to a low level when the change in electric potential level (from low level to high level) of the shift register output SRO4 occurs. The D latch circuit 42*a* outputs a low level until a change in electric potential level (from high level to low level) of the shift register output SRO4 occurs in the signal M2 to be supplied to the clock terminal CK (during a period in which the signal M2 is at a high level). Next, when the change in electric potential level (from high level to low level) of the shift register output SRO4 in the signal M2 is supplied to the clock terminal CK, the D latch circuit 42*a* latches an input state of the polarity signal CMI1 which input state is obtained when the change occurs, i.e., a low level. Then, the low level is maintained until the signal M2 becomes at a high level in the second frame.

Note that in the first row, the CS signal CS1 illustrated in FIG. 38 is outputted by causing the shift register outputs SRO1 and SRO3 to latch the polarity signal CMI1.

Next, a change in waveforms of respective signals of the third row is to be described. In the initial state, the polarity signal CMI2 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI2 which input state is obtained when the change occurs, i.e., a high level. Then, the high level is maintained until the signal M3 becomes at a high level.

Subsequently, the shift register output SRO5 which has been shifted to the fifth row in the gate line driving circuit 30 is supplied to the other terminal of the OR circuit 43*b*. Note that the shift register output SRO5 is also supplied to one terminal of the OR circuit 45*b* of the CS circuit 45.

A change in electric potential level (from low level to high level) of the shift register output SRO5 in the signal M3 is supplied to the clock terminal CK of the D latch circuit 43*a*, and the D latch circuit 43*a* transfers an input state of the polarity signal CMI2 which input state is supplied to the terminal D when the change occurs, i.e., a low level. Namely, the electric potential of the CS signal CS3 changes from a high level to a low level when the change in electric potential level (from low level to high level) of the shift register output SRO5 occurs. The D latch circuit 43*a* outputs a low level until a change in electric potential level (from high level to low level) of the shift register output SRO5 occurs in the signal M3 to be supplied to the clock terminal CK (during a period in which the signal M3 is at a high level). Next, when the change in electric potential level (from high level to low level) of the shift register output SRO5 in the signal M3 is supplied to the clock terminal CK, the D latch circuit 43*a* latches an input state of the polarity signal CMI2 which input state is obtained when the change occurs, i.e., a low level. Then, the low level is maintained until the signal M3 becomes at a high level in the second frame.

Next, a change in waveforms of respective signals of the fourth row is to be described. In the initial state, the polarity signal CMI1 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI1 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level.

Subsequently, the shift register output SRO6 which has been shifted to the sixth row in the gate line driving circuit 30 is supplied to the other terminal of the OR circuit 44*b*. Note that the shift register output SRO6 is also supplied to one terminal of the OR circuit 46*b* of the CS circuit 46.

A change in electric potential level (from low level to high level) of the shift register output SRO6 in the signal M4 is supplied to the clock terminal CK of the D latch circuit 44*a*, and the D latch circuit 44*a* transfers an input state of the polarity signal CMI1 which input state is supplied to the terminal D when the change occurs, i.e., a high level. Namely, the electric potential of the CS signal CS4 changes from a low level to a high level when the change in electric potential level (from low level to high level) of the shift register output SRO6 occurs. The D latch circuit 44*a* outputs a high level until the next time a change in electric potential level (from high level to low level) of the shift register output SRO6 occurs in the signal M4 to be supplied to the clock terminal CK (during a period in which the signal M4 is at a high level). Next, when the change in electric potential level (from high level to low level) of the shift register output SRO6 in the signal M4 is supplied to the clock terminal CK, the D latch circuit 44*a* latches an input state of the polarity signal CMI1 which input state is obtained when the change occurs, i.e., a high level. Then, the high level is maintained until the signal M4 becomes at a high level in the second frame.

Note that in the fifth row, the CS signal CS5 illustrated in FIG. 38 is outputted by causing the shift register outputs SRO5 and SRO7 to latch the polarity signal CMI2.

This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 39:
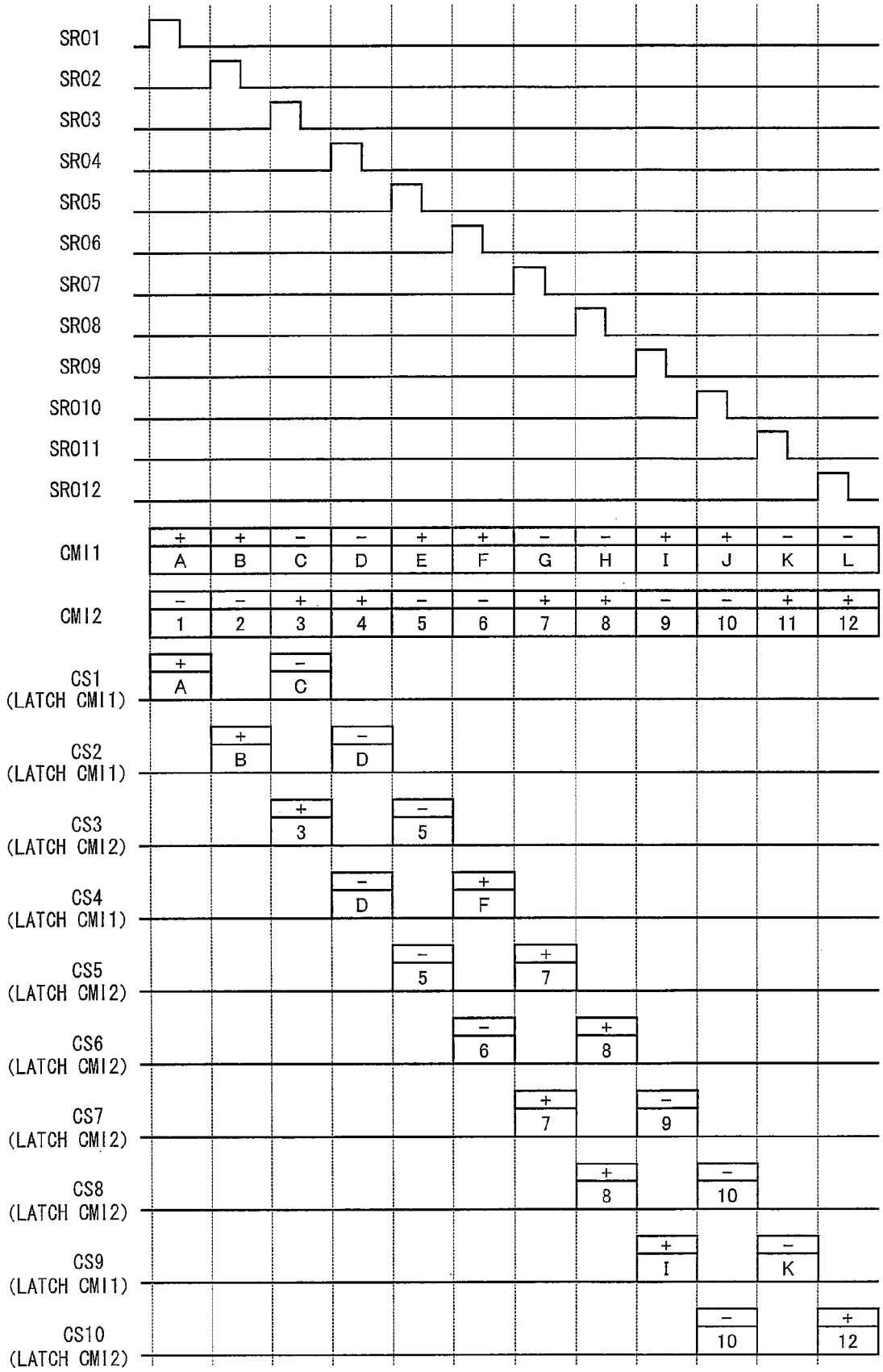
FIG. 39 illustrates how (i) a polarity signal and a shift register output each of which is supplied to a CS circuit of Example 10 and (ii) a CS signal which is supplied from the CS circuit correspond to each other.

A relationship between the polarity signal CMI1 or CMI2 and the shift register output SROn each of which is supplied to the CS circuit 4*n* is described here. FIG. 39 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other.

As for CMI1 of FIG. 16, signs A through L correspond to respective one horizontal scanning periods and indicate polarities of the respective one horizontal scanning periods. For example, CMI1 has a positive polarity during the second horizontal scanning period "B", has a negative polarity during the third horizontal scanning period "C", has a negative polarity during the fourth horizontal scanning period "D", and has a positive polarity during the fifth horizontal scanning period "E". As for CMI2, signs 1 through 12 correspond to respective one horizontal scanning periods and indicate polarities of the respective one horizontal scanning periods. For example, CMI2 has a negative polarity during the first horizontal scanning period "1", has a negative polarity during the second horizontal scanning period "2", has a positive polarity during the third horizontal scanning period "3", and has a positive polarity during the fourth horizontal scanning period "4". CMI1 and CMI2 are supplied to the CS circuit 4*n* in accordance with a given rule.

According to the CS circuit 4*n*, since the shift register output SROn of the nth row and the shift register output SROn+2 of the (n+2)th row are supplied to the clock terminal CK, (i) CMI to be supplied to the data terminal D during the nth horizontal scanning period and (ii) CMI to be supplied to the data terminal D during the (n+2)th horizontal scanning period are latched. For example, the CS circuit 41 loads (i) a positive polarity of "A" of CMI1 during the first horizontal scanning period and (ii) a positive polarity of "C" of CMI1 during the third horizontal scanning period. The CS circuit 42 loads (i) a positive polarity of "B" of CMI1 during the second horizontal scanning period and (ii) a negative polarity of "D" of CMI1 during the fourth horizontal scanning period. The CS circuit 43 loads (i) a positive polarity of "3" of CMI2 during the third horizontal scanning period and (ii) a negative polarity of "5" of CMI2 during the fifth horizontal scanning period. The CS circuit 44 loads (i) a negative polarity of "D" of CMI1 during the fourth horizontal scanning period and (ii) a positive polarity of "F" of CMI1 during the sixth horizontal scanning period. Each of the CS signals CSn illustrated in FIGS. 37 and 38 is thus outputted.

Example 11

The liquid crystal display device 3 which is described in Example 8 and carries out 2-line (2H) reversal driving may be arranged as below. Namely, the arrangement is such that the CS circuit 4*n* of the nth row receives the shift register output SROn of the corresponding nth row and the shift register output SROn+3 of the (n+3)th row.

Figure 40:
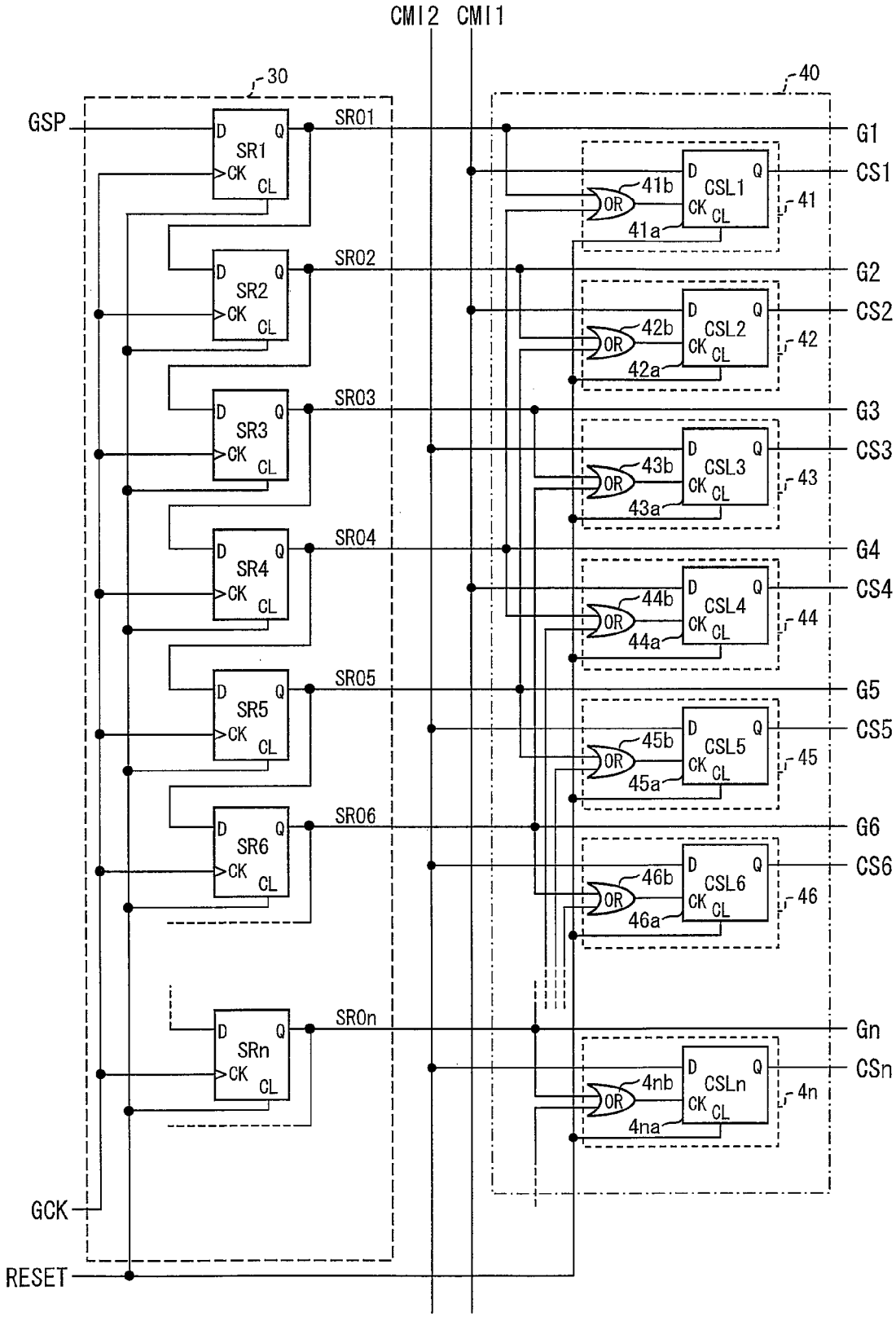
FIG. 40 is a block diagram illustrating configurations of a gate line driving circuit and a CS bus line driving circuit of Example 11.

FIG. 40 illustrates configurations of the gate line driving circuit 30 and the CS bus line driving circuit 40. For example, the OR circuit 42*b* of the CS circuit 42 receives the shift register output SRO2 and the shift register output SRO5 of the fifth row, and the polarity signal CMI1 is supplied to the terminal D of the D latch circuit 42*a*. The OR circuit 43*b* of the CS circuit 43 receives the shift register output SRO3 and the shift register output SRO6 of the sixth row, and the polarity signal CMI2 is supplied to the terminal D of the D latch circuit 43*a*.

Figure 41:
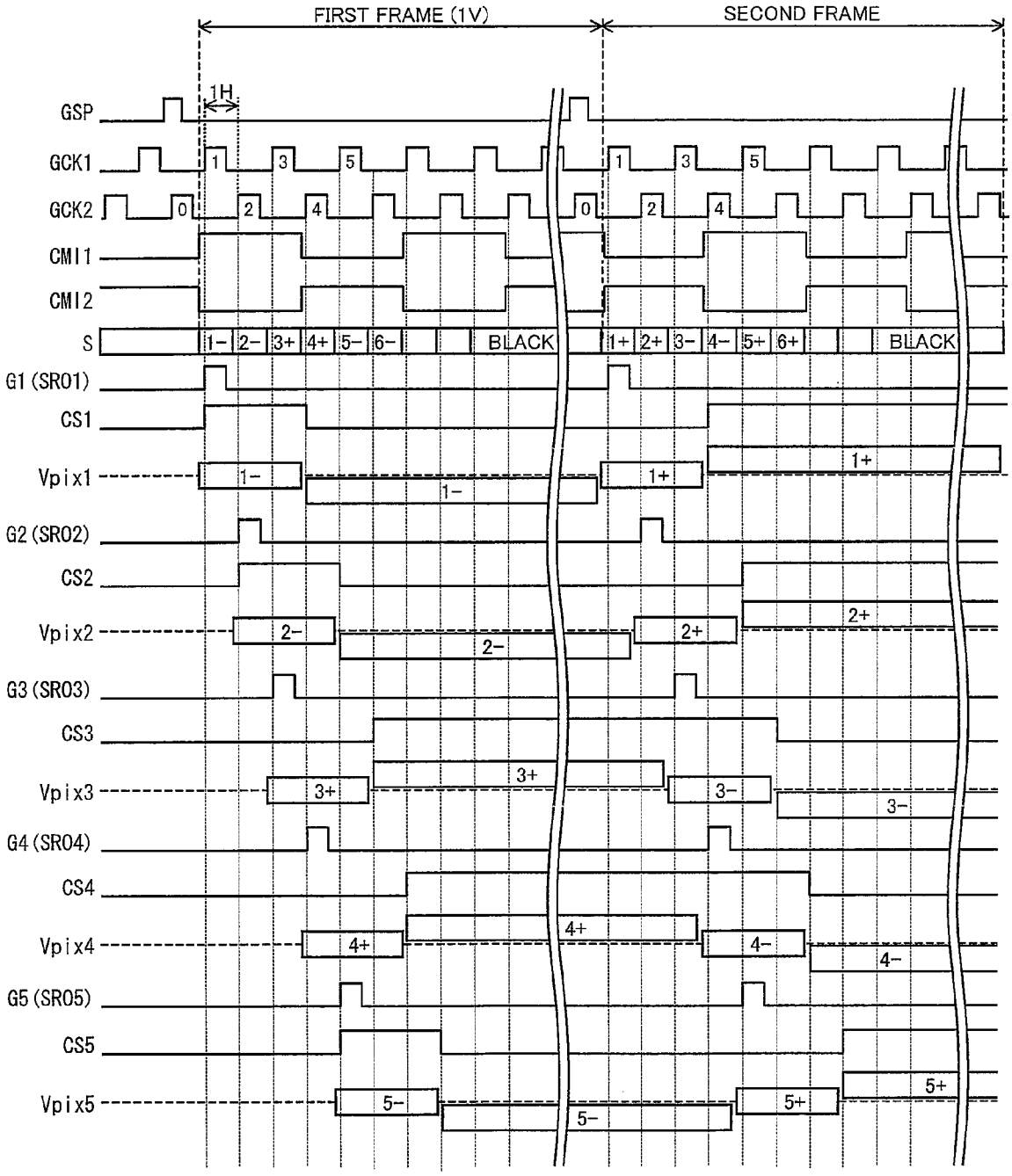
FIG. 41 is a timing chart illustrating waveforms of respective signals, the waveforms being obtained in a case where 3-line (3H) reversal driving is carried out in a liquid crystal display device 3 of Example 11.

FIG. 41 is a timing chart illustrating waveforms of respective signals of the liquid crystal display device 3 which has such an arrangement and carries out 2-line (2H) reversal driving. Note that the polarity signals CMI1 and CMI2 are set so that their respective polarities are reversed every two horizontal scanning periods (2H) and the polarities are opposite to each other.

Figure 42:
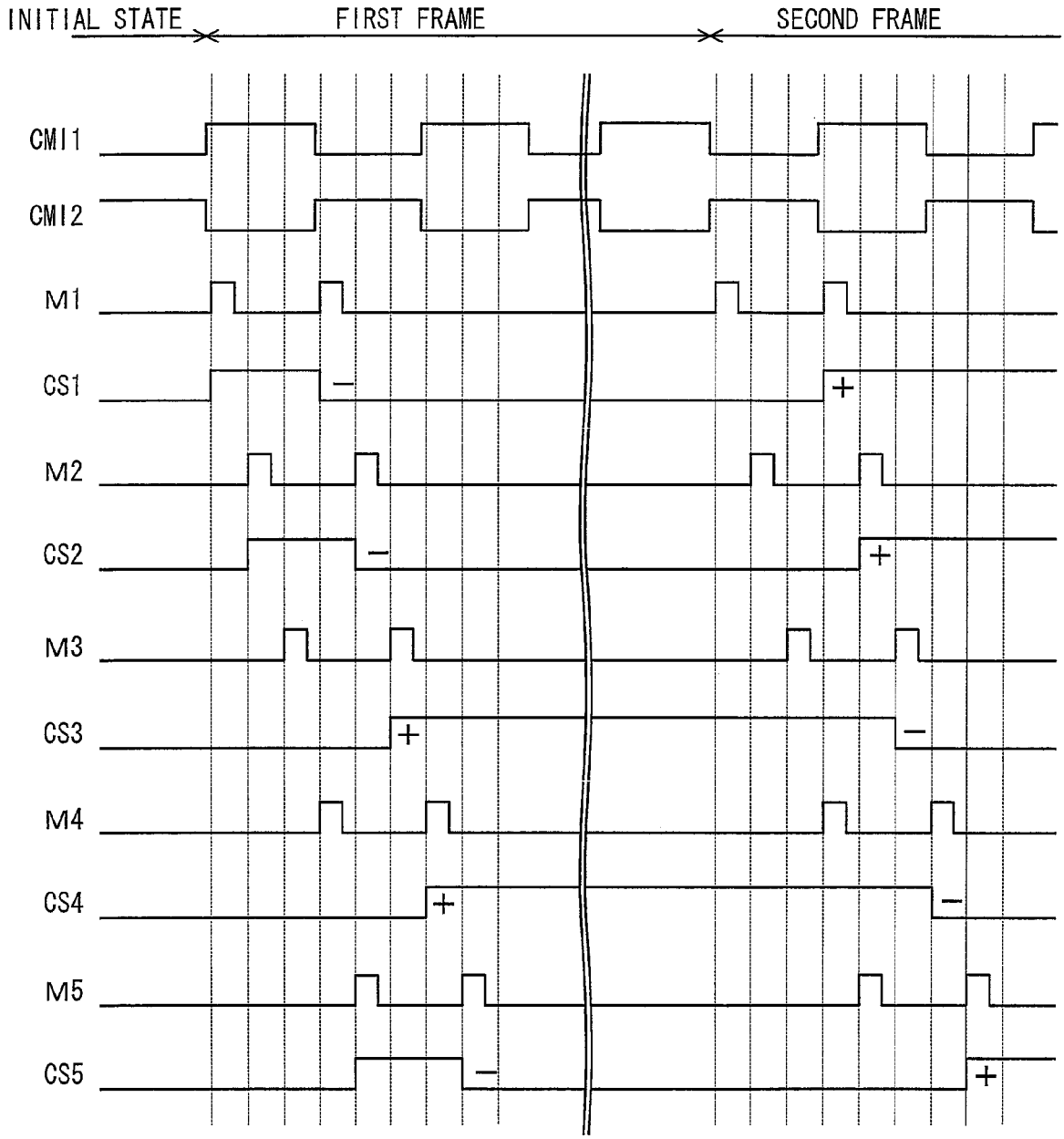
FIG. 42 illustrates waveforms of respective signals supplied to/from a CS bus line driving circuit of the liquid crystal display device 3 of Example 11.
Figure 43:
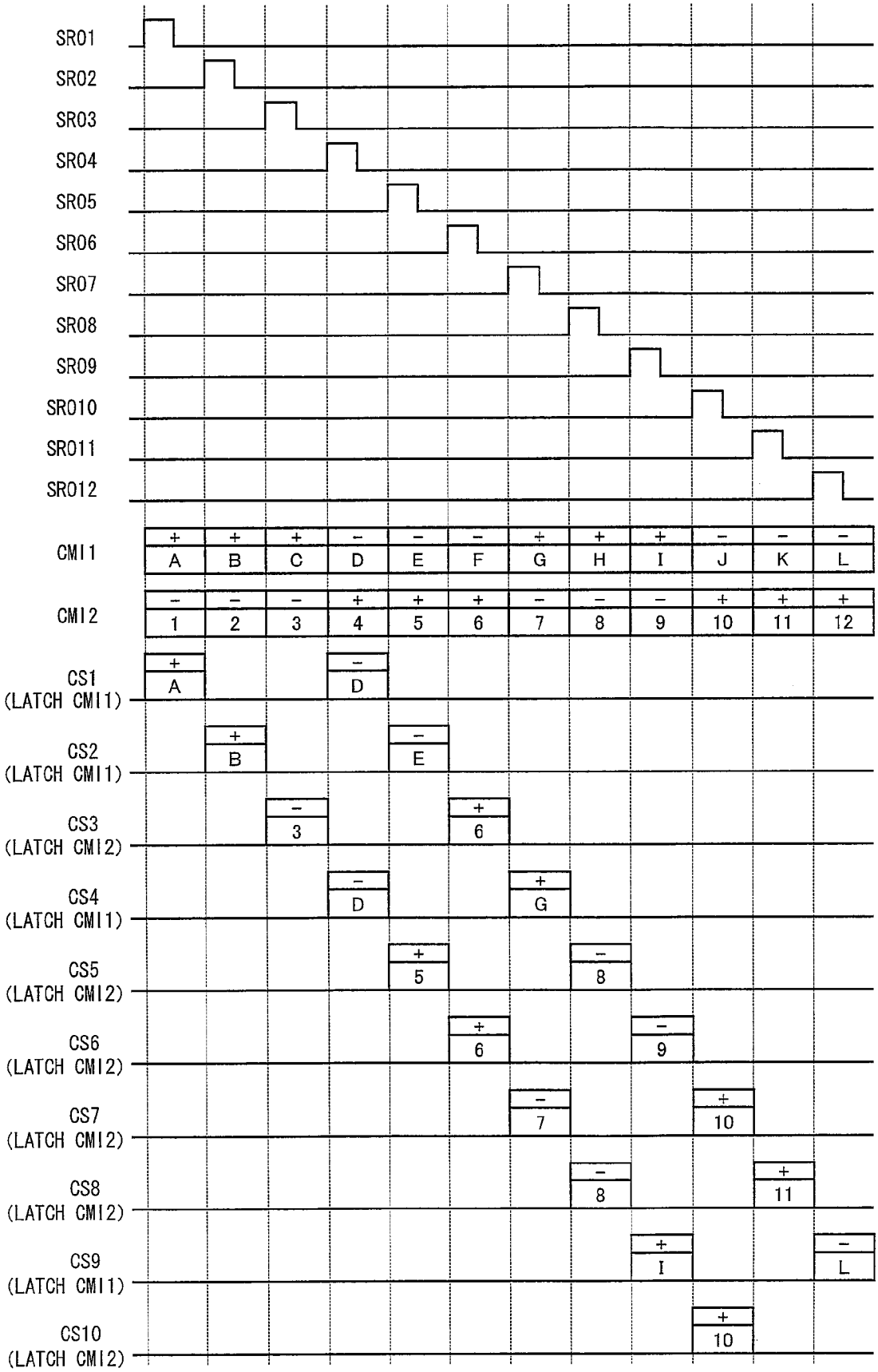
FIG. 43 illustrates how (i) a polarity signal and a shift register output each of which is supplied to a CS circuit of Example 11 and (ii) a CS signal which is supplied from the CS circuit correspond to each other.

FIG. 42 illustrates waveforms of respective signals supplied to/from the CS bus line driving circuit 40 of the liquid crystal display device 3 of Example 11. FIG. 43 illustrates how (i) the polarity signal CMI1 (or CMI2) and the shift register output SROn each of which is supplied to the CS circuit 4*n* and (ii) the CS signal CSn to be supplied from the CS circuit 4*n* correspond to each other. A description of operation of the CS circuit is omitted here since the operation is similar to that described earlier in each of the Examples (especially Example 5).

Embodiment 4

A fourth embodiment of the present invention is described below with reference to FIGS. 44 through 51. Note that, for convenience, members having functions identical to those of the respective members described in the First Embodiment are given respective identical reference numerals, and a description of those members is omitted here. Note also that terms defined in the First Embodiment are used also in the present examples in accordance with the definition unless otherwise noted.

A schematic arrangement of a liquid crystal display device 4 in accordance with the present embodiment is identical to that of the liquid crystal display device 1 illustrated in FIGS. 1 and 2. Accordingly, a description of the schematic arrangement of the liquid crystal display device 4 is omitted here. The following description specifically discusses a gate line driving circuit 30 and a CS bus line driving circuit 40 of the present embodiment. The liquid crystal display device 4 is provided with a plurality of signal lines for supplying a polarity signal CMI from a control circuit 50 (see FIG. 1) to the CS bus line driving circuit 40. In order to implement n-line reversal (nH) driving, in such an arrangement, the number of polarity signals CMI and a timing (a frequency) at which polarities of the respective polarity signals CMI are reversed are adjusted. The following description discusses a specific example.

Example 12

Figure 44:
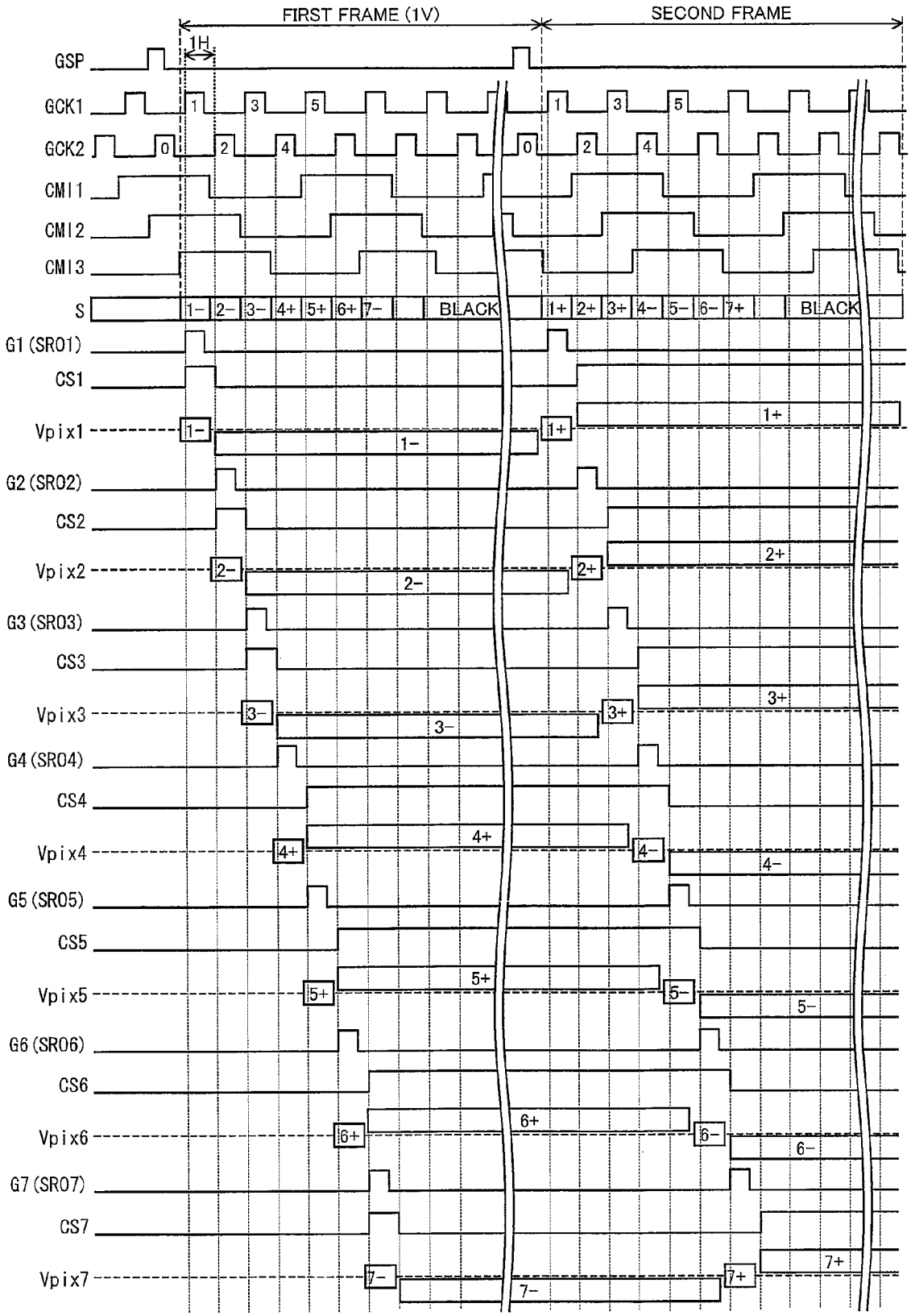
FIG. 44 is a timing chart illustrating waveforms of respective signals, the waveforms being obtained in a case where 3-line (3H) reversal driving is carried out in a liquid crystal display device 4 of Example 12.

FIG. 44 is a timing chart illustrating waveforms of respective signals of the liquid crystal display device 4 which carries out 3-line (3H) reversal driving. In FIG. 44, the polarity signals CMI1, CMI2, and CMI3 are set so that their respective polarities are reversed every three horizontal scanning periods (3H), phases of CMI1 and CMI2 are shifted by one horizontal scanning period (1H), and phases of CMI2 and CMI3 are shifted by one horizontal scanning period (1H).

In the initial state, each of the CS signals CS1 through CS7 is fixed at an electric potential having one level (a low level in FIG. 44) (see FIG. 44). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 44 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 45:
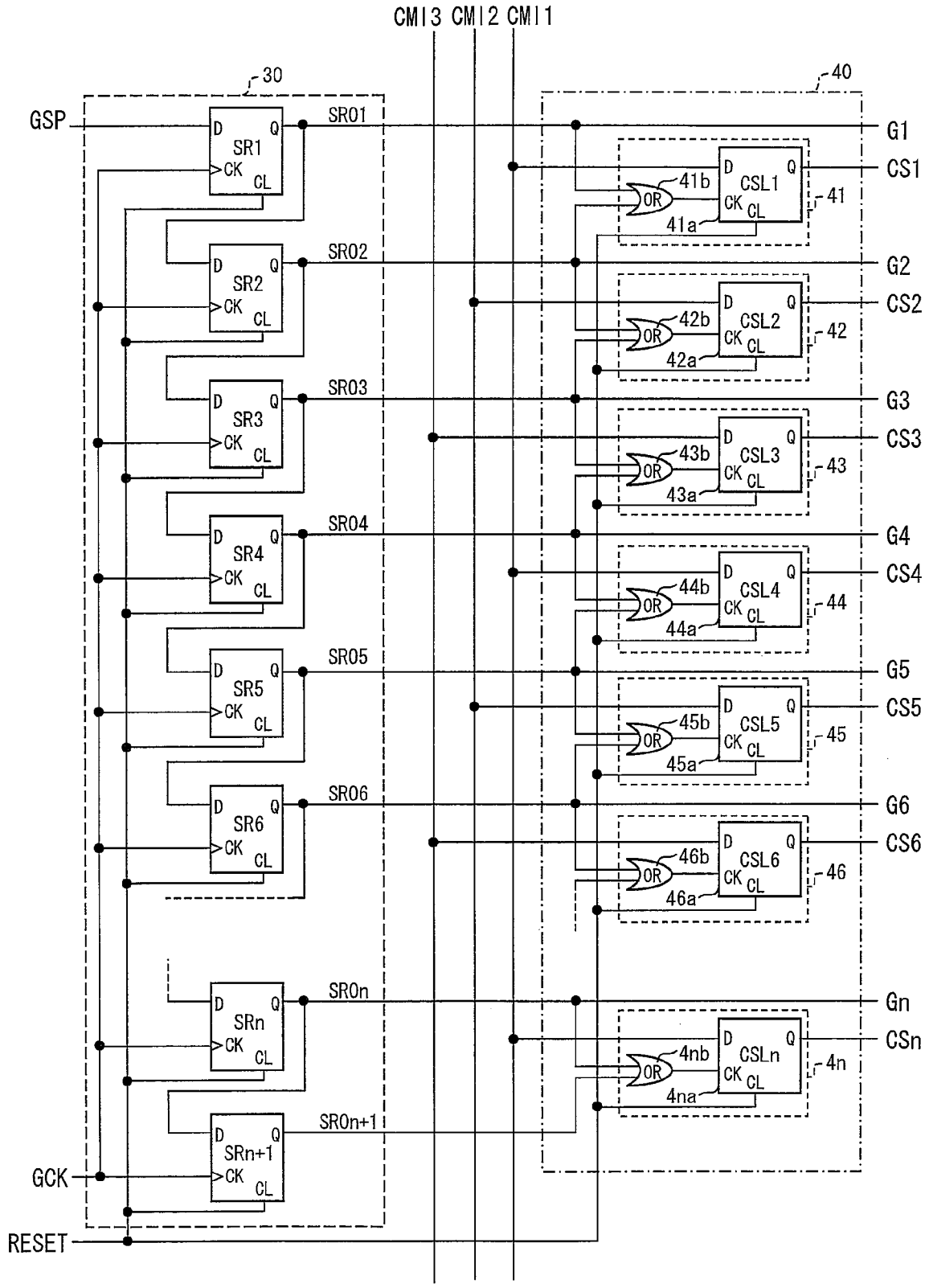
FIG. 45 is a block diagram illustrating configurations of a gate line driving circuit and a CS bus line driving circuit of Example 12.

FIG. 45 illustrates configurations of the gate line driving circuit 30 and the CS bus line driving circuit 40. The CS circuit 41 receives a shift register output SRO1 and a shift register output SRO2 corresponding to the respective gate signals G1 and G2, a polarity signal CMI1, and a reset signal RESET. The CS circuit 42 receives the shift register output SRO2 and a shift register output SRO3 corresponding to the respective gate signals G2 and G3, a polarity signal CMI2, and the reset signal RESET. The CS circuit 43 receives the shift register output SRO3 and a shift register output SRO4 corresponding to the respective gate signals G3 and G4, the polarity signal CMI3, and the reset signal RESET. The CS circuit 44 receives the shift register output SRO4 and a shift register output SRO5 corresponding to the respective gate signals G4 and G5, the polarity signal CMI1, and the reset signal RESET. As described earlier, each of the CS circuits receives a shift register output SROn of the corresponding nth row and a shift register output SROn+1 of the (n+1)th row following the nth row, and the polarity signals CMI1 and CMI2 are supplied to the CS circuits regularly (from the nth row in the order of CMI1, CMI2, CMI3, CMI1, CMI2, and CMI3). The polarity signals CMI1, CMI2, and CMI3 and the reset signal RESET are supplied from the control circuit 50.

Figure 46:
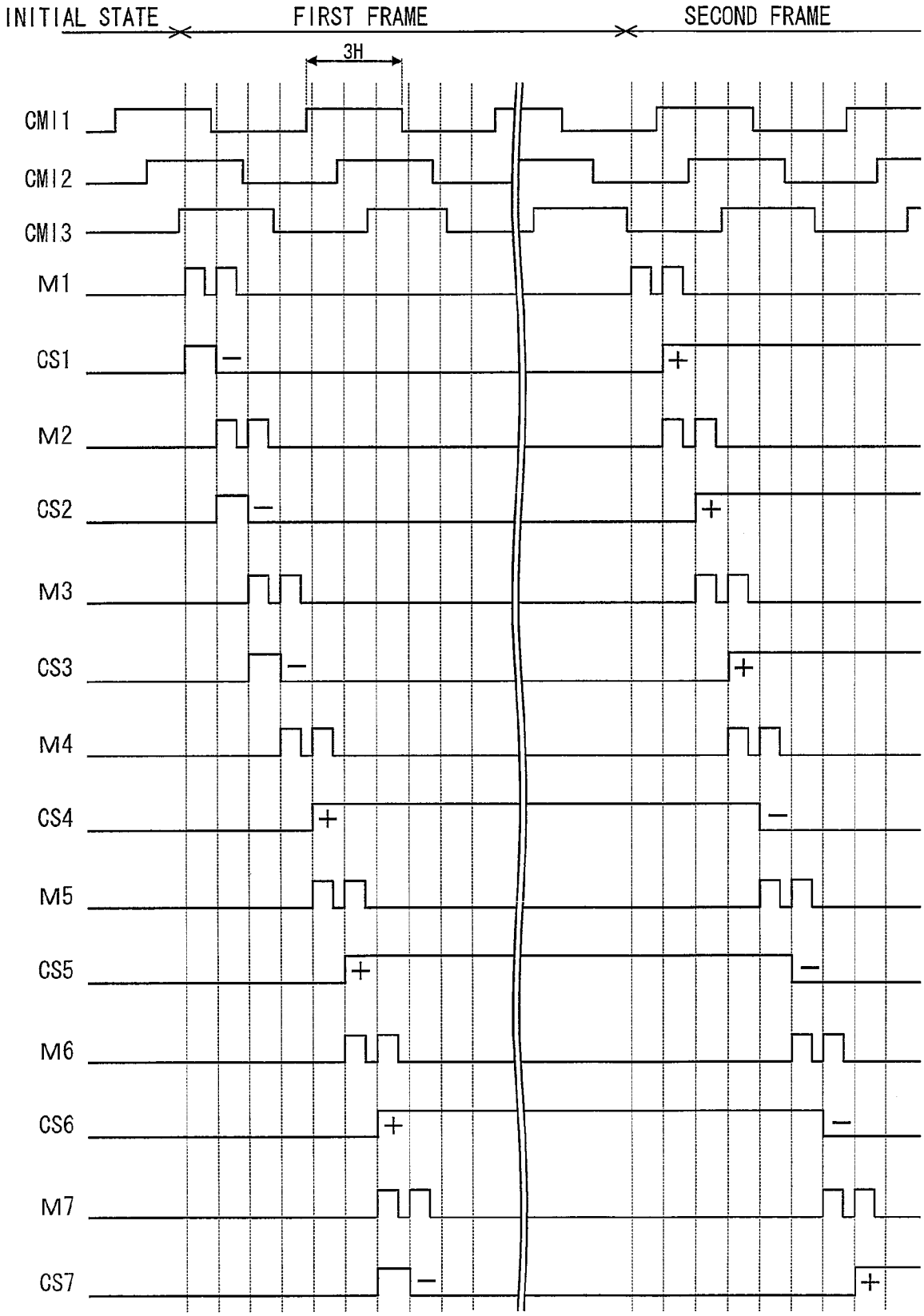
FIG. 46 illustrates waveforms of respective signals supplied to/from a CS bus line driving circuit of the liquid crystal display device 4 of Example 12.

For convenience, the following description mainly takes, as an example, the CS circuits 42 and 43 corresponding to the respective second and third rows. FIG. 46 illustrates waveforms of respective signals supplied to/from the CS bus line driving circuit 40 of the liquid crystal display device 4 of Example 12.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output 51202 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level.

Subsequently, the shift register output SRO3 which has been shifted to the third row in the gate line driving circuit 30 is supplied to the other terminal of the OR circuit 42*b*. Note that the shift register output SRO3 is also supplied to one terminal of the OR circuit 43*b* of the CS circuit 43.

A change in electric potential level (from low level to high level) of the shift register output SRO3 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO3 occurs. The D latch circuit 42*a* outputs a low level until a change in electric potential level (from high level to low level) of the shift register output SRO3 occurs in the signal M2 to be supplied to the clock terminal CK (during a period in which the signal M2 is at a high level). Next, when the change in electric potential level (from high level to low level) of the shift register output SRO3 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

In the second frame, during a period in which the shift register output SRO2 is at a high level in the signal M2, after the D latch circuit 42*a* transfers an input state (a low level) of the polarity signal CMI2 which input state is supplied to the data terminal D, the D latch circuit 42*a* latches an input state (a low level) of the polarity signal CMI2, the input state being obtained when a change in electric potential level (from high level to low level) of the shift register output SRO2 is supplied to the clock terminal CK. Then, the low level is maintained until the next time the signal M2 becomes at a high level.

Next, a change in electric potential level (from low level to high level) of the shift register output SRO3 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO3 occurs. The D latch circuit 42*a* outputs a high level until a change in electric potential level (from high level to low level) of the shift register output SRO3 to be supplied to the clock terminal CK occurs (during a period in which the signal M2 is at a high level). Next, when the change in electric potential level (from high level to low level) of the shift register output SRO2 is supplied to the clock terminal CK, the D latch circuit. 42*a* latches an input state of the polarity signal CMI2 which input state is obtained when the change occurs, i.e., a high level. Then, the high level is maintained until the signal M2 becomes at a high level in the third frame.

Note that in the first row, the CS signal CS1 illustrated in FIG. 46 is outputted by causing the shift register outputs SRO1 and SRO2 to latch the polarity signal CMI1.

Next, a change in waveforms of respective signals of the third row is to be described. In the initial state, the polarity signal CMI3 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level)

of the shift register output SRO3 in the signal M3 is supplied to the clock terminal CK of the D latch circuit 43*a*, and the D latch circuit 43*a* transfers an input state of the polarity signal CMI3 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI3 which input state is obtained when the change occurs, i.e., a high level. Then, the high level is maintained until the signal M3 becomes at a high level.

Subsequently, the shift register output SRO4 which has been shifted to the fourth row in the gate line driving circuit 30 is supplied to the other terminal of the OR circuit 43*b*. Note that the shift register output SRO4 is also supplied to one terminal of the OR circuit 43*b* of the CS circuit 43.

A change in electric potential level (from low level to high level) of the shift register output SRO4 in the signal M3 is supplied to the clock terminal CK of the D latch circuit 43*a*, and the D latch circuit 43*a* transfers an input state of the polarity signal CMI3 which input state is supplied to the terminal D when the change occurs, i.e., a low level. Namely, the electric potential of the CS signal CS3 changes from a high level to a low level when the change in electric potential level (from low level to high level) of the shift register output SRO4 occurs. The D latch circuit 43*a* outputs a low level until a change in electric potential level (from high level to low level) of the shift register output SRO4 occurs in the signal M3 to be supplied to the clock terminal CK (during a period in which the signal M3 is at a high level). Next, when the change in electric potential level (from high level to low level) of the shift register output SRO4 in the signal M3 is supplied to the clock terminal CK, the D latch circuit 43*a* latches an input state of the polarity signal CMI3 which input state is obtained when the change occurs, i.e., a low level. Then, the low level is maintained until the signal M3 becomes at a high level in the second frame.

In the second frame, during a period in which the shift register output SRO3 is at a high level in the signal M3, after the D latch circuit 43*a* transfers an input state (a low level) of the polarity signal CMI3 which input state is supplied to the data terminal D, the D latch circuit 43*a* latches an input state (a low level) of the polarity signal CMI3, the input state being obtained when a change in electric potential level (from high level to low level) of the shift register output SRO3 is supplied to the clock terminal CK. Then, the low level is maintained until the next time the signal M3 becomes at a high level.

Next, a change in electric potential level (from low level to high level) of the shift register output SRO4 is supplied to the clock terminal CK of the D latch circuit 43*a*, and the D latch circuit 43*a* transfers an input state of the polarity signal CMI3 which input state is supplied to the terminal D when the change occurs, i.e., a high level. Namely, the electric potential of the CS signal CS3 changes from a low level to a high level when the change in electric potential level (from low level to high level) of the shift register output SRO3 occurs. The D latch circuit 43*a* outputs a high level until a change in electric potential level (from high level to low level) of the shift register output SRO4 to be supplied to the clock terminal CK occurs (during a period in which the signal M3 is at a high level). Next, when the change in electric potential level (from high level to low level) of the shift register output SRO3 is supplied to the clock terminal CK, the D latch circuit 43*a* latches an input state of the polarity signal CMI3 which input state is obtained when the change occurs, i.e., a high level. Then, the high level is maintained until the signal M3 becomes at a high level in the third frame.

Next, a change in waveforms of respective signals of the fourth row is to be described. In the initial state, the polarity signal CMI1 is supplied to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI1 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level.

Subsequently, the shift register output SRO5 which has been shifted to the fifth row in the gate line driving circuit 30 is supplied to the other terminal of the OR circuit 44*b*. Note that the shift register output SRO5 is also supplied to one terminal of the OR circuit 45*b* of the CS circuit 45.

A change in electric potential level (from low level to high level) of the shift register output SRO5 in the signal M4 is supplied to the clock terminal CK of the D latch circuit 44*a*, and the D latch circuit 44*a* transfers an input state of the polarity signal CMI1 which input state is supplied to the terminal D when the change occurs, i.e., a high level. Namely, the electric potential of the CS signal CS4 changes from a low level to a high level when the change in electric potential level (from low level to high level) of the shift register output SRO5 occurs. The D latch circuit 44*a* outputs a high level until the next time a change in electric potential level (from high level to low level) of the shift register output SRO5 occurs in the signal M4 to be supplied to the clock terminal CK (during a period in which the signal M4 is at a high level). Next, when the change in electric potential level (from high level to low level) of the shift register output SRO5 in the signal M4 is supplied to the clock terminal CK, the D latch circuit 44*a* latches an input state of the polarity signal CMI1 which input state is obtained when the change occurs, i.e., a high level. Then, the high level is maintained until the signal M4 becomes at a high level in the second frame.

In the second frame, during a period in which the shift register output SRO4 is at a high level in the signal M4, after the D latch circuit 44*a* transfers an input state (a high level) of the polarity signal CMI1 which input state is supplied to the data terminal D, the D latch circuit 44*a* latches an input state (a high level) of the polarity signal CMI2, the input state being obtained when a change in electric potential level (from high level to low level) of the shift register output SRO4 is supplied to the clock terminal CK. Then, the high level is maintained until the next time the signal M4 becomes at a high level.

Next, a change in electric potential level (from low level to high level) of the shift register output SRO5 is supplied to the clock terminal CK of the D latch circuit 44*a*, and the D latch circuit 44*a* transfers an input state of the polarity signal CMI1 which input state is supplied to the terminal D when the change occurs, i.e., a low level. Namely, the electric potential of the CS signal CS4 changes from a high level to a low level when the change in electric potential level (from low level to high level) of the shift register output SRO5 occurs.

The D latch circuit 44*a* outputs a low level until the next time a change in electric potential level (from high level to low level) of the shift register output SRO5 to be supplied to the clock terminal CK occurs (during a period in which the signal M4 is at a high level). Next, when the change in electric potential level (from high level to low level) of the shift register output SRO5 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level in the third frame.

Note that in the fifth row, the CS signal CS5 illustrated in FIG. 46 is outputted by causing the shift register outputs SRO5 and SRO6 to latch the polarity signal CMI2.

As described earlier, according to Example 12, 3H reversal driving can be carried out by use of the polarity signals CMI1, CMI2, and CMI3 whose polarities are reversed every 3H and whose phases are shifted thereamong. This allows the CS bus line driving circuit 40 to operate properly in the first frame also in 3H reversal driving. Therefore, it is possible to remove irregular waveforms which are described above and serve as a cause for lateral stripes in the first frame and to yield an effect of removing lateral stripes of light and shade which stripes are produced in a display video in the first frame, so as to enhance a display quality.

Figure 47:
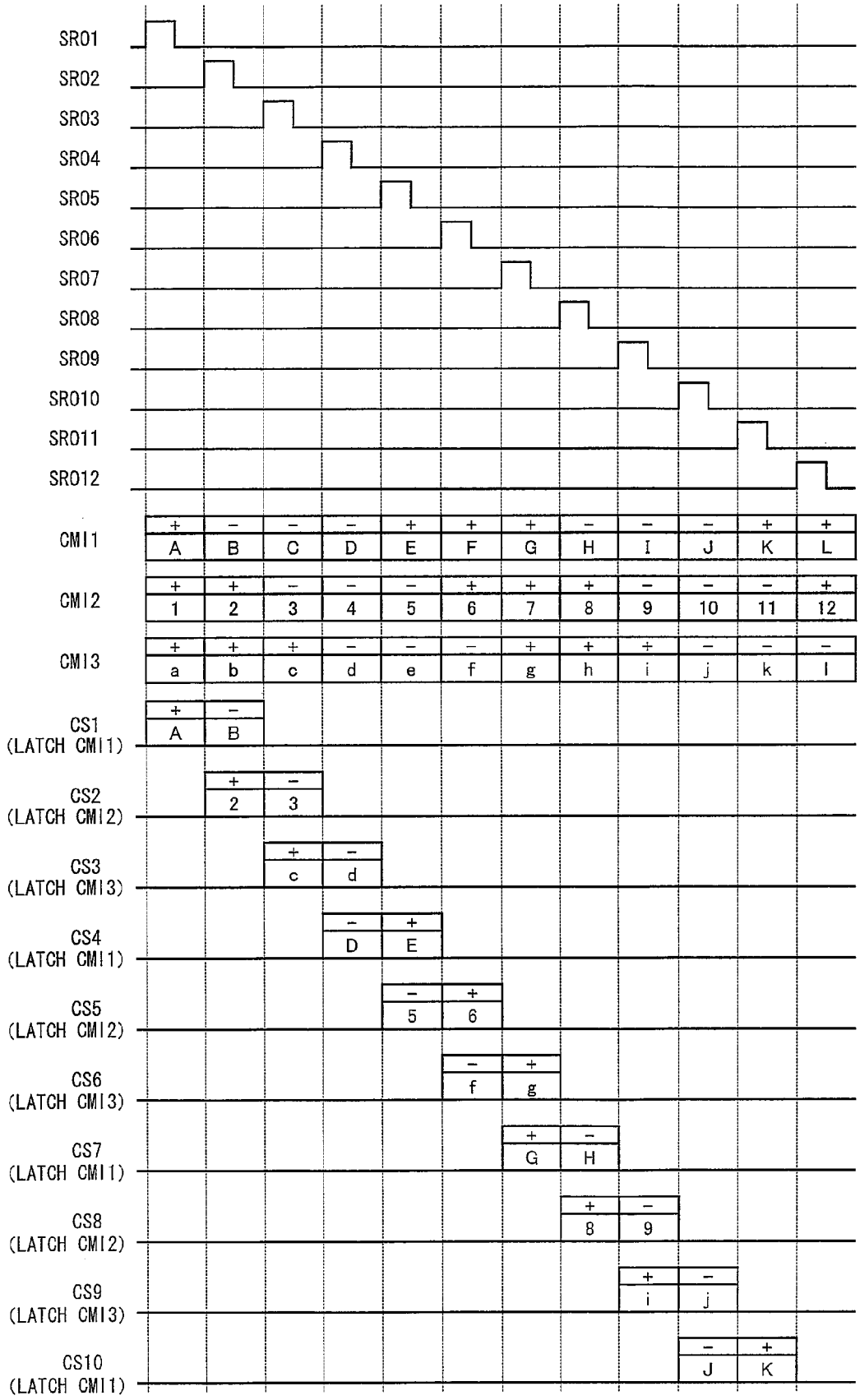
FIG. 47 illustrates how (i) a polarity signal and a shift register output each of which is supplied to a CS circuit of Example 12 and (ii) a CS signal which is supplied from the CS circuit correspond to each other.

A relationship between the polarity signal CMI1, CMI2, or CMI3 and the shift register output SROn each of which is supplied to the CS circuit 4*n* is described here. FIG. 47 illustrates how (i) the polarity signal (any of CMI1, CMI2, and CMI3) and the shift register output SROn each of which is supplied to the CS circuit 4*n* and (ii) the CS signal CSn to be supplied from the CS circuit 4*n* correspond to each other.

As for CMI1 of FIG. 47, signs A through L correspond to respective one horizontal scanning periods and indicate polarities (positive polarities or negative polarities) of the respective one horizontal scanning periods. For example, CMI1 has a positive polarity during the first horizontal scanning period "A", has a negative polarity during the second horizontal scanning period "B", has a negative polarity during the third horizontal scanning period "C", and has a negative polarity during the fourth horizontal scanning period "D". As for CMI2, signs 1 through 12 correspond to respective one horizontal scanning periods and indicate polarities of the respective one horizontal scanning periods. For example, CMI2 has a positive polarity during the first horizontal scanning period "1", has a positive polarity during the second horizontal scanning period "2", has a negative polarity during the third horizontal scanning period "3", and has a negative polarity during the fourth horizontal scanning period "4". As for CMI3, signs a through 1 correspond to respective one horizontal scanning periods and indicate polarities of the respective one horizontal scanning periods. For example, CMI3 has a positive polarity during the first horizontal scanning period "a", has a positive polarity during the second horizontal scanning period "b", has a positive polarity during the third horizontal scanning period "c", and has a negative polarity during the fourth horizontal scanning period "d". As described earlier, the polarities of the respective polarity signals CMI1, CMI2, and CMI3 are reversed every three horizontal scanning periods (3H), the phases of CMI1 and CMI2 are shifted by one horizontal scanning period (1H), and the phases of CMI2 and CMI3 are shifted by one horizontal scanning period (1H). For example, CMI1, CMI2, and CMI3 are regularly supplied to each of the CS circuits (CMI1 to the CS circuit 41, CMI2 to the CS circuit 42, CMI3 to the CS circuit 43, CMI1 to the CS circuit 44, CMI2 to the CS circuit 45, and CMI3 to the CS circuit 46).

According to the CS circuit 4*n*, since the shift register output SROn of the nth row and the shift register output SROn+1 of the (n+1)th row are supplied to the clock terminal CK, (i) CMI to be supplied to the data terminal D during the nth horizontal scanning period and (ii) CMI to be supplied to the data terminal D during the (n+1)th horizontal scanning period are latched. For example, the CS circuit 41 loads (i) a positive polarity of "A" of CMI1 during the first horizontal scanning period and (ii) a negative polarity of "B" of CMI1 during the second horizontal scanning period. The CS circuit 42 loads (i) a positive polarity of "2" of CMI2 during the second horizontal scanning period and (ii) a negative polarity of "3" of CMI2 during the third horizontal scanning period. The CS circuit 43 loads (i) a positive polarity of "c" of CMI3 during the third horizontal scanning period and (ii) a negative polarity of "d" of CMI3 during the fourth horizontal scanning period. The CS circuit 44 loads (i) a negative polarity of "D" of CMI1 during the fourth horizontal scanning period and (ii) a positive polarity of "E" of CMI1 during the fifth horizontal scanning period. Each of the CS signals CSn illustrated in FIGS. 44 and 46 is thus outputted.

As described earlier in Examples 12, in a case where a plurality of polarity signals CMI1, CMI2, and CMI3 are used which are different from each other in frequency, 3H reversal driving can be implemented. In a case where a frequency and the number of polarity signals are changed, 4H, . . . , nH (n-line) reversal driving can be similarly implemented. For example, 4H reversal driving may be arranged such that four polarity signals CMI1 through CMI4 are used, a frequency of each of the polarity signals is set so that polarities of the respective polarity signals are reversed every 4H, and the polarity signals are sequentially supplied to each of the CS circuits.

Example 13

Figure 48:
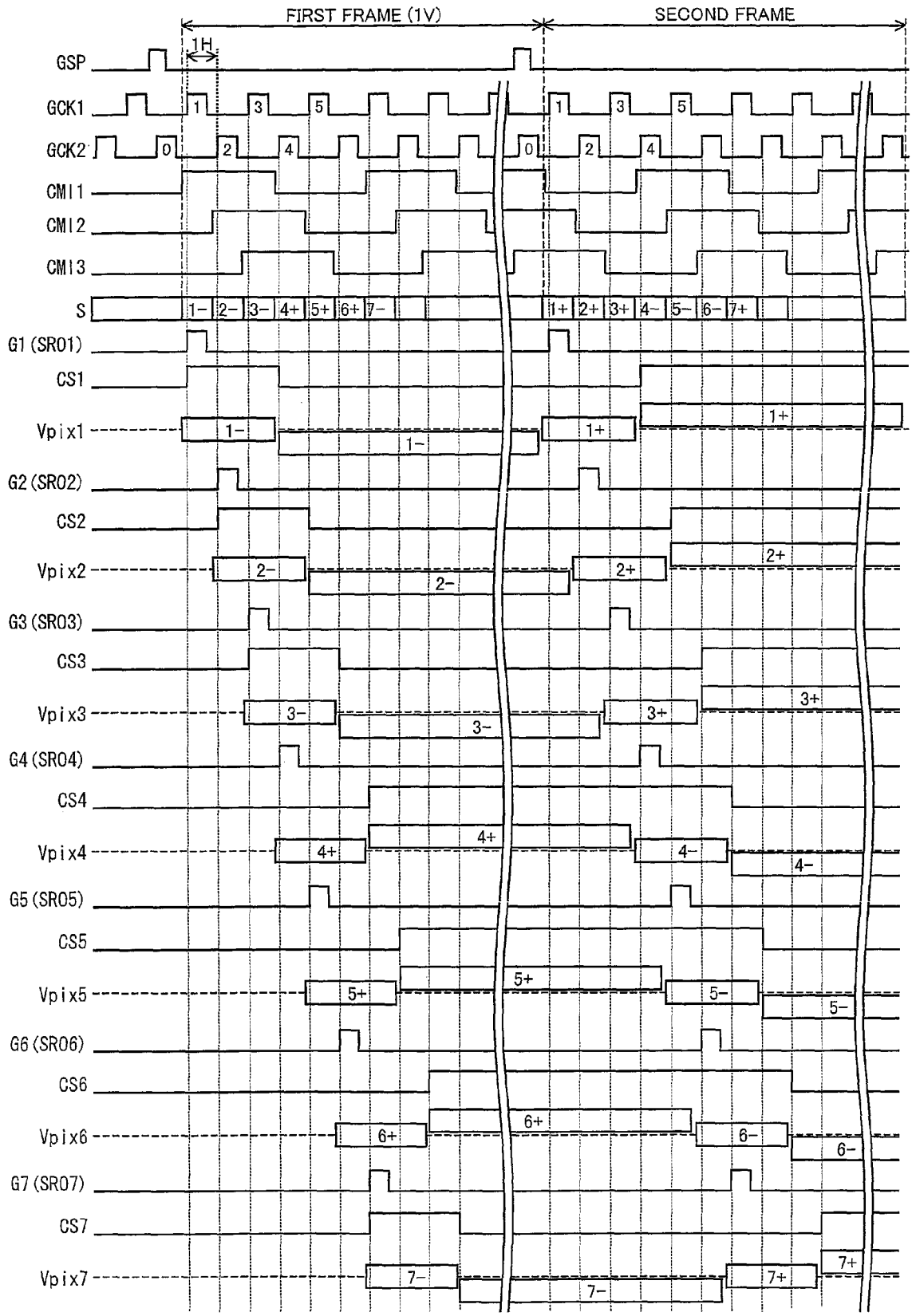
FIG. 48 is a timing chart illustrating waveforms of respective signals, the waveforms being obtained in a case where 3-line (3H) reversal driving is carried out in a liquid crystal display device 4 of Example 13.

Example 12 is arranged such that the CS circuit 4*n* of the nth row receives the shift register output SROn of the corresponding nth row and the shift register output SROn+1 of the (n+1)th row following the nth row. However, an arrangement of the liquid crystal display device 4 of the present invention is not limited to such an arrangement. For example, the liquid crystal display device 4 may also be arranged such that the CS circuit 4*n* of the nth row receives the shift register output SROn of the corresponding nth row and a shift register output SROn+3 of the (n+3)th row (see FIG. 49). Namely, the CS circuit 41 receives the shift register output SRO1 of the corresponding first row and the shift register output SRO4 of the fourth row. FIG. 48 is a timing chart illustrating waveforms of respective signals of the liquid crystal display device 4 which has such an arrangement and carries out 3-line (3H) reversal driving. In FIG. 48, as in the case of Example 12, the polarities of the respective polarity signals CMI1, CMI2, and CMI3 are reversed every three horizontal scanning periods (3H), the phases of CMI1 and CMI2 are shifted by one horizontal scanning period (1H), and the phases of CMI2 and CMI3 are shifted by one horizontal scanning period (1H). Further, a timing at which the polarities of the respective polarity signals CMI1, CMI2, and CMI3 of Example 13 is different from that of Example 12.

In the initial state, each of the CS signals CS1 through CS7 is fixed at an electric potential having one level (a low level in FIG. 48) (see FIG. 48). In the first frame, the CS signal CS1 of the first row is at a high level when the gate signal G1 corresponding thereto falls, the CS signal CS2 of the second row is at a high level when the gate signal G2 corresponding thereto falls, and the CS signal CS3 of the third row is at a high level when the gate signal G3 corresponding thereto falls. In contrast, the CS signal CS4 of the fourth row is at a low level when the gate signal G4 corresponding thereto falls, the CS signal CS5 of the fifth row is at a low level when the gate signal G5 corresponding thereto falls, and the CS signal CS6 of the sixth row is at a low level when the gate signal G6 corresponding thereto falls. The CS signal CS7 of the seventh row is at a high level when the gate signal G7 corresponding thereto falls.

Note here that the source signal S has an amplitude in accordance with a gray scale indicated by a video signal and is a signal whose polarity is reversed every three horizontal scanning periods (3H). Note also that, since FIG. 48 assumes that a uniform video is displayed, the source signal S has a constant amplitude. The gate signals G1 through G7 have gate ON electric potentials during the respective first through seventh 1H periods in an active period (an effective scanning period) of each frame and have gate OFF electric potentials during the other periods of the each frame.

Then, electric potential levels of the respective CS signals CS1 through CS7 change between high and low levels after the gate signals G1 through G7 corresponding to the respective CS signals CS1 through CS7 fall. Specifically, in the first frame, the CS signals CS1, CS2, and CS3 fall after the gate signals G1, G2, and G3 corresponding to the respective CS signals CS1, CS2, and CS3 fall, and the CS signals CS4, CS5, and CS6 rise after the gate signals G4, G5, and G6 corresponding to the respective CS signals CS4, CS5, and CS6 fall. Note that the second frame has a relationship opposite to that of the first frame. The CS signals CS1, CS2, and CS3 rise after the gate signals G1, G2, and G3 corresponding to the respective CS signals CS1, CS2, and CS3 fall, and the CS signals CS4, CS5, and CS6 fall after the gate signals G4, G5, and G6 corresponding to the respective CS signals CS4, CS5, and CS6 fall.

This removes lateral stripes of light and shade which stripes are produced in a display video in the first frame, so that a display quality can be enhanced.

Specific configurations of the gate line driving circuit 30 and the CS bus line driving circuit 40 are described here for carrying out control described above.

Figure 49:
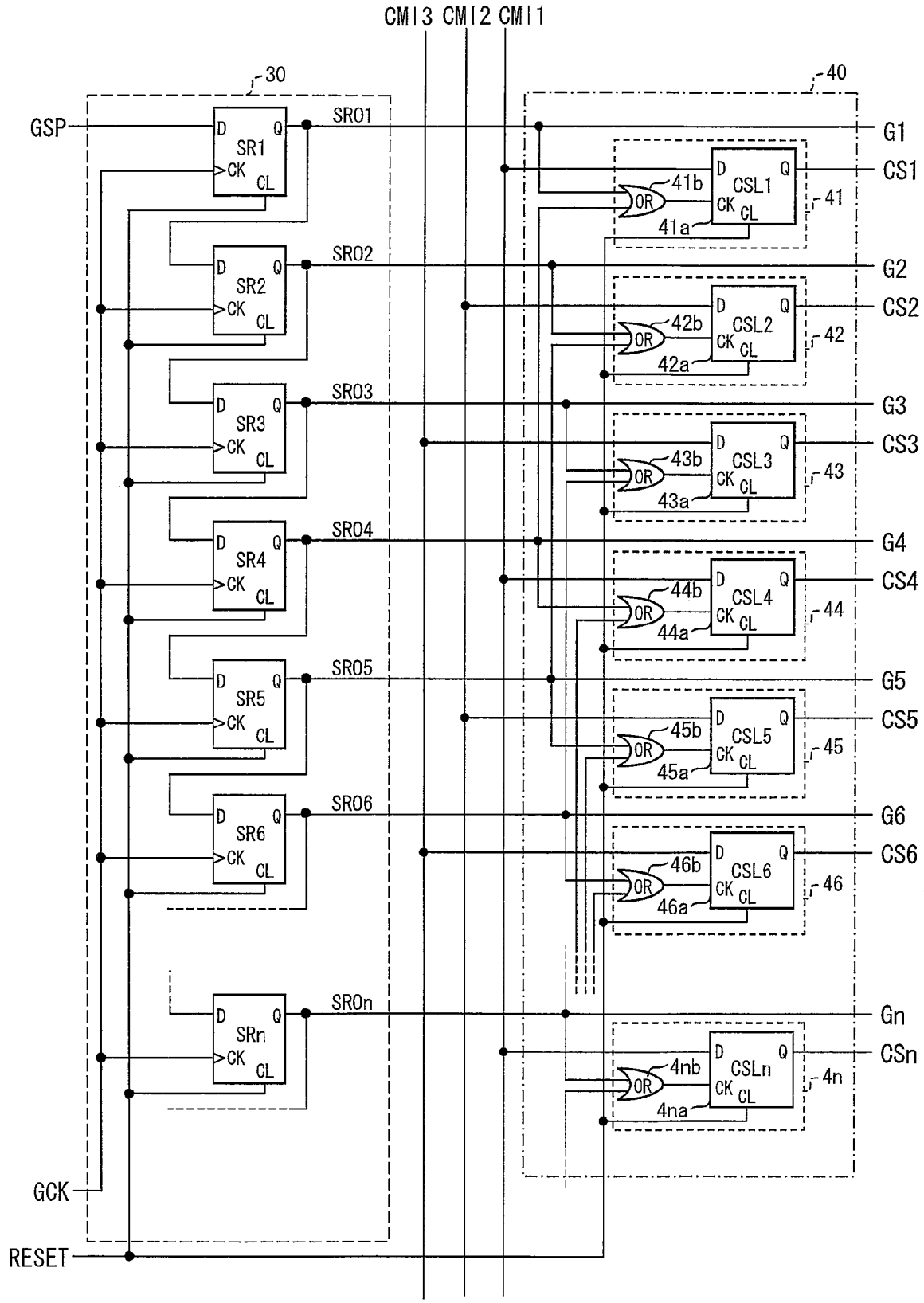
FIG. 49 is a block diagram illustrating configurations of a gate line driving circuit and a CS bus line driving circuit of Example 13.

FIG. 49 illustrates configurations of the gate line driving circuit 30 and the CS bus line driving circuit 40. The CS circuit 41 receives the shift register output SRO1 and a shift register output SRO4 corresponding to the respective gate signals G1 and G4, a polarity signal CMI1, and a reset signal RESET. The CS circuit 42 receives the shift register output SRO2 and a shift register output SRO5 corresponding to the respective gate signals G2 and G5, a polarity signal CMI2, and the reset signal RESET. The CS circuit 43 receives the shift register output SRO3 and a shift register output SRO6 corresponding to the respective gate signals G3 and G6, the polarity signal CMI3, and the reset signal RESET. The CS circuit 44 receives the shift register output SRO4 and a shift register output SRO7 corresponding to the respective gate signals G4 and G7, the polarity signal CMI1, and the reset signal RESET. As described earlier, each of the CS circuits receives a shift register output SROn of the corresponding nth row and a shift register output SROn+3 of the (n+1)th row following the nth row, and the polarity signals CMI1, CMI2, and CMI3 are sequentially supplied to the CS circuits every one row (from the nth row in the order of CMI1, CMI2, CMI3, CMI1, CMI2, and CMI3). The polarity signals CMI1, CMI2, and CMI3 and the reset signal RESET are supplied from the control circuit 50.

For convenience, the following description takes, as an example, the CS circuits 42, 43, and 44 corresponding to the respective second through fourth rows, so as to discuss operation of the first frame.

First, a change in waveforms of respective signals of the second row is to be described. In the initial state, the polarity signal CMI2 is supplied to the terminal D of the D latch circuit 42*a* of the CS circuit 42, and the reset signal RESET is supplied to the reset terminal CL of the D latch circuit 42*a* of the CS circuit 42. The reset signal RESET maintains, at a low level, an electric potential of the CS signal CS2 to be supplied from the output terminal Q of the D latch circuit 42*a*.

Thereafter, the shift register output SRO2 corresponding to the gate signal G2 to be supplied to the gate line 12 of the second row is supplied from the shift register circuit SR2 to one terminal of the OR circuit 42*b* of the CS circuit 42. Then, a change in electric potential level (from low level to high level) of the shift register output SRO2 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a high level. Namely, the electric potential of the CS signal CS2 changes from a low level to a high level when the change in electric potential level (from low level to high level) of the shift register output SRO2 occurs. The D latch circuit 42*a* outputs a high level until a change in electric potential level (from high level to low level) of the shift register output SRO2 occurs in the signal M2 to be supplied to the clock terminal CK (during a period in which the signal M2 is at a high level). Next, when the change in electric potential level (from high level to low level) of the shift register output SRO2 in the signal M2 is supplied to the clock terminal CK, the D latch circuit 42*a* latches an input state of the polarity signal CMI2 which input state is obtained when the change occurs, i.e., a high level. Then, the high level is maintained until the signal M2 becomes at a high level.

Subsequently, the shift register output SRO5 which has been shifted to the fifth row in the gate line driving circuit 30 is supplied to the other terminal of the OR circuit 42*b*. Note that the shift register output SRO5 is also supplied to one terminal of the OR circuit 45*b* of the CS circuit 45.

A change in electric potential level (from low level to high level) of the shift register output SRO5 in the signal M2 is supplied to the clock terminal CK of the D latch circuit 42*a*, and the D latch circuit 42*a* transfers an input state of the polarity signal CMI2 which input state is supplied to the terminal D when the change occurs, i.e., a low level. Namely, the electric potential of the CS signal CS2 changes from a high level to a low level when the change in electric potential level (from low level to high level) of the shift register output SRO5 occurs. The D latch circuit 42*a* outputs a low level until a change in electric potential level (from high level to low level) of the shift register output SRO5 occurs in the signal M2 to be supplied to the clock terminal CK (during a period in which the signal M2 is at a high level). Next, when the change in electric potential level (from high level to low level) of the shift register output SRO5 in the signal M2 is supplied to the clock terminal CK, the D latch circuit 42*a* latches an input state of the polarity signal CMI2 which input state is obtained when the change occurs, i.e., a low level. Then, the low level is maintained until the signal M2 becomes at a high level in the second frame.

Next, a change in waveforms of respective signals of the third row is to be described. In the initial state, the polarity signal CMI3 is supplied to the terminal D of the D latch circuit 43*a* of the CS circuit 43, and the reset signal RESET is supplied to the reset terminal CL of the D latch circuit 43*a* of the CS circuit 43. The reset signal RESET maintains, at a low level, an electric potential of the CS signal CS3 to be supplied from the output terminal Q of the D latch circuit 43*a*.

Thereafter, the shift register output SRO3 corresponding to the gate signal G3 to be supplied to the gate line 12 of the third row is supplied from the shift register circuit SR3 to one terminal of the OR circuit 43*b* of the CS circuit 43. Then, a change in electric potential level (from low level to high level) of the shift register output SRO3 in the signal M3 is supplied to the clock terminal CK of the D latch circuit 43*a*, and the D latch circuit 43*a* transfers an input state of the polarity signal CMI3 which input state is supplied to the terminal D when the change occurs, i.e., a high level. Namely, an electric potential level of the CS signal CS3 changes from a low level to a high level when a change in electric potential level (from low level to high level) of the shift register output SRO3 occurs. The D latch circuit 43*a* outputs a high level until a change in electric potential level (from high level to low level) of the shift register output SRO3 occurs in the signal M3 to be supplied to the clock terminal CK (during a period in which the signal M3 is at a high level). Next, when the change in electric potential level (from high level to low level) of the shift register output SRO3 in the signal M3 is supplied to the clock terminal CK, the D latch circuit 43*a* latches an input state of the polarity signal CMI3 which input state is obtained when the change occurs, i.e., a high level. Then, the high level is maintained until the signal M3 becomes at a high level.

Subsequently, the shift register output SRO6 which has been shifted to the sixth row in the gate line driving circuit 30 is supplied to the other terminal of the OR circuit 43*b*. Note that the shift register output SRO6 is also supplied to one terminal of the OR circuit 45*b* of the CS circuit 46.

A change in electric, potential level (from low level to high level) of the shift register output SRO6 in the signal M3 is supplied to the clock terminal CK of the D latch circuit 43*a*, and the D latch circuit 43*a* transfers an input state of the polarity signal CMI3 which input state is supplied to the terminal D when the change occurs, i.e., a low level. Namely, the electric potential of the CS signal CS3 changes from a high level to a low level when the change in electric potential level (from low level to high level) of the shift register output SRO6 occurs. The D latch circuit 43*a* outputs a low level until a change in electric potential level (from high level to low level) of the shift register output SRO6 occurs in the signal M3 to be supplied to the clock terminal CK (during a period in which the signal M3 is at a high level). Next, when the change in electric potential level (from high level to low level) of the shift register output SRO6 in the signal M3 is supplied to the clock terminal CK, the D latch circuit 43*a* latches an input state of the polarity signal CMI3 which input state is obtained when the change occurs, i.e., a low level. Then, the low level is maintained until the signal M3 becomes at a high level in the second frame.

Next, a change in waveforms of respective signals of the fourth row is to be described. In the initial state, the polarity signal CMI1 is supplied, to the data terminal D of the D latch circuit 44*a* of the CS circuit 44, and the reset signal RESET is supplied to the reset terminal CL of the D latch circuit 44*a* of the CS circuit 44. The reset signal RESET maintains, at a low level, an electric potential of the CS signal CS4 to be supplied from the output terminal Q of the D latch circuit 44*a*.

Thereafter, the shift register output SRO4 of the fourth row is supplied from the shift register circuit SR4 to one terminal of the OR circuit 44*b* of the CS circuit 44. Then, a change in electric potential level (from low level to high level) of the shift register output SRO4 in the signal M4 is supplied to the clock terminal CK of the D latch circuit 44*a*, and the D latch circuit 44*a* transfers an input state of the polarity signal CMI1 which input state is supplied to the data terminal D when the change occurs, i.e., a low level. The D latch circuit 44*a* outputs a low level until the next time a change in electric potential level (from high level to low level) of the shift register output SRO4 occurs in the signal M4 to be supplied to the clock terminal CK (during a period in which the signal M4 is at a high level). Next, when the change in electric potential level (from high level to low level) of the shift register output SRO4 in the signal M4 is supplied to the clock terminal CK, the D latch circuit 44*a* latches an input state of the polarity signal CMI1 which input state is obtained when the change occurs, i.e., a low level. Then, the low level is maintained until the signal M4 becomes at a high level.

Subsequently, the shift register output SRO7 which has been shifted to the seventh row in the gate line driving circuit 30 is supplied to the other terminal of the OR circuit 44*b*. Note that the shift register output SRO7 is also supplied to one terminal of the OR circuit 47*b* of the CS circuit 47.

A change in electric potential level (from low level to high level) of the shift register output SRO7 in the signal M4 is supplied to the clock terminal CK of the D latch circuit 44*a*, and the D latch circuit 44*a* transfers an input state of the polarity signal CMI1 which input state is supplied to the terminal D when the change occurs, i.e., a high level. Namely, the electric potential of the CS signal CS4 changes from a low level to a high level when the change in electric potential level (from low level to high level) of the shift register output SRO7 occurs. The D latch circuit 44*a* outputs a high level until the next time a change in electric potential level (from high level to low level) of the shift register output SRO7 occurs in the signal M4 to be supplied to the clock terminal CK (during a period in which the signal M4 is at a high level). Next, when the change in electric potential level (from high level to low level) of the shift register output SRO7 in the signal M4 is, supplied to the clock terminal CK, the D latch circuit 44*a* latches an input state of the polarity signal CMI1 which input state is obtained when the change occurs, i.e., a high level. Then, the high level is maintained until the signal M4 becomes at a high level in the second frame.

Figure 50:
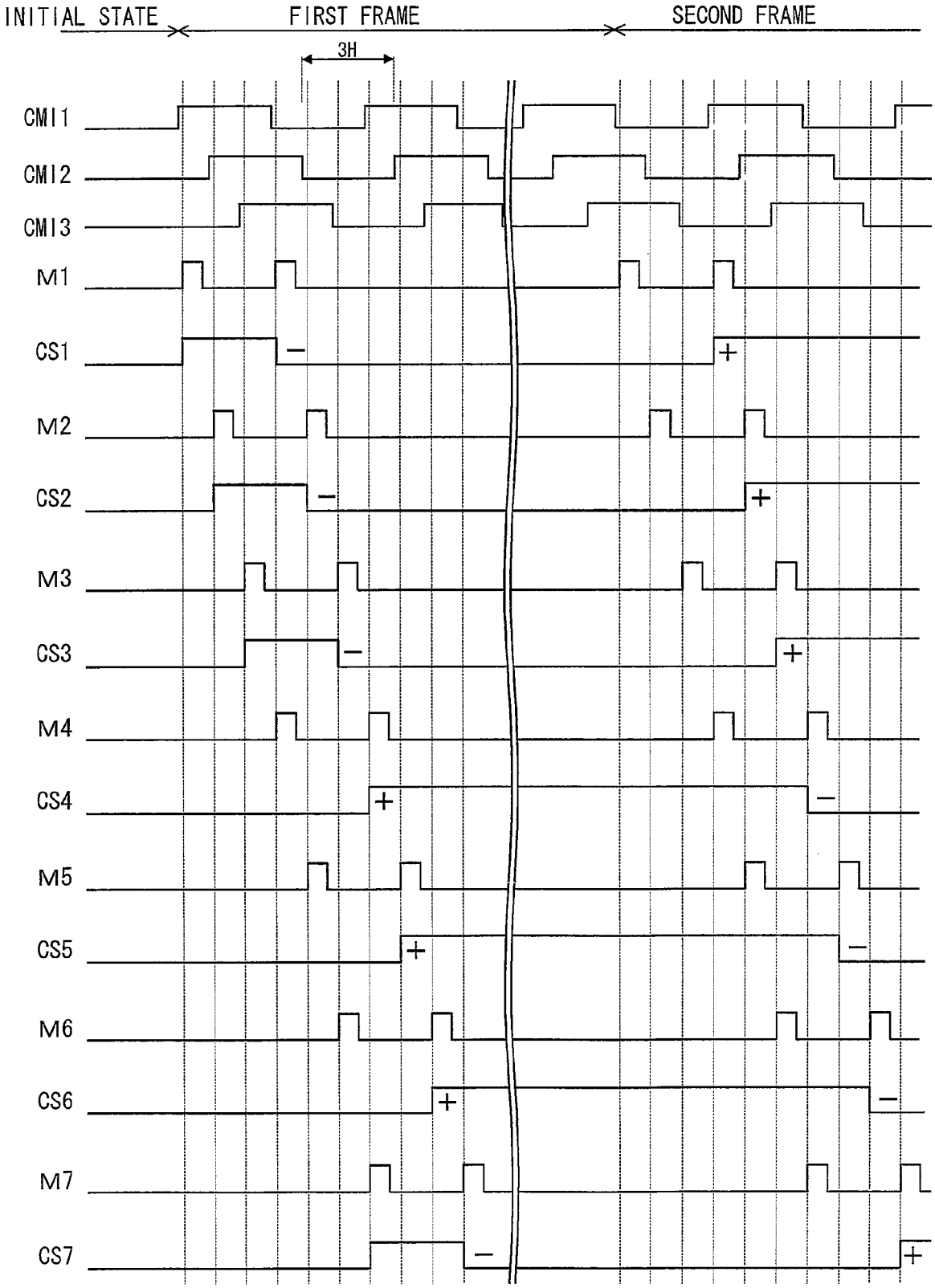
FIG. 50 illustrates waveforms of respective signals supplied to/from a CS bus line driving circuit of the liquid crystal display device 4 of Example 13.

According to the above operation, in the first through third rows, an electric potential level of the CS signal which level is obtained when the gate signal of a corresponding row falls (when the TFT 13 in an ON state is turned off) falls after the gate signal of the corresponding row has fallen, and in the fourth through sixth rows, an electric potential level of the CS signal which level is obtained when the gate signal of a corresponding row falls (when the TFT 13 in an ON state is turned off) rises after the gate signal of the corresponding row has fallen (see FIGS. 49 and 50).

As described earlier, according to Example 13, also in an arrangement such that the CS circuit 4*n* of the nth row receives the shift register output SROn of the corresponding nth row and a shift register output SROn+a of a row later than the (n+1)th row (the (n+3)th row in the above example), nH reversal driving (3H reversal driving in the above example) can be carried out by adjusting a timing at which the polarities of the respective polarity signals CMI1, CMI2, and CMI3 are reversed.

Figure 51:
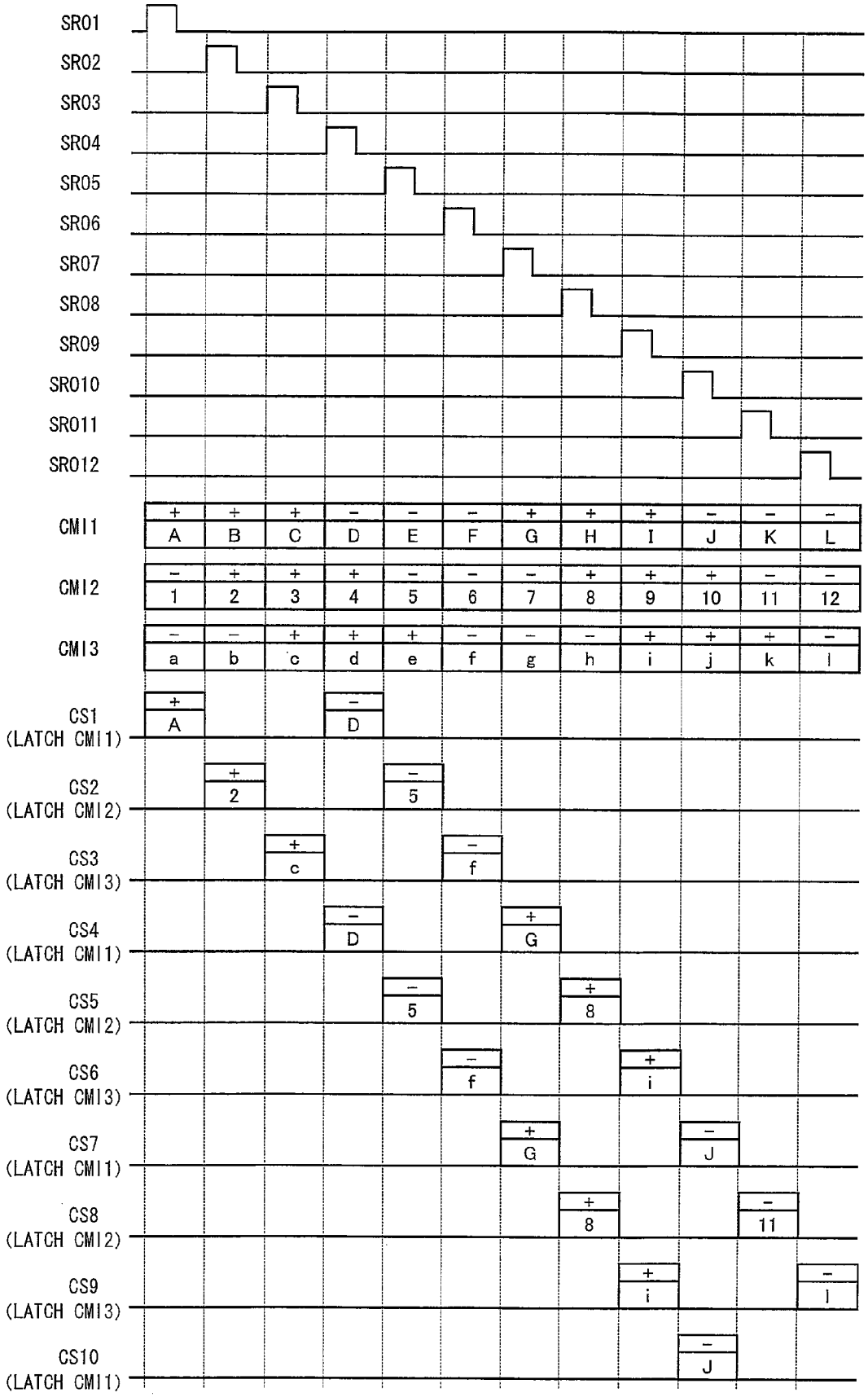
FIG. 51 illustrates how (i) a polarity signal and a shift register output each of which is supplied to a CS circuit of Example 13 and (ii) a CS signal which is supplied from the CS circuit correspond to each other.
Figure 52:
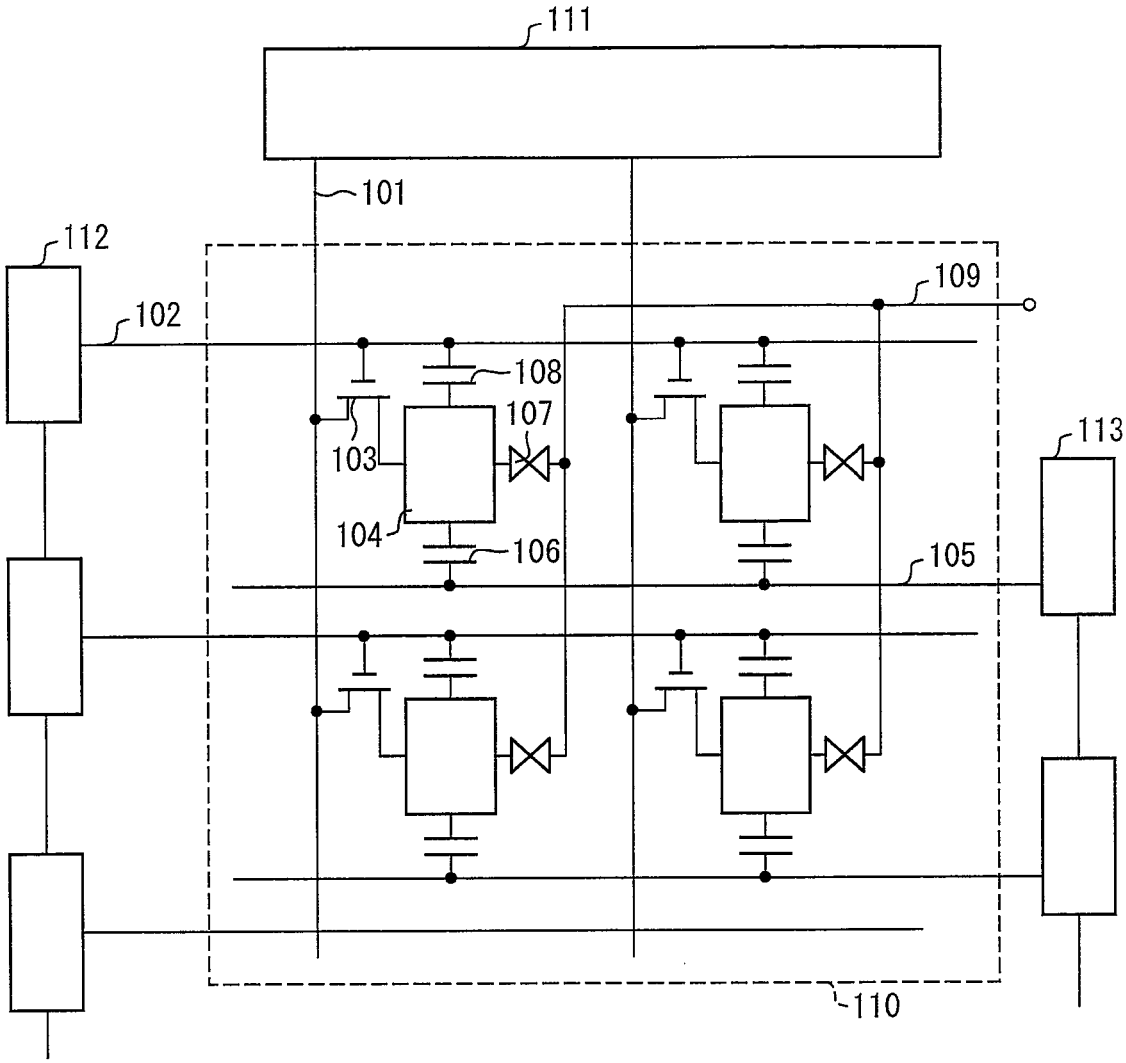
FIG. 52 is a block diagram illustrating an arrangement of a conventional liquid crystal display device which carries out CC driving.
Figure 53:
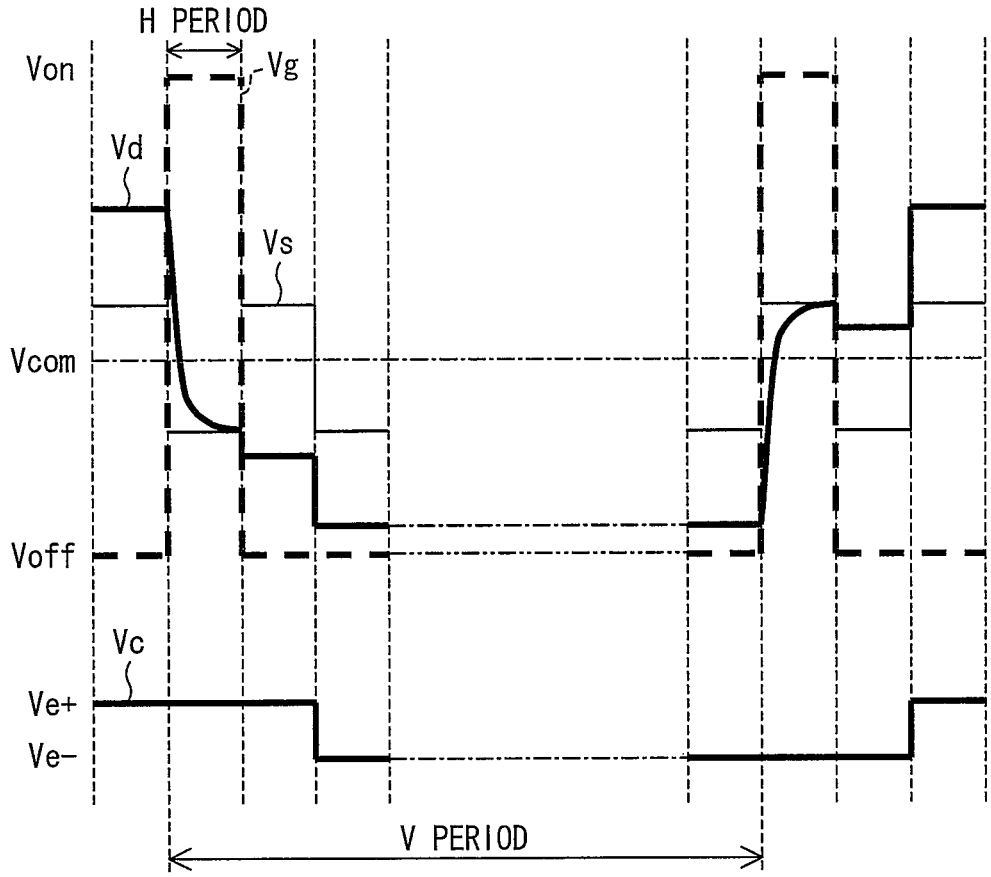
FIG. 53 is a timing chart illustrating waveforms of respective signals of the conventional liquid crystal display device.

A relationship between the polarity signal CMI1, CMI2, or CMI3 and the shift register output SROn each of which is supplied to the CS circuit 4*n* is described here. FIG. 51 illustrates how (i) the polarity signal (any of CMI1, CMI2, and CMI3) and the shift register output SROn each of which is supplied to the CS circuit 4*n* and (ii) the CS signal CSn to be supplied from the CS circuit 4*n* correspond to each other.

As for CMI1 of FIG. 47, signs A through L correspond to respective one horizontal scanning periods and indicate polarities (positive polarities or negative polarities) of the respective one horizontal scanning periods. For example, CMI1 has a positive polarity during the first horizontal scanning period "A", has a positive polarity during the second horizontal scanning period "B", has a positive polarity during the third horizontal scanning period "C", and has a negative polarity during the fourth horizontal scanning period "D". As for CMI2, signs 1 through 12 correspond to respective one horizontal scanning periods and indicate polarities of the respective one horizontal scanning periods. For example, CMI2 has a negative polarity during the first horizontal scanning period "1", has a positive polarity during the second horizontal scanning period "2", has a positive polarity during the third horizontal scanning period "3", and has a positive polarity during the fourth horizontal scanning period "4". As for CMI3, signs a through 1 correspond to respective one horizontal scanning periods and indicate polarities of the respective one horizontal scanning periods. For example, CMI3 has a negative polarity during the first horizontal scanning period "a", has a negative polarity during the second horizontal scanning period "b", has a positive polarity during the third horizontal scanning period "c", and has a positive polarity during the fourth horizontal scanning period "d". As described earlier, the polarities of the respective polarity signals CMI1, CMI2, and CMI3 are reversed every three horizontal scanning periods (3H), the phases of CMI1 and CMI2 are shifted by one horizontal scanning period (1H), and the phases of CMI2 and CMI3 are shifted by one horizontal scanning period (1H). For example, CMI1, CMI2, and CMI3 are regularly supplied to each of the CS circuits (CMI1 to the CS circuit 41, CMI2 to the CS circuit 42, CMI3 to the CS circuit 43, CMI1 to the CS circuit 44, CMI2 to the CS circuit 45, and CMI3 to the CS circuit 46).

According to the CS circuit 4*n*, since the shift register output SROn of the nth row and the shift register output SROn+3 of the (n+3)th row are supplied to the clock terminal CK, (i) CMI to be supplied to the data terminal D during the nth horizontal scanning period and (ii) CMI to be supplied to the data terminal D during the (n+3)th horizontal scanning period are latched. For example, the CS circuit 41 loads (i) a positive polarity of "A" of CMI1 during the first horizontal scanning period and (ii) a negative polarity of "D" of CMI1 during the fourth horizontal scanning period. The CS circuit 42 loads (i) a positive polarity of "2" of CMI2 during the second horizontal scanning period and (ii) a negative polarity of "5" of CMI2 during the fifth horizontal scanning period. The CS circuit 43 loads (i) a positive polarity of "c" of CMI3 during the third horizontal scanning period and (ii) a negative polarity of "f" of CMI3 during the sixth horizontal scanning period. The CS circuit 44 loads (i) a negative polarity of "D" of CMI1 during the fourth horizontal scanning period and (ii) a positive polarity of "G" of CMI1 during the seventh horizontal scanning period. Each of the CS signals CSn illustrated in FIGS. 48 and 50 is thus outputted.

As described earlier in Examples 13, in a case where a plurality of polarity signals CMI1, CMI2, and CMI3 are used which are different from each other in frequency, 3H reversal driving can be implemented. In a case where a frequency and the number of polarity signals are changed, 4H, . . . , nH (n-line) reversal driving can be similarly implemented. For example, 4H reversal driving may be arranged such that four polarity signals CMI1 through CMI4 are used, a frequency of each of the polarity signals is set so that polarities of the respective polarity signals are reversed every 4H, and the polarity signals are sequentially supplied to each of the CS circuits.

A retaining circuit of the present invention is not limited to the D latch circuit and may be configured as, for example, a memory circuit.

Figure 58:
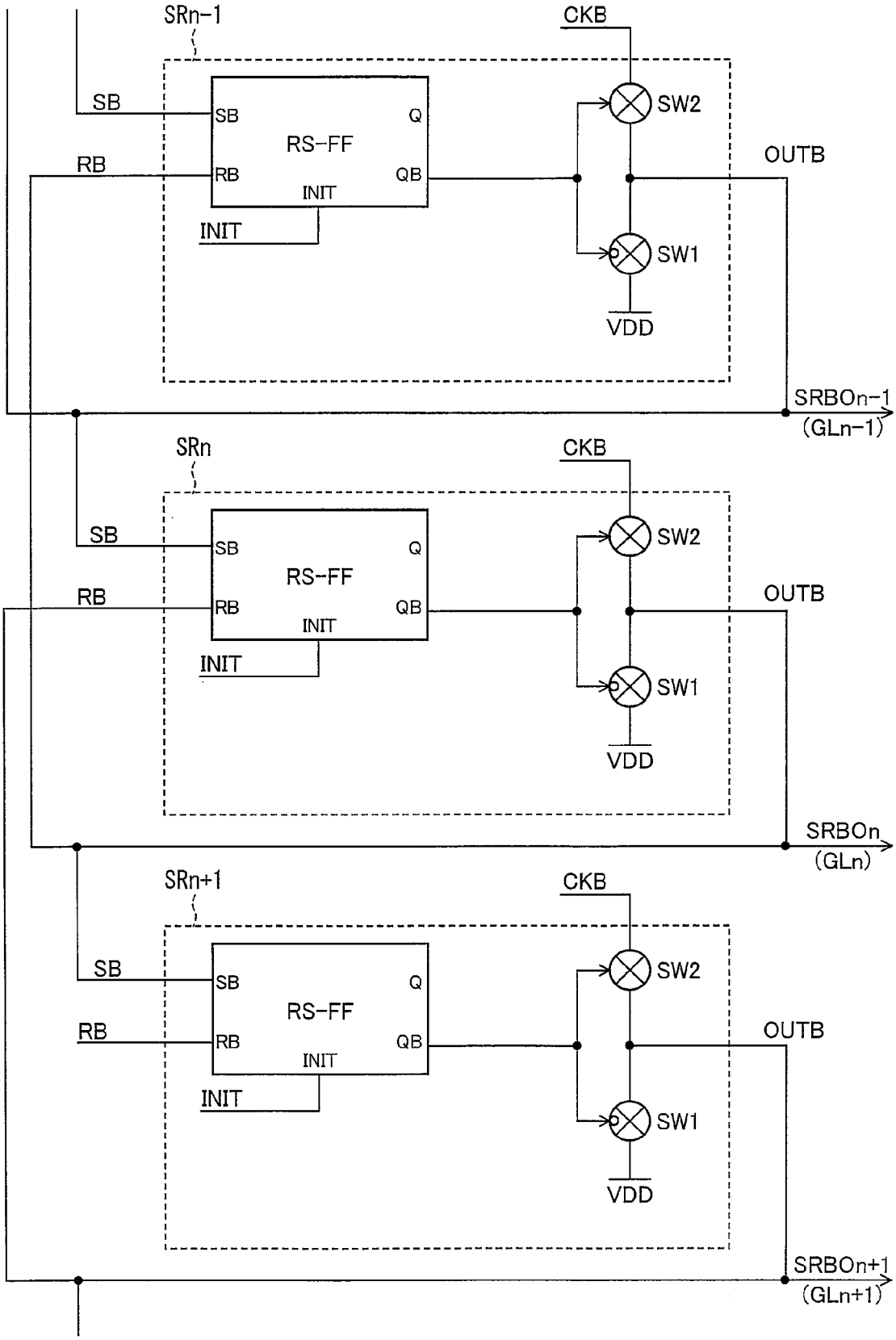
FIG. 58 is a block diagram illustrating another configuration of the gate line driving circuit of the liquid crystal display device of the present invention.
Figure 59:
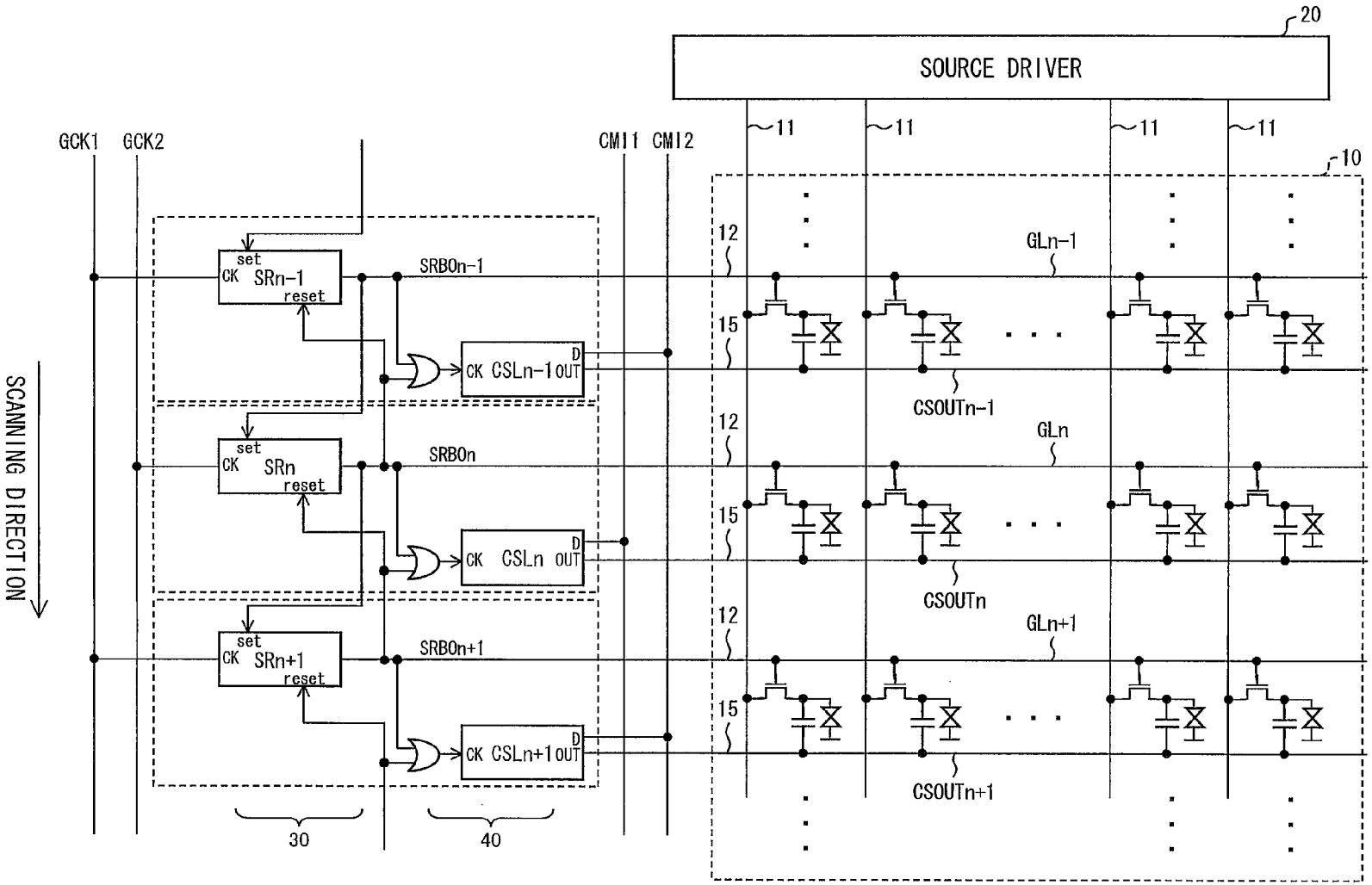
FIG. 59 is a block diagram illustrating an arrangement of the liquid crystal display device including the gate line driving circuit illustrated in FIG. 58.
Figure 60:
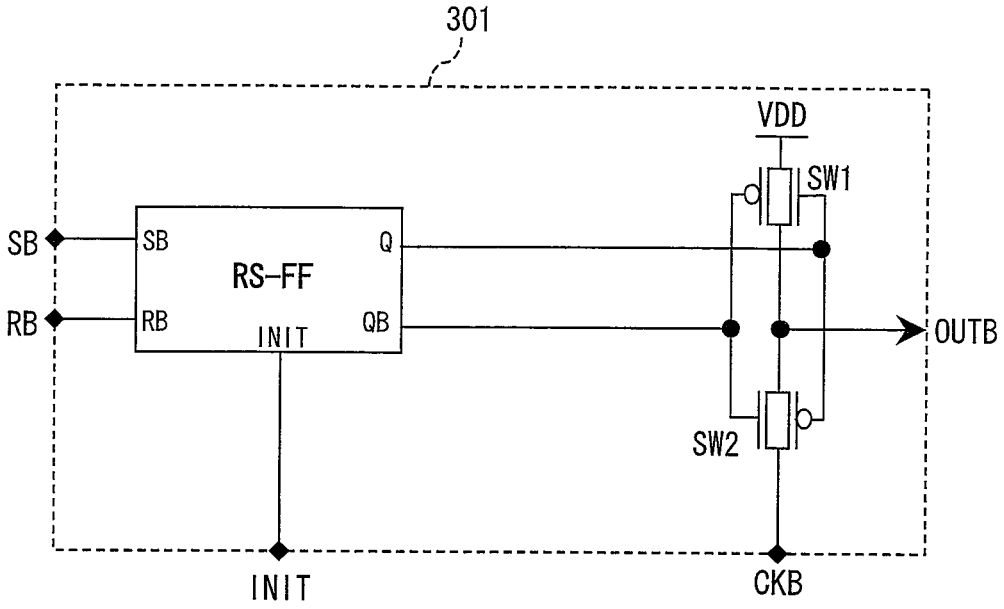
FIG. 60 is a block diagram illustrating a configuration of a shift register circuit constituting the gate line driving circuit illustrated in FIG. 58.
Figure 61:
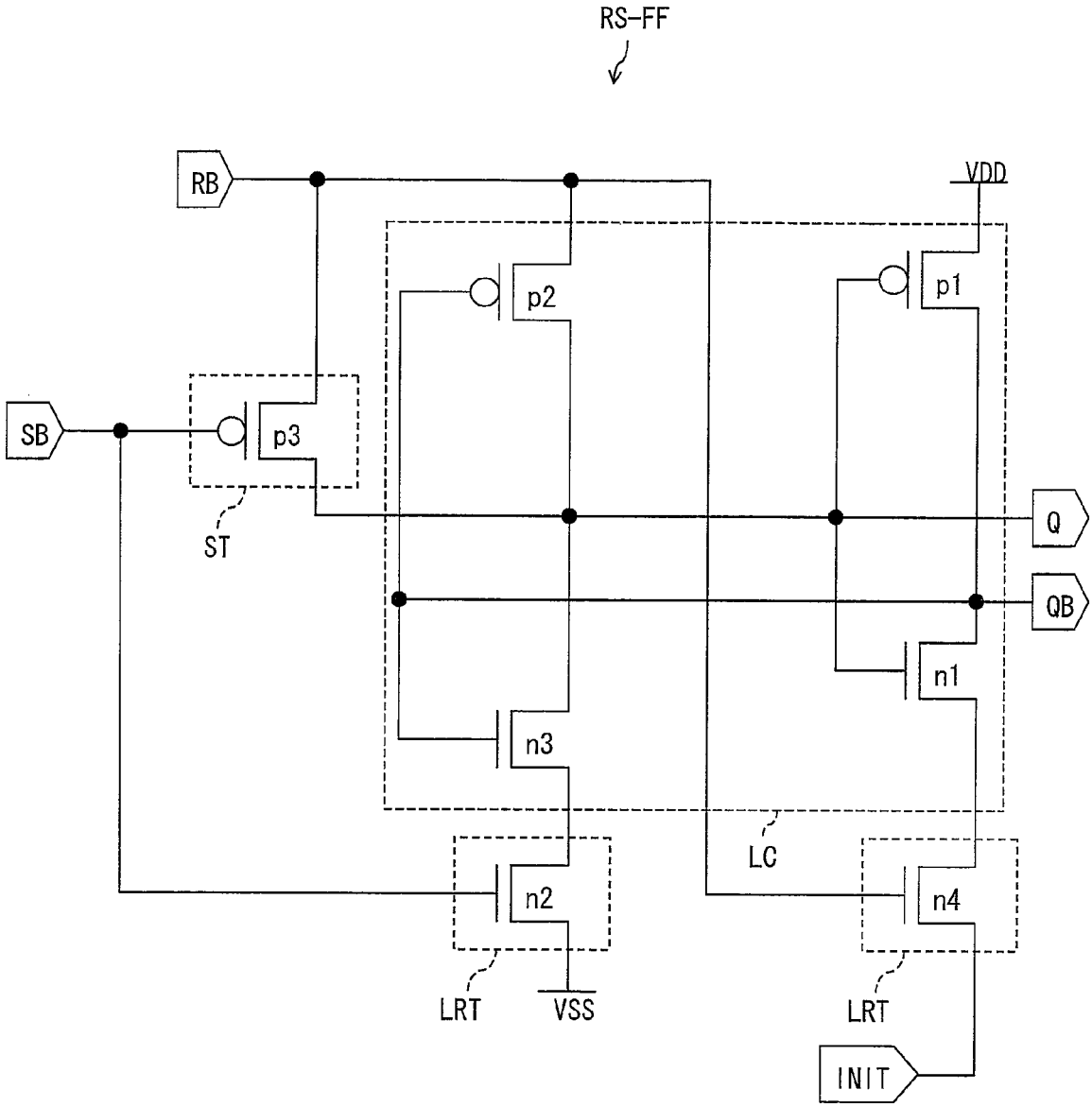
FIG. 61 is a circuit diagram illustrating a configuration of a flip-flop constituting the shift register circuit illustrated in FIG. 60.

The gate line driving circuit 30 of the liquid crystal display device in accordance with the present invention may have a configuration illustrated in FIG. 58. FIG. 59 is a block diagram illustrating an arrangement of the liquid crystal display device including the gate line driving circuit 30. FIG. 60 is a block diagram illustrating a configuration of a shift register circuit 301 constituting the gate line driving circuit 30. Each stage of the shift register circuit 301 includes a flip-flop RS-FF and switching circuits SW1 and SW2. FIG. 61 is a circuit diagram illustrating a configuration of the flip-flop RS-FF.

The flip-flop RS-FF includes a P-channel transistor p2 and an N-channel transistor n3 which constitute a CMOS circuit, a P-channel transistor p1 and an N-channel transistor n1 which constitute a CMOS circuit, a P-channel transistor p3, an N-channel transistor n2, an N-channel transistor 4, an SB terminal, an RB terminal, an INIT terminal, a Q terminal, and a QB terminal (see FIG. 61). The flip-flop RS-FF is configured as follows: A gate of p2, a gate of n3, a drain of p1, a drain of n1, and the QB terminal are connected. A drain of p2, a drain of n3, a drain of p3, a gate of p1, a gate of n1, and the Q terminal are connected. A source of n3 and a drain of n2 are connected. The SB terminal is connected to each of a gate of p3 and a gate of n2. The RB terminal is connected to each of a source of p3, a source of p2, and a gate of n4. A source of n1 and a drain of n4 are connected. The INIT terminal is connected to a source of n4. A source of p1 is connected to VDD. A source of n2 is connected to VSS. In such a configuration, p2, n3, p1, and n1 constitute a latch circuit LC, p3 serves as a set transistor ST, and n2 and n4 serve as latch release transistors (release transistors) LRT.

Figure 62:
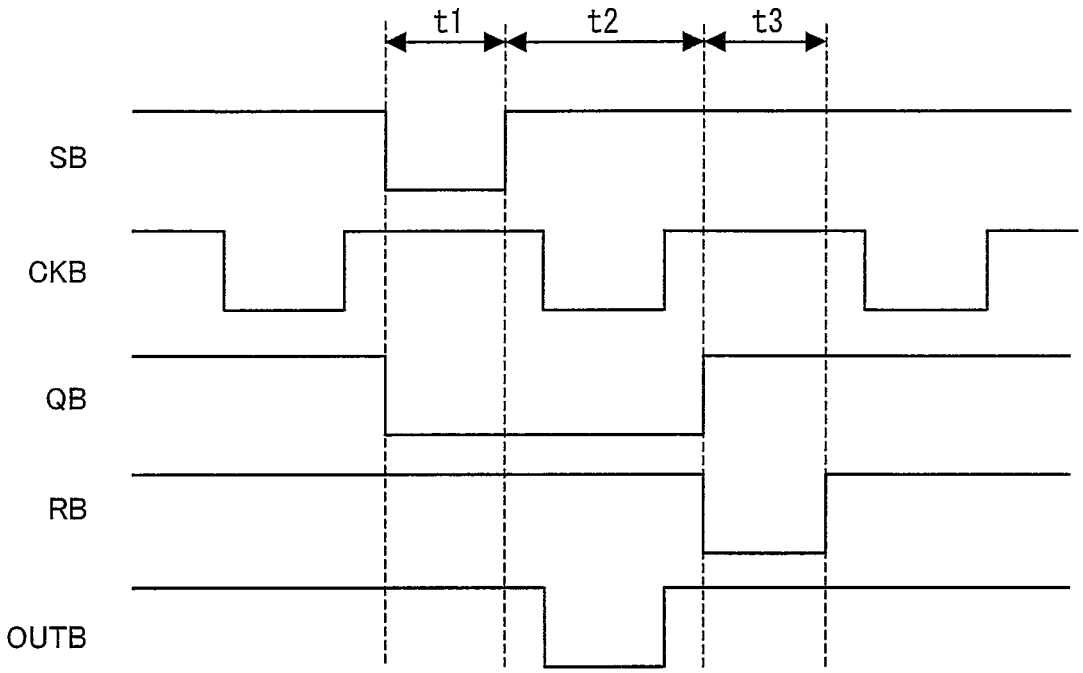
FIG. 62 is a timing chart illustrating operation of the flip-flop illustrated in FIG. 61.

FIG. 62 is a timing chart illustrating operation of the flip-flop RS-FF. For example, during t1 of FIG. 62, Vdd of the RB terminal is supplied to the Q terminal, so that n1 is turned on and INIT (Low) is supplied to the QB terminal. During t2, an SB signal is at a High level, so that p3 is turned off and n2 is turned on. Therefore, a state of t1 is maintained during t2. During t3, an RB signal is at a Low level, so that p1 is turned on and Vdd (High) is supplied to the QB terminal.

The QB terminal of the flip-flop RS-FF is connected to each of the N-channel side gate of the switching circuit SW1 and the P-channel side gate of the switching circuit SW2. One side of a conductive electrode of the switching circuit SW1 is connected to VDD, the other side of the conductive electrode of the switching circuit SW1 is connected to each of an OUTB terminal which is an output terminal of this stage and one side of a conductive electrode of the switching circuit SW2, and the other side of the conductive electrode of the switching circuit SW2 is connected to a CKB terminal to which a clock signal is supplied.

According to the shift register circuit 301, during a period in which a QB signal of the flip-flop FF is at a Low level, an OUTB signal is at a High level since the switch SW2 is off and the switching circuit SW1 is on. During a period in which the QB signal is at a High level, a CKB signal is loaded and then supplied from the OUTB terminal since the switching circuit SW2 is on and the switching circuit SW1 is off.

According to the shift register circuit 301, the OUTB terminal of a first stage is connected to the SB terminal of a second stage following the first stage, and the OUTB terminal of the second stage is connected to the RB terminal of the first stage. For example, the OUTB terminal of an nth shift register circuit SRn is connected to the SB terminal of an (n+1)th shift register circuit SRn+1, and the OUTB terminal of the (n+1)th shift register circuit SRn+1 is connected to the RB terminal of the nth shift register circuit SRn. Note that a GSPB signal is supplied to the first shift register circuit SR1. According to a gate driver GD, the CKB terminal of an odd-numbered stage and the CKB terminal of an even-numbered stage are connected to different GCK lines (lines for supplying GCK), and the INIT terminal of each stage is connected to a shared INIT line (a line for supplying an INIT signal). For example, the CKB terminal of the nth shift register circuit SRn is connected to a GCK2 line, and the CKB terminal of the (n+1)th shift register circuit SRn+1 is connected to a GCK1 line. The INIT terminal of each of the nth shift register circuit SRn and the (n+1)th shift register circuit SRn+1 is connected to a shared INIT signal line.

A display driving circuit of a liquid crystal display device of the present invention can also have the following configuration.

The display driving circuit which (i) includes a plurality of rows each including a scanning signal line, a switching element that is turned on/off by the scanning signal line, a pixel electrode that is connected to one end of the switching element, and a retention capacitor wire that is coactively-coupled with the pixel electrode and (ii) drives a display panel including a data signal line that is connected to the other end of the switching element of each of the plurality of rows to carry out a gray scale display in accordance with an electric potential of the pixel electrode, the display driving circuit includes: a scanning signal line driving circuit; a data signal line driving circuit; and a retention capacitor wire driving circuit, the scanning signal line driving circuit outputting a scanning signal for turning on the switching element of the each of plurality of rows during a horizontal scanning period which is sequentially allotted to the each of plurality of rows, the data signal line driving circuit carrying out n-line reversal driving in which a data signal is outputted whose polarity is reversed in sync with a vertical scanning period, is identical for all the pixels provided in an identical row, and is reversed every n (n is an integer not less than 2) adjacent rows, the retention capacitor wire driving circuit outputting a retention capacitor wire signal whose electric potential changes between high and low levels after the horizontal scanning period of the each of plurality of rows in accordance with the polarity of the data signal which polarity is obtained during the horizontal scanning period, the retention capacitor wire signal outputting the retention capacitor wire signal so that, when a switching element of a corresponding row in an ON state is turned off, the retention capacitor wire signal of the corresponding row is different in electric potential every n adjacent rows.

The display driving circuit that is used for a display device which causes a signal electric potential written to a pixel electrode included in a pixel to change in direction in accordance with a polarity of the signal electric potential by supplying a retention capacitor wire signal to a retention capacitor wire with which the pixel electrode forms a capacitor, the display driving circuit can be configured to further include: a shift register circuit, retaining circuits being provided so as to correspond to respective stages of the shift register circuit, and a retention target signal being supplied to each of the retaining circuits, (i) an output signal of a first stage and (ii) an output signal of a later stage than the first stage each being supplied to a logic circuit that corresponds to the first stage, when an output of the logic circuit becomes active, a retaining circuit that corresponds to the first stage loading and retaining the retention target signal, the retaining circuit that corresponds to the first stage supplying the output signal of the first stage to a scanning signal line which is connected to a pixel that corresponds to the first stage, and supplying, as the retention capacitor wire signal, an output of the retaining circuit that corresponds to the first stage to a retention capacitor wire with which a pixel electrode of the pixel that corresponds to the first stage forms a capacitor, and the retention target signal to be supplied to a plurality of retaining circuits and the retention target signal to be supplied to another plurality of retaining circuits being different in phase from each other.

The display driving circuit that is used for a display device which causes a signal electric potential written to a pixel electrode included in a pixel to change in direction in accordance with a polarity of the signal electric potential by supplying a retention capacitor wire signal to a retention capacitor wire with which the pixel electrode forms a capacitor, the display driving circuit can be configured to further include: a shift register circuit, retaining circuits being provided so as to correspond to respective stages of the shift register circuit, and a retention target signal being supplied to each of the retaining circuits, (i) an output signal of a first stage and (ii) an output signal of a later stage than a second stage following the first stage each being supplied to a logic circuit that corresponds to the first stage, when an output of the logic circuit becomes active, a retaining circuit that corresponds to the first stage loading and retaining the retention target signal, and the retaining circuit that corresponds to the first stage supplying the output signal of the first stage to a scanning signal line which is connected to a pixel that corresponds to the first stage, and supplying, as the retention capacitor wire signal, an output of the retaining circuit that corresponds to the first stage to a retention capacitor wire with which a pixel electrode of the pixel that corresponds to the first stage forms a capacitor.

The display driving circuit that is used for a display device which causes a signal electric potential written to a pixel electrode included in a pixel to change in direction in accordance with a polarity of the signal electric potential by supplying a retention capacitor wire signal to a retention capacitor wire with which the pixel electrode forms a capacitor, the display driving circuit can be configured such that: the polarity of the data signal to be supplied to the data signal line is reversed every n (n is an integer not less than 2) horizontal scanning periods; and the retention capacitor wire signal to be supplied to the retention capacitor wire with which the pixel electrode included in the pixel forms a capacitor is different in electric potential every n adjacent rows when a state of the scanning signal to be supplied to the scanning signal line that is connected to the pixel changes from an active state to a non-active state.

A display driving circuit in accordance with the present invention that is used for a display device which causes a signal electric potential written from a data signal line to a pixel electrode included in a pixel to change in direction in accordance with a polarity of the signal electric potential by supplying a retention capacitor wire signal to a retention capacitor wire with which the pixel electrode forms a capacitor, the display driving circuit reverses, every n (n is an integer not less than 2) horizontal scanning periods, the polarity of the signal electric potential to be supplied to the data signal line, and causes the signal electric potential written from the data signal line to the pixel electrode to change in a different direction every n adjacent rows.

According to the display driving circuit, the retention capacitor wire signal causes the signal electric potential written to the pixel electrode to change in direction in accordance with a polarity of the signal electric potential. This enables CC driving.

According to the configuration, the signal electric potential written from the data signal line to the pixel electrode changes in a different direction every n adjacent rows in n-line (nH) reversal driving. According to this, for example, while 2-line reversal driving is being carried out, it is possible to remove lateral stripes of light and shade which stripes are produced in a display video in the first frame. This allows, in a display device which carries out CC driving, enhancement of a display quality by removing lateral stripes that are produced in a display video while n-line reversal driving is being carried out.

The display driving circuit can be configured to further include: a shift register which includes a plurality of stages that are provided so as to correspond to a respective plurality of scanning signal lines, retaining circuits being provided so as to correspond to the respective plurality of stages, and a retention target signal being supplied to each of the retaining circuits, (i) an output signal of a first stage and (ii) an output signal of a later stage than the first stage each being supplied to a logic circuit that corresponds to the first stage, when an output of the logic circuit becomes active, a retaining circuit that corresponds to the first stage loading and retaining the retention target signal, the retaining circuit that corresponds to the first stage supplying the output signal of the first stage to a scanning signal line which is connected to a pixel that corresponds to the first stage, and supplying, as the retention capacitor wire signal, an output of the retaining circuit that corresponds to the first stage to a retention capacitor wire with which a pixel electrode of the pixel that corresponds to the first stage forms a capacitor, and the retention target signal to be supplied to a plurality of retaining circuits and the retention target signal to be supplied to another plurality of retaining circuits being different in phase from each other.

The display driving circuit can be configured to further include: a shift register which includes a plurality of stages that are provided so as to correspond to a respective plurality of scanning signal lines, retaining circuits being provided so as to correspond to the respective plurality of stages, and a retention target signal being supplied to each of the retaining circuits, (i) an output signal of a first stage and (ii) an output signal of a later stage than a second stage following the first stage each being supplied to a logic circuit that corresponds to the first stage, when an output of the logic circuit becomes active, a retaining circuit that corresponds to the first stage loading and retaining the retention target signal, and the retaining circuit that corresponds to the first stage supplying the output signal of the first stage to a scanning signal line which is connected to a pixel that corresponds to the first stage, and supplying, as the retention capacitor wire signal, an output of the retaining circuit that corresponds to the first stage to a retention capacitor wire with which a pixel electrode of the pixel that corresponds to the first stage forms a capacitor.

The display driving circuit can be configured such that: the retaining circuits retain the retention target signal at their respective timings in which output signals of different stages of the shift register are active; and the retention target signal has a polarity which is reversed at a given timing, and the polarity is different between when the output signal of the first stage which output signal is supplied to the logic circuit becomes active and when the output signal of the later stage which output signal is supplied to the logic circuit becomes active.

The display driving circuit can be configured such that one and the other of two of the retaining circuits receive respective first and second retention target signals, the two retaining circuits carrying out retaining operation during an identical horizontal scanning period.

The display driving circuit can be configured such that the first and second retention target signals are different from each other in timing at which their respective polarities are reversed.

The display driving circuit can be configured such that: the retaining circuit that corresponds to the first stage includes: a first input section which receives the output signal of the first stage; a second input section which receives the retention target signal; and an output section which supplies the retention capacitor wire signal to a retention capacitor wire that corresponds to the first stage; the retaining circuit that corresponds to the first stage outputs, as a first electric potential of the retention capacitor wire signal, a first electric potential of the retention target signal which first electric potential is supplied to the second input section when the output signal of the first stage which output signal is supplied to the first input section becomes active; during a period in which the output signal of the first stage which output signal is supplied to the first input section is active, the retention capacitor wire signal changes in electric potential in accordance with a change in electric potential of the retention target signal which is supplied to the second input section; and the retaining circuit that corresponds to the first stage outputs, as a second electric potential of the retention capacitor wire signal, a second electric potential of the retention target signal which second electric potential is supplied to the second input section when the output signal of the first stage which output signal is supplied to the first input section becomes non-active.

The display driving circuit can be configured such that each of (i) an output signal of an mth stage of the shift register and (ii) an output signal of an (m+n)th stage of the shift register is supplied to a logic circuit that corresponds to the mth stage, and a polarity of the retention target signal which is supplied to a retaining circuit that corresponds to the mth stage is reversed every n horizontal scanning periods.

The display driving circuit can be configured such that each of the retaining circuits is a D latch circuit or a memory circuit.

A display device in accordance with the present invention includes: a display driving circuit mentioned above; and a display panel.

A display driving method in accordance with the present invention for driving a display device which causes a signal electric potential written from a data signal line to a pixel electrode included in a pixel to change in direction in accordance with a polarity of the signal electric potential by supplying a retention capacitor wire signal to a retention capacitor wire with which the pixel electrode forms a capacitor, the display driving method includes the steps of:

(a) reversing, every n (n is an integer not less than 2) horizontal scanning periods, the polarity of the signal electric potential to be supplied to the data signal line; and (b) causing the signal electric potential written from the data signal line to the pixel electrode to change in a different direction every n adjacent rows.

Note that a display device in accordance with the present invention is desirably a liquid crystal display device.

The invention is not limited to the embodiments above, but may be properly altered based on common general technical knowledge. An embodiment based on a combination of the embodiments above is encompassed in an embodiment of the invention.

INDUSTRIAL APPLICABILITY

The present invention is preferably applicable particularly to driving of an active matrix liquid crystal display device.

REFERENCE SIGNS LIST

1 Liquid crystal display device (Display device)
10 Liquid crystal display panel (Display panel)
11 Source bus line (Data signal line)
12 Gate line (Scanning signal line)
13 TFT (Switching element)
14 Pixel electrode
15 CS bus line (Retention capacitor wire)
20 Source bus line driving circuit (Data signal line driving circuit)
30 Gate line driving circuit (Scanning signal line driving circuit)
40 CS bus line driving circuit (Retention capacitor wire driving circuit)
4*n* CS circuit
4*na* D latch circuit (Retaining circuit, Retention capacitor wire driving circuit)
4*nb* OR circuit (Logic circuit)
50 Control circuit
SR Shift register circuit
CMI Polarity signal (Retention target signal)

The invention claimed is:

1. A display driving circuit that is used for a display device, the display driving circuit configured to, cause a signal electric potential written from a data signal line to a pixel electrode included in a pixel to change in direction in accordance with a polarity of the signal electric potential by supplying a retention capacitor wire signal to a retention capacitor wire with which the pixel electrode forms a capacitor, the pixel being connected with a scanning signal line and the data signal line via a transistor wherein, said display driving circuit comprises a shift register including stages arranged in a column direction and retaining circuits corresponding to respective ones of the stages, an output of each stage of the shift register is supplied for a corresponding scanning signal line, an output of each retaining circuit is supplied for corresponding retention capacitor wire, as each of m and k is a natural number, (i) a retaining circuit corresponding to mth stage of the shift register retains or passes a first retention target signal depending on outputs of mth and (m+k)th stages of the shift register, and (ii) a retaining circuit corresponding to (m+k)th stage of the shift register retains or passes a second retention target signal depending on outputs of (m+k)th and (m+k+k)th stages of the shift register, and as n is an integer not less than 2, polarities of signal electric potentials supplied for respective pixels in a pixel column invert every n pixels adjacent in the column direction.

2. The display driving circuit as set forth in claim 1, wherein said display driving circuit comprises logic circuits corresponding to respective ones of the stages of the shift register, the outputs of mth and (m+k)th stages of the shift register are supplied for the logic circuit corresponding to the mth stage, the retaining circuit corresponding to mth stage of the shift register retains the first retention target signal when an output of the logic circuit corresponding to mth stage is inactive, and the retaining circuit corresponding to mth stage of the shift register passes the first retention target signal when the output of the logic circuit corresponding to mth stage is active.

3. The display driving circuit as set forth in claim 1, wherein (i) a polarity of the first retention target signal when the output of the mth stage of the shift register is active and (ii) a polarity of the first retention target signal when the output of the (m+k)th stage of the shift register is active are different.

4. The display driving circuit as set forth in claim 1, wherein a reverse timing of polarity of the first retention target signal and a reverse timing of polarity of the second retention target signal are different.

5. The display driving circuit as set forth in claim 1, wherein a polarity of the first retention target signal inverts every n horizontal scanning periods.

6. The display driving circuit as set forth in claim 1, wherein a polarity of the first retention target signal inverts every k horizontal scanning periods.

7. The display driving circuit as set forth in claim 1, wherein each of the retaining circuits is a D latch circuit or a memory circuit.

8. A display device comprising:

a display driving circuit recited in claim 1; and a display panel.

* * * * *